US007246768B2

(12) United States Patent
Fujiwara et al.

(10) Patent No.: US 7,246,768 B2
(45) Date of Patent: Jul. 24, 2007

(54) METHOD OF PROCESSING WEB EDGE

(75) Inventors: Takayuki Fujiwara, Minamiashigara (JP); Katsuhiro Sugiyama, Minamiashigara (JP); Tomohiro Nakata, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 5 days.

(21) Appl. No.: 10/878,487

(22) Filed: Jun. 29, 2004

(65) Prior Publication Data

US 2005/0029388 A1 Feb. 10, 2005

Related U.S. Application Data

(62) Division of application No. 09/986,434, filed on Nov. 8, 2001, now Pat. No. 6,793,169.

(30) Foreign Application Priority Data

| | | |
|---|---|---|
| Nov. 8, 2000 | (JP) | 2000-340134 |
| Dec. 22, 2000 | (JP) | 2000-389845 |
| Dec. 22, 2000 | (JP) | 2000-389853 |
| Dec. 22, 2000 | (JP) | 2000-389864 |
| Dec. 22, 2000 | (JP) | 2000-390374 |
| Dec. 22, 2000 | (JP) | 2000-391468 |

(51) Int. Cl.
*B65H 18/08* (2006.01)

(52) U.S. Cl. ..... 242/530.1; 242/533.7

(58) Field of Classification Search ..... 242/530.1, 242/530.3, 530.4, 533.7, 525.3
See application file for complete search history.

(56) References Cited

U.S. PATENT DOCUMENTS

| | | | |
|---|---|---|---|
| 3,086,726 | A | 4/1963 | Aaron |
| 3,406,924 | A | 10/1968 | Burns et al. |
| 3,944,152 | A | 3/1976 | Heymanns |
| 3,990,646 | A | 11/1976 | Salgo |
| 4,063,692 | A | 12/1977 | Buggy |
| 4,467,975 | A | 8/1984 | Friedman |
| 4,629,139 | A | 12/1986 | Sanda et al. |
| 4,947,536 | A | 8/1990 | Suzuki |

(Continued)

FOREIGN PATENT DOCUMENTS

| | | |
|---|---|---|
| JP | 48-38149 | 11/1973 |

(Continued)

OTHER PUBLICATIONS

Japanese Abstract, 55040196 A, Mar. 21, 1980.

(Continued)

*Primary Examiner*—William A. Rivera
(74) *Attorney, Agent, or Firm*—Sughrue Mion, PLLC

(57) ABSTRACT

A web processing apparatus has a cutting mechanism for cutting elongate webs of different widths from a raw web, a core rotating mechanism for selectively holding cores having different diameters and different axial lengths and rotating a selected one of the cores in opposite directions, a winding mechanism for supporting one of the elongate webs on an outer circumferential surface of the core to wind the elongate web in different winding directions when the core is rotated, and a cutting mechanism for cutting an end of the elongate web to produce a roll after the elongate web is wound around the core.

3 Claims, 97 Drawing Sheets

U.S. PATENT DOCUMENTS

| | | | | |
|---|---|---|---|---|
| 5,799,898 | A | 9/1998 | Sumida et al. | |
| 5,927,640 | A | 7/1999 | Yokoe | |
| 6,149,099 | A | 11/2000 | Meinecke et al. | |
| 6,793,169 | B2 * | 9/2004 | Fujiwara et al. ..... | 242/530.1 |

FOREIGN PATENT DOCUMENTS

| | | |
|---|---|---|
| JP | 57-40052 | 8/1982 |
| JP | 58-157663 | 9/1983 |
| JP | 6-234444 | 8/1994 |
| JP | 10-25043 | 1/1998 |

OTHER PUBLICATIONS

Japanese Abstract, 48-38149,. Nov. 12, 1973.
Japanese Abstract, 10025043 A, Jan. 27, 1998.
Japanese Abstract, 58157663 A, Sep. 19, 1983.
Japanese Abstract, 06234444 A, Aug. 23, 1994.

* cited by examiner

START

S1
A#1=S1C/V
NO
YES
MEASURE CORE
S2
S3
EQUAL TO S1C/V ?
NO
YES
LOAD CORE INTO A AXIS
S4
DISCHARGE CORE AS UNACCEPTABLE
S5
S6
A#1=S2C/V
NO
YES
MEASURE CORE
S7
S8
EQUAL TO S2C/V ?
NO
YES
LOAD CORE INTO A AXIS
S9
DISCHARGE CORE AS UNACCEPTABLE
S10
S11
B#2=S1C/V
NO
YES
MEASURE CORE
S12
S13
EQUAL TO S1C/V ?
NO
YES
LOAD CORE INTO B AXIS
S14
DISCHARGE CORE AS UNACCEPTABLE
S15
1

METHOD OF PROCESSING WEB EDGE

This is a divisional of application Ser. No. 09/986,434 filed Nov. 8, 2001 now U.S. Pat. No. 6,793,169; the disclosure of which is incorporated herein by reference.

BACKGROUND OF THE INVENTION

1. Field of the Invention

The present invention relates to a web winding apparatus for winding an elongate web cut to a predetermined width on a core, a method of and an apparatus for processing a web edge which is produced when a raw web is cut off, and a web processing apparatus for cutting an end of the elongate web to produce a web roll.

2. Description of the Related Art

Generally, winding machines for automatically winding an elongate web, e.g., an elongate film, on a core and cutting machines for cutting a wide raw film into an elongate film having a given width and automatically winding the elongate film on a core have various winding mechanisms for supporting the elongate film on the outer circumferential surface of the core when the core is rotated in a winding position.

Such winding mechanisms have a holder angularly movable for holding a spool on the tip end of a belt wrapper and a drive mechanism for reciprocally moving the belt wrapper until the central axis of the spool held by the holder is aligned with the central axis of a winding drum, as disclosed in Japanese patent publication No. 57-40052, for example.

Japanese utility model publication No. 48-38149 discloses a strip coiler having a mandrel for winding a strip into a coil, and a plurality of wrapper roll frames disposed around the mandrel with wrapper rolls and guide plates being positioned inwardly thereof, the wrapper roll frames each having an end pivotally mounted on a housing, and a plurality of fluid pressure cylinders coupled to the wrapper roll frames for pressing the wrapper rolls toward and retracting the wrapper rolls away from a position to start winding the strip.

It has become necessary in recent years to process various films of the same kind having different widths to meet demands for a variety of film products. Cutting machines and winding machines are thus required to have a winding mechanism capable of handling different widths of films.

For example, FIG. 93 of the accompanying drawings shows a winding mechanism 1 having two belt wrappers (or block wrappers) 4 for holding given portions of opposite ends of a core 3 which is supported by a core rotating mechanism 2, and a moving mechanism 5 for moving the belt wrappers 4 axially in the directions indicated by the arrow A depending on the axial length of the core 3. The moving mechanism 5 has a guide frame 6 extending in the directions indicated by the arrow A. The belt wrappers 4 are disposed on the guide frame 6 so as to be movable therealong by rack and pinion means (not shown) actuated by motors 7. The belt wrappers 4 are positioned in respective locations on the guide frame 6 depending on the axial length of the core 3, i.e., the width of a raw film.

However, since a film F is supported on the core 3 by the two belt wrappers 4, the film F cannot be held under pressure across its full width. Therefore, the film F wound around the core 3 tends to become loose or be displaced at its ends, and hence is not wound stably on the core 3.

One solution is to use a winding mechanism 1' shown in FIG. 94 of the accompanying drawings. The winding mechanism 1' has a plurality of block wrappers (or belt wrappers) 8 for holding the outer circumferential surface of a core 3 that is supported by a core rotating mechanism 2, and a moving mechanism 5' for placing a given number of block wrappers 8 in a winding position depending on the axial length of the core 3. The moving mechanism 5' has a guide frame 6' extending in the directions indicated by the arrow A, with the block wrappers 8 being disposed on the guide frame 6' so as to be movable therealong by motors 7'.

The winding mechanism 1' is, however, problematic in that when a size change is performed in the transverse direction of a film F, those block wrappers 8 positioned in interference with the core rotating mechanism 2 need to be retracted into retracted zones 9' outside of a raw film width 9, and hence the guide frame 6' is considerably long in the directions indicated by the arrow A, making the winding mechanism 1' large in overall size.

For changing the size of the core 3 and changing the direction in which the film F is wound, it is proposed to unitize the winding mechanism 1' in its entirety and replace the unitized winding mechanism 1' with another unit. However, since the winding mechanism 1' is large in size, such unit replacement is difficult to perform.

If an actuator such as a cylinder or the like with a fixed stroke were used to move each of the block wrappers 8 in the directions indicated by the arrow A, then the winding mechanism 1' could handle only films F of a particular size and would be poor in adaptability. For this reason, each of the block wrappers 8 uses a servomotor or a stepping motor as the positioning motor 7', and hence needs a complex wiring and a complex control process.

To meet recent demands for a variety of film products, there have also been required two lines of film products, one having a film wound on a core with a coated surface of the film being directed toward the core, i.e., a roll with an inner coated surface, and the other having a film wound on a core with a coated surface of the film being directed away from the core, i.e., a roll with an outer coated surface. Therefore, various automatic winding apparatus capable of automatically changing the direction in which the film faces, i.e., the winding direction, are employed in the cutting and winding processes (see, for example, Japanese laid-open patent publication No. 10-25043 and Japanese laid-open patent publication No. 58-157663).

According to Japanese laid-open patent publication No. 10-25043, as shown in FIG. 95 of the accompanying drawings, two lock arms 3*a*, 3*b* swingable by respective cylinders 2*a*, 2*b* are disposed one on each side of a core 1*a* that is disposed in a film winding position. A rubber band 4*a* is trained around the lock arms 3*a*, 3*b*. A guide plate 7*a* for directing a film F which is fed vertically downwardly past a guide roller 5*a* selectively on both sides of the core 1*a* is swingably disposed above the core 1*a*.

For winding the film F counterclockwise around the core 1*a*, the guide plate 7*a* is placed in the solid-line position in FIG. 95, and the lock arm 3*b* is held in an open position by the cylinder 2*b*. Therefore, the film F which is fed vertically downwardly past the guide roller 5*a* has its leading end guided by the guide plate 7*a* and enters between the core 1*a* and the lock arm 3*b*. Then, when the core 1*a* rotates counterclockwise in the direction indicated by the arrow, the leading end of the film F is introduced between the core 1*a* and the rubber band 4*a*, causing the film F to be wound around the core 1*a*.

For winding the film F clockwise around the core 1*a*, the guide plate 7*a* is swung from the solid-line position to the dotted-line position, and the cylinders 2*a*, 2*b* are actuated to bring the lock arm 3*a* into an open position away from the core 1*a* and place the lock arm 3*b* in a closed position. The film F is now introduced between the core 1*a* and the rubber band 4*a* on the right side of the core 1*a*, and wound clockwise around the core 1*a*.

However, since the film F that has been cut transversely travels along a tortuous path before the leading end of the film F enters between the rubber band 4*a* and the core 1*a*, or it is difficult to control the rubber band 4*a*, which serves as a belt wrapper, in the transverse direction of the film F, even if the position of the leading end of the film F that is paid out is accurately controlled, an edge Fa of the film F may possibly project from the end of the core 1*a*, as shown in FIG. 96 of the accompanying drawings, due to a meandering movement of the rubber band 4*a*. Consequently, the projecting edge Fa tends to be damaged when a roll made up of the film F wound around the core 1*a* is delivered to and packaged by a packaging process, or the packaged roll is shipped.

It has been desired to use various cores having different diameters including a 2-inch diameter and a 3-inch diameter and also having different widths covering various film widths. There is also a demand for the production of film rolls having films wound on such cores with both inner and outer coated surfaces.

According to the above conventional arrangements, though the direction in which the film faces or the winding direction can be changed, it is impossible to handle different outside diameters of cores and different film widths. Therefore, it is necessary to provide different automatic winding apparatus dedicated to handling various cores of different diameters and different axial lengths. As a result, a large facility is required for installing the different winding apparatuses, and the production cost is high.

Various proposals have heretofore been made to automatically wind an elongate film. One such proposal is a slitter apparatus disclosed in Japanese laid-open patent publication No. 6-234444, for example. In the conventional slitter apparatus, after a narrow web is wound to a given full length on a core disposed on the lower end of a core holding frame, producing a fully wound roll, a roll removal carriage is elevated to the core holding frame and supports the fully wound roll on its upper surface. The roll removal carriage removes the fully wound roll from the core holding frame, and is lowered while supporting the fully wound roll thereon.

When the core holding frame is moved and a new roll abuts against a touch roller, a cutting blade cuts off the narrow web in the transverse direction. Thereafter, one end of the cut-off narrow web is wound around the fully wound roll, and the other end is wound around the new core, starting to wind the narrow web around the new core.

When the roll removal carriage supports the fully wound roll, as shown in FIG. 97 of the accompanying drawings, a core rotating shaft 2*c* on a core holding frame 1*b* is rotated to wind a narrow web 4*b* to a given full length around a core 3*c*, producing a fully wound roll 5*b*. Thereafter, a roll removal carriage 6*b* is lifted to place the fully wound roll 5*b* thereon.

However, unless the narrow web 4*b* is wound to a certain length around the core 3*c*, the fully wound roll 5*b* is small in diameter, and when the roll removal carriage 6*b* is lifted, it may possibly interfere with the core holding frame 1*b*. Consequently, the fully wound roll 5*b* cannot be removed unless the fully wound roll 5*b* has a relatively large diameter, i.e., the narrow web 4*b* is substantially fully wound on the core 3*c*.

Usually, the roll removal carriage 6*b* has a width equal to or smaller than the minimum width of the fully wound roll 5*b* so as to handle size changes of various fully wound rolls 5*b* having different widths. However, when a fully wound roll 5*b* having a maximum width is discharged, the roll removal carriage 6*b* may possibly be damaged because the surface pressure developed by contact between the roll removal carriage 6*b* and the fully wound roll 5*b* is high. In addition, a complex size changing structure is needed, resulting in the high cost of the facility.

In the winding process described above, unwanted film edges are cut off both sides of the raw film, and need to be efficiently processed. It is known to collect severed film edges with an air stream. However, wide film edges which have been cut off a raw film cannot be collected with an air stream. Another process is to use a chopper to cut film edges into small pieces. However, the use of the chopper is liable to increase the cost of the facility, and is likely to cause trouble due to electrostatic charges which may impede to achieve a desired edge processing capability.

Heretofore, it has been customary for a worker to process film edges manually. Specifically, after a film edge is wound around an edge shaft, the film edge is cut off by the worker using scissors. Then, the worker manually removes the film edge from the edge shaft, and discards the film edge into a trash box.

Since the film edge is processed in a dark room as the film needs to be shielded from light, it is difficult for the worker to use the scissors and carry the film edge which is heavy.

Wide film edges need to be processed highly frequently because there is a limitation, such as 147 N (Newton), for example, on weights that can be carried by workers. When such film edges are processed, since the production facility needs to be shut off, the overall process of processing films cannot be performed efficiently. In addition, it is not possible to reduce the cost of films by making the film edge processing unattended by workers.

SUMMARY OF THE INVENTION

It is a general object of the present invention to provide a web winding apparatus which is of a simple structure and is capable of winding an elongate film smoothly and highly accurately around a core.

A primary object of the present invention is to provide a web winding apparatus which is of a simple and compact structure and is capable of winding an elongate web smoothly and highly accurately around various cores having different axial lengths.

Another primary object of the present invention is to provide a web winding apparatus which is of a simple structure and is capable of automatically changing the direction in which a web faces, i.e., the winding direction, and of winding an elongate web highly accurately and efficiently around a core.

Still another primary object of the present invention is to provide a web winding apparatus which is of a simple structure and is capable of easily handling changes in the width and outside diameter of a roll for winding an elongate web efficiently.

Another primary object of the present invention is to provide a web winding apparatus which is of a simple and compact structure and is capable of winding an elongate web smoothly and highly accurately around various cores having different axial lengths in various directions in which the web faces or various winding directions.

A general object of the present invention is to provide a method of and an apparatus for processing a web edge efficiently in a short period of time with an effectively increased web processing capability. Another general object of the present invention is to provide a web processing apparatus which is capable of winding a web around various cores having different axial lengths and different diameters in various directions in which the web faces or various winding directions for producing various web rolls smoothly and automatically.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
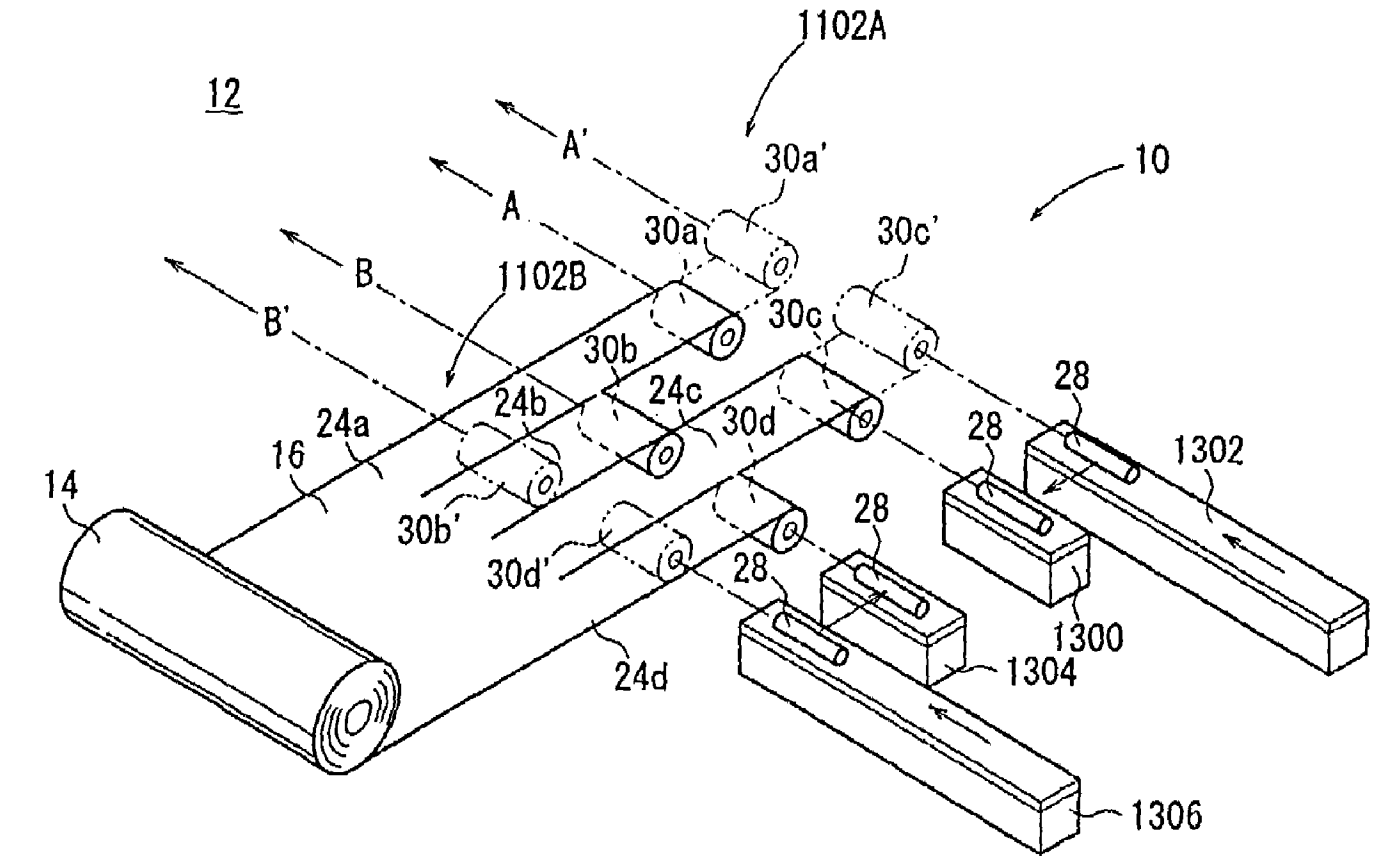
FIG. 1 is a schematic perspective view of an upstream portion of a film processing and cutting machine which incorporates a web processing apparatus according to the present invention.

FIG. 1 schematically shows in perspective an upstream portion of a film processing and cutting machine (web processing apparatus) 12 which incorporates film (web) winding apparatus 10 according to the present invention. The film processing and cutting machine 12 cuts an elongate raw film (raw web) 16 at transversely spaced intervals as it is unwound from a photosensitive roll (hereinafter referred to as "film roll") 14 of a PET film, a TAC film, a PEN film, or a print sheet used as a base, winds the severed elongate films around respective cores 28 with film winding apparatus 10, and then cuts the elongate films to a given length in the longitudinal direction thereof, thus producing a plurality of rolls 30*a* through 30*d*, 30*a*' through 30*d*'.

The film processing and cutting machine 12 is capable of producing a plurality of types of rolls 30*a* through 30*d*, 30*a*' through 30*d*' according to a production plan. Specifically, the film processing and cutting machine 12 has a first winding unit 1102A and a second winding unit 1102B that are spaced from each other by a given distance in the direction in which the elongate raw films 16 are drawn from the film roll 14. The first winding unit 1102A and the second winding unit 1102B produce the rolls 30*a*, 30*c* or 30*a*', 30*c*' and the rolls 30*b*, 30*d* or 30*b*', 30*d*'.

The rolls 30*a* through 30*d* and the rolls 30*a*' through 30*d*' differ from each other as to the direction in which the elongate raw films 16 are wound. The rolls 30*a* through 30*d* and the rolls 30*a*' through 30*d*' are available in various types dependent on combinations of widths of the elongate raw films 16, diameters of the cores 28, and directions in which the elongate raw films 16 are wound.

A region of the first winding unit 1102A for manufacturing the rolls 30*a*, 30*c* in which the elongate raw films 16 are wound clockwise will be referred to as an A axis, a region of the first winding unit 1102A for manufacturing the rolls 30*a*', 30*c*' in which the elongate raw films 16 are wound counterclockwise as an A' axis, a region of the second winding unit 1102B for manufacturing the rolls 30*b*, 30*d* in which the elongate raw films 16 are wound clockwise as a B axis, and a region of the second winding unit 1102B for manufacturing the rolls 30*b*', 30*d*' in which the elongate raw films 16 are wound counterclockwise as a B' axis.

Alongside of the film winding apparatus 10 of the film processing and cutting machine 12, there are disposed feed mechanisms 1300, 1302 for supplying cores 28 to the first winding unit 1102A and feed mechanisms 1304, 1306 for supplying cores 28 to the second winding unit 1102B. The feed mechanism 1300 supplies cores 28 to the A axis of the first winding unit 1102A, the feed mechanism 1302 supplies cores 28 to the A' axis of the first winding unit 1102A, the feed mechanism 1304 supplies cores 28 to the B axis of the second winding unit 1102B, and the feed mechanism 1306 supplies cores 28 to the B' axis of the second winding unit 1102B.

Figure 2:
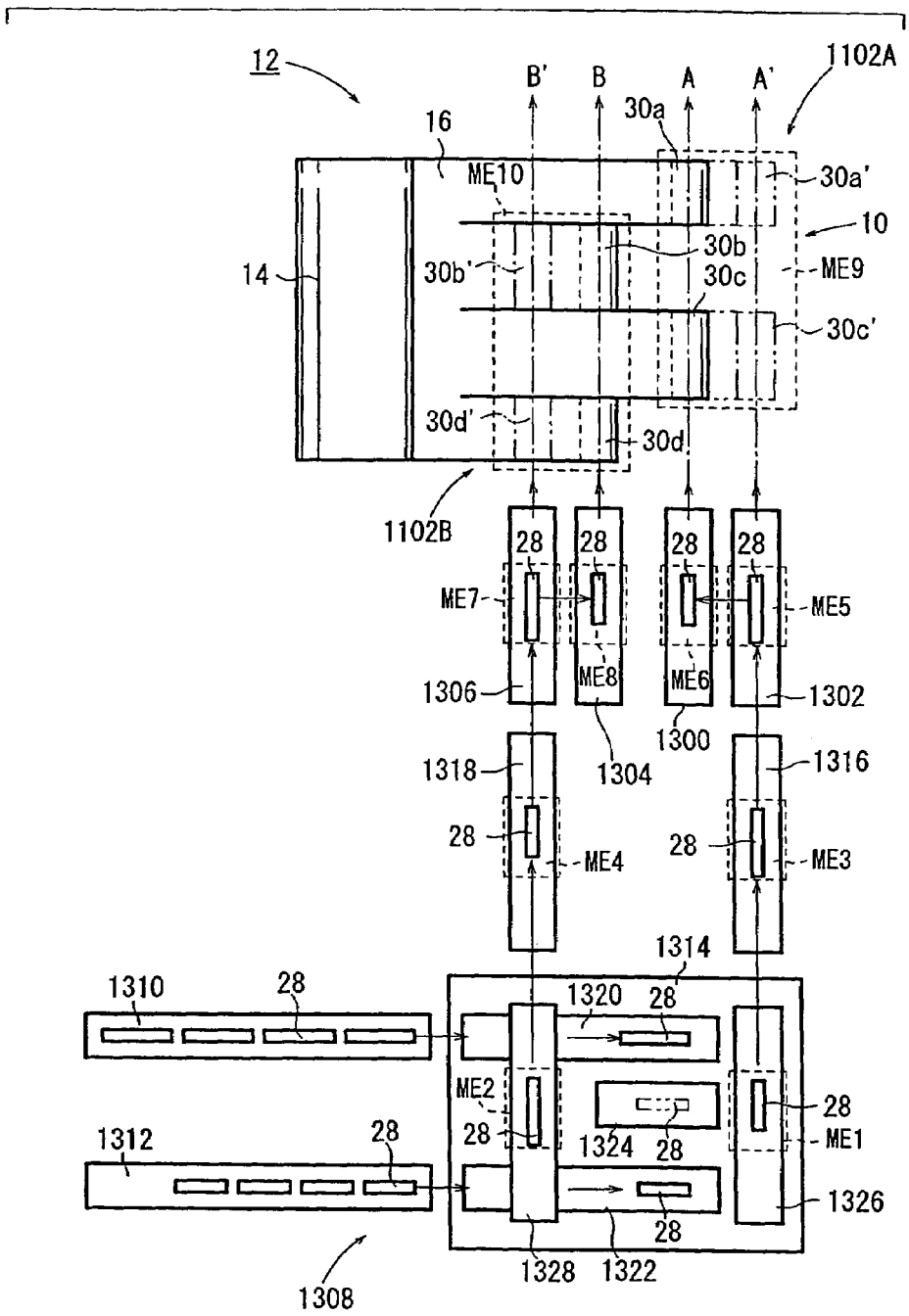
FIG. 2 is a plan view of the film processing and cutting machine shown in FIG. 1 and a core supply apparatus for supplying cores to the film processing and cutting machine.

FIG. 2 illustrates in plan the film processing and cutting machine 12 shown in FIG. 1 and a core supply apparatus 1308 for supplying cores 28 to the film processing and cutting machine 12.

The core supply apparatus 1308 comprises two feed mechanisms 1310, 1312 for supplying a plurality of cores 28 that have been cut to given lengths depending on the widths of the rolls 30*a* through 30*d* and the rolls 30*a*' through 30*d*' which are manufactured by the film processing and cutting machine 12, and a core loader 1314 for sorting out cores 28 according to length and diameter. The core loader 1314 and the feed mechanisms 1302, 1306 disposed close to the film processing and cutting machine 12 are connected to each other by feed mechanisms 1316, 1318.

The core loader 1314 has a feed mechanism 1320 connected to the feed mechanism 1310 and a feed mechanism 1322 connected to the feed mechanism 1312. A discharger 1324 for discharging cores 28 that have been determined as defective is disposed between the feed mechanisms 1320, 1322. The core loader 1314 also has feed mechanisms 1326, 1328 extending transversely across the feed mechanisms 1320, 1322 and connected to the feed mechanisms 1316, 1318, respectively. Above the discharger 1324, there is disposed a core feed robot (not shown) for loading cores 28 fed to the feed mechanisms 1320, 1322 into the feed mechanisms 1326, 1328 or the discharger 1324. The core loader 1314 has a measuring means (not shown) for measuring the length and diameter of each of supplied cores 28.

Figure 3:
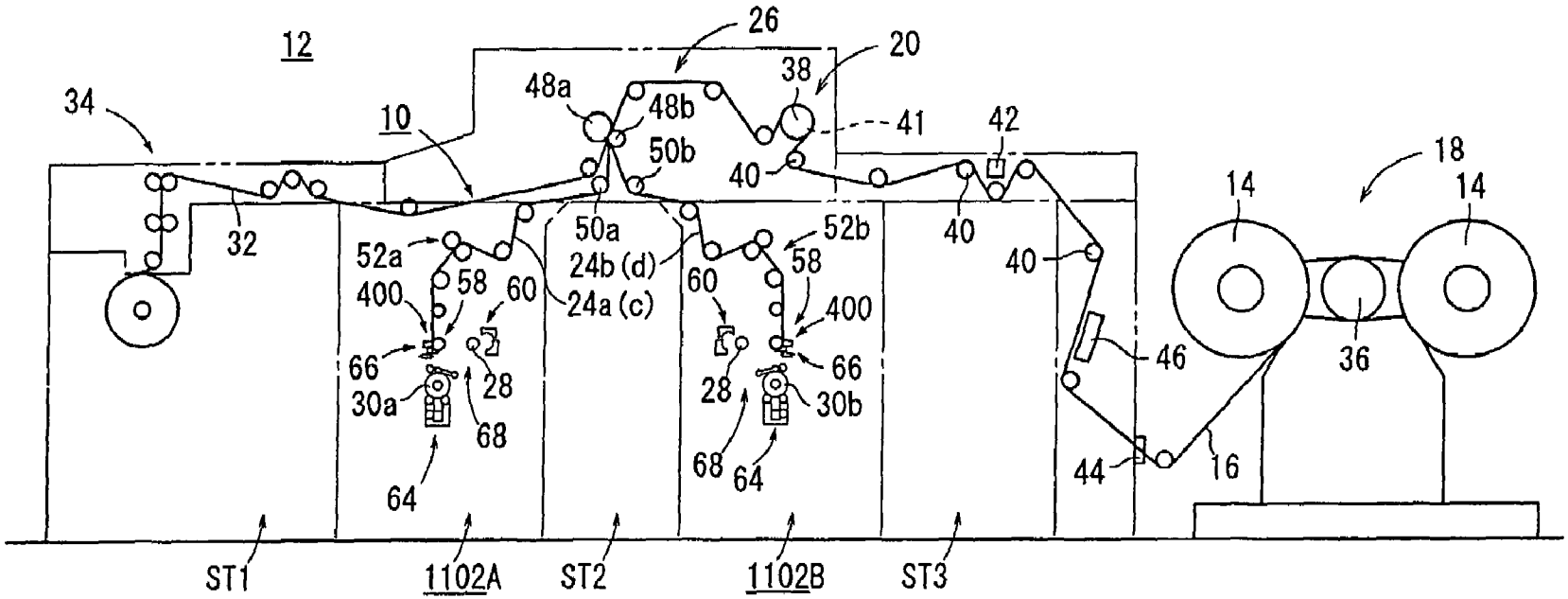
FIG. 3 is a schematic elevational view of the film processing and cutting machine.

As shown in FIG. 3, the film processing and cutting machine 12 has a film delivery apparatus 18 for rotating film rolls 14 to deliver an elongate raw film 16, a feed apparatus 20 for feeding the elongate raw film 16 successively to next processes, a cutting apparatus (cutting mechanism) 26 for cutting the elongate raw film 16 fed by the feed apparatus 20 at transversely spaced intervals into a plurality of elongate film blanks and cutting off film edges from the elongate film blanks, thus producing a plurality of elongate films (elongate webs) 24*a* through 24*d* having given widths, film winding apparatus 10 for winding the elongate films 24*a* through 24*d* around respective cores 28 and cutting the elongate films 24*a* through 24*d* to given lengths, thereby producing rolls 30*a* through 30*d* (or 30*a*' through 30*d*') as products, and a processing apparatus (web edge processing mechanism) 34 for processing unwanted edges (web edges) 32 discharged from the elongate raw film 16.

The film delivery apparatus 18 has a delivery shaft 36 by which a pair of film rolls 14 is supported for indexed movement. The film rolls 14 are unwound by an unwinding motor (not shown). The feed apparatus 20 has a suction drum (reference roller) 38 serving as a main feed roller and a plurality of rollers 40. The suction drum 38 is controlled in speed to rotate according to a predetermined pattern of peripheral speeds by a servomotor 1016 (described later on). An encoder 41 is connected to the shaft of the suction drum 38.

One of the rollers 40 which are disposed between the delivery shaft 36 and the suction drum 38 is associated with a tension detector (tension pickup) 42. The tension of the film between the delivery shaft 36 and the suction drum 38 is controlled by the tension detector 42 and the unwinding motor mounted on the delivery shaft 36. Near the delivery shaft 36, there are disposed an EPC sensor 44 for detecting the position of an end of the elongate raw film 16 to adjust the position of the end and a splicing suction table 46 for splicing the trailing end of the elongate raw film 16 to the leading end of a new elongate raw film 16.

Figure 4:
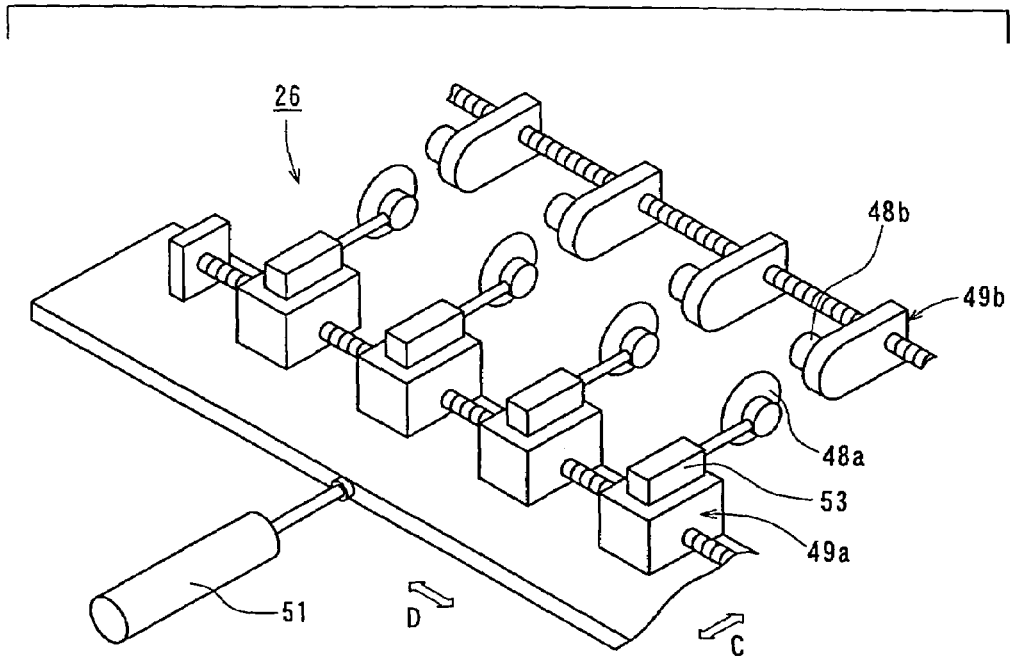
FIG. 4 is a fragmentary perspective view of a cutting mechanism of the film processing and cutting machine.

The cutting apparatus 26 has a plurality of laterally spaced first round blades 48*a* and a plurality of laterally spaced second round blades 48*b*. As shown in FIG. 4, the first round blades 48*a* are mounted on respective five upper blade units 49*a* that are positionally adjustable by an AC servomotor (not shown) in the transverse directions, indicated by the arrow D, of the elongate raw film 16. The upper blade units 49*a* are movable in unison away from a cutting position by a cylinder 51 for easy blade replacement and maintenance.

The first round blades 48*a* can be brought into the cutting position by respective cylinders (drive units) 53, and can be rotated by respective motors (not shown). The second round blades 48*b* are mounted on respective nine upper blade units 49*b* that are positionally adjustable by an AC servomotor (not shown) in the transverse directions, indicated by the arrow D, of the elongate raw film 16.

The cutting apparatus 26 includes, in its lower portion, separation rollers 50*a*, 50*b* for separating severed elongate films 24*a*, 24*b* away from each other. The film winding apparatus 10 are disposed downstream of the separation rollers 50*a*, 50*b* with nip roller pairs 52*a*, 52*b* interposed therebetween.

In FIG. 3, there are two left and right film winding apparatus 10 associated with the elongate films 24*a* through 24*d*. Only the film winding apparatus 10 associated with the elongate films 24*a*, 24*c* will be described below, and the film winding apparatus 10 associated with the elongate films 24*b*, 24*d* will not be described below. Those parts of the film winding apparatus 10 associated with the elongate films 24*b*, 24*d* which are identical to those of the film winding apparatus 10 associated with the elongate films 24*a*, 24*c* are denoted by identical reference characters.

Figure 5:
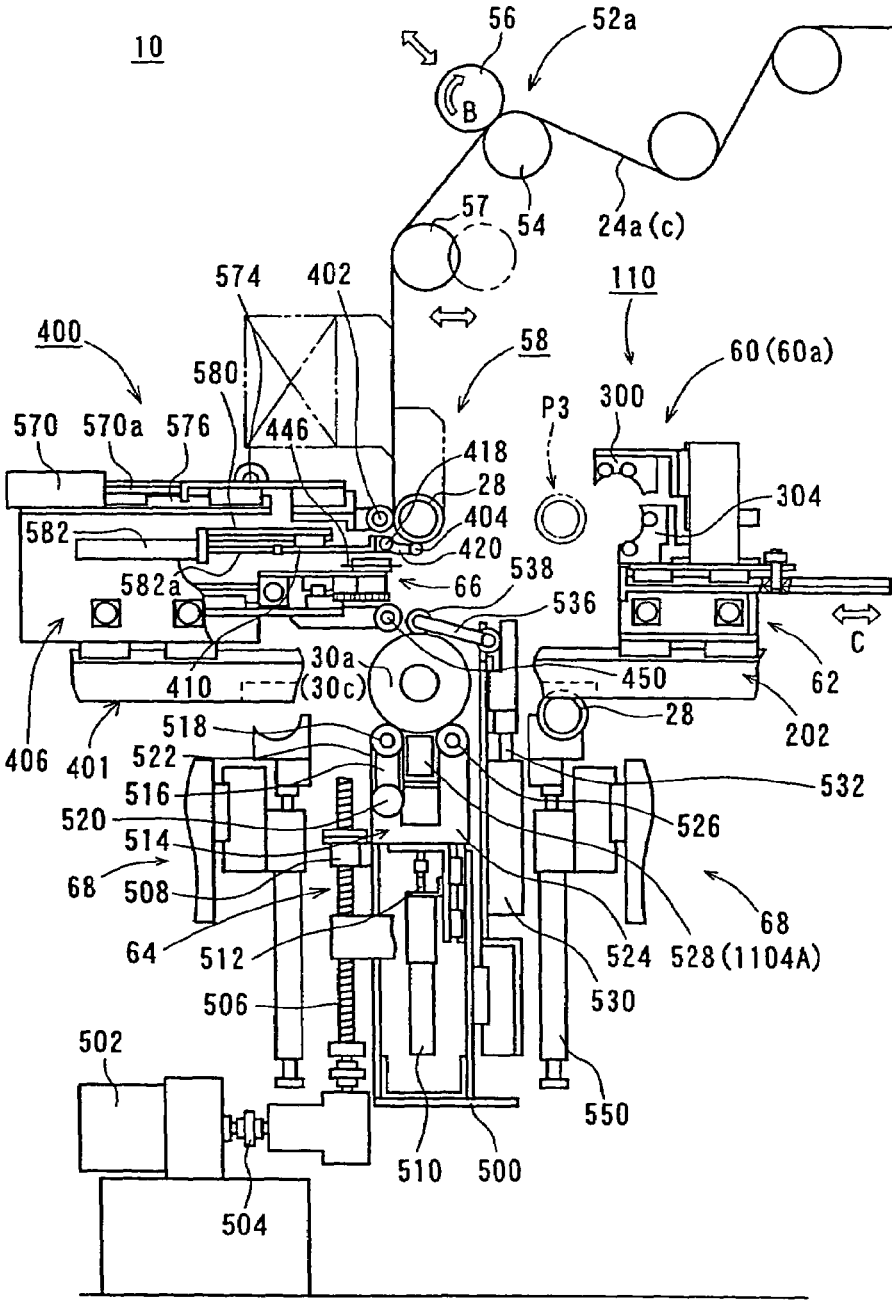
FIG. 5 is an elevational view of a film winding apparatus of the film processing and cutting machine.

As shown in FIG. 5, the nip roller pair 52*a* comprises a backup roller 54 connected to a rotary actuator (not shown) and a nip roller 56 movable toward and away from the backup roller 54. The backup roller 54 has its peripheral speed set such that its feed speed in the direction indicated by the arrow B is higher than the suction drum 38. When the nip roller 56 is pressed against the backup roller 54 in sandwiching relation to the elongate film 24*a*, a certain tension is applied to elongate film 24*a* as it is fed into the cutting apparatus 26 though no tension is applied to the elongate film 24*a* downstream of the nip roller 56. A switching roller 57 for switching between the production of a film roll with an inner coated surface and the production of a film roll with an outer coated surface is horizontally movably disposed downstream of the nip roller pair 52*a*.

As shown in FIGS. 3 and 5, the film winding apparatus 10 has a core rotating mechanism 58 for holding and rotating cores 28, a plurality of (e.g., 14) block wrappers 60 (or 60*a*) for winding the elongate films 24*a*, 24*c* to a given length around cores 28 to produce rolls 30*a*, 30*c*, a moving mechanism 62 for moving a given number of block wrappers 60 (or 60*a*) by a distance depending on the axial length of the cores 28 in the directions indicated by the arrow C transverse to the axial directions of the cores 28 indicated by the arrow D to place the given number of block wrappers 60 (or 60*a*) in a winding position P1 (see FIG. 12) for the elongate films 24*a*, 24*c*, a product receiving mechanism 64 for gripping the circumferential surfaces of the elongate films 24*a*, 24*c* wound around the cores 28 while applying a certain tension to the elongate films 24*a*, 24*c*, the product receiving mechanism 64 being movable away from the block wrappers 60 (or 60*a*), a cutting mechanism 66 for transversely cutting the elongate films 24*a*, 24*c* while they are being tensioned by the product receiving mechanism 64, and a pair of left and right core supply mechanisms 68 disposed one on each side of the product receiving mechanism 64, for automatically supplying cores 28 to the block wrappers 60 (or 60*a*) depending on the winding direction of the elongate films 24*a*, 24*c*.

Figure 6:
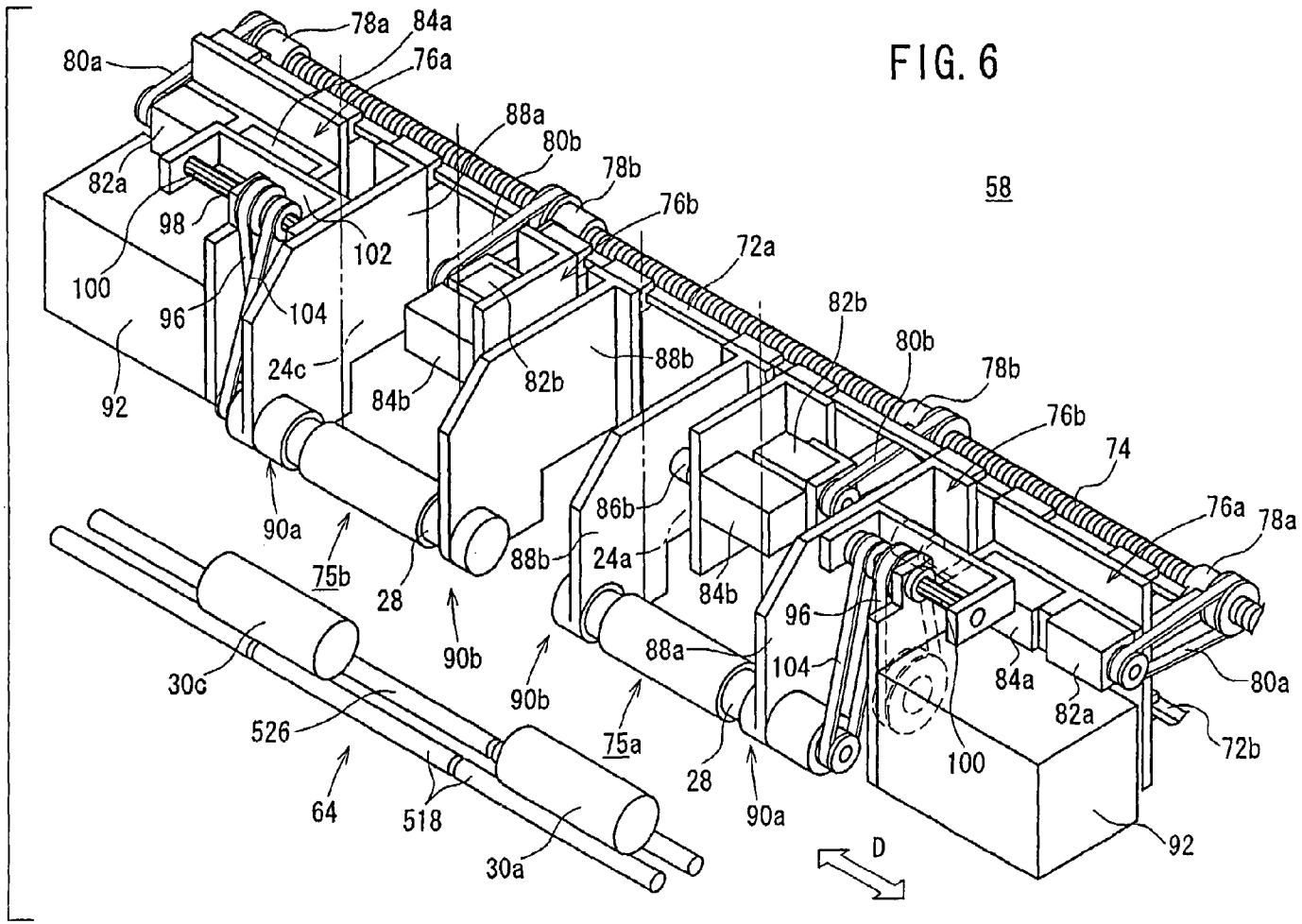
FIG. 6 is a perspective view of a core rotating mechanism of the film processing and cutting machine.

As shown in FIG. 6, the core rotating mechanism 58 has first and second core rotating units 75*a*, 75*b* for supporting two cores 28 coaxially with each other and simultaneously winding the elongate films 24*a*, 24*c* around the respective cores 28. The first and second core rotating units 75*a*, 75*b* are positionally adjustable by two guide rails 72*a*, 72*b* and a ball screw 74 which extend in the directions indicated by the arrow D (axial directions of the cores 28).

Figure 7:
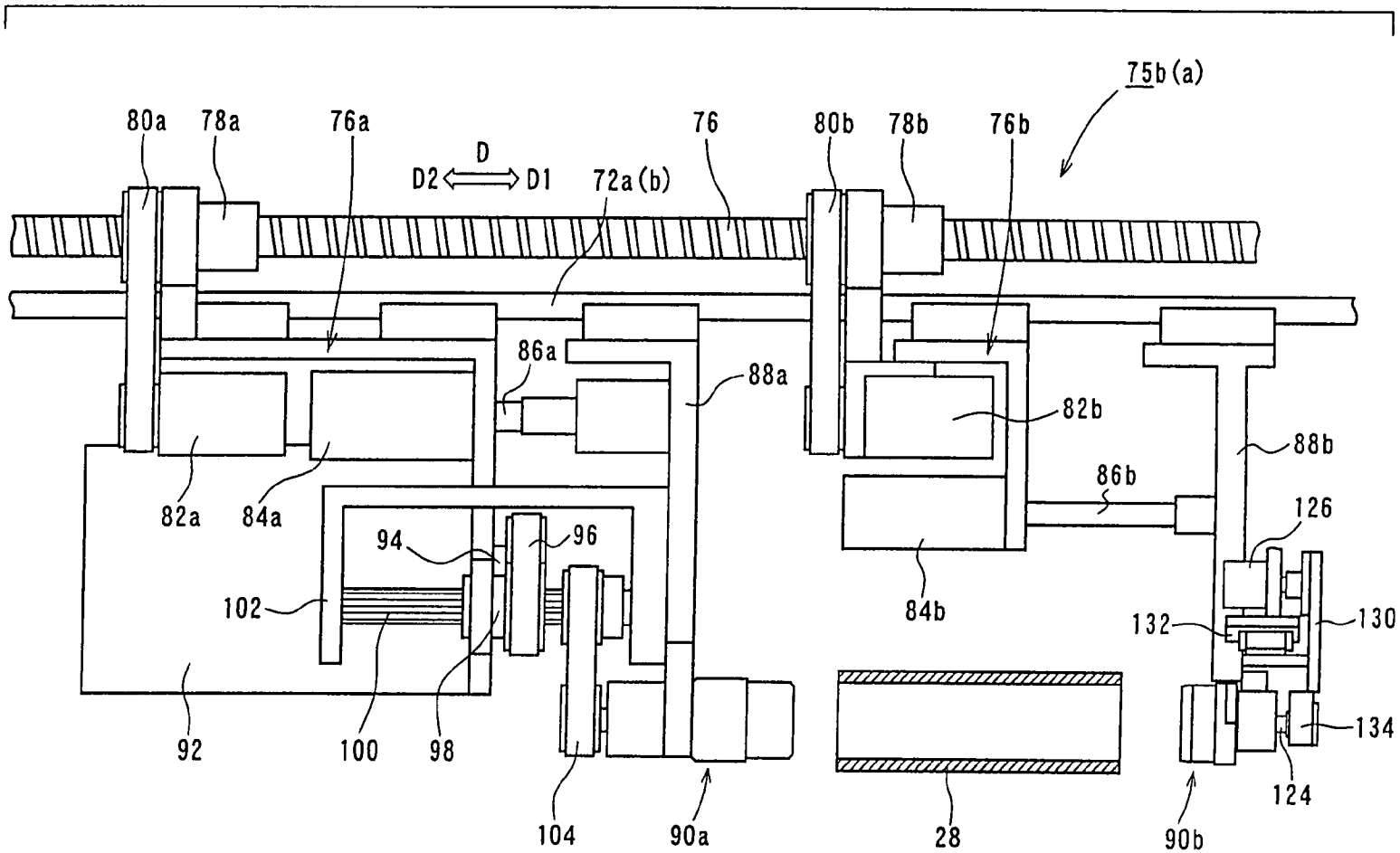
FIG. 7 is a plan view of the core rotating mechanism.

As shown in FIGS. 6 and 7, the first and second core rotating units 75*a*, 75*b* have respective movable bases 76*a*, 76*b* supported on the guide rails 72*a*, 72*b* and the ball screw 74. The movable bases 76*a*, 76*b* support thereon respective nuts 78*a*, 78*b* threaded over the ball screw 74 and respective servomotors 82*a*, 82*b* for rotating the respective nuts 78*a*, 78*b* individually through belt and pulley means 80*a*, 80*b*, respectively.

Cylinders 84*a*, 84*b* are fixed respectively to the movable bases 76*a*, 76*b* and have respective rods 86*a*, 86*b* projecting therefrom to which respective take-up arms 88*a*, 88*b* are secured. Core chucks 90*a*, 90*b* are rotatably mounted on the respective take-up arms 88*a*, 88*b*. The core chuck 90*a* can be rotated selectively in normal and reverse directions by a servomotor 92.

The servomotor 92 is fixedly mounted on the movable base 76*a* and has a drive shaft 94 to which a rotary tube 98 is coupled by a belt and pulley means 96. The rotary tube 98 has spline grooves defined in its inner circumferential surface, and a spline shaft 100 is fitted in the spline grooves. The spline shaft 100 is rotatably supported on a casing 102 fixed to the take-up arm 88*a*. The core chuck 90*a* is coupled to an end of the spline shaft 100 by a belt and pulley means 104.

Figure 8:
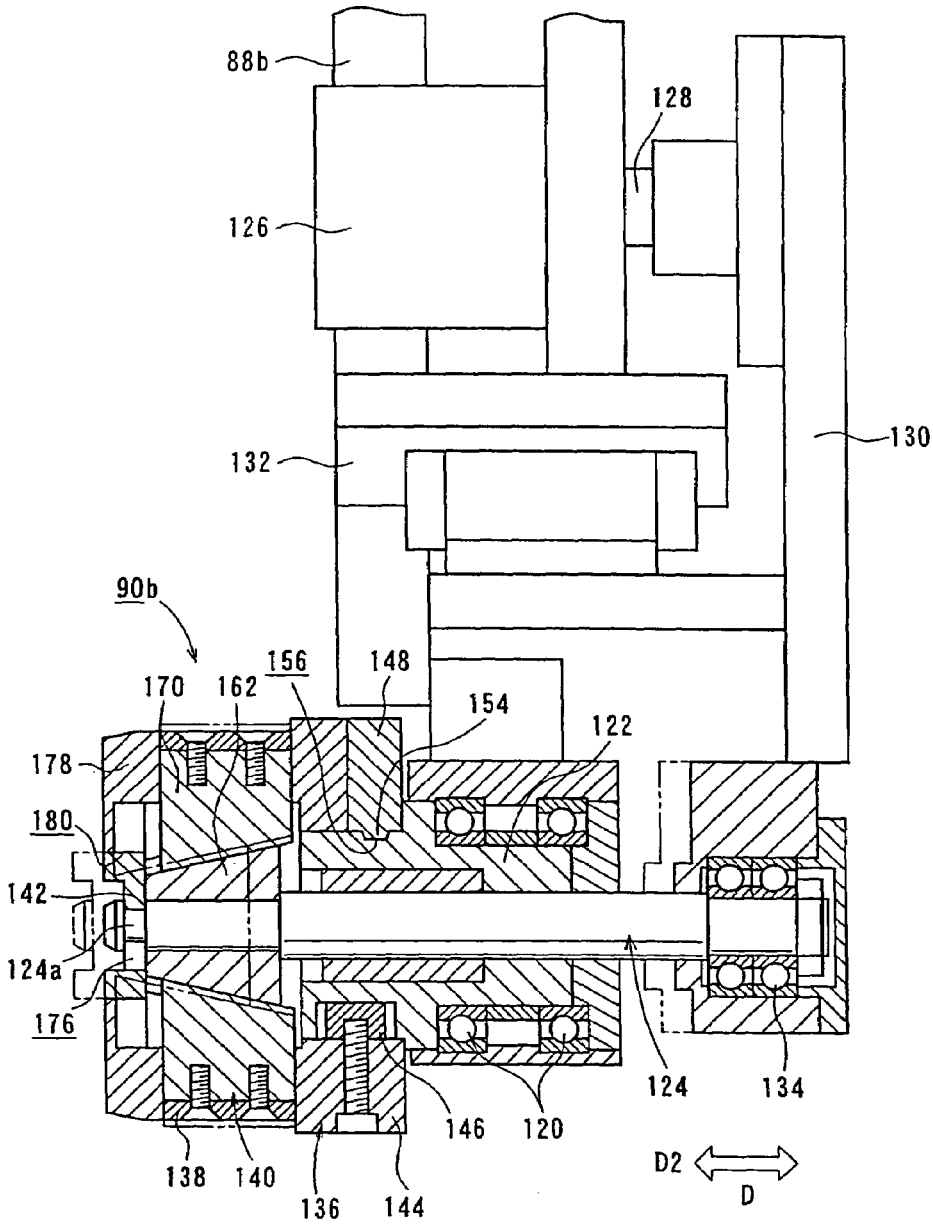
FIG. 8 is a cross-sectional view of a core chuck of the core rotating mechanism.

As shown in FIG. 8, a hollow rotatable shaft 122 is rotatably supported on an end of the take-up arm 88*b* by bearings 120. A rod 124 is inserted in the hollow rotatable shaft 122 and is axial movable in the directions indicated by the arrows D by a cylinder 126. The rod 124 is of an axially stepped structure which is progressively smaller in diameter toward its distal end and has a small-diameter neck 124*a* on its distal end. The cylinder 126 is fixed to the take-up arm 88*b* and has a rod 128 projecting therefrom in a direction away from the core chuck 90*b*. A movable plate 130 is coupled to the rod 128 and movable toward and away from the take-up arm 88*b* along a pair of left and right linear guides 132. The rod 124 is rotatably supported on an end of the movable plate 130 by bearings 134.

Figure 9:
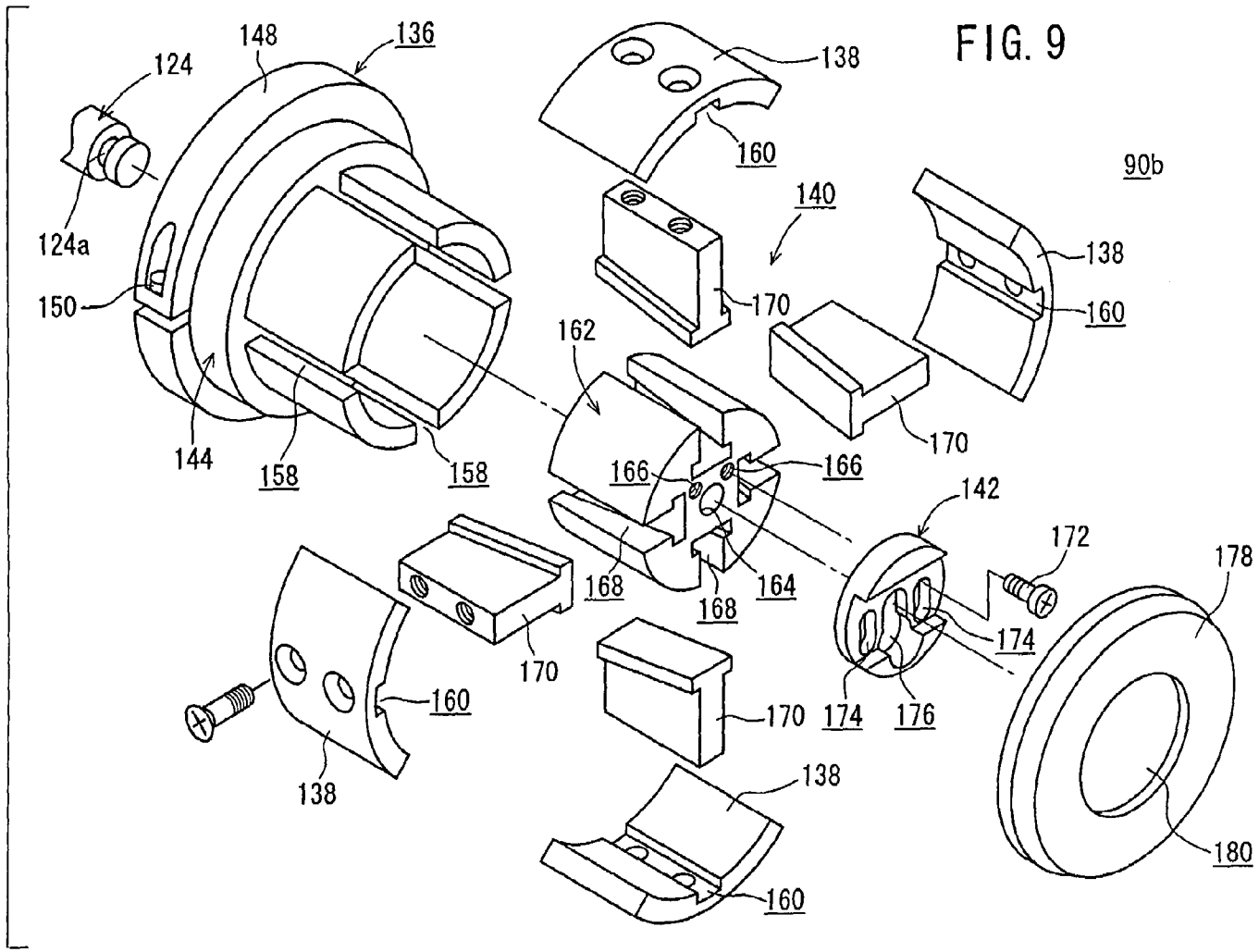
FIG. 9 is an exploded perspective view of the core chuck.

As shown in FIGS. 8 and 9, the core chuck 90*b* comprises a fixing member 136 for fixing the core chuck 90*b* to the rotatable shaft 122, a plurality of, e.g., four, radially expandable and contractible fingers 138 for holding the inner circumferential surface of the core 28, a wedge member 140 coupled to the rod 124 for radially expanding and contacting the fingers 138 in unison, and a rod fixing member 142 for mounting the wedge member 140 on the rod 124.

Figure 10:
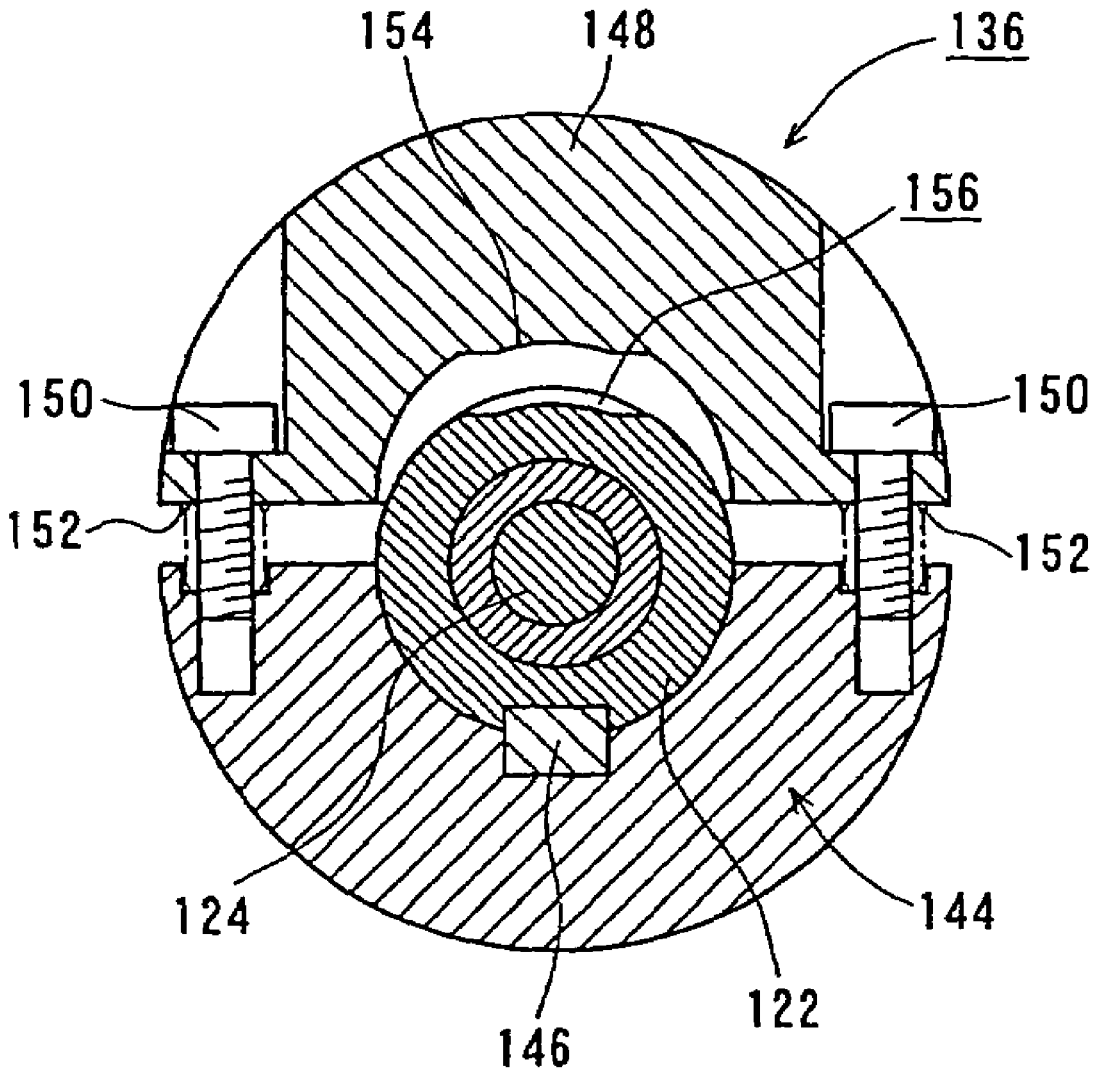
FIG. 10 is a transverse cross-sectional view of a fixing member of the core chuck.

As shown in FIGS. 8 through 10, the fixing member 136 has a cylindrical member 144 which is coupled to the rotatable shaft 122 by a key 146. The cylindrical member 144 has a recess defined therein, and a support member 148 is openably and closably mounted in the recess. The support member 148 is of a substantially arcuate shape and is mounted on the cylindrical member 144 by a pair of mounting screws 150 and a pair of springs 152. The support member 148 has a trapezoidal land 154 disposed on its inner circumferential surface which can be fitted in a trapezoidal groove 156 defined in the rotatable shaft 122.

As shown in FIG. 9, the cylindrical member 144 has a plurality of, e.g., four, slit-like openings 158 defined in its tip end portion at circumferentially spaced angular intervals and extending axially. The radially expandable and contractible fingers 138 are of a substantially arcuate shape and have respective grooves 160 defined in their inner circumferential surfaces and extending axially. The grooves 160 are positioned in alignment with the respective slit-like openings 158 of the fixing member 136.

The wedge member 140 has a substantially cylindrical body 162 having a hole 164 defined centrally therethrough, with the rod 124 being inserted in the hole 164. The body 162 has two threaded holes 166 defined in an end face thereof and four grooves 168 defined in its outer circumferential surface at circumferentially spaced angular intervals. Wedge pieces 170 are disposed respectively in the grooves 168 for axial movement in directions inclined toward the center of the body 162. The wedge pieces 170 are disposed respectively in the slit-like openings 158 in the cylindrical member 144 and have respective outer circumferential ends disposed respectively in the grooves 160 of the radially expandable and contractible fingers 138 and fastened thereto by screws.

The rod fixing member 142 is substantially in the form of a disk and has a pair of oblong holes 174 for the insertion of mounting screws 172 therein and a rod hole 176 defined between the oblong holes 174 and having a larger-diameter end. The larger-diameter end of the rod hole 176 has such a diameter that the distal end of the rod 124 can be inserted into the larger-diameter end of the rod hole 176. The rod hole 176 has an opposite smaller-diameter end whose diameter is smaller than the diameter of the distal end of the rod 124 and corresponds to the diameter of the neck 124*a* of the rod 124. A cover 178 is fixed to a distal end of the fixing member 136 and has a central hole 180 defined therein for the passage of the rod fixing member 142 therethrough.

Figure 11:
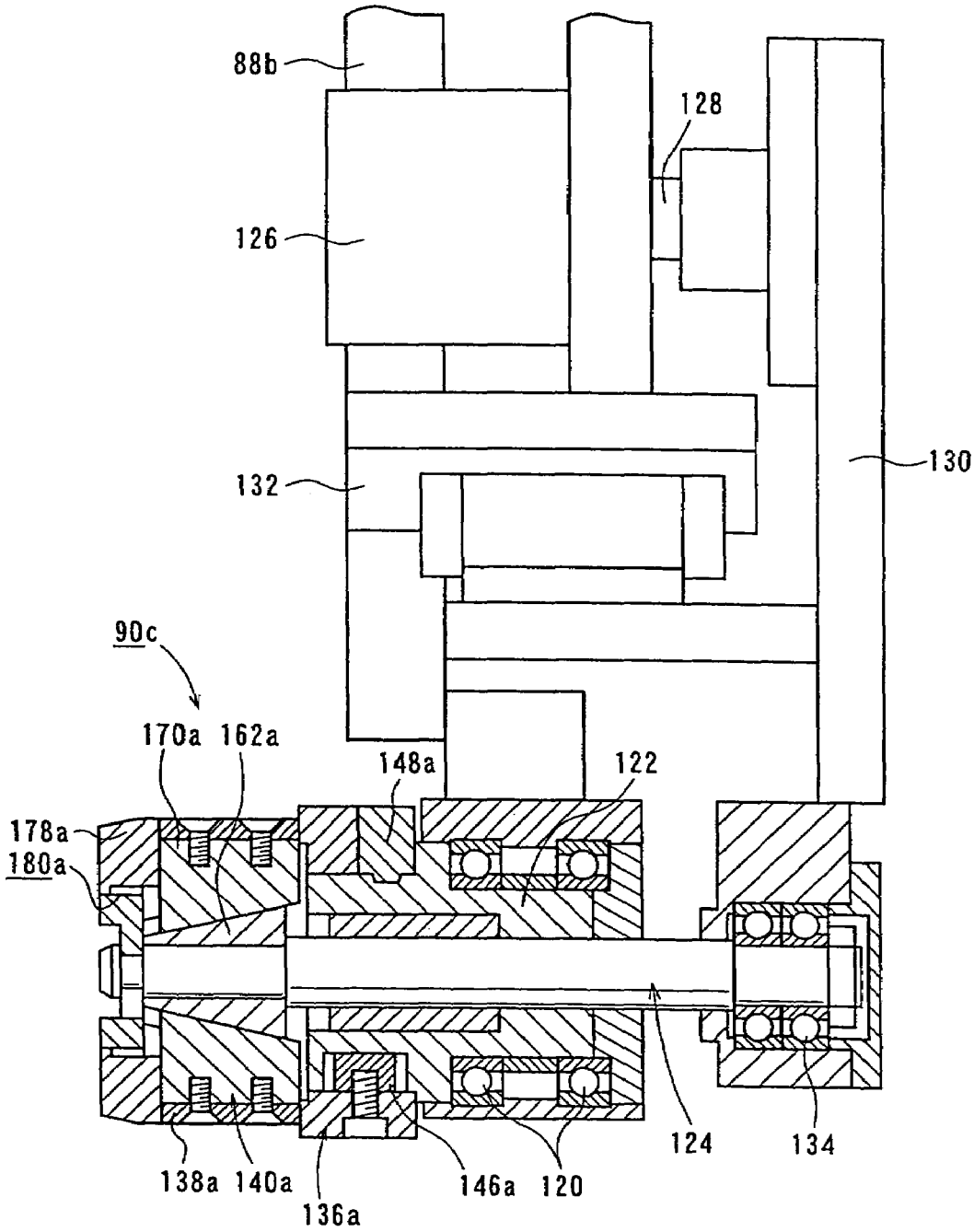
FIG. 11 is a cross-sectional view of a small-diameter core chuck.

The core chuck 90*b* is constructed to hold a large-diameter core 28, e.g., a core 28 having a diameter of 3 inches. A core chuck 90*c* shown in FIG. 11 which can hold a small-diameter core 28, e.g., a core 28 having a diameter of 2 inches, is also available for replacement of the core chuck 90*b*. The core chuck 90*c* is identical in structure to the core chuck 90*b*. Those parts of the core chuck 90*c* which are identical to those of the core chuck 90*b* are denoted by identical reference numerals with a suffix "a", and will not be described in detail below.

Figure 12:
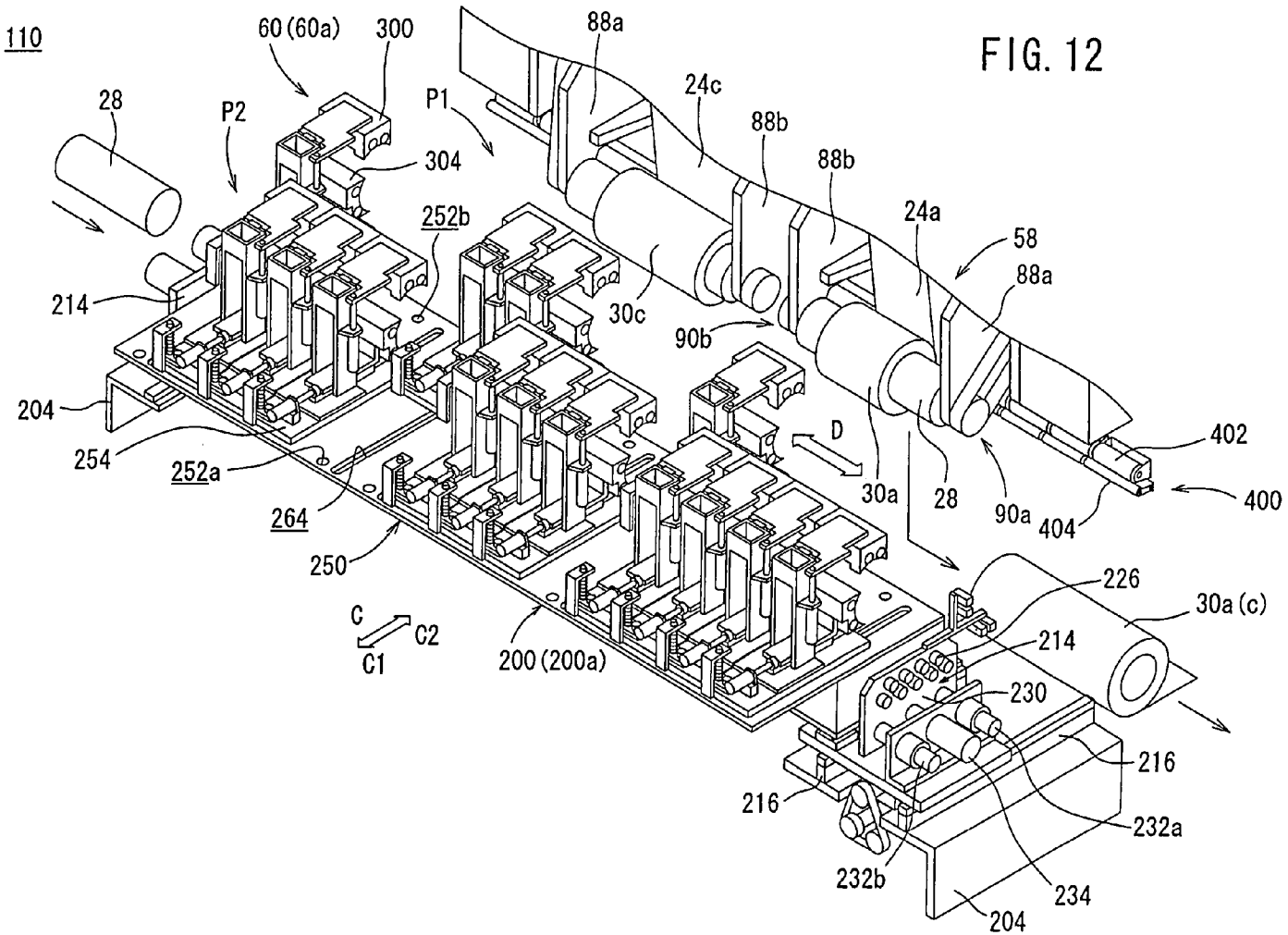
FIG. 12 is a perspective view of a block wrapper and a first unit body of a film winding mechanism.
Figure 13:
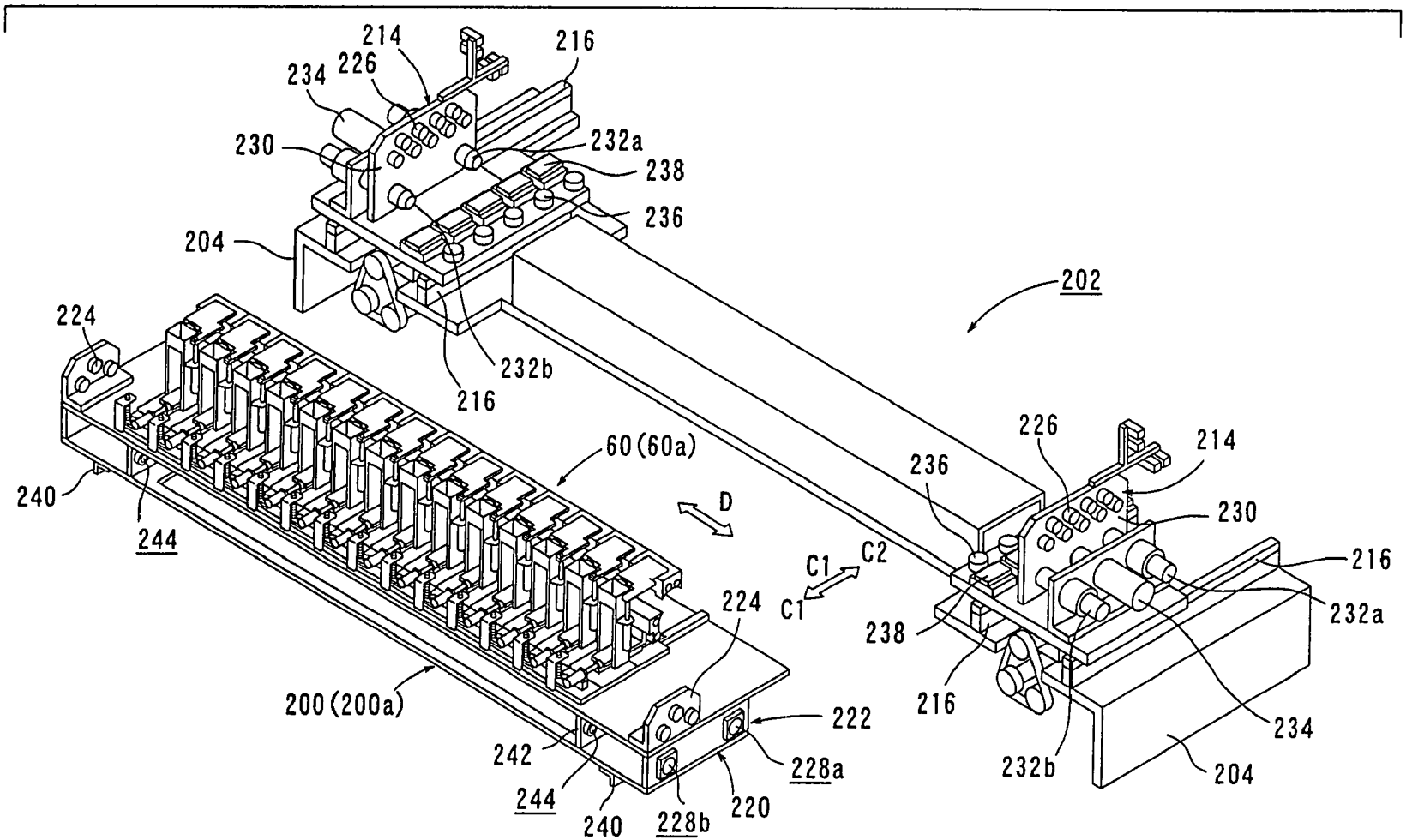
FIG. 13 is a perspective view of the block wrapper, the first unit body, and a first drive unit.

As shown in FIG. 5, the block wrappers 60 (or 60*a*) and a winding nip roller unit 400 disposed in confronting relation to the block wrappers 60 (or 60*a*) jointly make up a winding mechanism 110. As shown in FIGS. 12 and 13, the winding mechanism 110 has a first unit body 200 (or 200*a*) on which the block wrappers 60 (or 60*a*) are individually movable in the directions indicated by the arrow C which are transverse to the axial directions of cores 28 (the directions indicated by the arrow D). The first unit body 200 (or 200*a*) is mounted on a first drive unit 202 and movable in the directions indicated by the arrow C. The first unit bodies 200, 200*a* are identical in structure to each other, and hence only the first unit body 200 will be described below.

Figure 17:
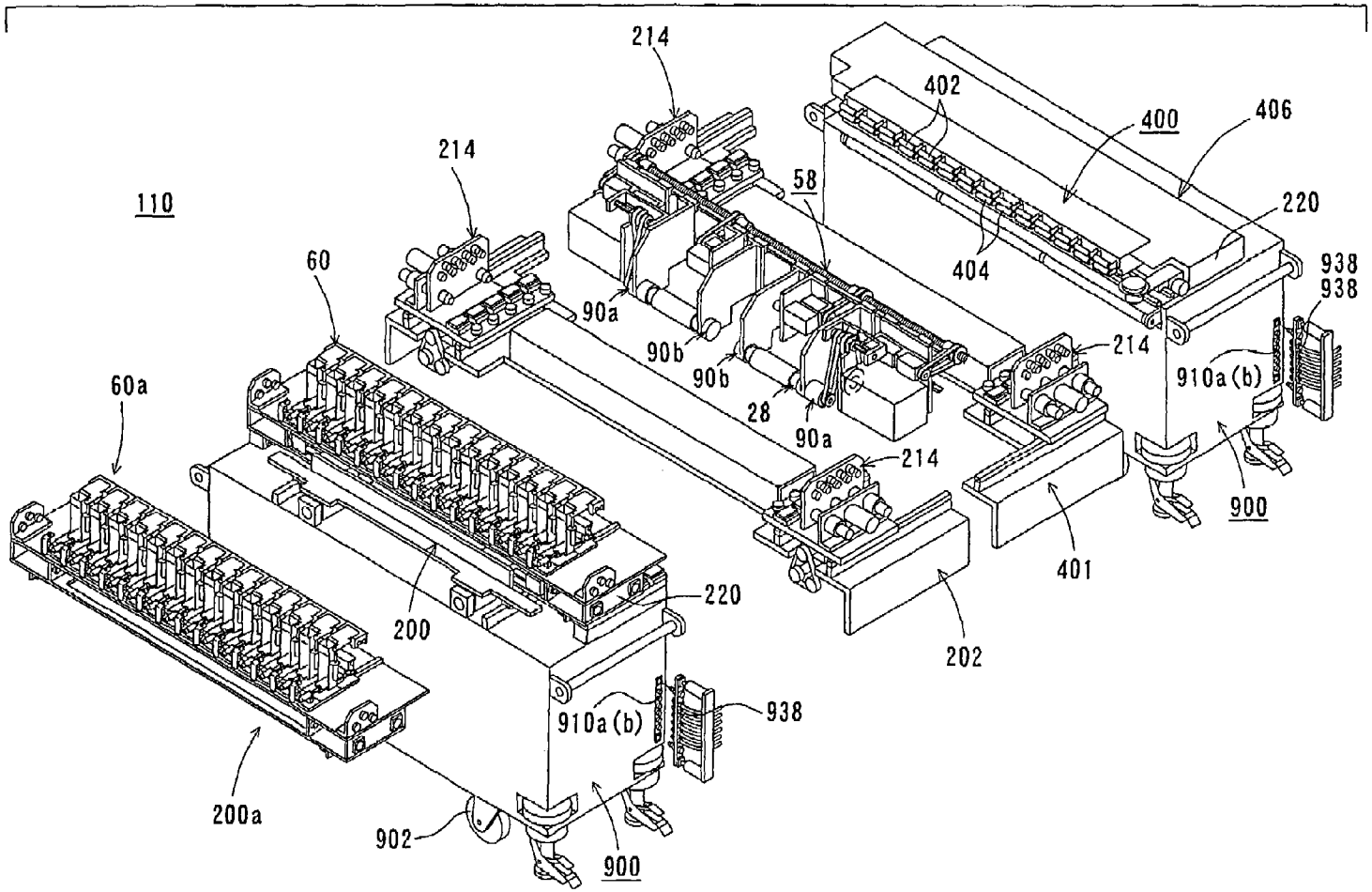
FIG. 17 is a perspective view of the block wrapper, first and second drive units, and a transfer carriage.

The block wrappers 60 on the first unit body 200 are used to hold large-diameter cores 28, e.g., cores 28 having a 3-inch diameter, and the block wrappers 60*a* on the first unit body 200*a* are used to hold small-diameter cores 28, e.g., cores 28 having a 2-inch diameter (see FIG. 17).

Figure 14:
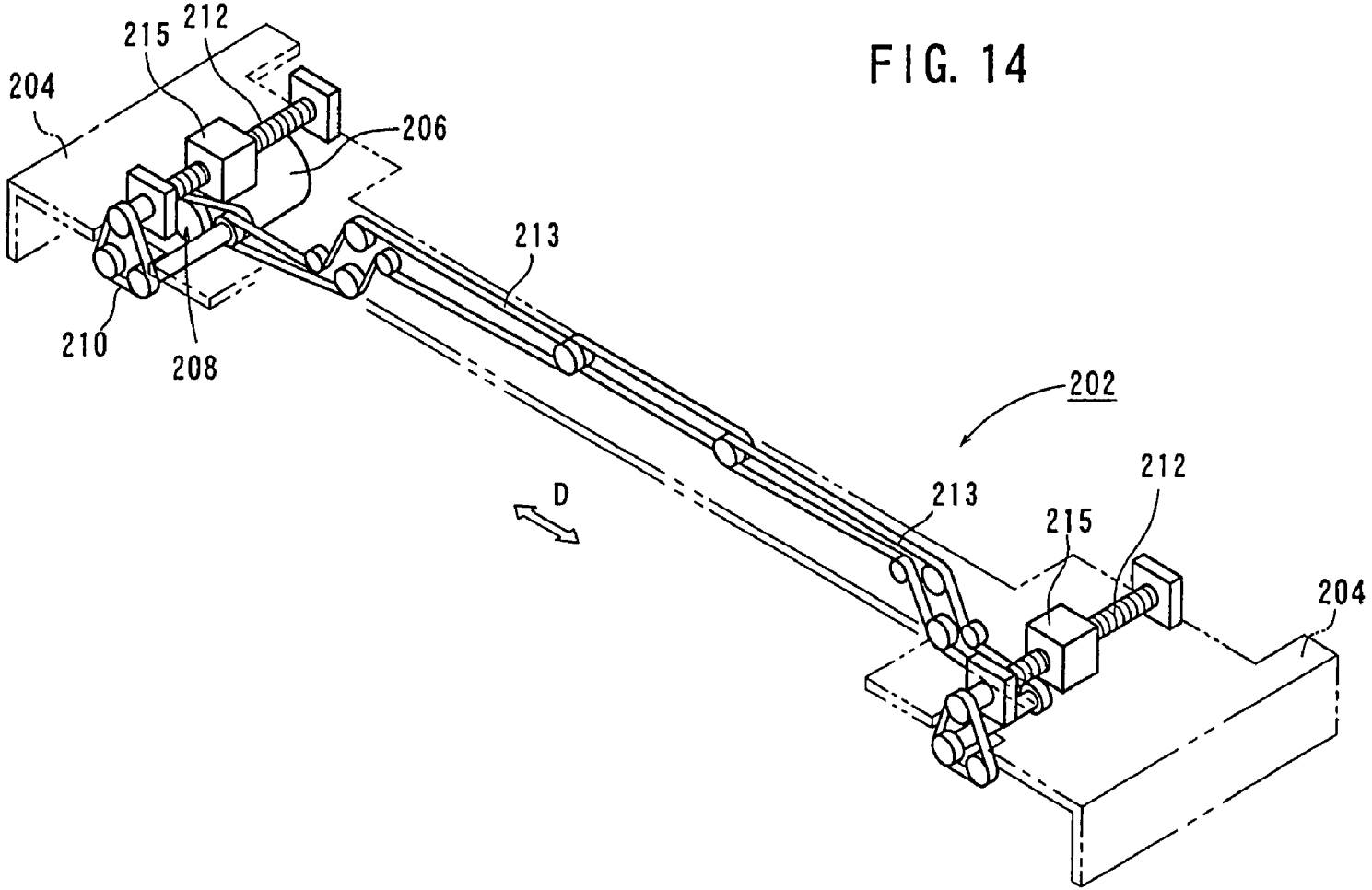
FIG. 14 is a perspective view showing a drive structure of the first drive unit.

The first drive unit 202 has a pair of frames 204 spaced from each other by a certain distance in the directions indicated by the arrow D. As shown in FIG. 14, a servomotor 206 is mounted on one of the frames 204. The servomotor 206 has a drive shaft 208 to which a ball screw 212 is coupled through a belt and pulley means 210. The belt and pulley means 210 is engaged by another belt and pulley means 213 which extends in the directions indicated by the arrow D. The belt and pulley means 213 is operatively connected to a ball screw 212 that is mounted on the other frame 204.

The ball screws 212 are rotatably supported on upper surfaces of the respective frames 204, and are threaded through respective nuts 215 mounted on respective movable bodies 214. Each of the movable bodies 214 is supported on a pair of guide rails 216 mounted on one of the frames 204 (see FIGS. 12 and 13).

As shown in FIG. 13, the first unit body 200 has joints 220 disposed respectively on its longitudinal opposite ends. On the joints 220 and the movable bodies 214, there are mounted unit locks 222 for positioning and fixing the first unit body 200 and air couplers 224, 226 for introducing drive air from an external drive air source into actuators (to be described later on) of the block wrappers 60 mounted on the first unit body 200.

The unit locks 222 have holes 228*a*, 228*b* defined in the joints 220 and lock pins 232*a*, 232*b* mounted on joint plates 230 of the movable bodies 214. The joint plates 230 are movable in the directions indicated by the arrow D by cylinders 234, and support the air couplers 226 which are connected to the external drive air source (not shown). The movable bodies 214 have respective cam followers 236 extending in the directions indicated by the arrow C for guiding the first unit body 200, and respective roller guides 238.

The air couplers 224 are fixedly mounted on upper surfaces of the opposite ends of the first unit body 200 which are spaced apart in the directions indicated by the arrow D. Plate-like receivers 240 guided by the cam followers 236 on the movable bodies 214 are mounted on the bottom of the first unit body 200, the plate-like receivers 240 extending in the directions indicated by the arrow C. The first unit body 200 houses therein upstanding support plates 242 positioned closely to the respective joints 220. The support plates 242 have respective lock holes 244 defined therein.

Each of the block wrappers 60 can be fixed to the first unit body 200 selectively in a winding position P1 and a retracted position P2 (see FIG. 12). The first unit body 200 and the block wrappers 60 have a lock mechanism 250 for fixing the block wrappers 60 selectively in the winding position P1 and the retracted position P2. The lock mechanism 250 has first and second holes 252*a*, 252*b* defined in association with the winding position P1 and the retracted position P2, respectively, for the block wrappers 60, and lock pins 256 movably mounted on a base 254, on which the block wrappers 60 are mounted, and fittable in the first and second holes 252*a*, 252*b*.

Figure 15:
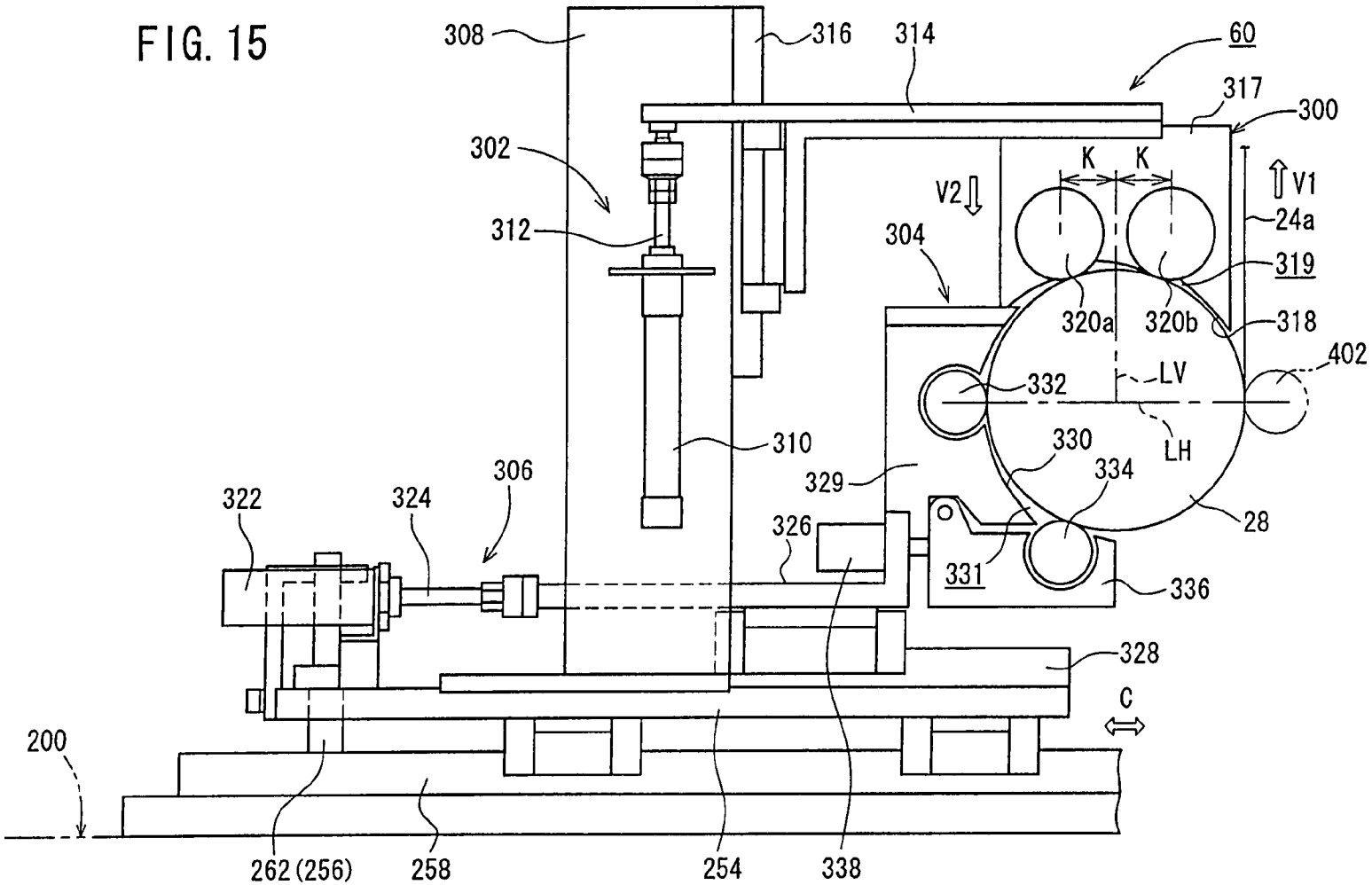
FIG. 15 is a side elevational view showing a structure of the block wrapper.
Figure 16:
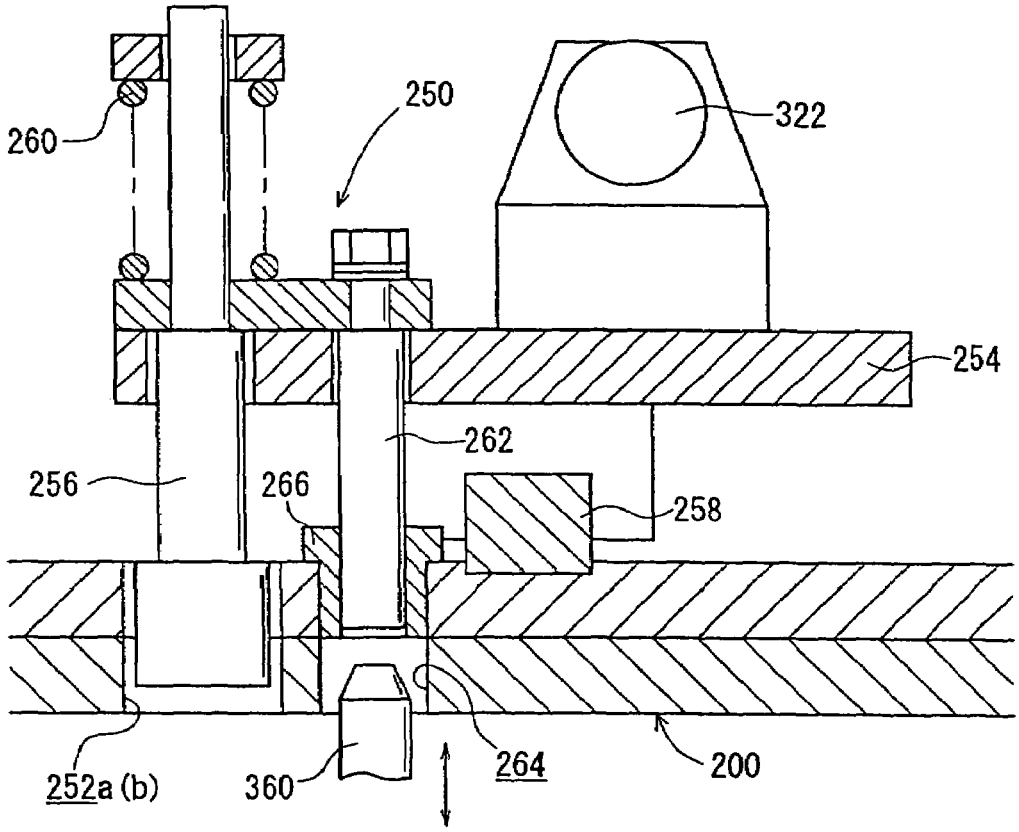
FIG. 16 is a cross-sectional view of a lock mechanism for fixing the block wrapper.

As shown in FIGS. 15 and 16, the base 254 is mounted on a guide rail 258 on the first unit body 200 for movement therealong in the directions indicated by the arrow C. A lock pin 256 which is normally biased downwardly by a spring 260 is mounted on the base 254. The lock pin 256 is combined with an operating pin 262 which is vertically movable in unison with the lock pin 256. The first unit body 200 has a slit-like groove 264 defined therein in alignment with the operating pin 262 and extending in the range in which the block wrappers 60 are movable. The operating pin 262 is inserted in a bushing 266 that is placed in the slit-like groove 264.

As shown in FIG. 15, the block wrappers 60 have respective upper wrappers 300 mounted on the base 254 and vertically movable by a lifting and lowering means 302, and side wrappers 304 mounted on the base 254 and horizontally movable by a moving means 306. The lifting and lowering means 302 has a rectangular support tube 308 mounted on the base 254 and extending vertically upwardly, and an actuator with a pressing force adjusting function in the form of a vertical cylinder 310, for example, is fixed to a side panel of the rectangular support tube 308. The cylinder 310 has an upwardly extending rod 312 to which there is fixed a vertically movable base 314 that is vertically movably supported on a guide rail 316 fixedly mounted another side panel of the rectangular support tube 308. Each of the upper wrappers 300 is mounted on the lower surface of a distal end portion of the vertically movable base 314.

Each of the upper wrappers 300 has a block 317 fixed to the vertically movable base 314. The block 317 has a guide surface 318 on its end close to the core 28 which has a radius of curvature slightly greater than the radius of curvature of the outer circumferential surface of the core 28. A gap 319 for passing the elongate film 24*a* therethrough is defined between the guide surface 318 and the core 28. First and second free rollers (first and second pressing rollers) 320*a*, 320*b* are rotatably supported on the block 317 and positioned on the guide surface 318 for pressing the elongate film 24*a* against the outer circumferential surface of the core 28. The first and second free rollers 320*a*, 320*b* are movable toward and away from the core 28 and can be pressed against the core 28 in the direction indicated by the arrow V2 which is opposite to the direction indicated by the arrow V1 in which the elongate film 24*a* is tensioned.

The first and second free rollers 320*a*, 320*b* are symmetrically positioned with respect to a hypothetical reference line LV which extends parallel to the direction indicated by the arrow V1 in which the elongate film 24*a* is tensioned and also extends diametrically across the core 28. Specifically, the first and second free rollers 320*a*, 320*b* are axially symmetrically positioned at equal distances K from the hypothetical reference line LV extending across the core 28.

The moving means 306 comprises an actuator with a pressing force adjusting function in the form of a horizontal cylinder 322, for example, mounted on the base 254. The cylinder 322 has a horizontally extending rod 324 to which there is fixed a movable base 326 that is supported on a rail 328 on the base 254 for movement in the directions indicated by the arrow C. Each of the side wrappers 304 is mounted on the movable base 326.

Each of the side wrappers 304 has a block 329 having a guide surface 330 on its end close to the core 28 which has a radius of curvature slightly greater than the radius of curvature of the outer circumferential surface of the core 28. A gap 331 for passing the elongate film 24*a* therethrough is defined between the guide surface 330 and the core 28. Third and fourth free rollers 332, 334 are rotatably supported on the block 329 and positioned on the guide surface 330.

The third free roller 332 as a third pressing roller is disposed on a hypothetical line LH that extends diametrically across the core 28 transversely to the hypothetical reference line LV. The fourth free roller 334 as a receiving roller is disposed in engagement with the core 28 in substantially diametrically opposite relation to the first and second free rollers 320*a*, 320*b*. The fourth free roller 334 is supported on a swing block 336 for angular movement with respect to the side wrapper 304. An air cylinder 338 as an air spring abuts against the swing block 336 for reliably holding the fourth free roller 334 against the core 28 even if the core 28 has a slightly different outside diameter.

Figure 18:
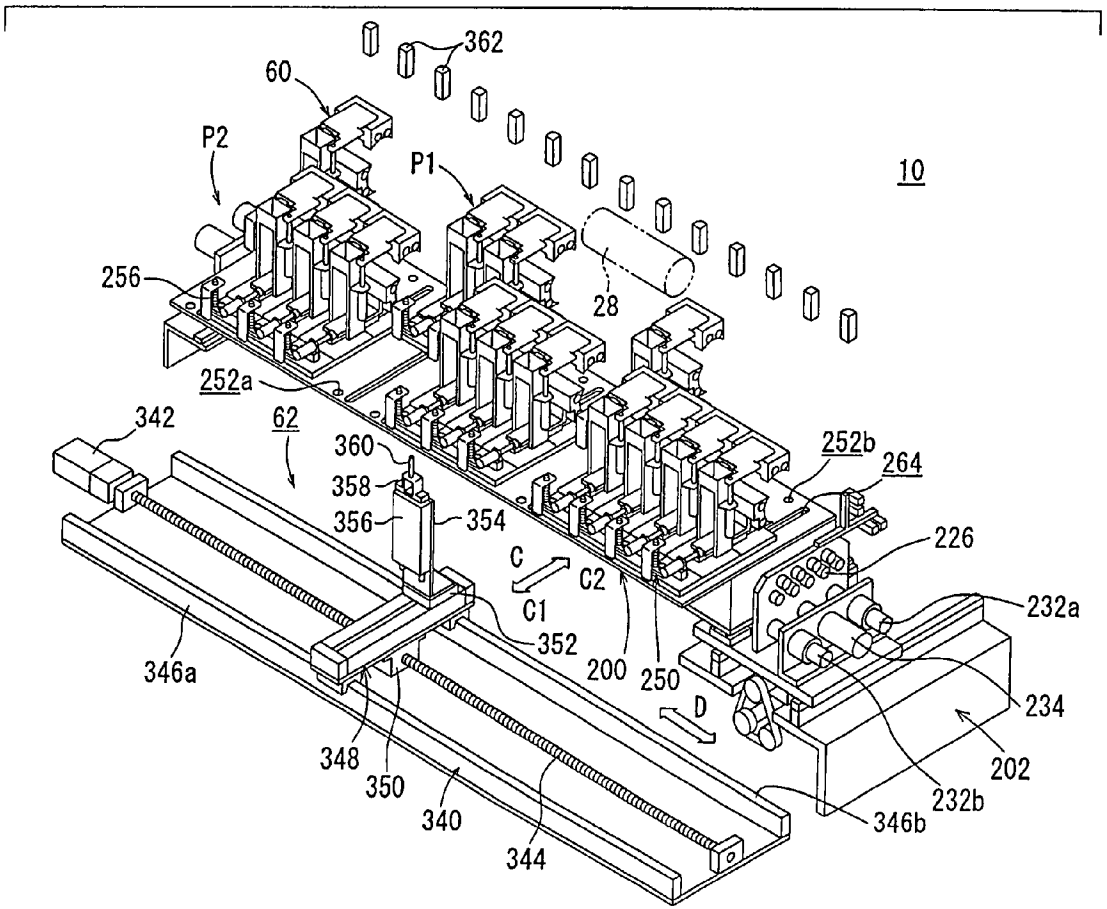
FIG. 18 is a perspective view of a moving mechanism for moving the block wrapper and the block wrapper.

As shown in FIG. 18, the moving mechanism 62 has a frame 340 having a predetermined length in the directions indicated by the arrow D, and a servomotor 342 mounted on an end of the frame 340. To the servomotor 342, there is coupled a ball screw 344 extending along the frame 340 in the directions indicated by the arrow D and rotatably supported on the frame 340. Guide rails 346*a*, 346*b* are mounted on the frame 340 in sandwiching relation to the ball screw 344. A moving base 348 is threaded over the ball screw 344 and slidably engages the guide rails 346*a*, 346*b*.

The moving base 348 has a nut 350 threaded over the ball screw 344, and supports thereon a movable base 352 that is movable longitudinally of the moving base 348 in the directions indicated by the arrow C. The movable base 352 serves as a rodless cylinder, and an attachment plate 354 is vertically mounted on the movable base 352 with a cylinder (movable member) 356 being vertically upwardly mounted on the attachment plate 354. The cylinder 356 has an upwardly projecting rod (not shown) supporting a frame member 358 to which there is secured a drive rod (drive member) 360 that extends vertically upwardly.

The drive rod 360 is inserted in the groove 264 defined in the first unit body 200. The drive rod 360 can push the operating pin 262, removing the lock pin 256 from the first hole 252*a* or the second hole 252*b*, and can also be moved in and along the groove 264 in the directions indicated by the arrow C. The moving mechanism 62 may have a plurality of movable bases 352 associated with the respective block wrappers 60, and any desired one of the movable bases 352 may be selectively moved in the directions indicated by the arrow C to move a corresponding one of the block wrappers 60.

A plurality of, e.g., 14, position confirmation sensors 362 are positioned above the first unit body 200 in association with the respective block wrappers 60, for detecting whether the block wrappers 60 are disposed in the winding position P1 or not.

Figure 19:
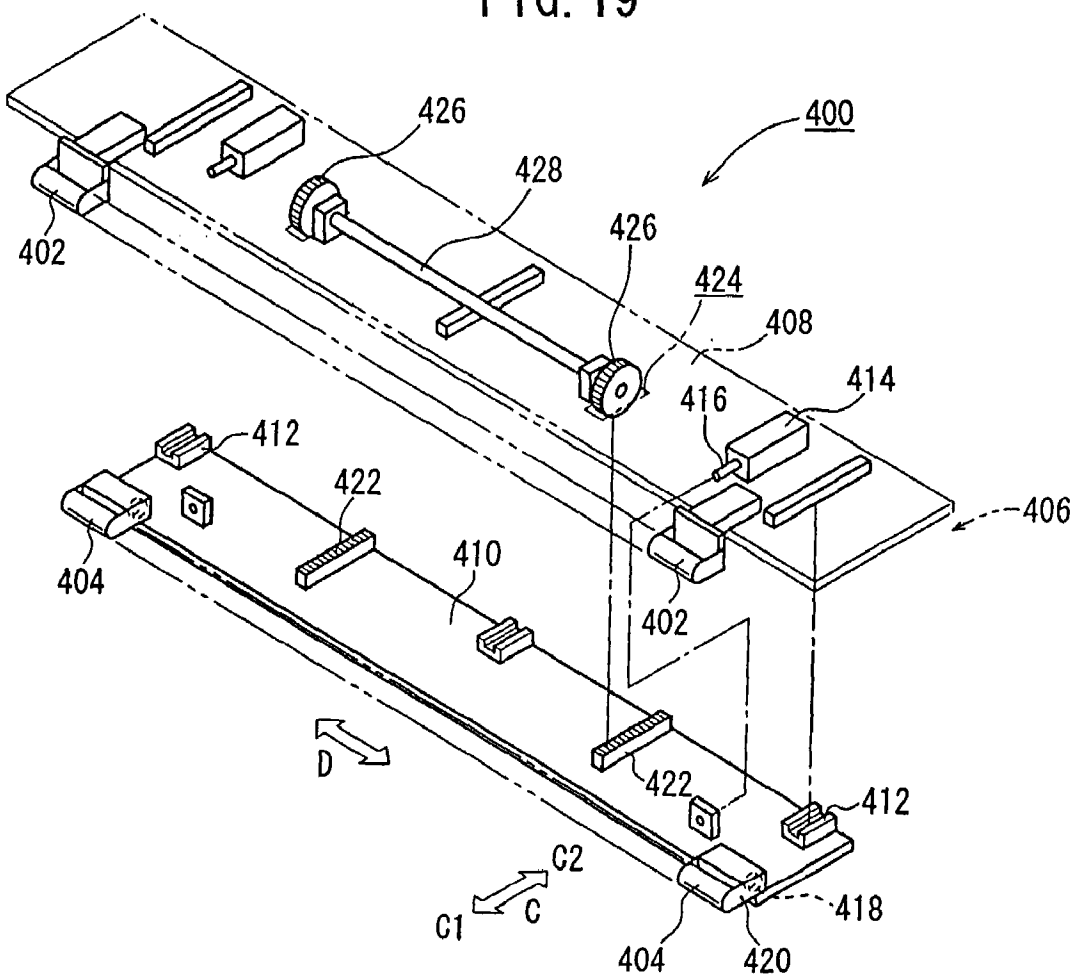
FIG. 19 is a perspective view, partly omitted from illustration, a winding nip roller unit of the film winding apparatus.

As shown in FIG. 5, the winding nip roller unit 400 of the winding mechanism 110 is mounted on a first drive unit 401 in a position confronting the block wrappers 60 (or 60*a*). As shown in FIG. 19, the winding nip roller unit 400 comprises winding nip rollers 402 for pressing and supporting the elongate film 24*a* on the outer circumferential surface of the core 28, and lower winding rollers 404 for causing an end of the cut elongate film 24*a* to extend along the outer circumferential surface of the core 28. For example, 14 winding nip rollers 402 and 14 lower winding rollers 404 are arrayed in the directions indicated by the arrow D in association with the respective block wrappers 60 (or 60*a*). Each of the winding nip rollers 402 and the lower winding rollers 404 has an axial dimension equal to or greater than the maximum width of the elongate film 24*a*.

As shown in FIG. 17, the winding nip roller unit 400 has a second unit body 406 having a joint 220 coupled to the second drive unit 401. The second unit body 406 and the second rive unit 401 are structurally identical to the first unit body 200 and the first drive unit 202. Those of the second unit body 406 and the second rive unit 401 which are identical to those of the first unit body 200 and the first drive unit 202 are denoted by identical reference characters, and will not be described in detail below.

As shown in FIG. 5, the second unit body 406 has a first cylinder 570 for moving the winding nip rollers 402 in the directions indicated by the arrow C. The first cylinder 570 has a projecting rod 570*a* coupled to a movable upper plate 574 which is movable along a linear guide 576 in unison with the winding nip rollers 402 by the first cylinder 570.

A movable lower plate 410 is disposed below the upper plate 574 for movement along a linear guide 580 in the directions indicated by the arrow C. The lower plate 410 is fixed to a rod 582*a* projecting from a second cylinder 582. A swing arm 420 is swingably supported on a distal end of the lower plate 410 by a spring 418. The lower winding rollers 404 are rotatably mounted on a distal end of the swing arm 420.

Figure 20:
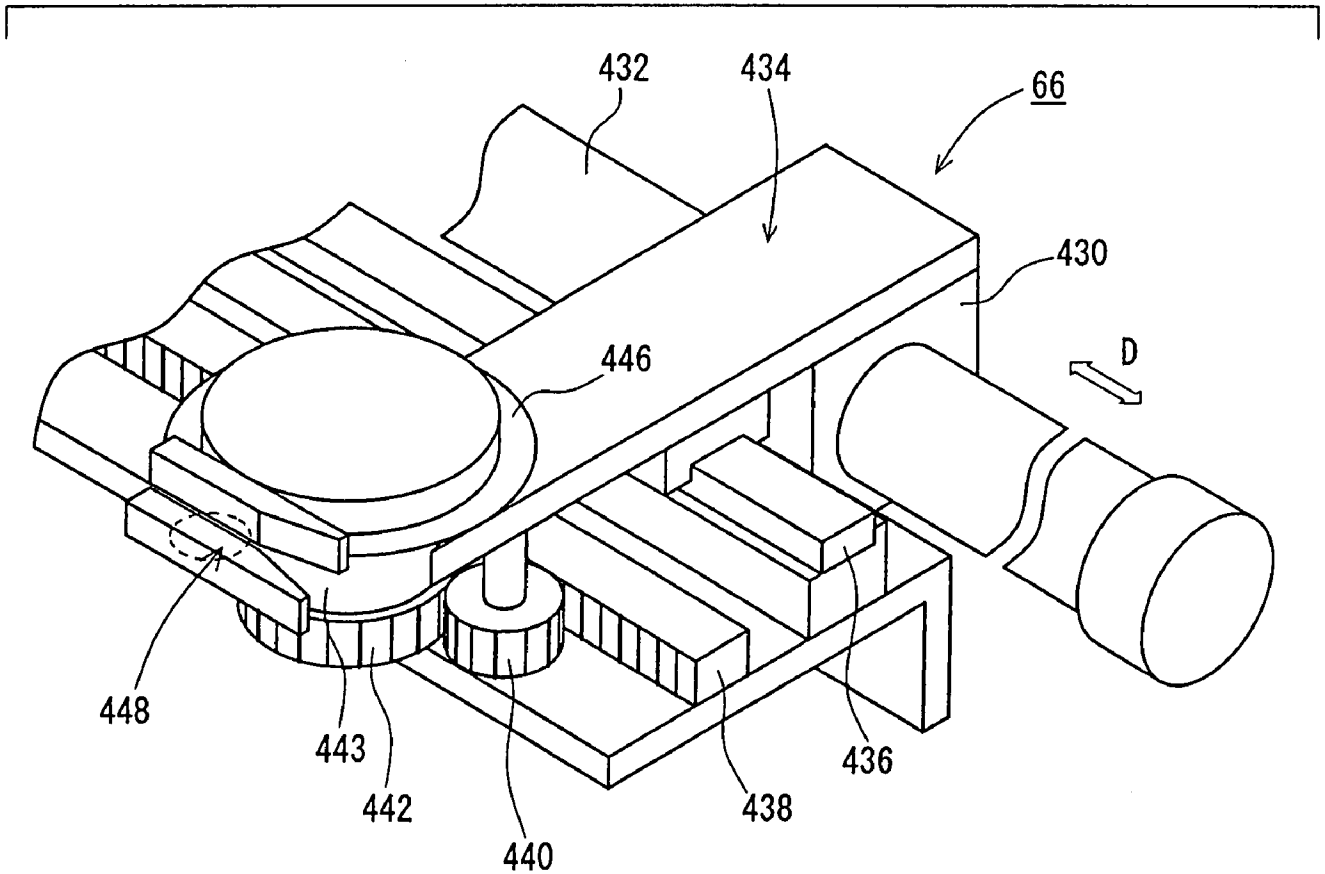
FIG. 20 is a perspective view of a cutting mechanism of the film winding apparatus.

The second unit body 406 incorporates the cutting mechanism 66. As shown in FIGS. 5 and 20, the cutting mechanism 66 comprises a rodless cylinder 430 mounted on the second unit body 406 by a rod 432 which extends axially of the core 28 in the directions indicated by the arrow D. A base member 434 is fixed to the rodless cylinder 430 and guided along a linear guide 436 in the directions indicated by the arrow D. Parallel to the linear guide 436, there extends a rack 438 meshing with a first pinion 440 which is held in mesh with a second pinion 442.

A disk-shaped cross cutter blade 446 is fixed to the second pinion 442 by a lifting and lowering cylinder 443. A sorting guide 448 for guiding the elongate film 24*a* is disposed at a distal end of the cross cutter blade 446. The elongate film 24*a* may be cut off by the cross cutter blade 446 alone or the cross cutter blade 446 as an upper blade and a lower blade disposed in confronting relation to the upper blade. The rodless cylinder 430 may be replaced with a motor, a timing belt, and a pulley for moving the base member 434. A free roller 450 supported on the second unit body 406 is disposed below the cutting mechanism 66 (see FIG. 5).

Figure 21:
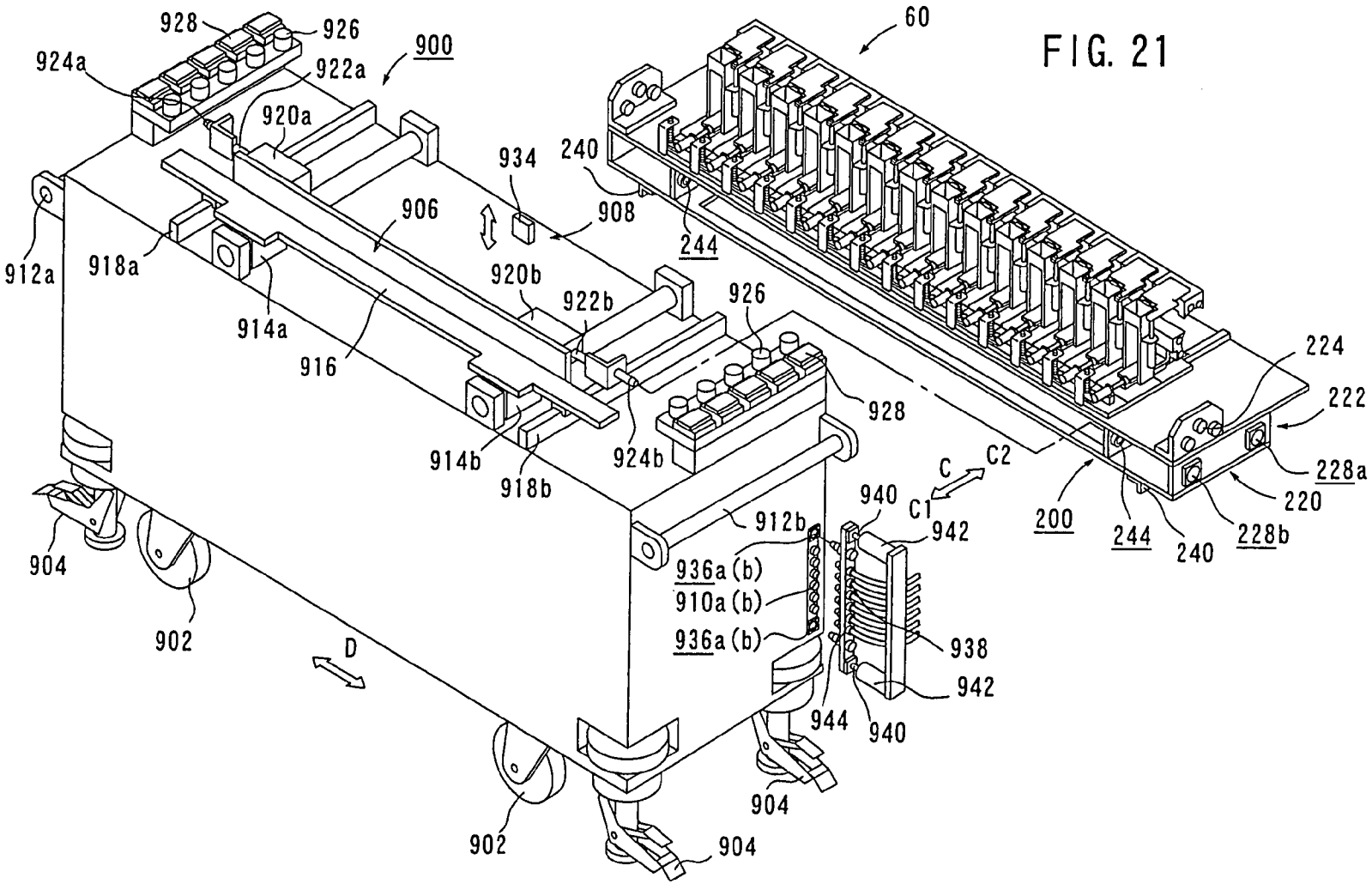
FIG. 21 is a perspective view of the transfer carriage and the first unit body.
Figure 22:
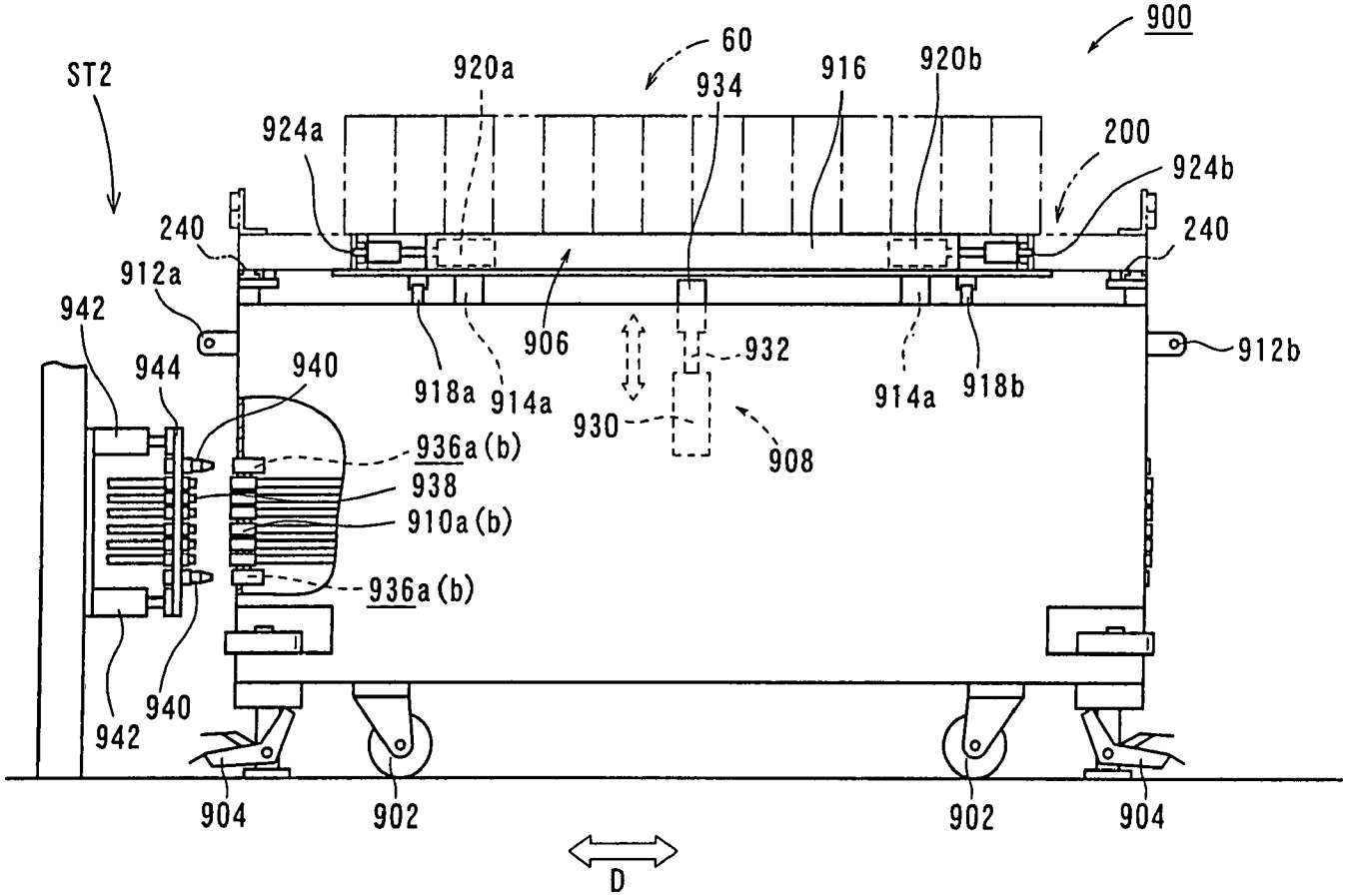
FIG. 22 is a front elevational view of the transfer carriage.

A transfer carriage 900 (see FIG. 17) is provided for automatically attaching and detaching the first unit body 200 (or 200*a*) and the second unit body 406 to and from the first drive unit 202 or the second drive unit 401. As shown in FIGS. 21 and 22, four wheels 902 are rotatably mounted on the bottom of the transfer carriage 900, and four pedal locks 904 are also mounted on the bottom of the transfer carriage 900 closely to the respective wheels 902.

The transfer carriage 900 comprises a moving unit 906 for moving the first unit body 200 (or 200*a*) or the second unit body 406 to and from the first drive unit 202 or the second drive unit 401, a lock unit 908 for locking the first unit body 200 (or 200*a*) or the second unit body 406 against unwanted movement on the transfer carriage 900, and air couplers 910*a*, 910*b* for introducing drive air from an external drive air source into actuators (described later on) of the moving unit 906 and the lock unit 908. Handles 912*a*, 912*b* are mounted on respective longitudinal opposite ends of the transfer carriage 900 for moving the transfer carriage 900 at either one of the longitudinal opposite ends of the transfer carriage 900.

The moving unit 906 has rodless cylinders 914*a*, 914*b* mounted on the transfer carriage 900 and spaced a given distance from each other in the directions indicated by the arrow D, the rodless cylinders 914*a*, 914*b* extending parallel to each other in the directions indicated by the arrow C. A movable base 916 is supported on the rodless cylinders 914*a*, 914*b*. Linear guides 918*a*, 918*b* are fixedly mounted on the transfer carriage 900 parallel to the rodless cylinders 914*a*, 914*b*. The movable base 916 is movable in directions indicated by the arrow C in engagement with the linear guides 918*a*, 918*b*.

Cylinders 920*a*, 920*b* oriented in the respective opposite directions indicated by the arrow D are fixed to the movable base 916 and have respective projecting rods 922*a*, 922*b* to which cylindrical hooks 924*a*, 924*b* are coupled. The hooks 924*a*, 924*b* are inserted in the respective lock holes 244 defined in the first unit body 200 (or 200*a*) or the second unit body 406. On the transfer carriage 900, there are disposed cam followers 926 and roller guides 928 arrayed in the directions indicated by the arrow C for guiding the receivers 240 mounted on the longitudinal opposite ends of the first unit body 200 (or 200*a*) or the second unit body 406.

The lock unit 908 has a cylinder 930 fixedly mounted in a substantially intermediate portion of the transfer carriage 900 in the longitudinal direction thereof. The cylinder 930 has a rod 932 projecting vertically upwardly therefrom with a drop prevention stopper 934 coupled thereto. The stopper 934 is inserted into a recess (or opening), not shown, which is defined in the first unit body 200 (or 200*a*) or the second unit body 406.

The air couplers 910*a*, 910*b* are mounted respectively on the longitudinal opposite ends of the transfer carriage 900. Positioning holes 936*a*, 936*b* are defined respectively in the longitudinal opposite ends of the transfer carriage 900 above and below the air couplers 910*a*, 910*b*. An air coupler 938 for being connected to the air coupler 910*a* or 910*b* and a pair of upper and lower lock pins 940 for being fitted in the positioning holes 936*a* or 936*b* are disposed in a unit replacement position where the transfer carriage 900 is placed. The air coupler 938 and the lock pins 940 are mounted on an attachment plate 944 which is movable horizontally by a pair of upper and lower cylinders 942.

There are four transfer carriages 900 thus constructed, for example, which are placed in a given holding station of the film processing and cutting machine 12. When necessary, the transfer carriages 900 are brought into unit replacing stations ST1, ST2, ST3 as shown in FIG. 3.

As shown in FIG. 5, the product receiving mechanism 64 has a vertically movable frame 500 which can be stopped selectively in four positions, i.e., in an upper position, an intermediate standby position, a film cutting position, and a lower end position, by a servomotor 502. The servomotor 502 has a drive shaft 504 operatively connected to a vertical ball screw 506 that is threaded through a nut 508 mounted on the vertically movable frame 500.

To the vertically movable frame 500, there is fixed a cylinder 510 having a vertically extending rod 512 coupled to a block 514. A first arm 516 extends upwardly from the block 514 and supports on its distal end an ejection roller 518 to which a tensioning servomotor 520 is coupled by a belt and pulley means 522. The block 514 includes a second arm 524 with a free roller 526 rotatably supported on its distal end. As shown in FIG. 6, the ejection roller 518 and the free roller 526 are axially divided into segments, and have overall lengths equal to or greater than the maximum width of the elongate film 24*a*.

Between the first and second arms 516, 524, there is disposed a conveyor 528 of a first feed unit 1104A (described later on) for ejecting a roll 30*a*, 30*c*, 30*a*', or 30*c*' (hereinafter referred to as roll 30*a*). To the vertically movable frame 500, there is secured a cylinder 530 having an upwardly extending rod 532 to which a rider roller 538 is connected by a swing arm 536.

Each of the core supply mechanisms 68 has a pusher 550 of a comb-toothed structure having teeth aligned with the respective gaps between the block wrappers 60 for smoothly supplying a core 28 to a core transfer position P3.

The core rotating mechanism 58 has a dimension smaller than the outside diameter of the core 28 so as to fit in a region where the winding mechanism 110 and the product receiving mechanism 64 are in contact with each other. Specifically, the core chucks 90*a*, 90*b* have a radius smaller than the radius of the outer circumference of the core 28, and the take-up arms 88*a*, 88*b* are shaped.

Figure 23:
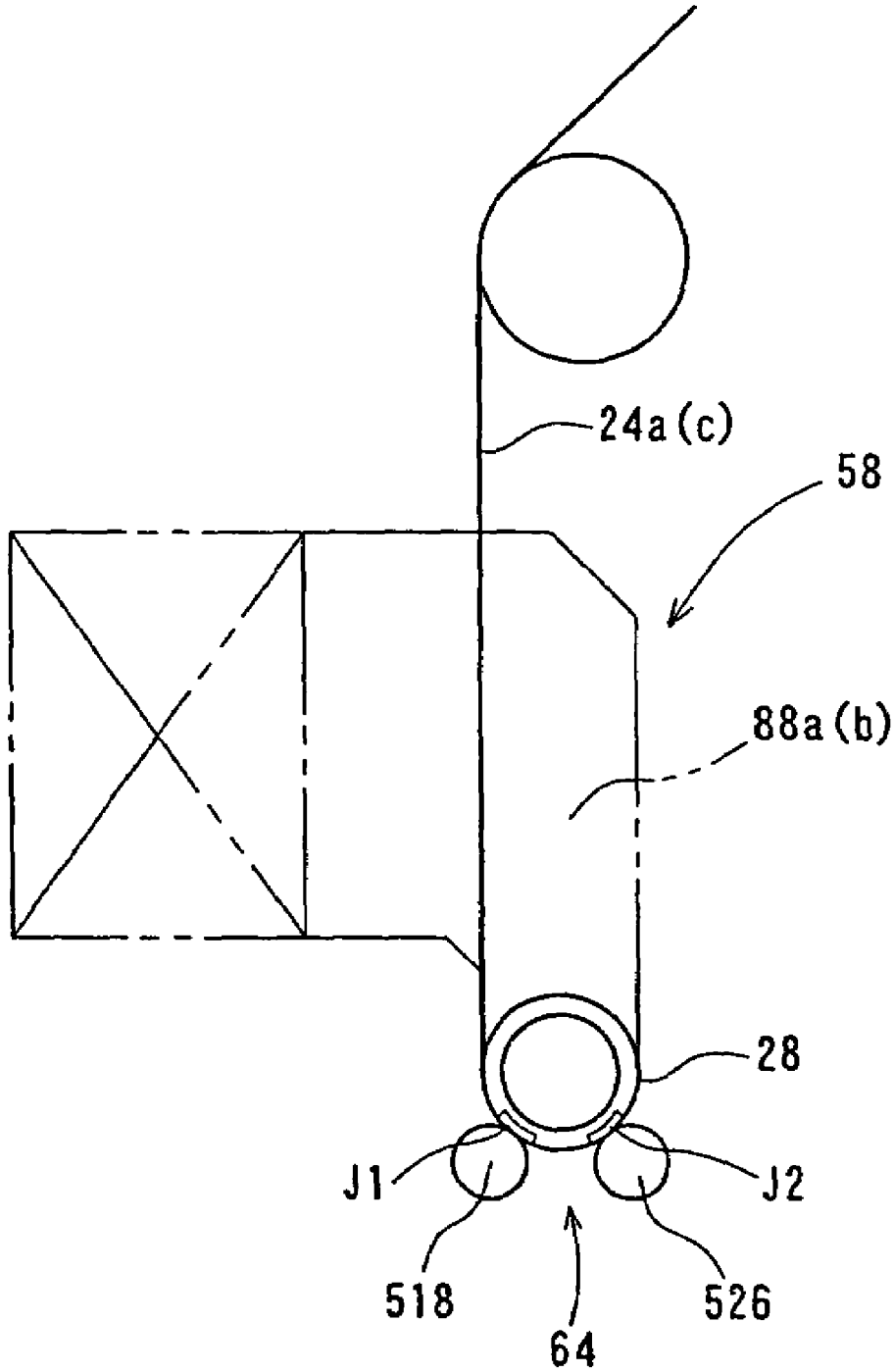
FIG. 23 is a view showing the manner in which a take-up arm and a product receiving mechanism interfere with each other.
Figure 24:
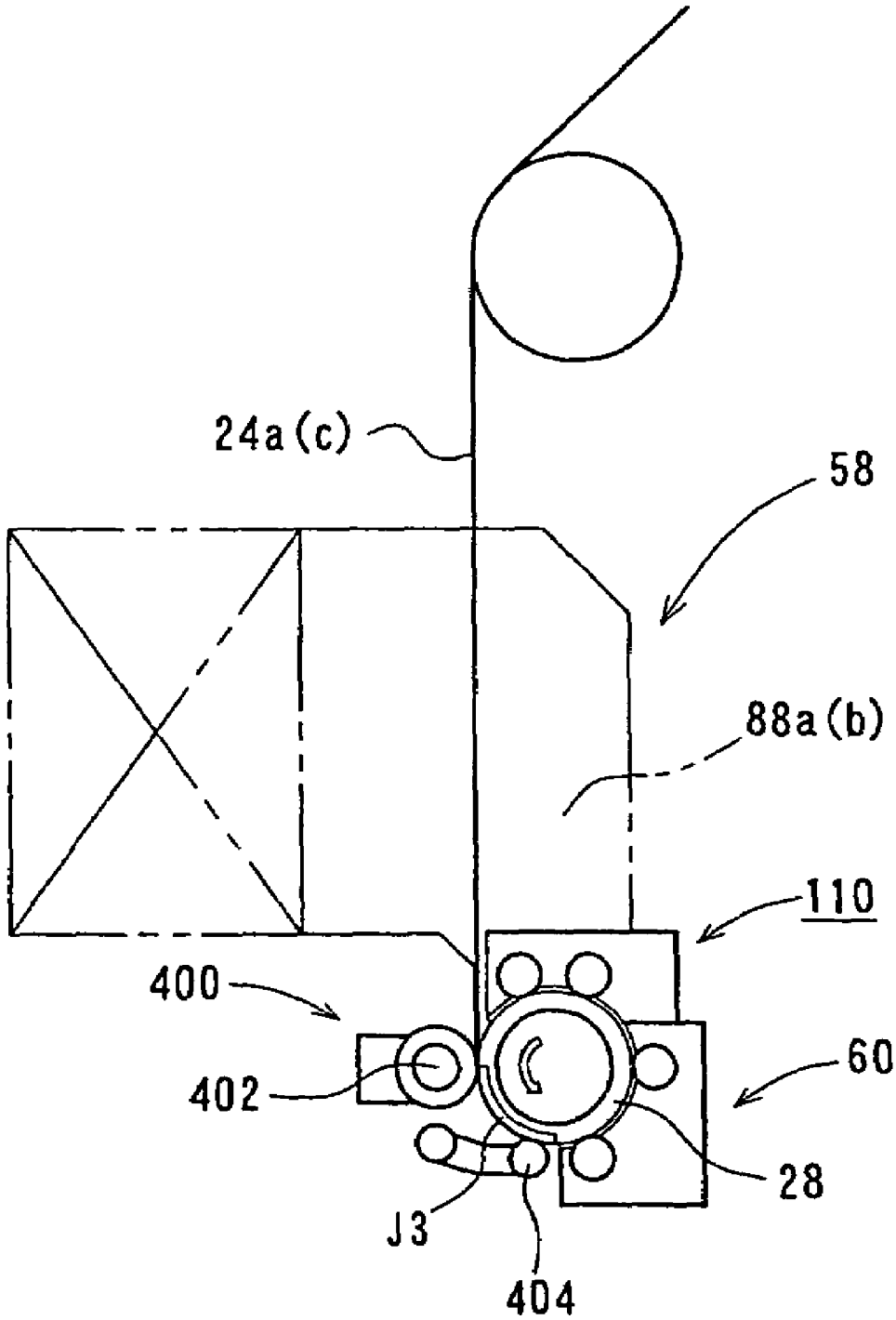
FIG. 24 is a view showing the manner in which the product receiving mechanism and the take-up arm interfere with each other in a counterclockwise winding direction.
Figure 25:
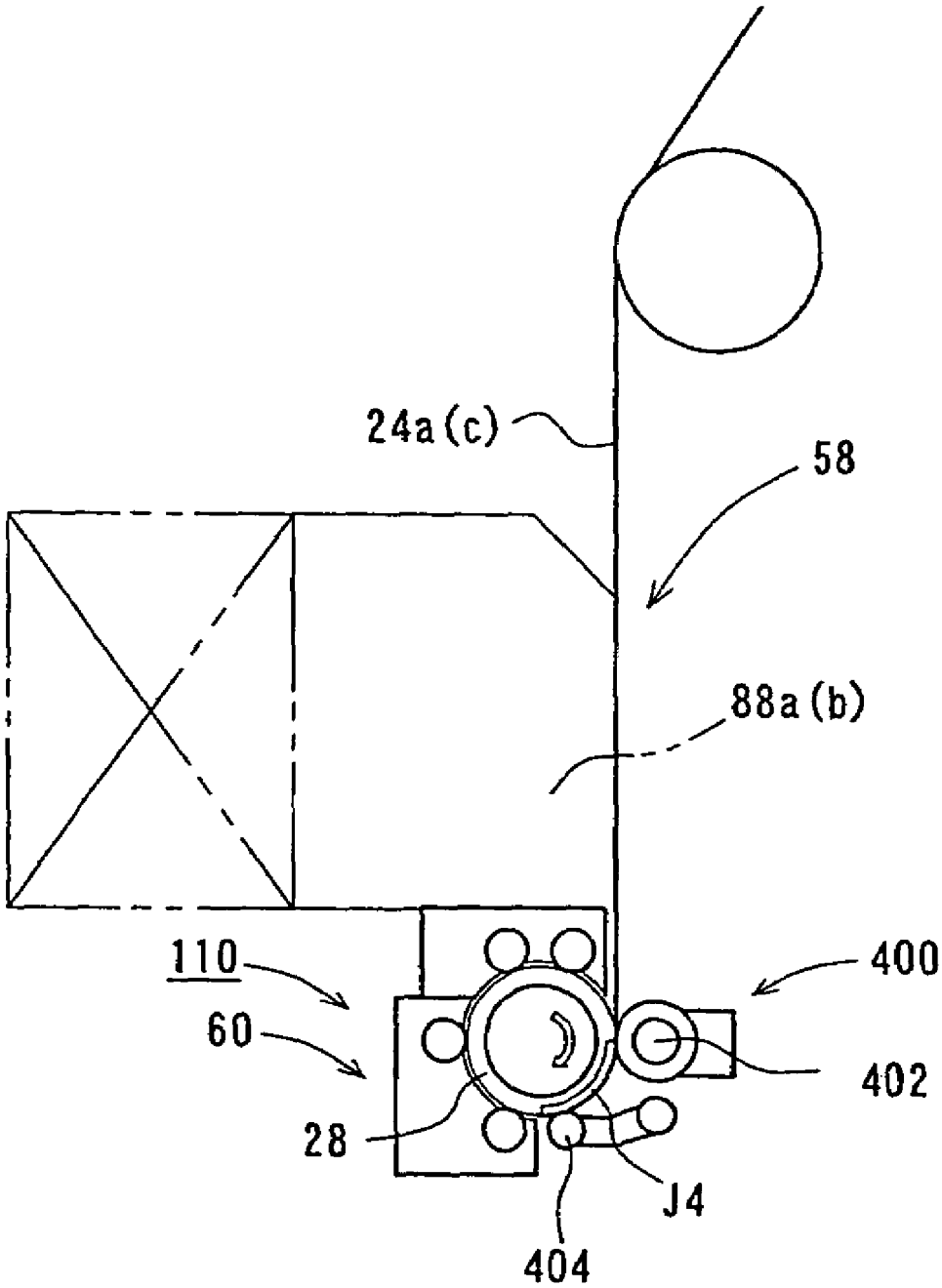
FIG. 25 is a view showing the manner in which the product receiving mechanism and the take-up arm interfere with each other in a clockwise winding direction.

More specifically, the take-up arms 88*a*, 88*b* have regions J1, J2 interfering with the ejection roller 518 and the free roller 526 of the product receiving mechanism 64, as shown in FIG. 23, a region J3 interfering with the winding nip rollers 402 and the lower winding rollers 404 of the winding nip roller unit 400 when the elongate film 24*a*, 24*c* is wound counterclockwise around the core 28, as shown in FIG. 24, and a region J4 interfering with the winding nip rollers 402 and the lower winding rollers 404 when the elongate film 24*a*, 24*c* is wound clockwise around the core 28, as shown in FIG. 25. The dimension of the take-up arms 88*a*, 88*b* is smaller than the outside diameter of the core 28 within the range of the regions J1 through J4.

Specifically, the range of the interfering regions J1 through J4 is located in an angular range of about 180° of a lower outer circumferential surface of the core 28. Within the above angular range, the take-up arms 88*a*, 88*b* have a semicircular shape smaller than the outside diameter of the core 28. Other portions of the take-up arms 88*a*, 88*b* are located in the range of the remaining 180° of the outer circumferential surface of the core 28, i.e., an angular range of about 180° of an upper outer circumferential surface of the core 28.

Figure 26:
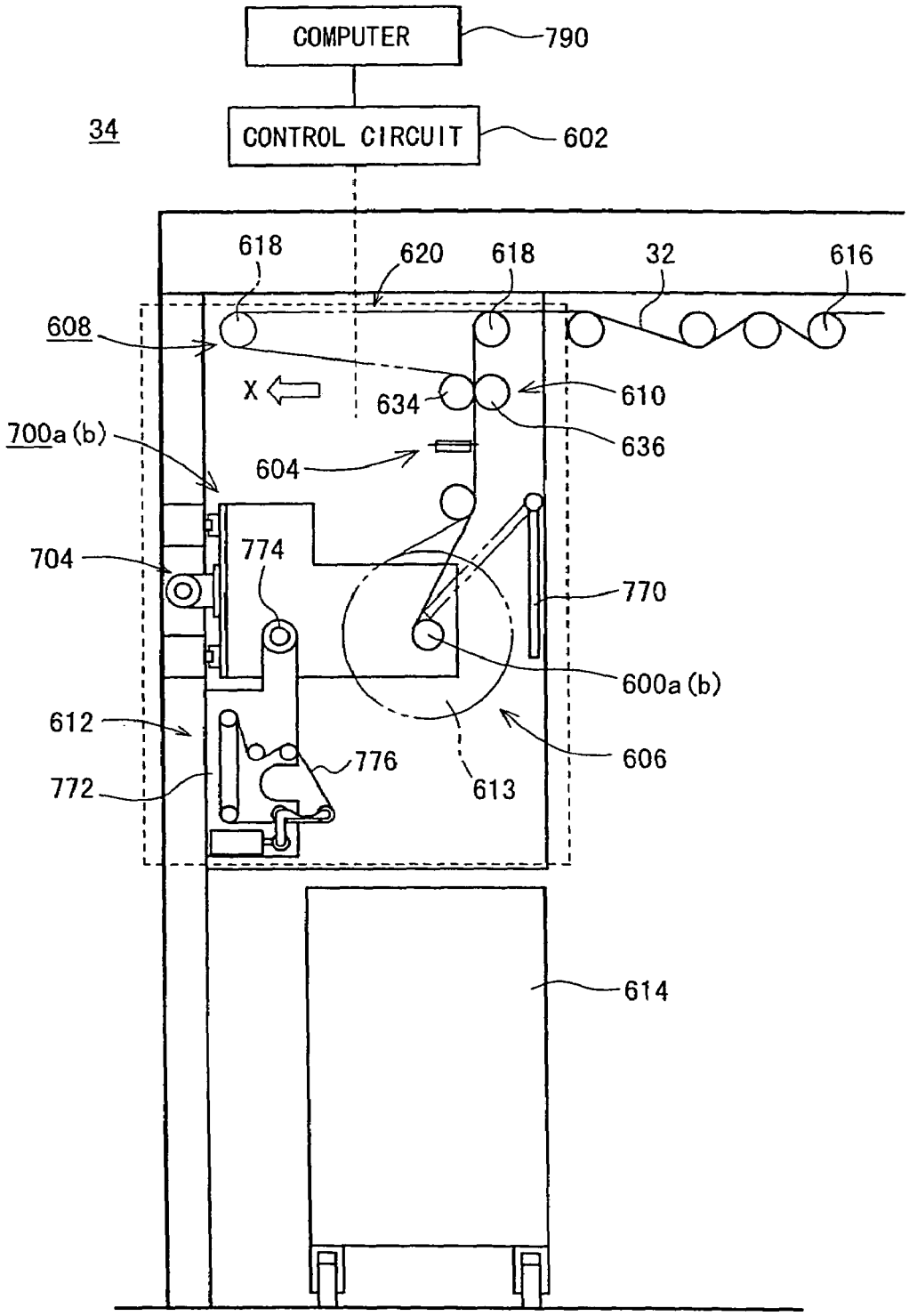
FIG. 26 is a schematic elevational view of a film edge processing apparatus according to a first embodiment of the present invention.

As shown in FIG. 26, the processing apparatus 34 comprises a pair of edge winding shafts 600*a*, 600*b* for automatically winding both edges 32, a control circuit (control mechanism) 602 for detecting whether the edges 32 have been wound around the edge winding shafts 600*a*, 600*b* by a predetermined weight or length, a cross-cutting mechanism 604 for automatically cutting the edges 32 transversely after the edges 32 have been wound around the edge winding shafts 600*a*, 600*b*, and a film edge discharging mechanism 606 for automatically removing the cut edges 32 from the edge winding shafts 600*a*, 600*b*.

Upstream of the cross-cutting mechanism 604, there are disposed a reserving mechanism 608 for drawing the edges 32 a predetermined length after the edges 32 have been wound around the edge winding shafts 600*a*, 600*b*, and a roller pair 610 for gripping the drawn edges 32 and delivering the edges 32 to the edge winding shafts 600*a*, 600*b*. A winding mechanism 612 for automatically winding the edges 32 around the edge winding shafts 600*a*, 600*b* is disposed closely to the edge winding shafts 600*a*, 600*b*. A movable storage box 614 for storing rolls 613 of the edges 32 that are automatically discharged from the edge winding shafts 600*a*, 600*b* indisposed below the edge winding shafts 600*a*, 600*b*.

Figure 27:
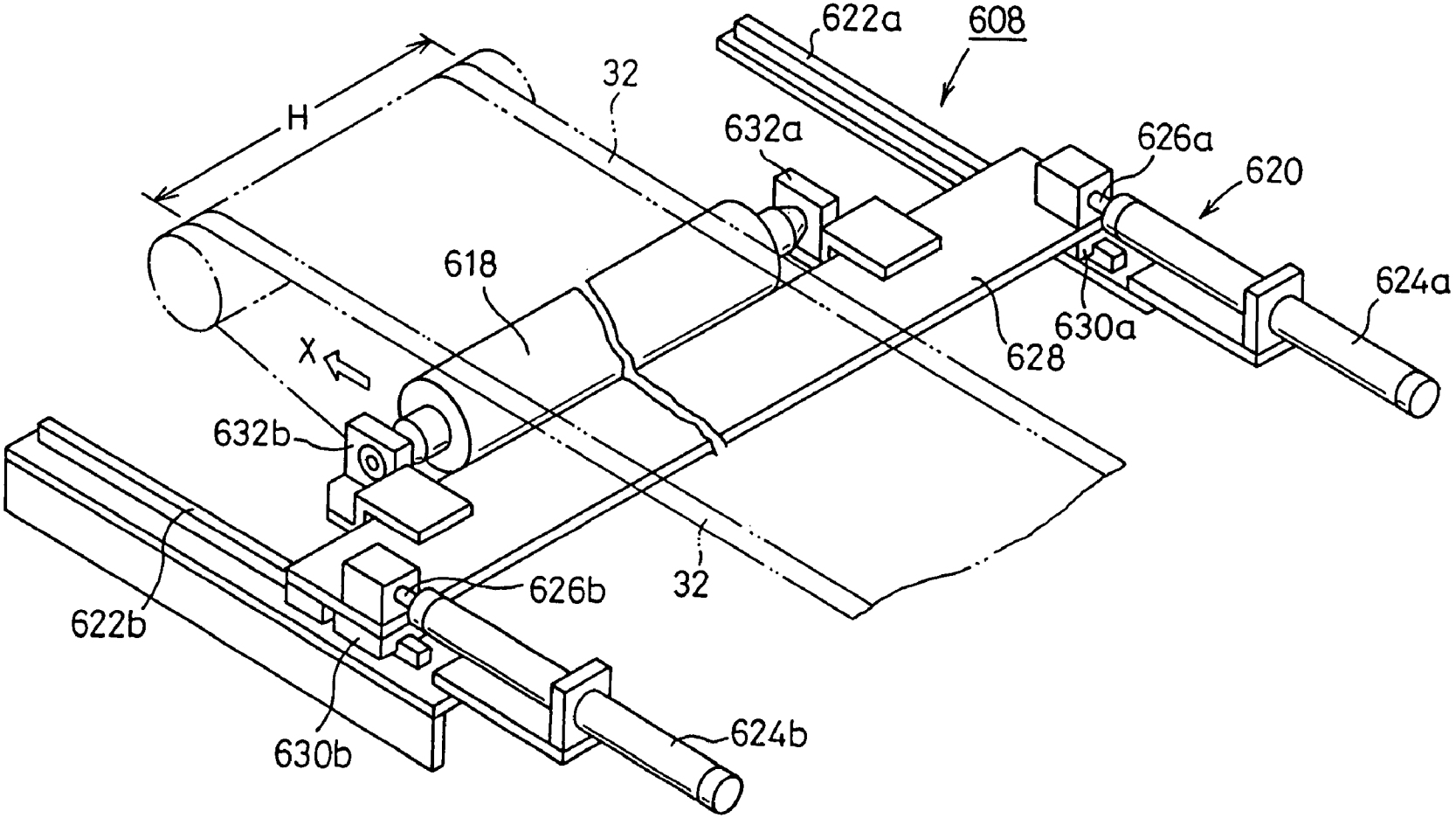
FIG. 27 is a perspective view of a reserving mechanism of the film edge processing apparatus.

A plurality of guide rollers 616 are disposed along a feed path for the edges 32. The reserving mechanism 608 has a free roller 618 doubling as one of the guide rollers 616. The free roller 618 is movable in the directions indicated by the arrow X by a drive unit 620. As shown in FIG. 27, the free roller 618 has an axial length greater than the width H of the raw film. The drive unit 620 has linear guides 622*a*, 622*b* disposed outwardly of the opposite ends of the free roller 618.

On the linear guides 622*a*, 622*b*, there are swingably mounted respective cylinders 624*a*, 624*b* having respective projecting rods 626*a*, 626*b* connected to respective opposite ends of a slide base 628. The linear guides 622*a*, 622*b* are engaged by respective guides 630*a*, 630*b* mounted on the respective opposite ends of the slide base 628. The free roller 618 has its opposite ends rotatably supported on the slide base 628 by respective attachments 632*a*, 632*b*. The free roller 618 is movable by a stroke capable of winding the edges 32 around the edge winding shafts 600*a*, 600*b* by about two turns.

The roller pair 610 comprises a backup roller 634 of aluminum and a nip roller 636 of rubber movable toward and away from the backup roller 634. The backup roller 634 and the nip roller 636 have an axial length greater than the width of the elongate raw film 16, and are capable of handling various edges 32 of different widths.

Figure 28:
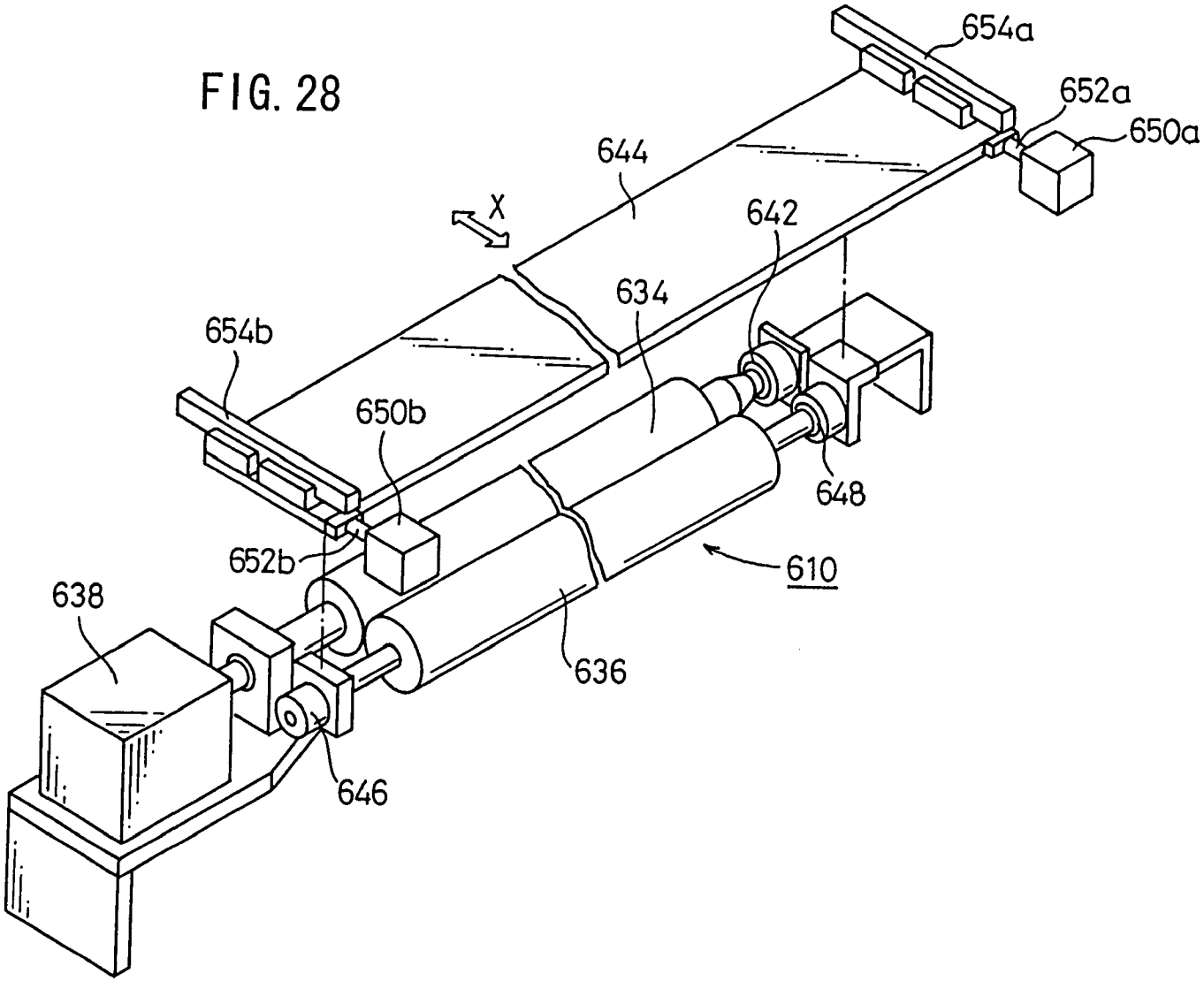
FIG. 28 is a perspective view of a roller pair of the film edge processing apparatus.

As shown in FIG. 28, a torque motor 638 is coupled to an end of the backup roller 634, whose other end is rotatably supported by a bearing 642. The nip roller 636 has an end rotatably supported on a movable base 644 by a one-way clutch 646 and the other end rotatably supported on the movable base 644 by a bearing 648. The one-way clutch 646 allows the nip roller 636 to rotate only in a direction to deliver the edges 32 toward the edge winding shafts 600*a*, 600*b*.

Rods 652*a*, 652*b* extending from respective cylinders 650*a*, 650*b* are coupled respectively to the opposite ends of the movable base 644, which is supported for movement along guide rails 654*a*, 654*b* in the directions indicated by the arrow X.

Figure 29:
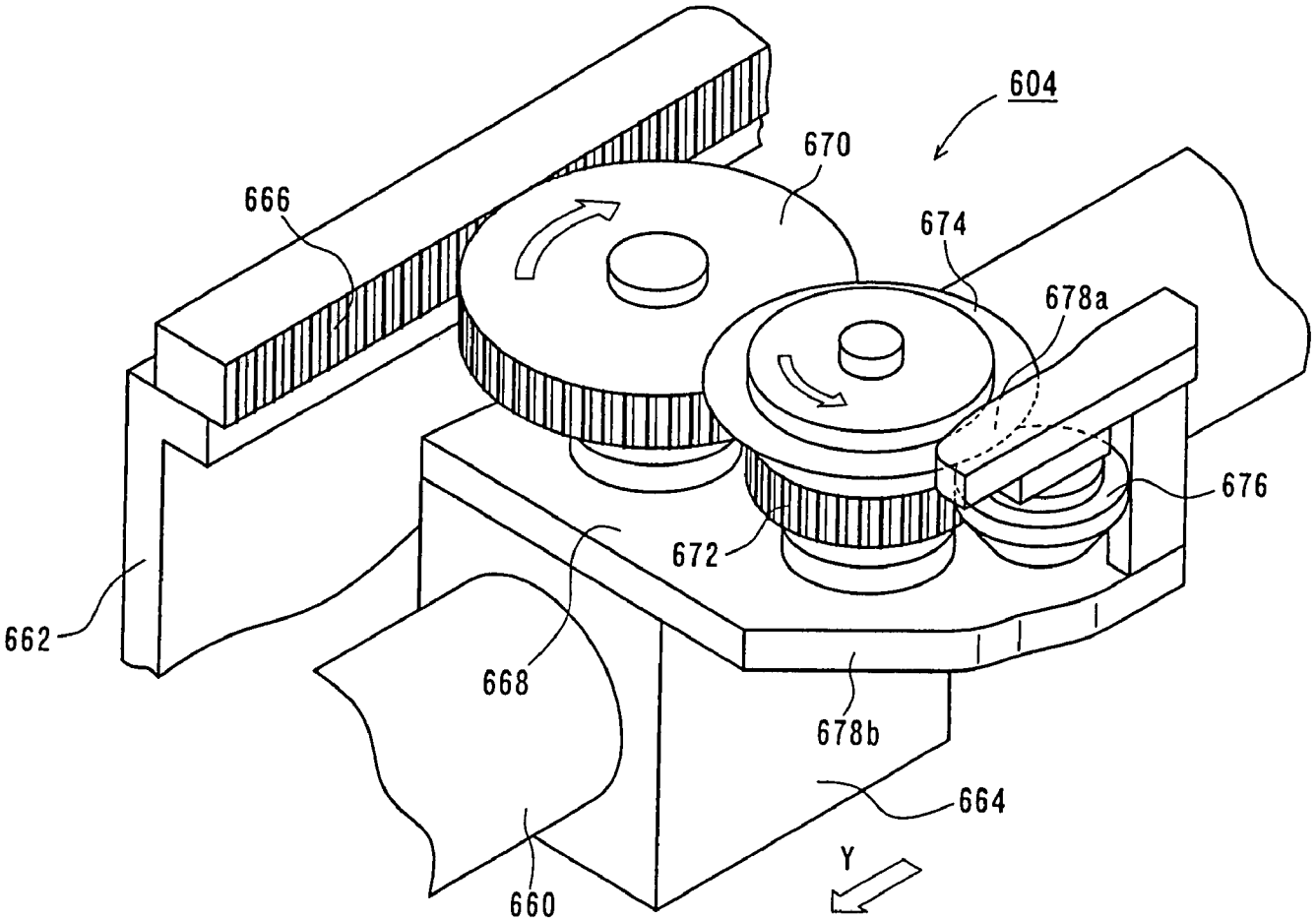
FIG. 29 is a perspective view of a cross cutter mechanism of the film edge processing apparatus.

As shown in FIG. 29, the cross-cutting mechanism 604 has a guide bar 660 which is longer than the width of the elongate raw film 16 and supported on a frame 662. The guide bar 660 is connected to a rodless cylinder 664 that is movable along the guide bar 660 in the directions indicated by the arrow Y. A rack 666 is fixedly mounted on the frame 662 parallel to the guide bar 660.

A base 668 is fixed to the rodless cylinder 664, and a first pinion 670 meshing with the rack 666 is rotatably mounted on the base 668. The first pinion 670 is also held in mesh with a second pinion 672 rotatably mounted on the base 668 and supporting a disk-shaped upper blade 674 coaxially fixed thereto. Another disk-shaped lower blade 676 for transversely cutting the edge 32 in coaction with the upper blade 674 is rotatably supported on the base 668. The base 668 has tapered guide surfaces 678*a*, 678*b* for guiding the edge 32 to the upper blade 674 and the lower blade 676. The rodless cylinder 664 may be replaced with another drive source such as a motor or the like.

Figure 30:
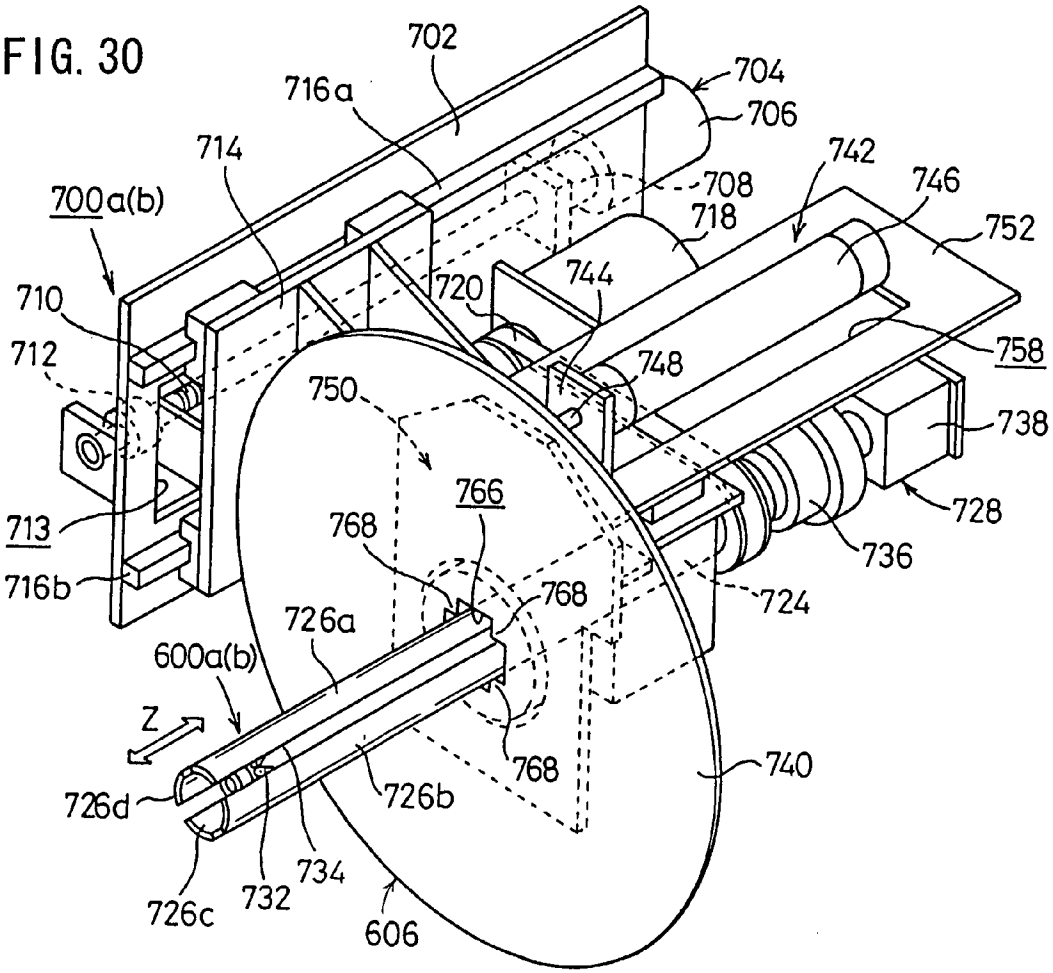
FIG. 30 is a perspective view of an edge winding shaft of the film edge processing apparatus.
Figure 31:
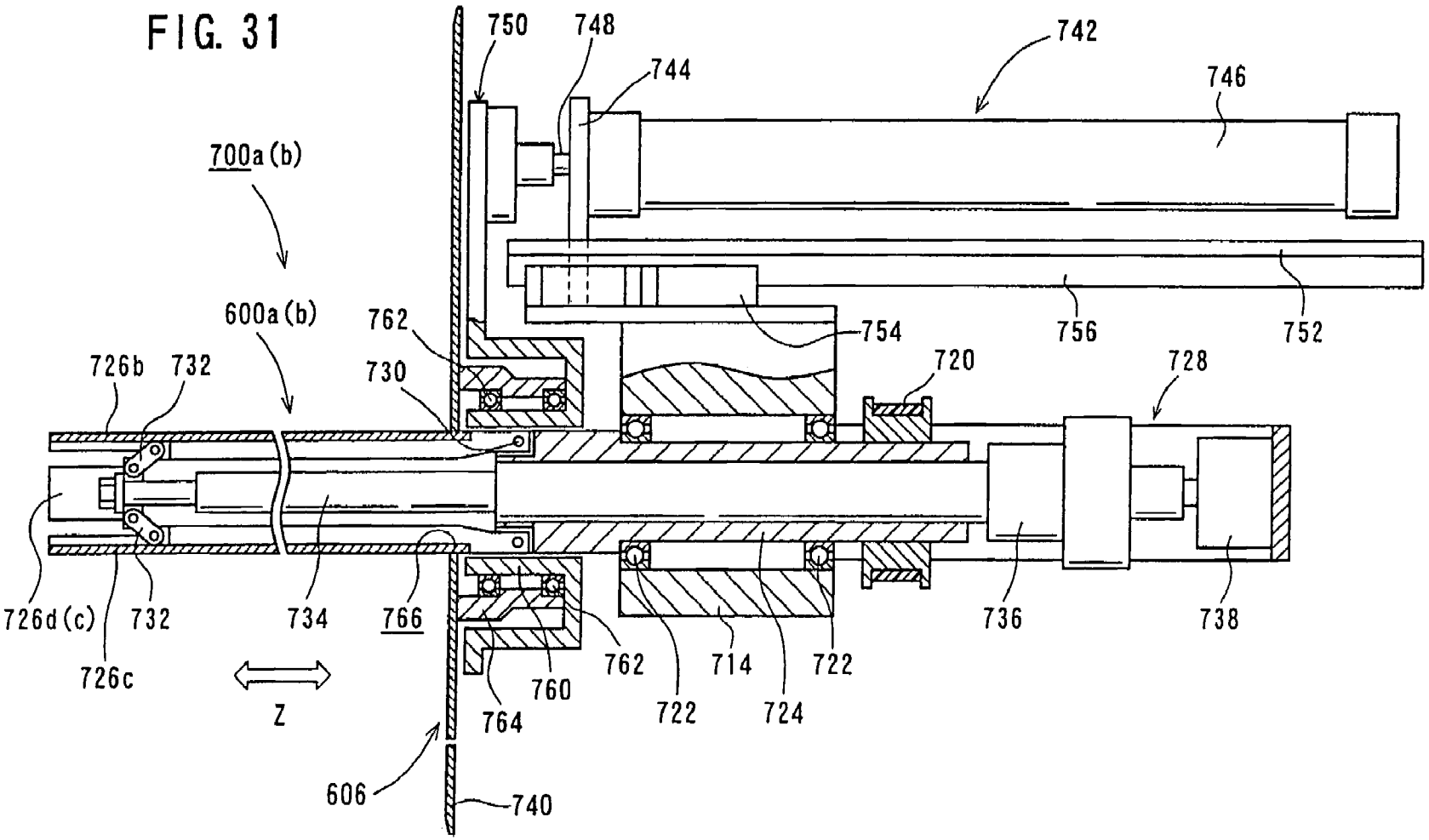
FIG. 31 is a cross-sectional view of the edge winding shaft and a film edge discharging mechanism.
Figure 32:
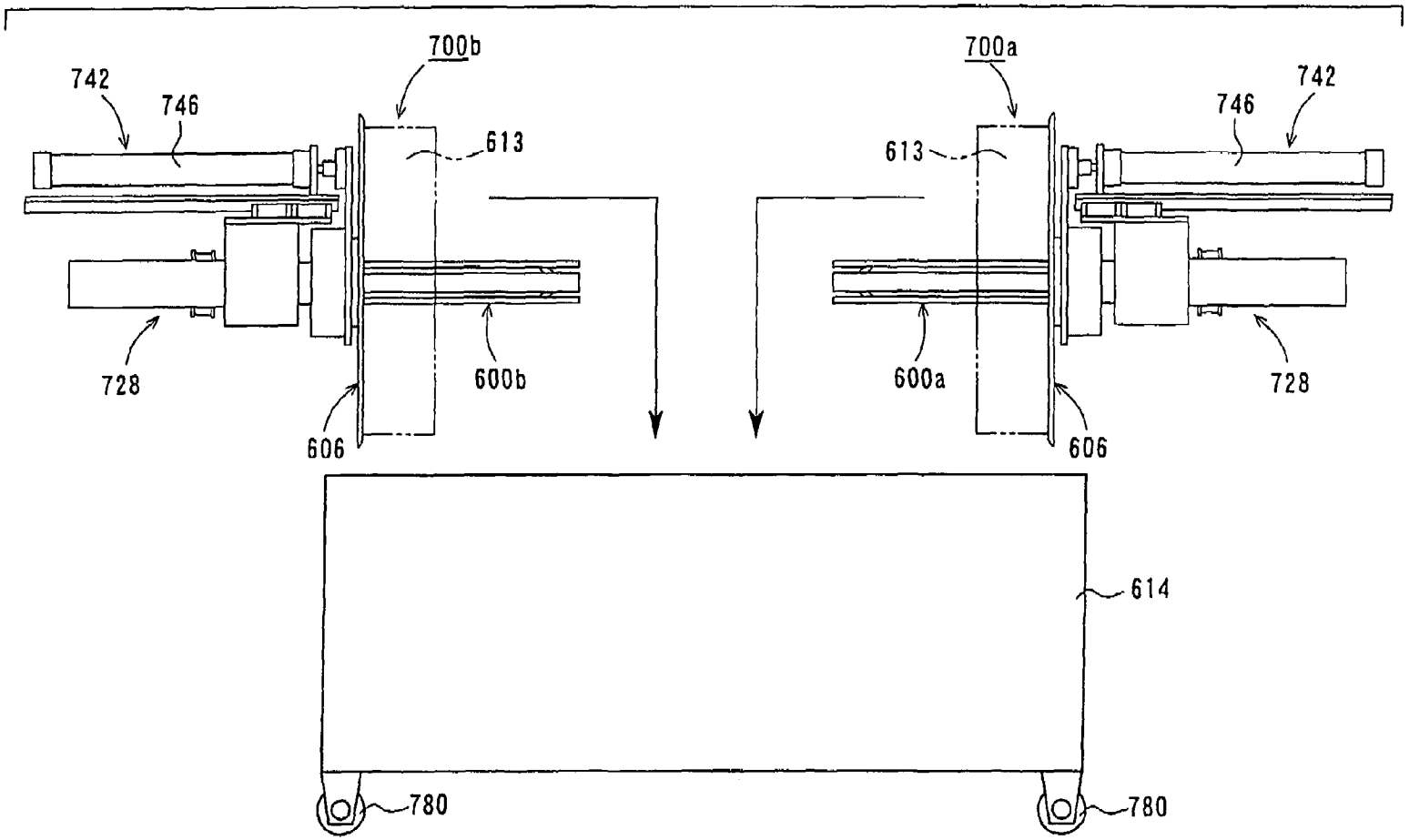
FIG. 32 is a front elevational view of the edge winding shaft and a storage box.

As shown in FIGS. 30 and 31, the edge winding shafts 600*a*, 600*b* are incorporated in respective edge winding units 700*a*, 700*b* that are disposed in confronting relation to each other (see FIG. 32). As shown in FIG. 30, the edge winding unit 700*a* has a moving unit 704 positionally adjustable along a support frame 702 which extends transversely across the elongate raw film 16 in the directions indicated by the arrow Z. The moving unit 704 comprises a servomotor 706 fixed to the support frame 702 and a ball screw 710 coaxially connected to the servomotor 706 by a coupling 708.

The ball screw 710 has opposite ends rotatably supported on the support frame 702 and is threaded through a nut 712 mounted on a slide base 714 through an opening 713 that is defined in the support frame 702. The slide base 714 is movable with respect to the support frame 702 parallel thereto along linear guides 716*a*, 716*b* mounted on the support frame 702.

A servomotor 718 is mounted on the slide base 714 and operatively coupled to the edge winding shaft 600*a* by a belt and pulley means 720. As shown in FIG. 30, the edge winding shaft 600*a* comprises a hollow rotatable cylinder 724 rotatably supported on the slide base 714 by bearings 722, a plurality of, e.g., four, radially expandable and contractible fingers 726*a* through 726*b* having respective ends swingably connected to a distal end of the hollow rotatable cylinder 724, and a drive unit 728 coupled to the other ends (distal ends) of the expandable and contractible fingers 726*a* through 726*b* for radially expanding and contracting the other ends thereof in unison with each other.

As shown in FIGS. 30 and 31, the expandable and contractible fingers 726*a* through 726*d* are of an arcuate shape in cross section, and have an axial length corresponding to the width of the edge 32. The ends of the expandable and contractible fingers 726*a* through 726*d* are swingably supported on the hollow rotatable cylinder 724 by pins 733, and the other ends of the expandable and contractible fingers 726*a* through 726*d* are coupled to a distal end of a drive rod 734 of the drive unit 728 by links 732. The drive rod 734 has a rear end coupled to a cylinder 738 through a bearing (angular ball bearing) 736.

The edge winding shaft 600*a* is inserted through a disk-shaped pusher 740, which can be moved by a drive unit 742 in the axial directions of the edge winding shaft 600*a*, i.e., in the directions indicated by the arrow Z. The drive unit 742 comprises a cylinder 746 having an end fixed to a support table 744 secured to the slide base 714. A pushing member 750 is connected to a rod 748 extending from the cylinder 746.

The pushing member 750 has a horizontal flat plate 752 to which there is fixed a pair of rails 756 supported on linear guides 754 on the slide base 714. The flat plate 752 has an opening 758 defined therein between the rails 756 and through which the support table 744 extends. The pushing member 750 has a cylindrical portion 760 through which the edge winding shaft 600*a* is inserted. A support tube 764 is rotatably supported on the outer circumferential surface of the cylindrical portion 760 by bearings 762.

The pusher 740 is secured to an end of the support tube 764. The pusher 740 is in the form of a thin plate and has a substantially rectangular hole 766 defined centrally therein and shaped complementarily to the expandable and contractible fingers 726*a* through 726*d*. The pusher 740 has protrusions 768 projecting into the hole 766 from its respective four corners.

As shown in FIG. 32, the edge winding unit 700*b* is structurally identical to the edge winding unit 700*a*. Those parts of the edge winding unit 700*b* which are identical to those of the edge winding unit 700*a* are denoted by identical reference characters, and will not be described in detail below.

As shown in FIG. 26, the winding mechanism 612 has a guide member 770 swingably supported by the edge winding units 700*a*, 700*b*, and a movable belt wrapper 772 for supporting the edges 32 on the edge winding shafts 600*a*, 600*b* when the edge winding shafts 600*a*, 600*b* are rotated.

The guide member 770 is in the form of a plate, and may have its surface buffed for reduced frictional resistance or may be made of a material of reduced frictional resistance such as polytetrafluoroethylene (PTFE), for example. The guide member 770 may comprise a belt conveyor. The belt wrapper 772 is angularly movable about a pivot shaft 774, and has a belt 776 for holding the edges 72 around the edge winding shafts 600*a*, 600*b*.

As shown in FIG. 32, the storage box 614 is movable on wheels 780 that are equipped with a brake, not shown. The storage box 614 is disposed in a position where rolls 613 are dropped respectively from the edge winding shafts 600*a*, 600*b*. Sensors (not shown) are provided to detect whether the storage box 614 is set in a given position or not and also whether the storage box 614 is full or not.

As shown in FIG. 26, a computer 790 is connected to the control circuit 602 which controls the processing apparatus 34 for its operation. The computer 790 transmits data of widths, thicknesses, and specific gravities of edges 32 to the control circuit 602. These data may alternatively be manually supplied to the control circuit 602 on an off-line basis.

Figure 33:
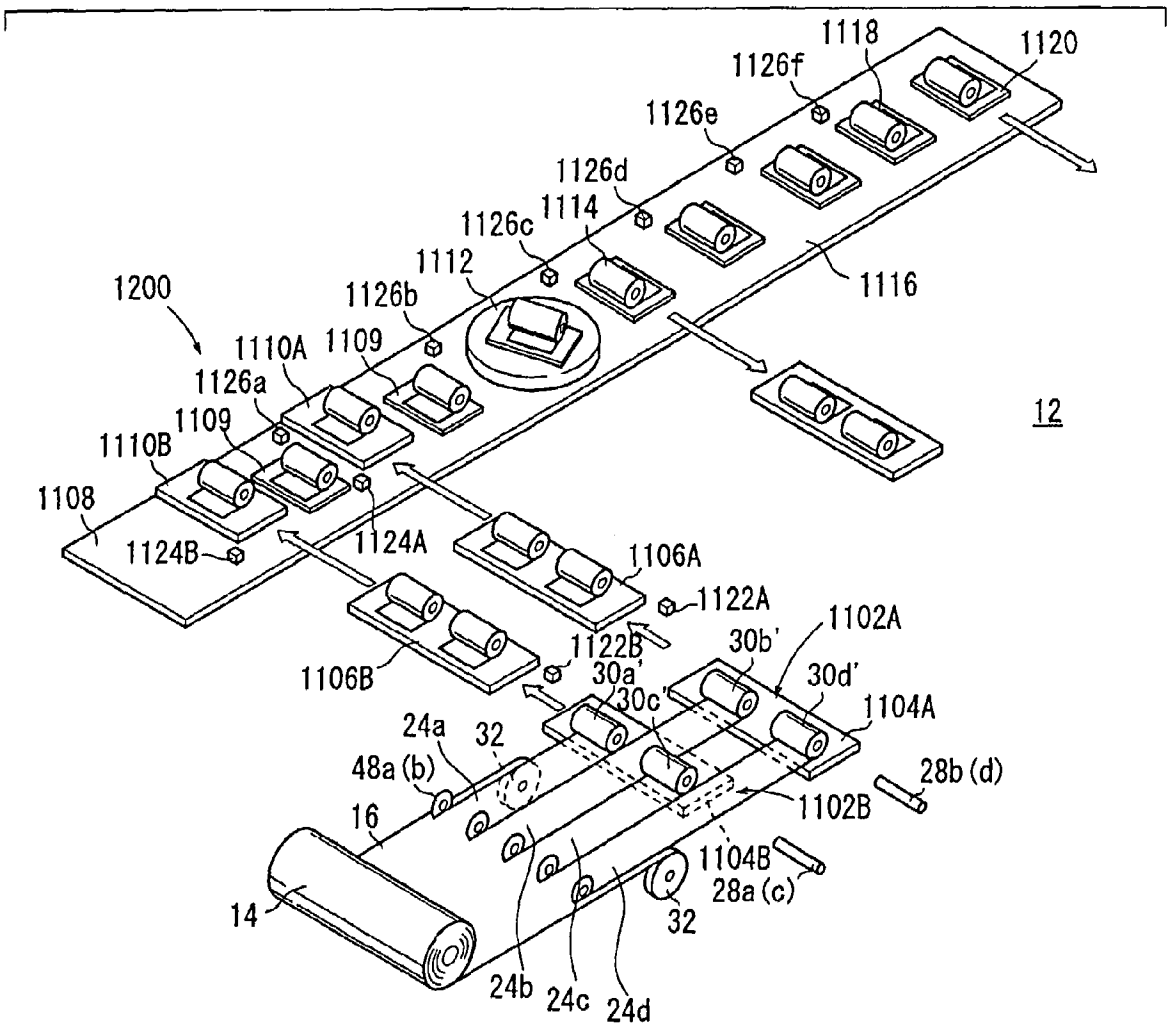
FIG. 33 is a perspective view of a film feed apparatus of the film processing and cutting machine.

As shown in FIG. 33, a film feed apparatus 1200 is disposed downstream of the film processing and cutting machine 12. The film feed apparatus 1200 comprises a first feed unit 1106A and a second feed unit 1106B for receiving rolls 30*a* through 30*d*, 30*a*' through 30*d*' from the first feed unit 1104A and the second feed unit 1104B and feeding the received rolls 30*a* through 30*d*, 30*a*' through 30*d*', and a main feed unit 1108 for arranging the rolls 30*a* through 30*d*, 30*a*' through 30*d*' received from the first feed unit 1106A and the second feed unit 1106B into an array and feeding the arrayed rolls 30*a* through 30*d*, 30*a*' through 30*d*' to a next process.

Over the main feed unit 1108 connected to the first feed unit 1106A and the second feed unit 1106B, there are disposed a first transfer unit 1110A and a second transfer unit 1110B for transferring the rolls 30*a* through 30*d*, 30*a*' through 30*d*' onto pallets 1109 on the main feed unit 1108. On the main feed unit 1108, there are disposed, successively from the first transfer unit 1110A and the second transfer unit 1110B, a turntable 1112 for changing the direction of the rolls 30*a* through 30*d*, 30*a*' through 30*d*', a roll discharger 1114 for discharging specified ones of the rolls 30*a* through 30*d*, 30*a*' through 30*d*', buffers 1116, 1118 for adjusting the speed at which the rolls 30*a* through 30*d*, 30*a*' through 30*d*' are fed, and a roll transfer unit 1120 for transferring the rolls 30*a* through 30*d*, 30*a*' through 30*d*' to a next process.

Roll passage detectors 1122A, 1122B and 1124A, 1124B for detecting passage of rolls 30*a* through 30*d*, 30*a*' through 30*d*' are disposed in front of and behind the first feed unit 1106A and the second feed unit 1106B. Similarly, roll passage detectors 1126*a* through 1126*f* for detecting passage of rolls 30*a* through 30*d*, 30*a*' through 30*d*' are disposed between the second transfer unit 1110B, the first transfer unit 111A, the turntable 1112, the coil discharger 1114, the buffers 1116, 1118, and the roll transfer unit 1120.

Figure 34:
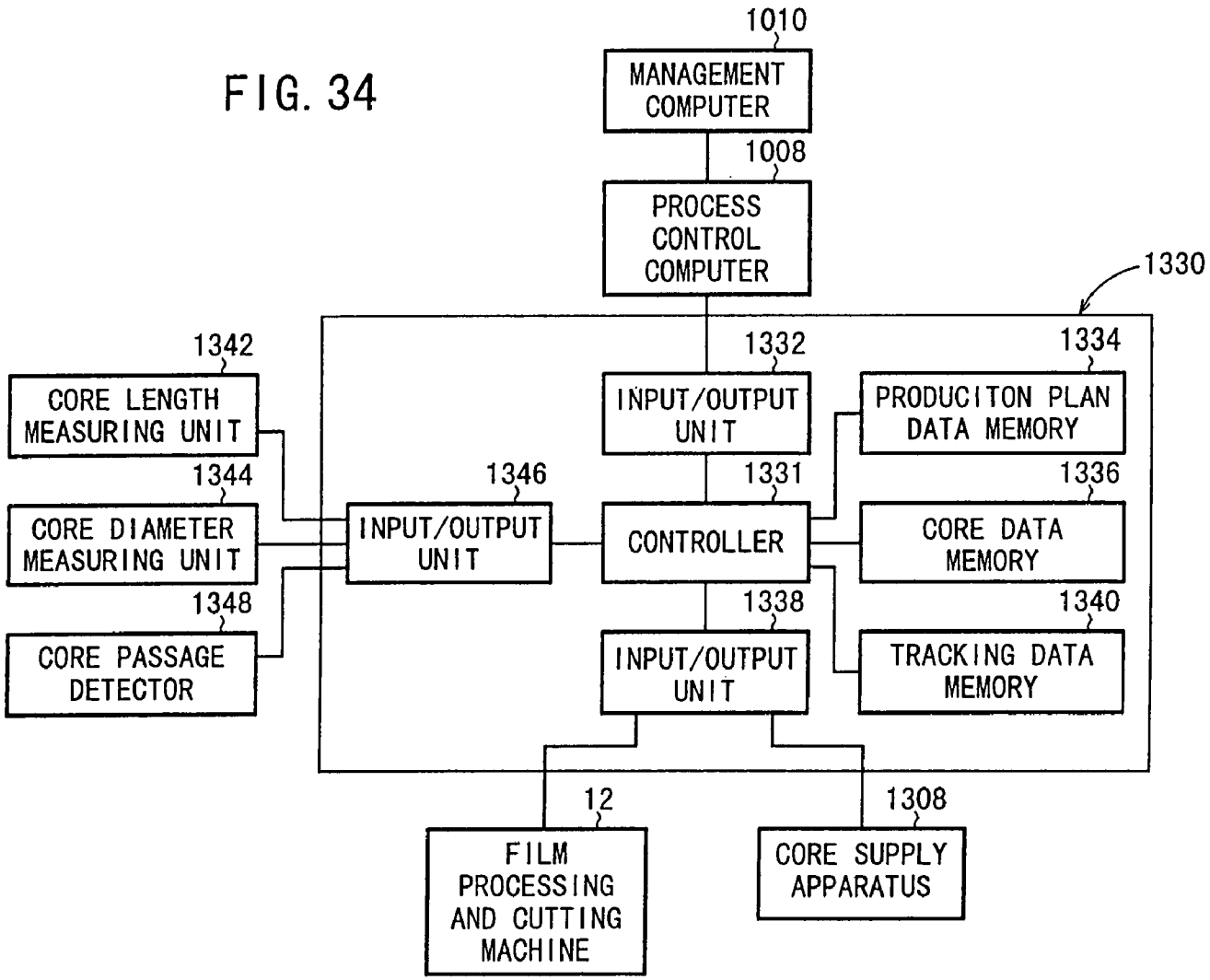
FIG. 34 is a block diagram of a control circuit of the film processing and cutting machine and the core supply apparatus.

FIG. 34 shows in block form a control circuit (comparing means) 1330 of the film processing and cutting machine 12 and the core supply apparatus 1308 which are constructed as described above. As shown in FIG. 34, the control circuit 1330 is controlled by a controller 1331, and a management computer 1010 is connected to the control circuit 1330 through a process control computer 1008. The management computer 1010 manages an overall production process involving the film processing and cutting machine 12 and the core supply apparatus 1308. The process control computer 1008 is supplied with production plan data from the management computer 1010.

The production plan data are stored via an input/output unit 1332 of the control circuit 1330 into a production plan data memory (required component information holding means) 1334. The production plan data stored in the production plan data memory 1334 include required component information representing widths of rolls 30*a* through 30*d*, 30*a*' through 30*d*' produced by the film processing and cutting machine 12 and diameters of cores 28, and data representing winding directions of rolls 30*a* through 30*d*, 30*a*' through 30*d*'.

The control circuit 1330 has a core data memory (supplied component information holding means) 1336 for storing core data supplied from the core supply apparatus 1308. Core data as supplied component information include data representing diameters and lengths of cores 28 that are cut to given lengths and supplied by the core supply apparatus 1308, and are supplied from the core supply apparatus 1308 via an input/output unit 1338.

Figure 35:
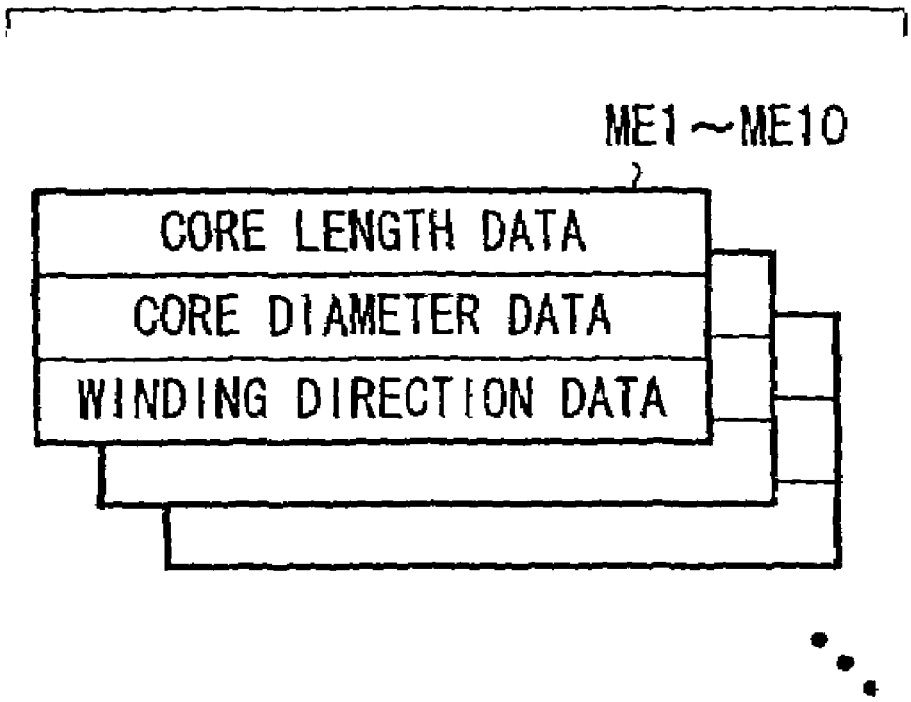
FIG. 35 is a diagram illustrative of tracking data stored in a tracking data memory of the control circuit shown in FIG. 34.

The control circuit 1330 has a tracking data memory 1340 for storing tracking data of cores 28 which are fed from the core loader 1314 of the core supply apparatus 1308 to the film winding apparatus 10 of the film processing and cutting machine 12. As shown in FIG. 35, the tracking data include length and diameter data of cores 28 that have been fed and winding direction data of rolls 30*a* through 30*d*, 30*a*' through 30*d*' that have been supplied. The tracking data are stored in memory areas ME1 through ME10 which are established in association with the feed mechanisms 1326, 1328, 1316, 1318, 1302, 1300, 1306, 1304, the first winding unit 1102A, and the second winding unit 1102B to which cores 28 are supplied.

The core loader 1314 has a core length measuring unit (component measuring means) 1342 for measuring lengths of cores 28 supplied to the feed mechanisms 1320, 1322 and a core diameter measuring unit (component measuring means) 1344 for measuring diameters of those cores 28. Data measured by these measuring units are supplied via an input/output unit 1346 to the controller 1331. A plurality of core passage detectors 1348 for detecting passage of cores 28 and copying tracking data stored in the tracking data memory 1340 are disposed in a feed path extending from the core loader 1314 to the film winding apparatus 10. Core detecting signals from the core passage detectors 1348 are supplied via the input/output unit 1346 to the controller 1331.

Figure 36:
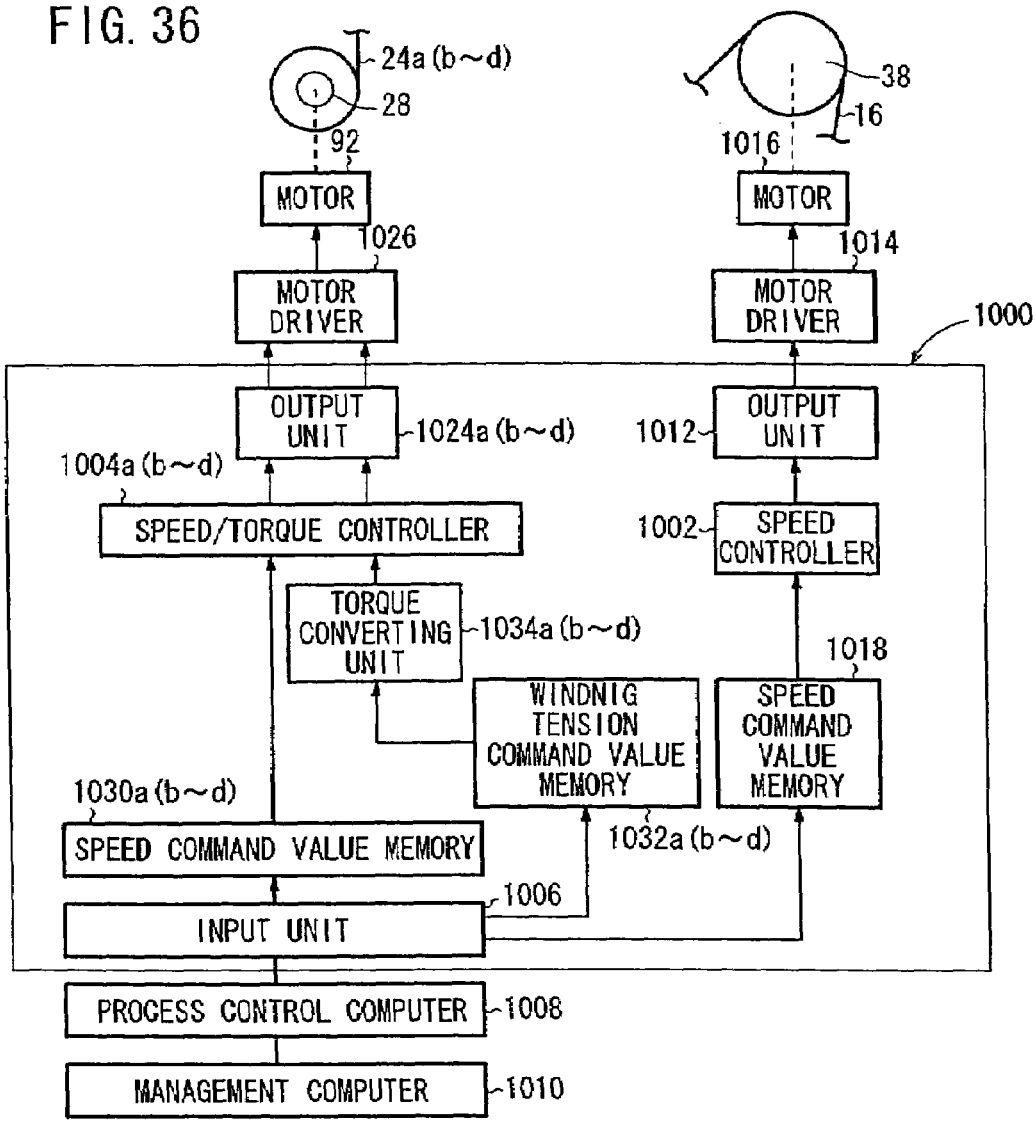
FIG. 36 is a block diagram of a control circuit of the film winding apparatus of the film processing and cutting machine.

FIG. 36 shows in block form a control circuit 1000 of the film winding apparatus 10. The control circuit 1000 has a speed controller 1002 for controlling the rotational speed of the suction drum 38, and speed/torque controllers (core rotation control means) 1004*a* through 1004*d* for controlling the rotational speeds and torques of the cores 28 in the core rotating mechanism 58.

The process control computer 1008 to which the management computer 1010 is connected is connected to the control circuit 1000 through an input unit 1006. The process control computer 1008 performs process control in the film winding apparatus 10. The film processing and cutting machine 12 has process control computers 1008 associated with respective processes. The management computer 1010 serves to manage all the process control computers 1008 of the film processing and cutting machine 12.

A motor driver 1014 is connected to the speed controller 1002 through an output unit 1012. The motor driver 1014 is also connected to a servomotor 1016 for rotating the suction drum 38. To the speed controller 1002, there is connected a speed command value memory 1018 for storing a speed command value supplied from the process control computer 1008. The servomotor 1016 is controlled according to the speed command value stored in the speed command value memory 1018.

Motor drivers 1026 are connected to the respective speed/torque controllers 1004*a* through 1004*d* through respective output units 1024*a* through 1024*d*. The motor drivers 1026 are connected to respective servomotors 92 for winding elongate films 24*a* through 24*d* around cores 28. To the speed/torque controllers 1004*a* through 1004*d*, there are connected respective speed command value memories 1030*a* through 1030*d* for storing speed command values supplied from the process control computers 1008, and respective winding tension command value memories (winding tension storing means) 1032*a* through 1032*d* for storing winding tension command values supplied from the process control computers 1008, through respective torque converting units (torque converting means) 1034*a* through 1034*d*. The servomotors 92 are controlled according to speed command values supplied from the speed/torque controllers 1004*a* through 1004*d* and winding tension command values converted by the torque converting units 1034*a* through 1034*d*.

Figure 37:
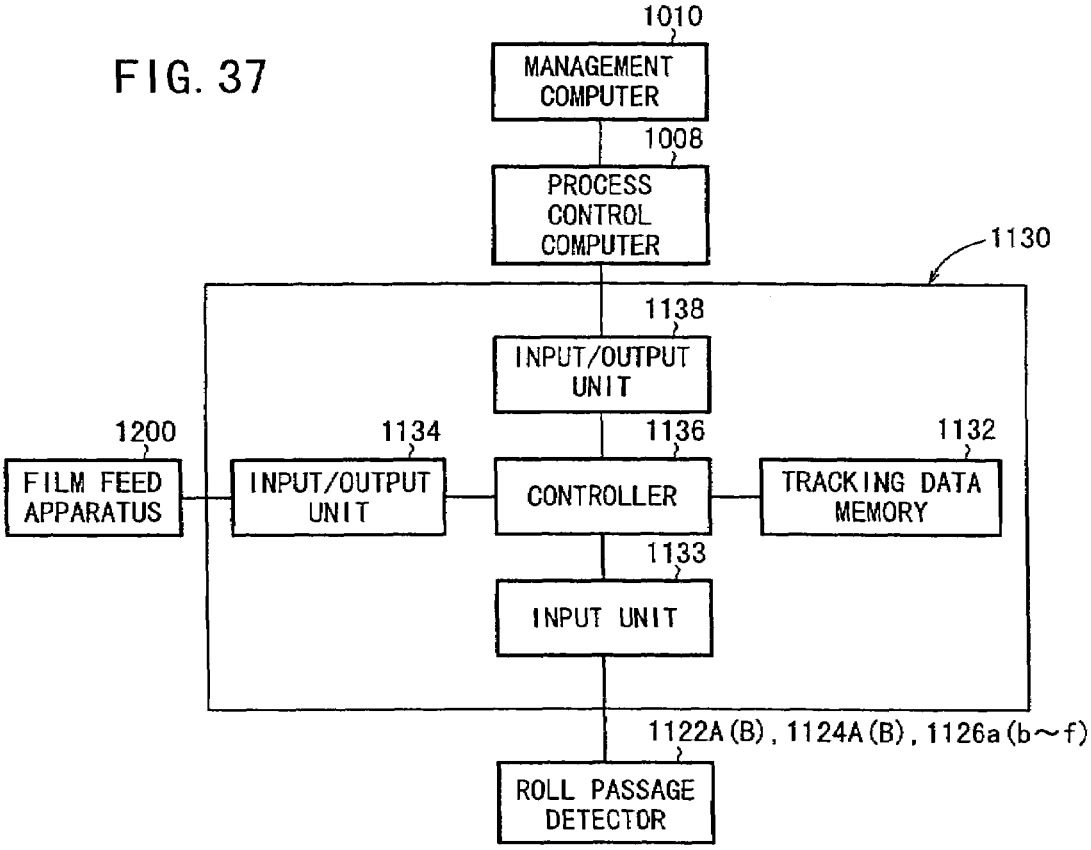
FIG. 37 is a block diagram of a control circuit of the film feed apparatus shown in FIG. 33.

FIG. 37 shows in block form a control circuit 1130 of the film feed apparatus 1200. The control circuit 1130 has a tracking data memory 1132 for storing tracking data for managing address information of rolls 30*a* through 30*d*, 30*a*' through 30*d*' fed by the film feed apparatus 1200, and a controller 1136 for receiving, via an input unit 1134, passage information of rolls 30*a* through 30*d*, 30*a*' through 30*d*' detected by the roll passage detectors 1122A, 1122B and 1124A, 1124B, 1126*a* through 1126*f*, and controlling the film processing and feeding apparatus 1100 via an input/output unit 1134 according to the passage information and the tracking data.

The process control computer 1008 to which the management computer 1010 is connected is connected to the control circuit 1130 through an input/output unit 1138. Based on a production plan, the management computer 1010 supplies the control circuit 1130 with cutting information for rolls 30*a* through 30*d*, 30*a*' through 30*d*'.

Figure 38:
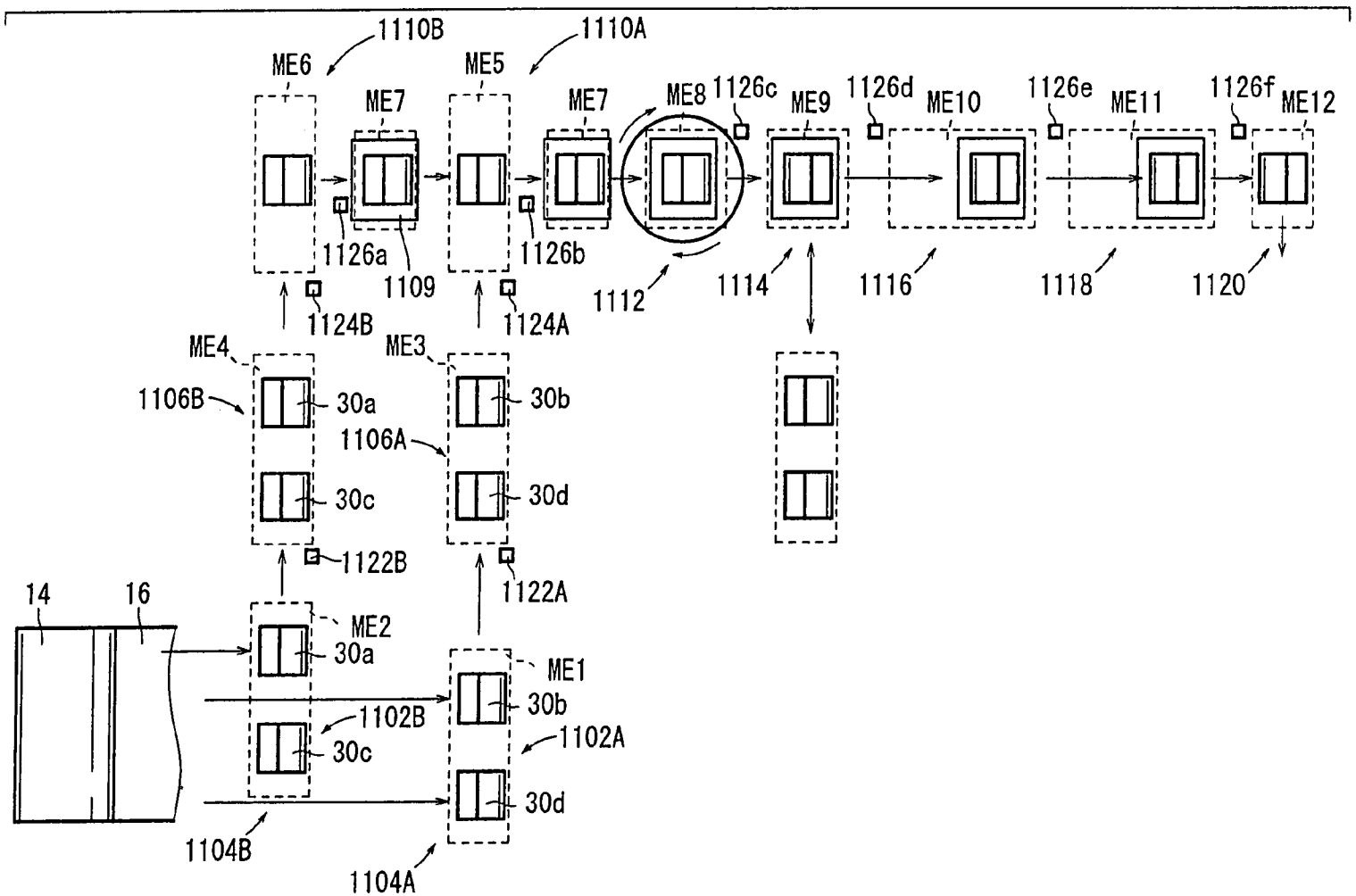
FIG. 38 is a view showing memory areas corresponding to various regions of the film feed apparatus shown in FIG. 33.

FIG. 38 shows the relationship between memory areas ME1 through ME12 of the tracking data memory 1132 for storing tracking data and various regions corresponding to the memory areas ME1 through ME12. The memory areas ME1, ME2 hold address information of rolls 30*a* through 30*d*, 30*a*' through 30*d*' in the first winding unit 1102A and the second winding unit 1102B. The memory areas ME3, ME4 hold address information of rolls 30*a* through 30*d*, 30*a*' through 30*d*' in the first feed unit 1106A and the second feed unit 1106B. The memory areas ME5, ME6 hold address information of rolls 30*a* through 30*d*, 30*a*' through 30*d*' in the first transfer unit 1110A and the second transfer unit 1110B. The memory areas ME7 through ME12 hold address information of rolls 30*a* through 30*d*, 30*a*' through 30*d*' in loading positions for the rolls 30*a* through 30*d*, 30*a*' through 30*d*' in the main feed unit 1108.

Figure 39:
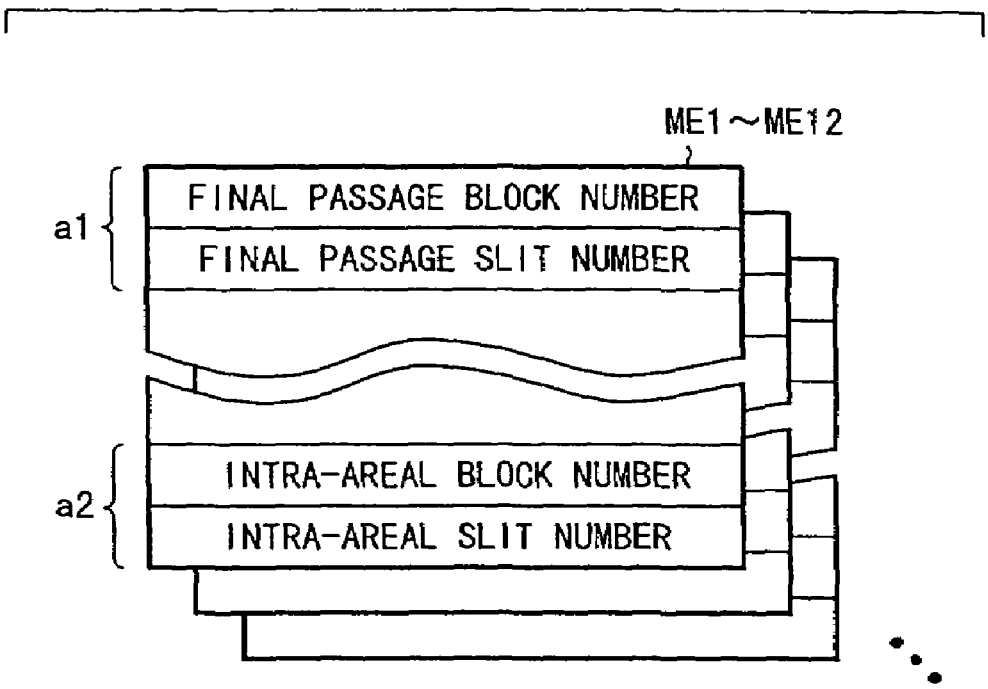
FIG. 39 is a diagram illustrative of tracking data stored in a tracking data memory of the control circuit shown in FIG. 37.

FIG. 39 shows an arrangement of tracking data stored in each of the memory areas ME1 through ME12 of the tracking data memory 1132. The tracking data have a header a1 and slit data a2. The header a1 includes block numbers (final passage block numbers) and slit numbers (final passage slit numbers) which represent final address information of rolls 30*a* through 30*d*, 30*a*' through 30*d*' that have passed respective regions of the film processing and feeding apparatus 1100 which correspond to the memory areas ME1 through ME12. The slit data a2 include block numbers (intra-areal block numbers) and slit numbers (intra-areal slit numbers) which represent final address information of rolls 30*a* through 30*d*, 30*a*' through 30*d*' that are presently positioned in the regions of the film feed apparatus 1200 which correspond to the memory areas ME1 through ME12.

Figure 40:
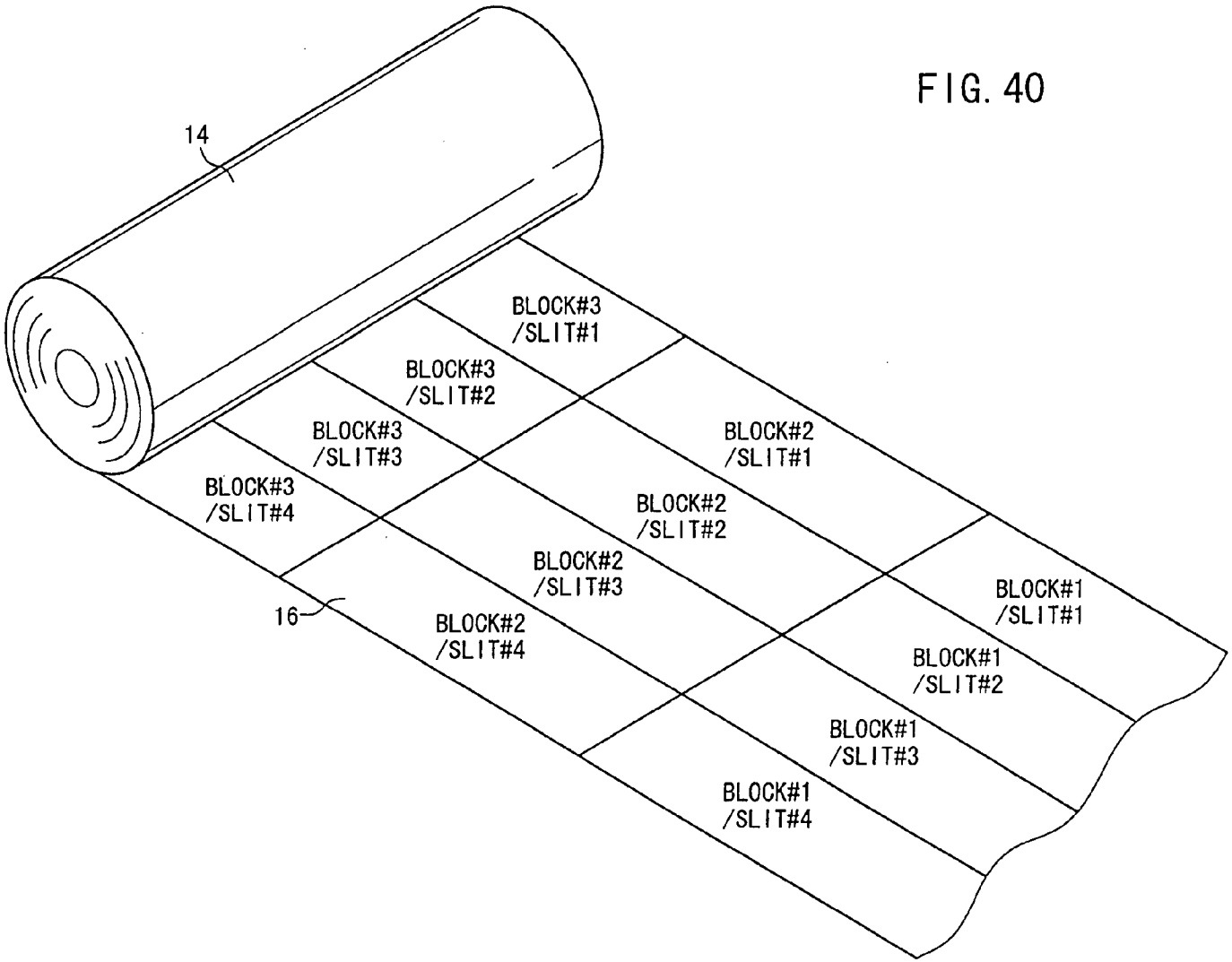
FIG. 40 is a perspective view illustrative of block numbers and slit numbers which are tracking data set on a film roll.

The block numbers and the slit numbers are defined as shown in FIG. 40. The block numbers are numbers representing rolls 30*a* through 30*d*, 30*a*' through 30*d*' that are produced by cutting the film roll 14 in a direction perpendicular to the longitudinal direction of the film roll 14. The slit numbers are numbers representing rolls 30*a* through 30*d*, 30*a*' through 30*d*' that are produced by cutting the film roll 14 in the longitudinal direction thereof with first and second round blades 48*a*, 48*b*. In a first embodiment, the block numbers are successively set as block #1, block #2, . . . in the longitudinal direction of the elongate raw film 16 as it is drawn from the film roll 14. The slit numbers are successively set as slit #1, slit #2, . . . in the transverse direction of the elongate raw film 16 from the side where rolls 30*a* through 30*d*, 30*a*' through 30*d*' are delivered.

Operation of the film processing and cutting machine 12 thus constructed will be described below.

Prior to a process of cutting the film roll 14 with the film processing and cutting machine 12, as shown in FIG. 34, the management computer 1010 supplies production plan data relative to a type of rolls 30*a* through 30*d*, 30*a*' through 30*d*' via the process control computer 1008 to the control circuit 1330. The control circuit 1330 stores the supplied production plan data into the production plan data memory 1334, and controls the film winding apparatus 10 of the film processing and cutting machine 12 via the input/output unit 1338 according to the production plan data. For example, according to the production plan data representing the width of rolls 30*a* through 30*d*, 30*a*' through 30*d*', the diameter of cores 28, and the winding direction of the elongate raw film 16, the control circuit 1330 adjusts the location of the cutting apparatus 26 and determines which of the first winding unit 1102A and the second winding unit 1102B is to manufacture rolls 30*a*' through 30*d*'.

Similarly, as shown in FIG. 37, the management computer 1010 supplies production information relative to a type of rolls 30*a* through 30*d*, 30*a*' through 30*d*' based on the production plan via the process control computer 1008 to the control circuit 1130. The control circuit 1130 controls the film feeding apparatus 1200 via the input/output unit 1134 according to the supplied production information. In the first embodiment, the locations of the first and second core rotating units 75*a*, 75*b* of the first winding unit 1102A and the second winding unit 1102B (see FIGS. 41 and 42) with respect to the direction indicated by the arrows and the locations of the first and second round blades 48*a*, 48*b* are adjusted depending on the diameter of the cores 28, the widths of the rolls 30*a* through 30*d*, 30*a*' through 30*d*', and the winding direction (indicative of whether a roll with an inner coated surface or a roll with an outer coated surface is to be produced).

Figure 41:
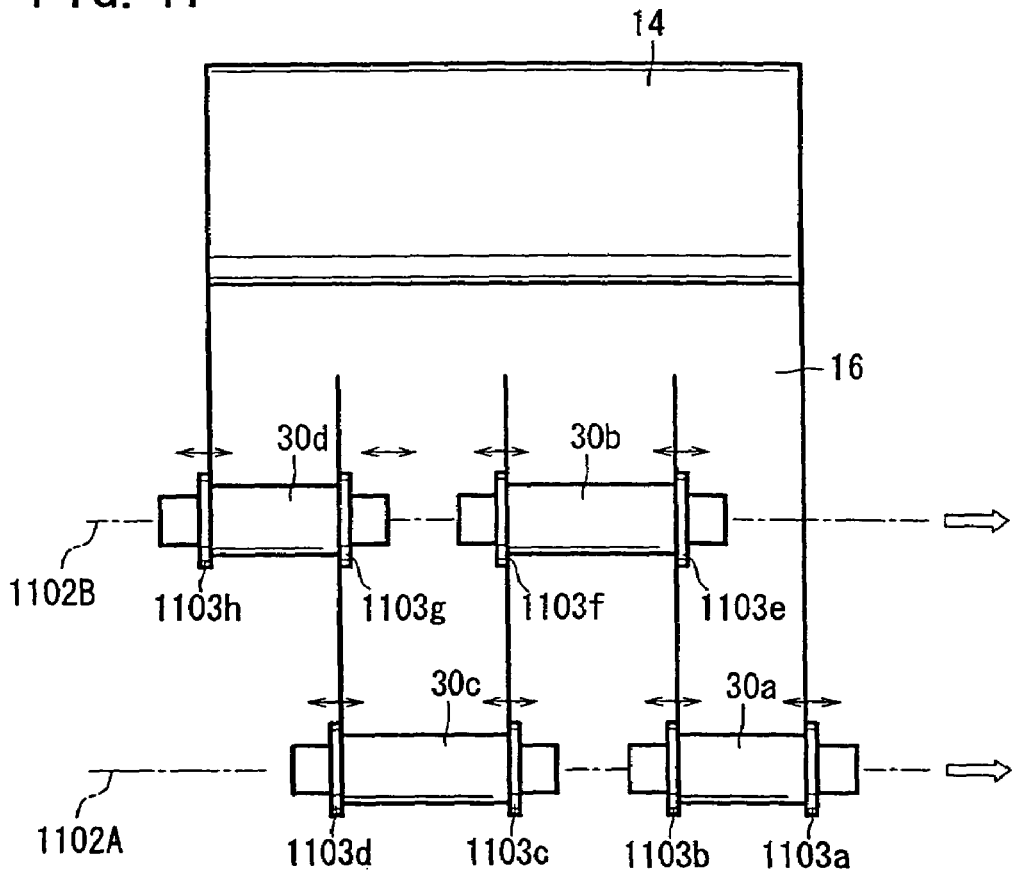
FIG. 41 is a view illustrative of a manufacturing pattern of rolls in the film processing and cutting machine shown in FIG. 33.

In FIG. 41, the distance between the core chucks 90*a*, 90*b* of the core rotating units 75*a*, 75*b* cannot be reduced beyond a certain width because of a mechanical interference. Therefore, the width of the roll 30*b* wound by the core rotating unit 75*a* of the second winding unit 1102B corresponding to the region between the core chucks 90*a*, 90*b* of the first winding unit 1102A is limited to a certain value. Similarly, the width of the roll 30*c* wound by the core rotating unit 75*b* of the first winding unit 1102A corresponding to the region between the core chucks 90*a*, 90*b* of the second winding unit 1102B is also limited to a certain value.

Figure 42:
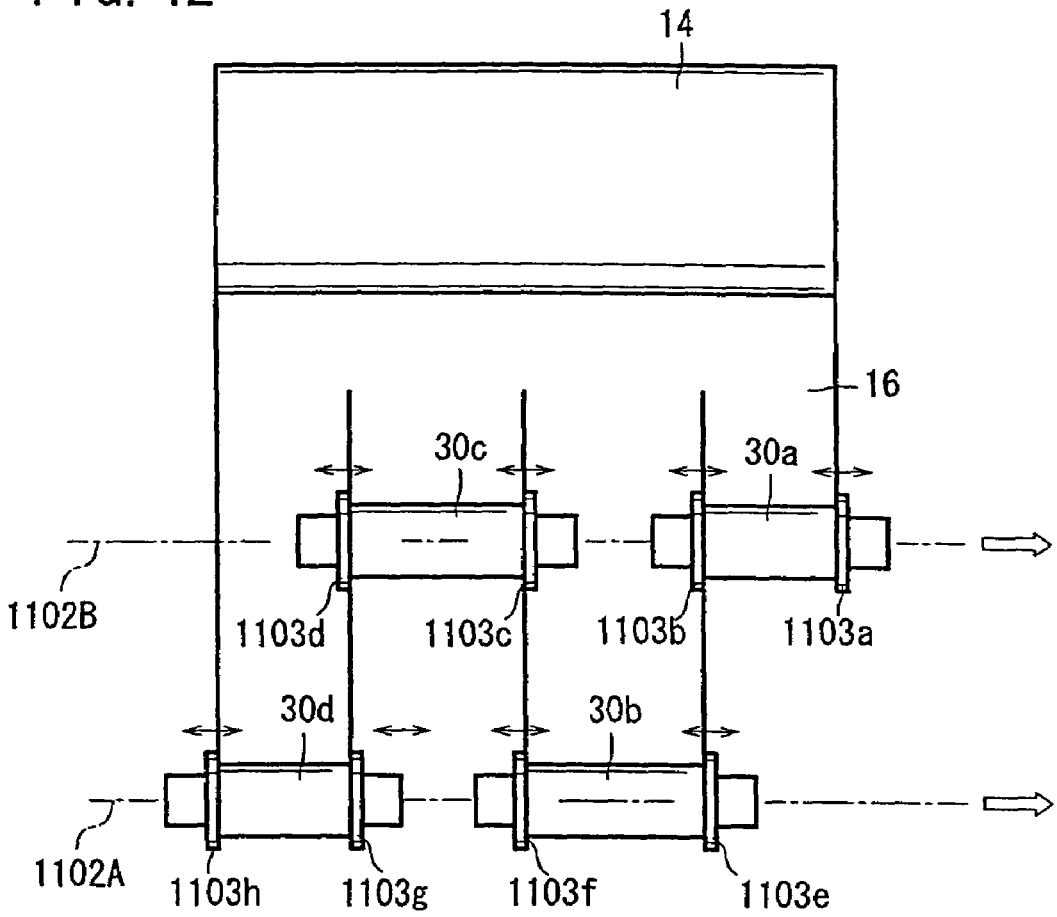
FIG. 42 is a view illustrative of a manufacturing pattern of rolls in the film processing and cutting machine shown in FIG. 33.

As a result, the first winding unit 1102A and the second winding unit 1102B have a choice of two patterns where the wide rolls 30*b*, 30*c* are positioned at its center, as shown in FIGS. 41 and 42. One of the patterns shown in FIGS. 41 and 42 is thus selected.

Figure 43:
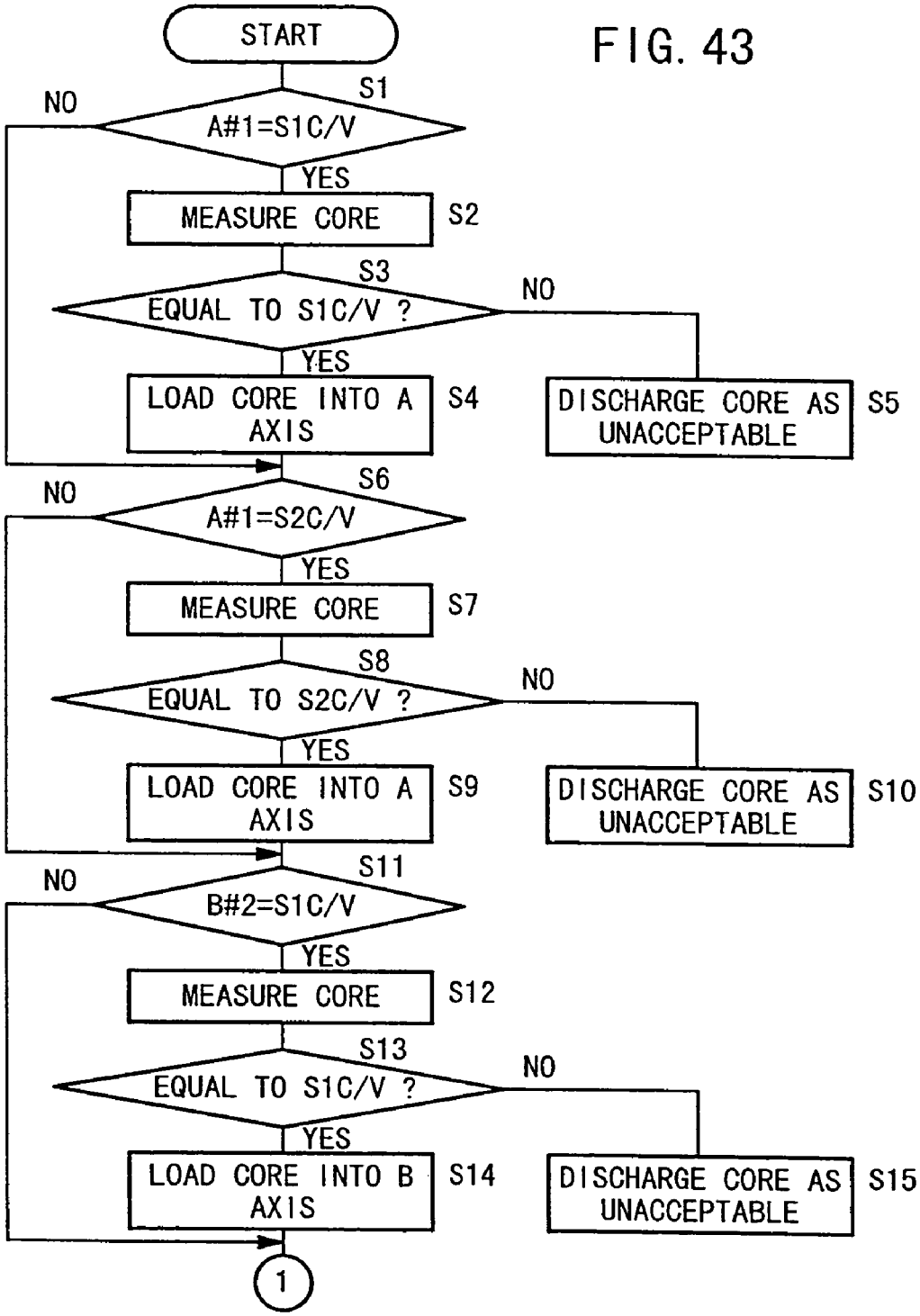
FIGS. 43 through 45 are a flowchart of an operation sequence of a core supply process.
Figure 44:
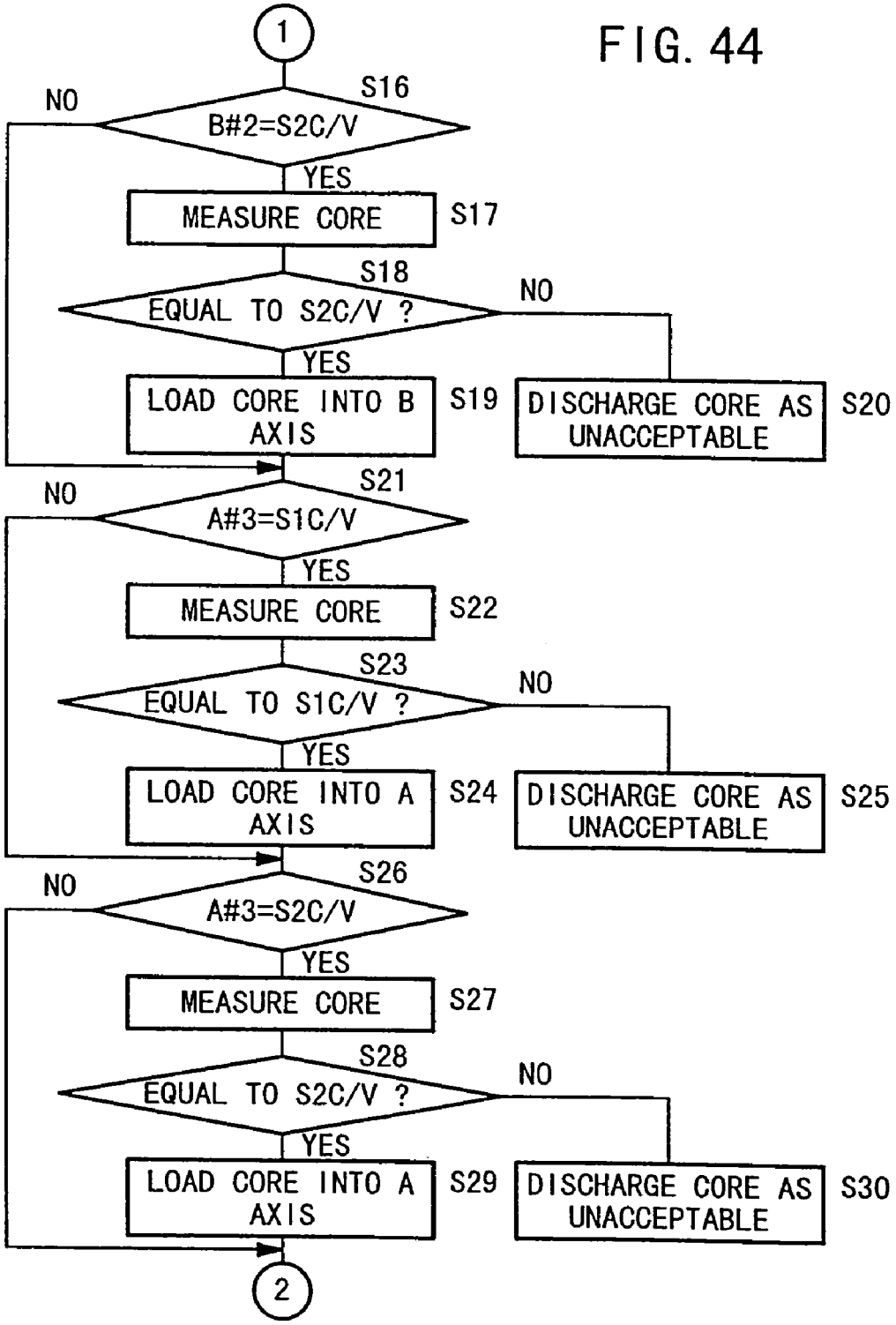
Figure 45:
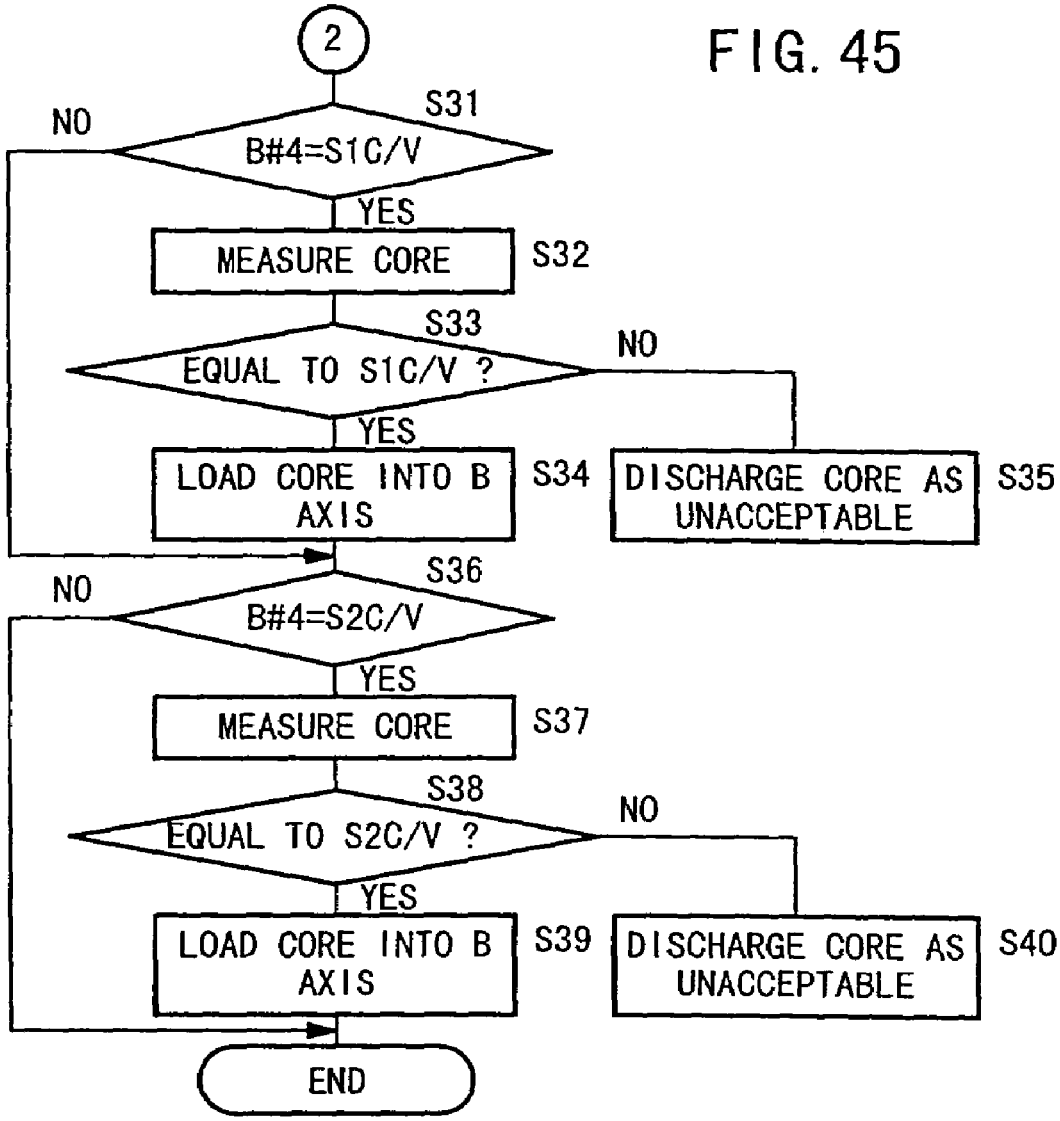

After the film processing apparatus 10 has been adjusted as described above, the control circuit 1330 instructs the core supply apparatus 1308 to supply cores 28 to be used according to the production plan data. A process of supplying cores 28 will be described below with reference to a flowchart shown in FIGS. 43 through 45.

In the flowchart, A#1 and A#3 represent core length data and core diameter data of cores 28 required for rolls 30*a* through 30*d*, 30*a*' through 30*d*' to be manufactured by the first winding unit 1102A of the film winding apparatus 10 shown in FIG. 2, B#1 and B#3 represent core length data and core diameter data of cores 28 required for rolls 30*a* through 30*d*, 30*a*' through 30*d*' to be manufactured by the second winding unit 1102B of the film winding apparatus 10, and S1C/V and S2C/V represent core length data and core diameter data of cores 28 supplied to the feed mechanisms 1320, 1322 of the core supply apparatus 1308 shown in FIG. 2.

The controller 1331 reads the data A#1 of a core 28 required to manufacture rolls 30*a*, 30*a*' in the first winding unit 1102A from the production plan data memory 1334, reads the data S1C/V of a core 28 fed to the feed mechanism 1320 of the core loader 1314 in the core supply apparatus 1308 from the core data memory 1336, and compares these data A#1, S1C/V with each other in step S1.

If A#1=S1C/V, indicating that a core 28 is fed to the feed mechanism 1320 of the core loader 1314, then the length and diameter of the core 28 supplied to the feed mechanism 1320 are measured in step S2. The length of a core 28 is measured by the core length measuring unit 1342 in the feed mechanism 1320, and supplied to the controller 1331 via the input unit 1346. The diameter of a core 28 is measured by the core diameter measuring unit 1344 in the core feed robot (not shown) for feeding the core 28 when the core 28 is gripped by the core feed robot, and supplied to the controller 1331 via the input unit 1346.

If the measured results agree with the data S1C/V relative to the core 28 in step S3, then the core feed robot loads the core 28 supplied to the feed mechanism 1320 into the feed mechanism 1326 corresponding to the A axis (associated with the first winding unit 1102A) of the film winding apparatus 10 in step S4. When the core 28 is loaded into the feed mechanism 1326, control goes to a process of supplying cores 28 to rolls 30*b*, 30*b*'.

If the measured results do not agree with the data S1C/V relative to the desired core 28 in step S3, then the controller 1331 determines that the data suffer some defect or the core supply apparatus 1308 fails to supply the core 28. The core feed robot loads the core 28 supplied to the feed mechanism 1320 into the discharger 1324 in step S5. When the core 28 is loaded into the discharger 1324, a process for a next core 28 may be repeated, or the core supply apparatus 1308 may be shut off, allowing the operator to confirm the situation.

When the suitable core 28 is loaded into the feed mechanism 1326 in step S4, the controller 1331 generates tracking data which comprise the core length data and core diameter data of the core 28 and the winding direction data, from the production plan data memory 1334, of a roll 30*a* or 30*a*' to which the core 28 is supplied, and stores the generated tracking data in the memory area ME1 of the tracking data memory 1340 corresponding to the feed mechanism 1326.

If A#1 ≠S1C/V in step S1, then the controller 1331 reads the data S2C/V of a core 28 fed to the feed mechanism 1322 of the core loader 1314 in the core supply apparatus 1308 from the core data memory 1336, and compares the data S2C/V with the data A#1 in step S6. Thereafter, as with steps S2 through S5, the core 28 supplied to the feed mechanism 1322 is loaded into the feed mechanism 1326 associated with the A axis of the film winding apparatus 10 or loaded as an inappropriate core 28 into the discharger 1324 in steps S7 through S10.

Then, the controller 1331 reads the data B#2 of a core 28 required to manufacture rolls 30*b*, 30*b*' in the second winding unit 1102B from the production plan data memory 1334, reads the data S1C/V of a core 28 fed to the feed mechanism 1320 of the core loader 1314 in the core supply apparatus 1308 from the core data memory 1336, and compares these data B#2, S1C/V with each other in step S11. Thereafter, as with steps S2 through S5, the core 28 supplied to the feed mechanism 1320 is loaded into the feed mechanism 1328 associated with the B axis of the film winding apparatus 10 or loaded as an inappropriate core 28 into the discharger 1324 in steps S12 through S15.

The memory area ME2 of the tracking data memory 1340 corresponding to the feed mechanism 1328 stores the core length data and core diameter data of the core 28 supplied to a roll 30*a* or 30*a*', and the winding direction data of the core 30*b* or 30*b*'.

If B#2 ≠S1C/V in step S11, then the controller 1331 reads the data S2C/V of a core 28 fed to the feed mechanism 1322 of the core loader 1314 in the core supply apparatus 1308 from the core data memory 1336, and compares the data S2C/V with the data B#2 in step S16. Thereafter, as with steps S12 through S15, the core 28 supplied to the feed mechanism 1322 is loaded into the feed mechanism 1328 associated with the B axis of the film winding apparatus 10 or loaded as an inappropriate core 28 into the discharger 1324 in steps S17 through S20.

When the core 28 corresponding to the roll 30*a* or 30*a*' is supplied to the feed mechanism 1326, the core 28 corresponding to the roll 30*b* or 30*b*' is supplied to the feed mechanism 1328, and these cores 28 are fed to the next feed mechanisms 1316, 1318, cores 28 are supplied to the roll 30*c* or 30*c*' and the roll 30*d* or 30*d*' in steps S21 through S40.

The cores 28 supplied from the core supply apparatus 1308 are fed together with tracking data added thereto to the film processing and cutting mechanism 12. Specifically, when the core passage detector 1348 detects the cores 28 fed from the feed mechanisms 1326, 1328 of the core loader 1314 to the feed mechanisms 1316, 1318, the controller 1331 copies the tracking data stored in the memory areas ME1, ME2 to the memory areas ME3, ME4 corresponding to the feed mechanisms 1316, 1318.

Similarly, as the cores 28 are fed from the feed mechanisms 1316, 1318 to the feed mechanisms 1302, 1306, the feed mechanisms 1300, 1304, the first winding unit 1102A, and the second winding unit 1102B, the tracking data are also copied from the memory areas ME3, ME4 successively to the memory areas ME5, ME7, the memory areas ME6, ME8, and the memory areas ME9, ME10.

By thus moving the tracking data together with the cores 28, it is possible to transfer the information of the cores 28 with the tracking data, thus preventing inappropriate cores 28 from being supplied to the film processing and cutting machine 12 in advance.

To the tracking data, there are added data of the winding directions of supplied rolls 30*a* through 30*d*, 30*a*' through 30*d*' to be able to determine which of the A and B axes or the A' and B' axes the cores 28 in the feed mechanisms 1302, 1306 are to be fed to.

As shown in FIG. 3, a film roll 14 mounted on the film delivery apparatus 18 is unwound by the non-illustrated unwinding motor to supply an elongate raw film 16 to the suction drum 38 of the feed apparatus 20. The speed of the suction drum 38 is controlled according to a given speed pattern by the servomotor 1016, and the length of the elongate raw film 16 as it is fed is detected by the encoder 41.

The elongate raw film 16 which is adjusted in speed by the suction drum 38 is fed to the cutting apparatus 26. As shown in FIG. 4, the first and second round blades 48*a*, 48*b* are arrayed in the directions indicated by the arrow D at spaced intervals corresponding to the widths of elongate films 24*a* through 24*d* to be cut. The first round blades 48*a* are rotated to cut the edges 32 off the elongate films 24*a* through 24*d*. The elongate films 24*a* through 24*d* from which the edges 32 are cut off are of a given width and fed to the film winding apparatus 10. Since the first round blades 48*a* are brought into the cutting position by the respective cylinders 53, the cutting apparatus 26 is capable of handling changes in the widths of the elongate films 24*a* through 24*d*.

The edges 32 are wound according to a certain tension pattern by the processing apparatus 34, as described later on. Since the elongate films 24*a* through 24*d* are processed similarly, only the processing of the elongate film 24*a* will be described below.

Figure 46:
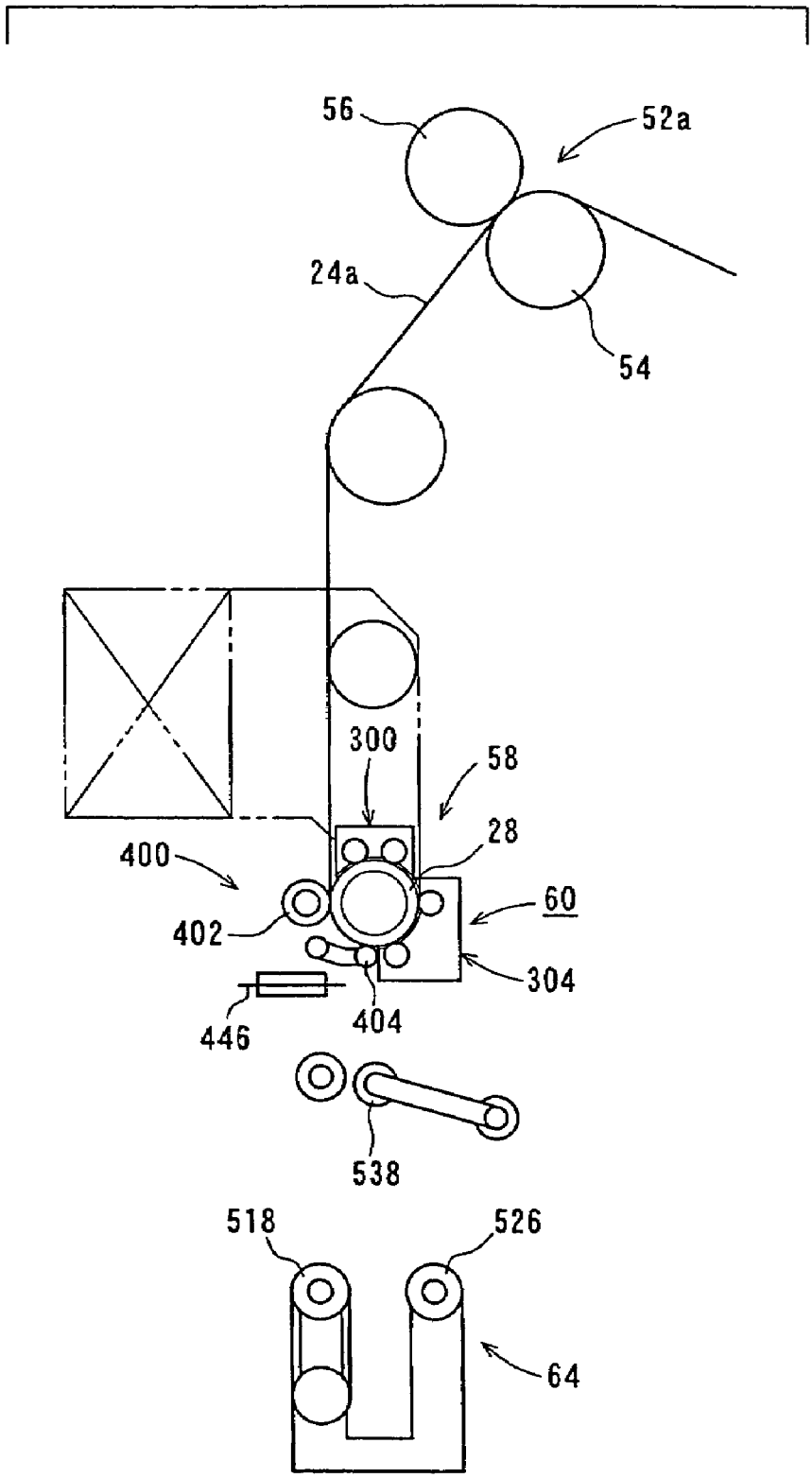
FIG. 46 is a view illustrative of the manner in which an elongate film starts being wound around a core.

When the elongate film 24*a* is wound around the core 28 in the film winding apparatus 10, as shown in FIG. 46, the core 28 is placed in the winding position with its circumferential surface gripped by the block wrapper 60, and the opposite ends of the core 28 is supported by the core chucks 90*a*, 90*b*.

As shown in FIG. 7, when the cylinder 84*a* is actuated, the take-up arm 88*a* is moved in the direction indicated by the arrow D1 while being guided by the guide rails 72*a*, 72*b* until the core chuck 90*a* mounted on the take-up arm 88*a* is fitted into one end of the core 28. When the cylinder 84*b* is actuated and the take-up arm 88*a* is moved thereby in the direction indicated by the arrow D2, the core chuck 90*b* mounted on the take-up arm 88*b* is fitted into the other end of the core 28.

Then, as shown in FIG. 8, the cylinder 126 mounted on the take-up arm 88*b* is actuated to move the movable plate 130, while being guided by the linear guide 132, in the direction indicated by the arrow D2 with respect to the take-up arm 88*b*. The rod 124 supported on the movable plate 130 by the bearing 134 is moved in the direction indicated by the arrow D2.

The body 162 of the wedge member 140 which is fixed to the rod 124 by the rod fixing member 142 is moved in unison with the rod 124 in the direction indicated by the arrow D2. Therefore, the wedge pieces 170 inserted in the grooves 168 in the body 162 are moved radially outwardly, radially spreading the radially expandable and contractible fingers 138 fixed to the wedge pieces 170. The outer circumferential surfaces of the radially expandable and contractible fingers 138 are now pressed against the inner circumferential surface of the core 28 thereby to hole the core 28.

In the winding nip roller unit 400, as shown in FIG. 5, the first cylinder 570 is actuated to move the winding nip roller 402 toward the core 28, thus supporting the elongate film 24*a* on the outer circumferential surface of the core 28. The second cylinder 582 is actuated to move the lower plate 410 forward, causing the lower winding roller 404 mounted on the lower plate 410 to wind the leading end portion of the elongate film 24*a* around the core 28 through an angular range of about 90°.

Figure 47:
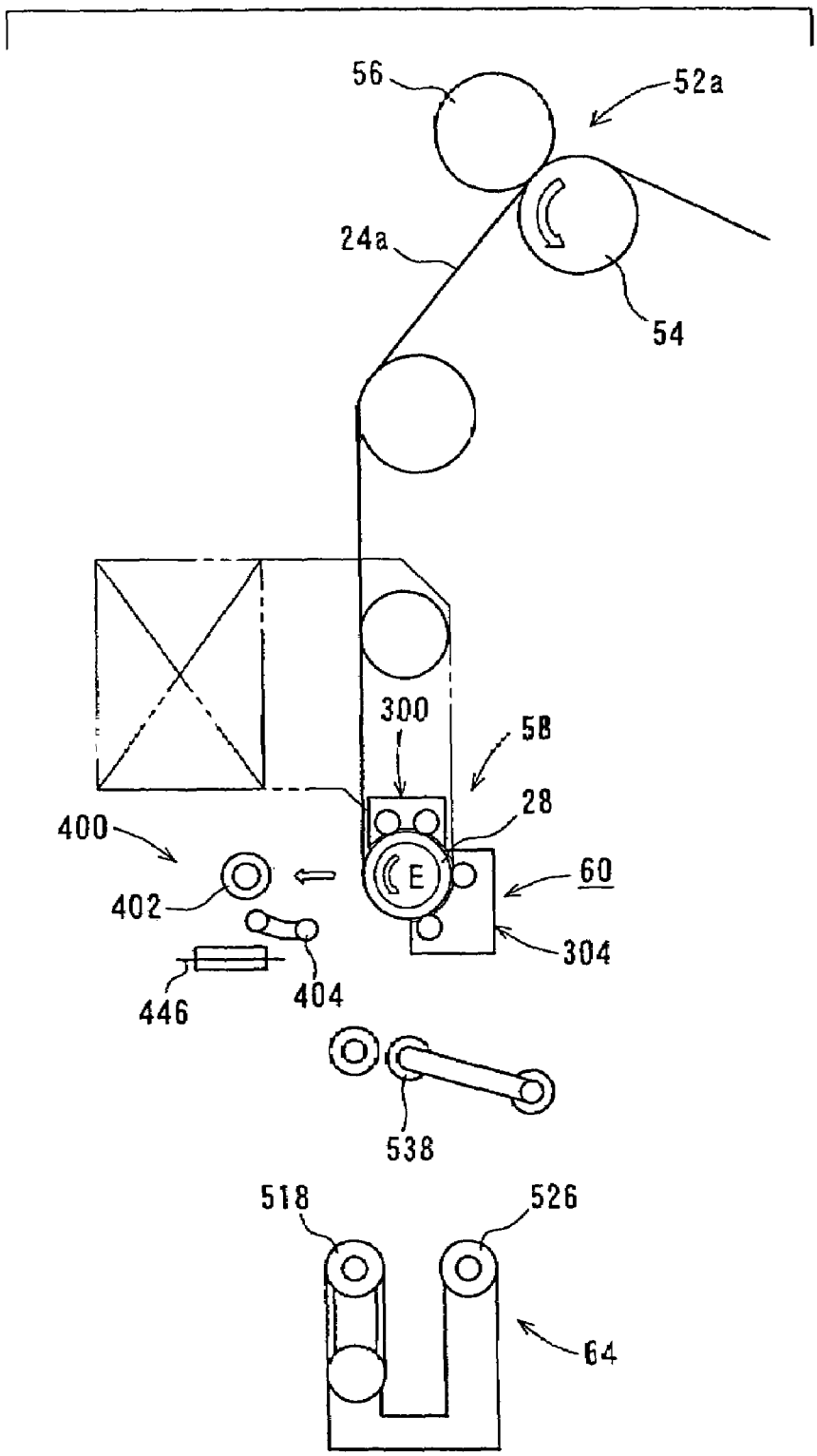
FIG. 47 is a view illustrative of the manner in which the winding nip roller unit is released from the core.

Then, the suction drum 38 is rotated, and the drive torque of the servomotor 92 enables the belt and pulley means 104 to start rotating the core chuck 90*a*, as shown in FIGS. 6 and 7. The core 28 is now rotated to wind the elongate film 24*a* around the core 28 through about 180° from the position where the elongate film 24*a* has been held by the lower winding roller 404 (the elongate film 24*a* is actually wound around the core 28 through about 270°), after which the winding nip roller 402 and the lower winding roller 404 of the winding nip roller unit 400 are spaced away from the core 28 (see FIG. 47).

Figure 48:
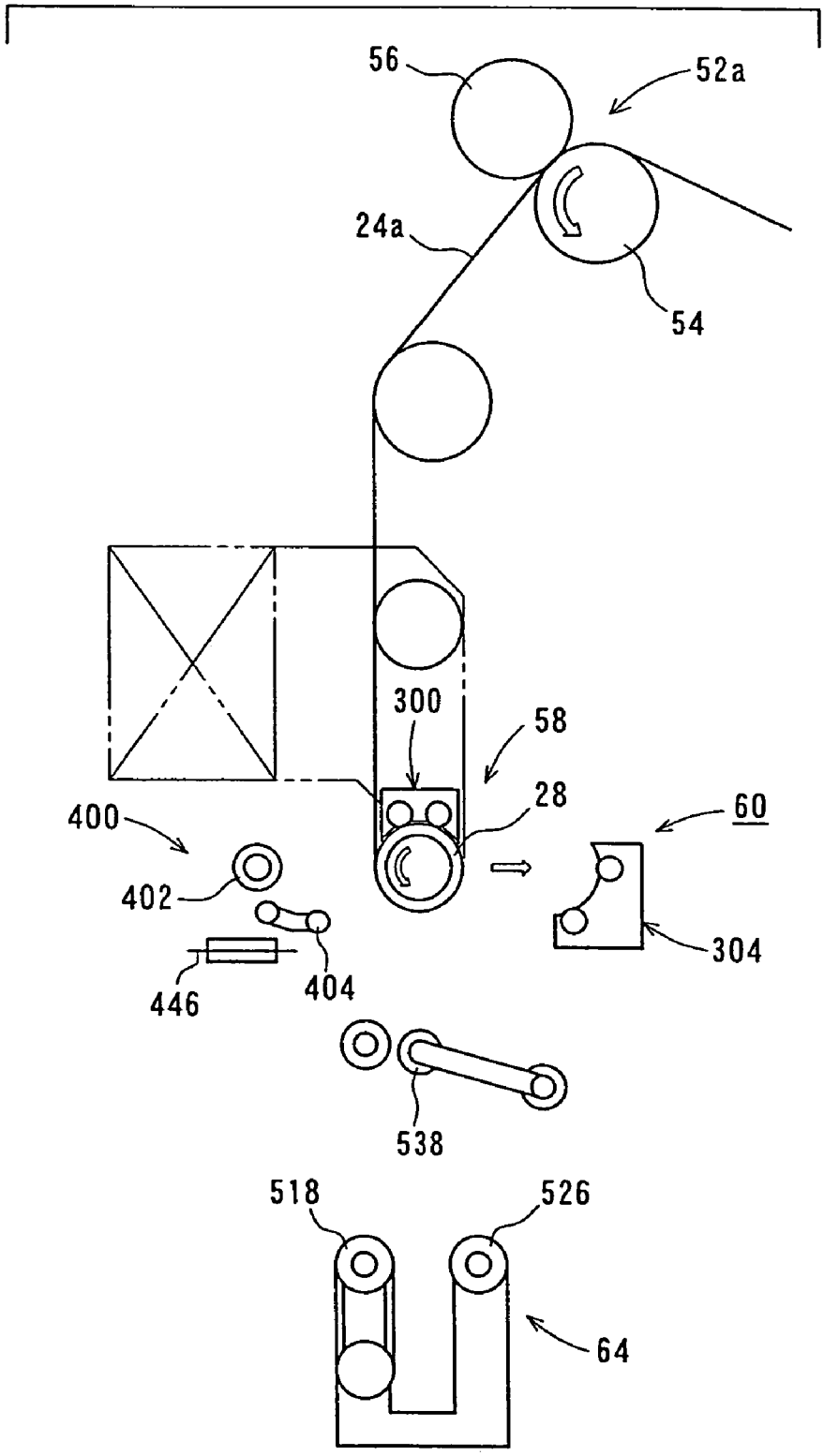
FIG. 48 is a view illustrative of the manner in which a side wrapper is released from the core.
Figure 49:
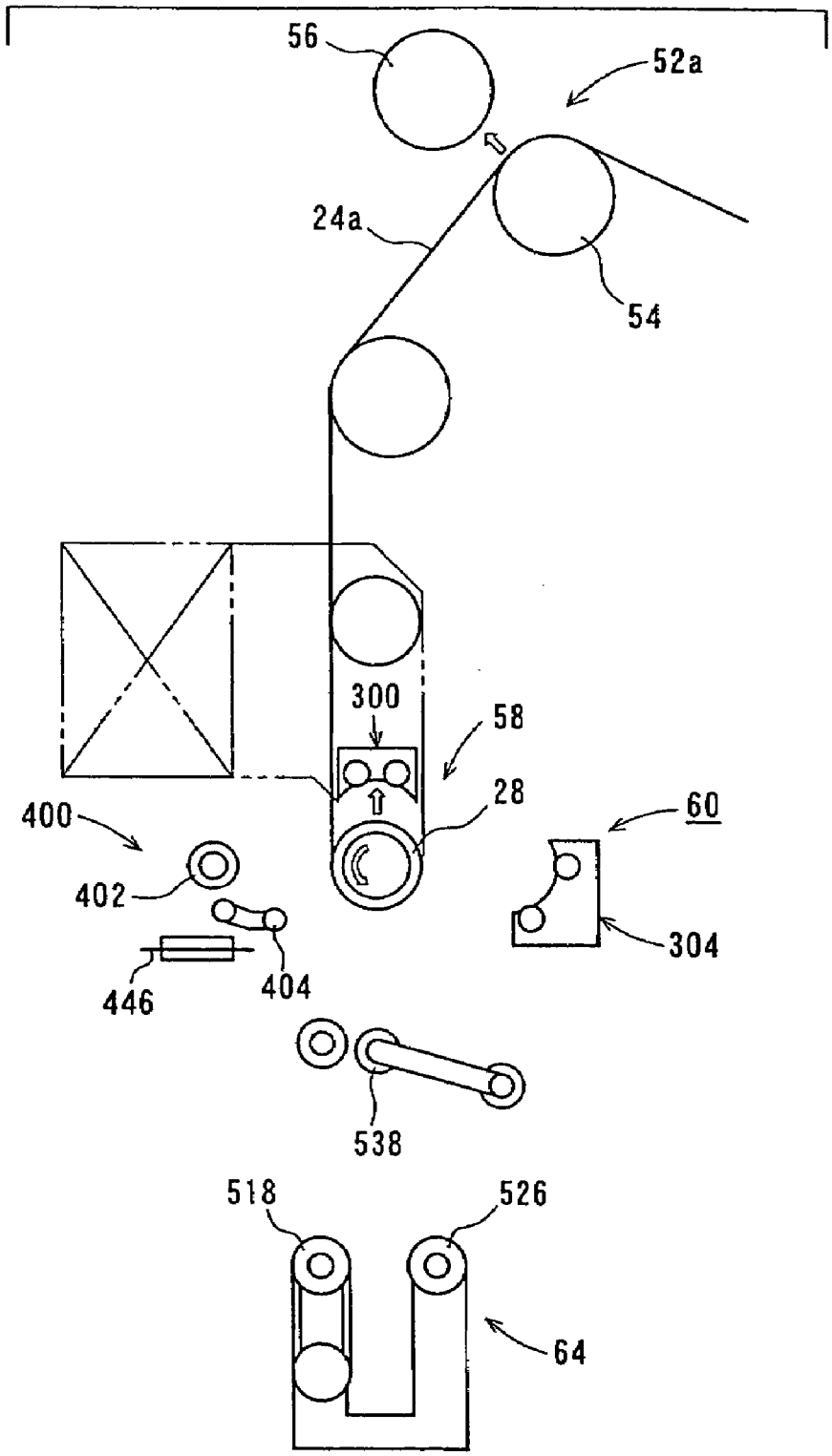
FIG. 49 is a view illustrative of the manner in which an upper wrapper is released from the core.

The servomotor 92 is energized to wind the elongate film 24*a* around the core 28 further through about 90° (a total of about 360°). Thereafter, as shown in FIG. 48, the side wrapper 304 of each block wrapper 60 is moved away from the core 28 by the cylinder 322. When one turn or more of the elongate film 24*a* is subsequently wound around the core 28, as shown in FIG. 49, the upper wrapper 300 of each block wrapper 60 is retracted upwardly by the cylinder 310, and the nip roller 56 is spaced away from the backup roller 54.

As described above, when the elongate film 24*a* starts being wound around the core 28, as shown in FIG. 46, the upper wrapper 300, the side wrapper 304, the winding nip roller 402, and the lower winding roller 404 of the winding mechanism 110 are positioned around the core 28. Then, the core rotating mechanism 58 is actuated to rotate the core 28 in the direction indicated by the arrow E in FIG. 47 to wind the elongate film 24*a* around the core 28, and the upper wrapper 300, the side wrapper 304, the winding nip roller 402, and the lower winding roller 404 are successively retracted from the core 28.

Specifically, after the elongate film 24*a* is wound around the core 28 through about 180° from the position where the elongate film 24*a* has been held by the lower winding roller 404, the winding nip roller 402 and the lower winding roller 404 are spaced away from the core 28. After the elongate film 24*a* is wound around the core 28 further through about 90°, the side wrapper 304 is spaced away from the core 28. When one turn or more of the elongate film 24*a* is subsequently wound around the core 28 (e.g., through about 540°), the upper wrapper 300 is spaced away from the core 28.

Therefore, when the elongate film 24*a* is initially wound, the leading end of the elongate film 24*a* is pressed against and supported by the first through fourth free rollers 320*a*, 320*b*, 332, 334 of the block wrapper 60, without sagging in the gaps 319, 331 between the blocks 317, 329 and the core 28. Stated otherwise, since the elongate film 24*a* is wound around the core 28 with only its leading end being held in position, the elongate film 24*a* is prevented from sagging under its tension, making it possible to efficiently produce a high-quality roll 30*a* in a desired wound shape that is reliably maintained through a simple process.

The times at which the upper wrapper 300, the side wrapper 304, the winding nip roller 402, and the lower winding roller 404 are moved are set based on the output signal from the encoder 41 that is coupled to the suction drum 38 which serves as a reference roller. The wound state of the elongate film 24*a* around the core 28 can be accurately detected, and the wrappers and the rollers can optimally be retracted based on the detected wound state of the elongate film 24*a*, effectively avoiding winding failures of the elongate film 24*a*. Consequently, the elongate film 24*a* can smoothly be wound around the core 28 in a stable wound shape, producing a high-quality roll 30*a*.

Figure 50:
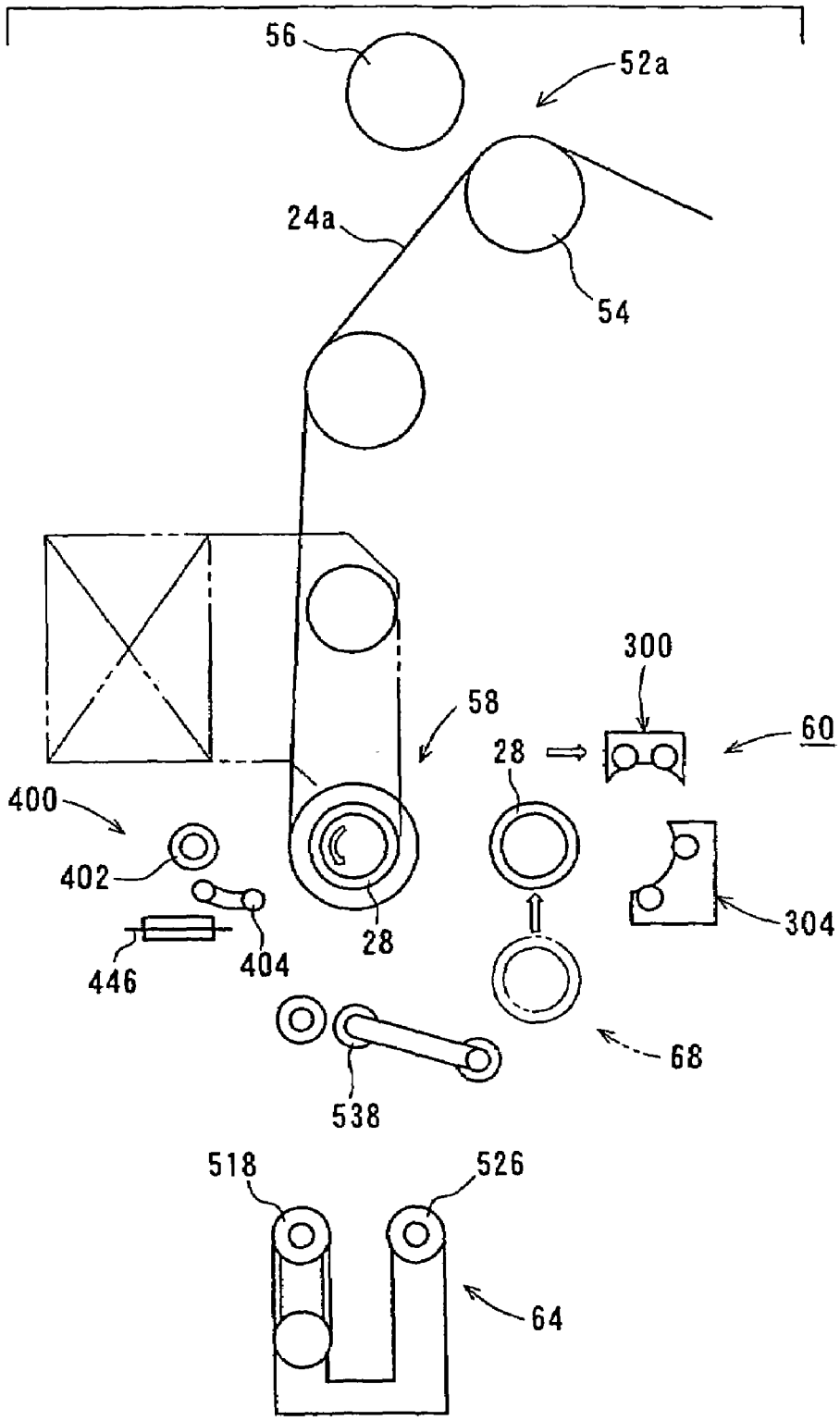
FIG. 50 is a view illustrative of the manner in which the elongate film is wound around the core.

While the elongate film 24*a* is being wound around the core 28 by the core rotating mechanism 58, the first unit body 200 on which the block wrappers 60 are mounted is temporarily moved in a direction away from the core 28, i.e., in the direction indicated by the arrow C1 in FIG. 12, by the ball screw 212 that is rotated by the servomotor 206 through the belt and pulley means 210. As shown FIG. 50, the pusher 550 of the core supply mechanism 68 holds a new core 28 and moves upwardly, and places the new core 28 in the core transfer position P3.

When the new core 28 is placed in the core transfer position P3, a given number of block wrappers 60 positioned along the axial length of the core 28 are moved in unison with each other to the core transfer position P3 by the first unit body 200. Thereafter, as shown in FIG. 15, the cylinder 310 of the lifting and lowering means 302 is actuated to lower the upper wrapper 300 to support an upper portion of the core 28. Then, the core supply mechanism 68 releases the core 28, and the cylinder 322 of the moving means 306 is actuated to move the side wrapper 304 forward, supporting side and lower portions of the core 28 (see FIG. 51). The pusher 550 is lowered, thereby transferring the new core 28 to the block wrappers 60.

Figure 51:
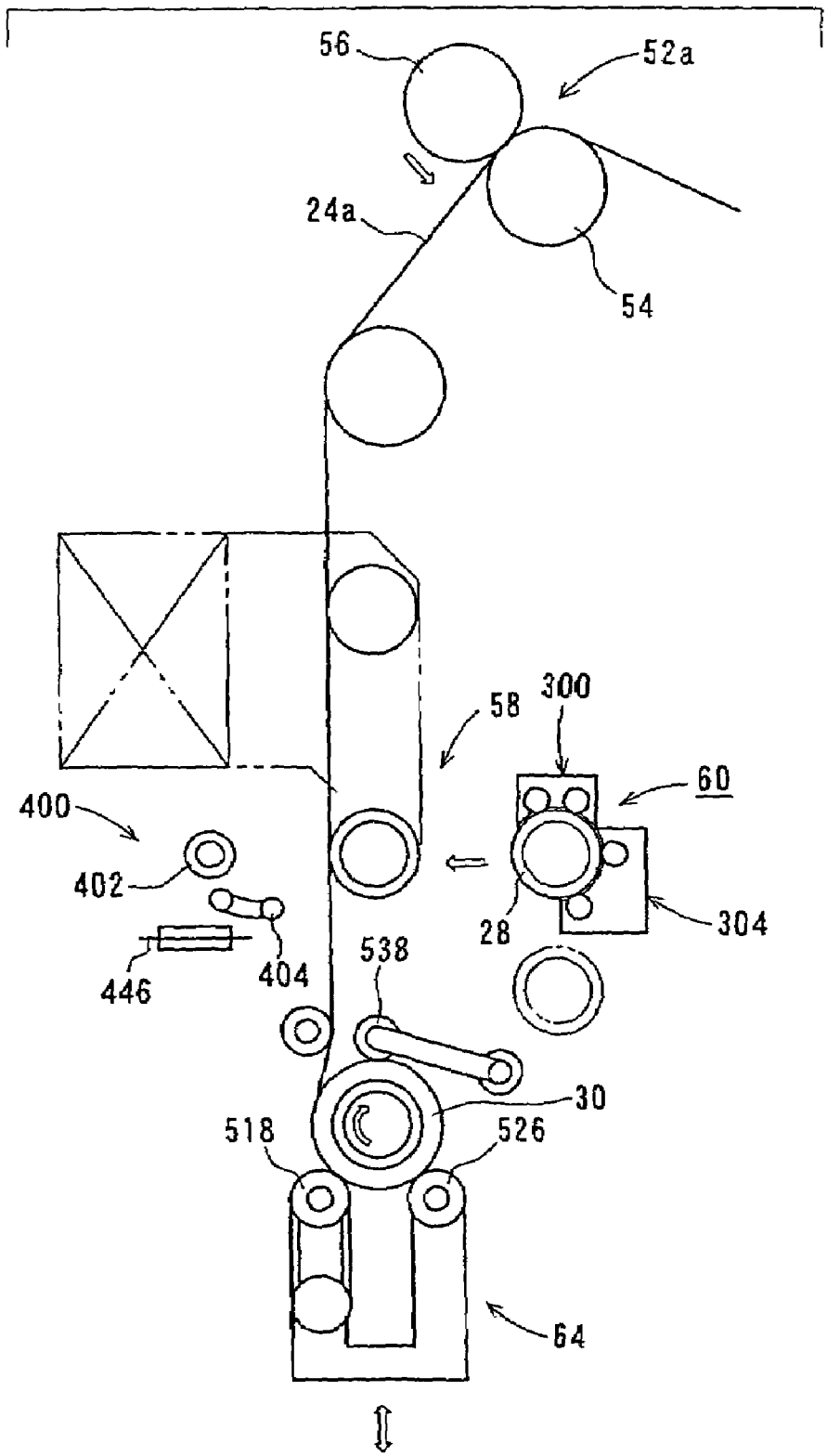
FIG. 51 is a view illustrative of the manner in which a film roll made of the elongate film wound around the core is discharged.

When the elongate film 24*a* is wound to a given length around the core 28 by the core rotating mechanism 58, as shown in FIG. 51, the nip roller 56 is moved toward the backup roller 54, suppressing tension variations in an upstream film path portion, and the product receiving mechanism 64 is elevated. On the product receiving mechanism 64, the roll 30*a* is held by the rider roller 538, the ejection roller 518, and the free roller 526. The servomotor 502 is energized to rotate the balls crew 506, causing the block 514 to lower the roll 30*a* to a vertical cutting position. At this time, since the roll 30*a* is lowered while unwinding the elongate film 24*a*, the elongate film 24*a* is kept under tension.

Then, the first drive unit 202 is actuated to move the first unit body 200 forward in the direction indicated by the arrow C2, and a new core 28 is held by the core rotating mechanism 58. The unit body 406 is moved forward to cause the winding nip roller 402 to press the elongate film 24*a* against the outer circumferential surface of the core 28.

Then, as shown in FIG. 20, the rodless cylinder 430 of the cutting mechanism 66 is actuated, moving the base member 434 in unison therewith in the transverse directions of the film, i.e., in the directions indicated by the arrow D. Therefore, the first pinion 440 meshing with the rack 438 extending in the directions indicated by the arrow D and the second pinion 442 meshing with the first pinion 440 are rotated to rotate and move the cross cutter blade 446 in the directions indicated by the arrow D, cross-cutting the elongate film 24*a* transversely while it is being guided by the sorting guide 448.

Figure 52:
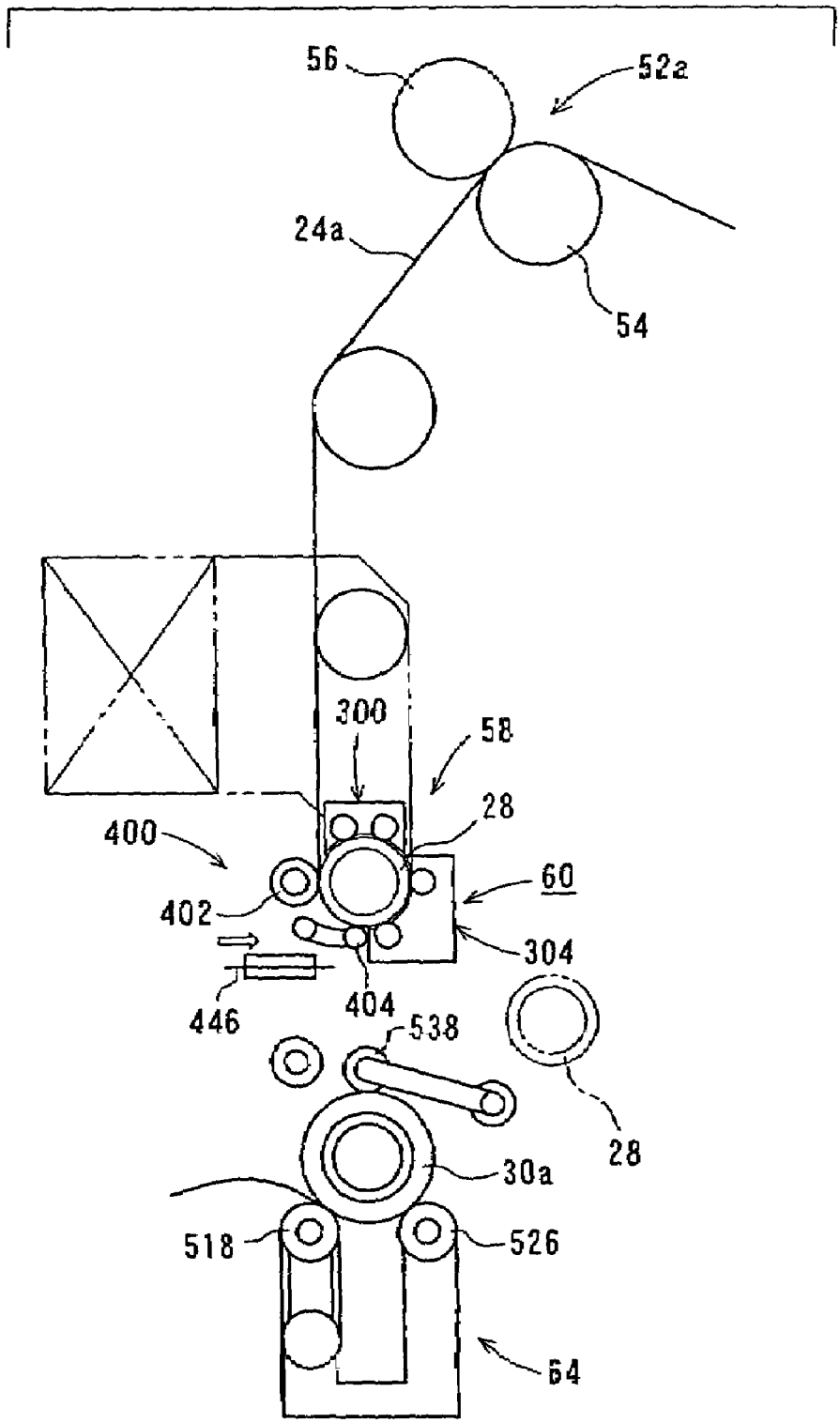
FIG. 52 is a view illustrative of the manner in which the elongate film is cut from the film roll.

After the elongate film 24*a* is cut, as shown in FIG. 19, the second cylinder 580 is actuated to move the lower winding roller 404 forward in the direction indicated by the arrow C1. Therefore, as shown in FIG. 52, the cut leading end portion of the elongate film 24*a* is wound around the core 28 through about 90°.

Figure 53:
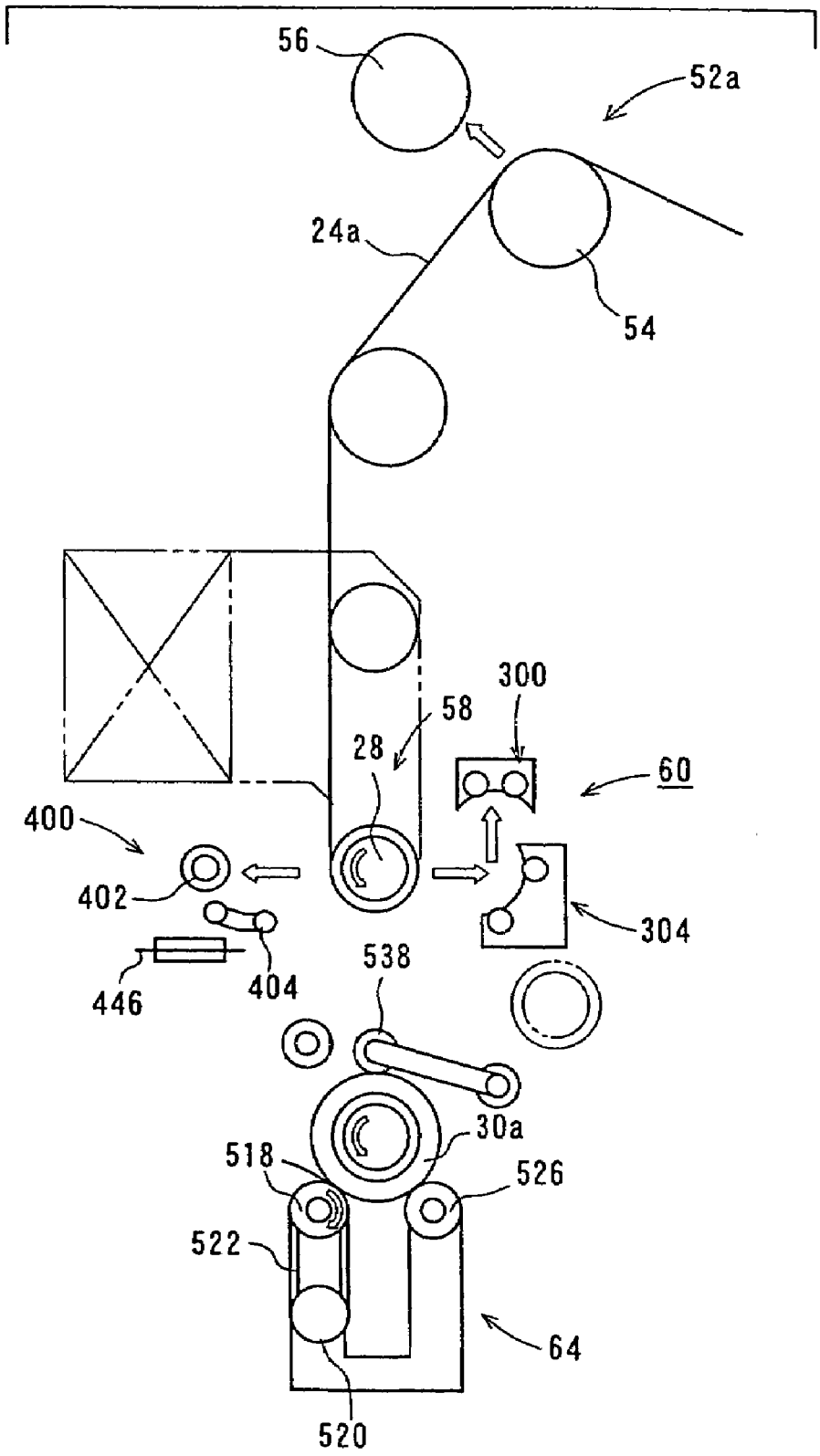
FIG. 53 is a view illustrative of the manner in which the end of the cut elongate film is wound, producing the film roll.

Then, as shown in FIG. 53, the elongate film 24*a* is wound around the core 28. On the product receiving mechanism 64, the servomotor 520 is energized to rotate the roll 30*a* in the winding direction, winding the cut trailing end of the elongate film 24*a* to a suitable length. The roll 30*a* is transferred from the product receiving mechanism 46 to the conveyor 528, which supplies the roll 30*a* to a next process.

When the rolls 30*a* through 30*d* are produced in the first winding unit 1102A and the second winding unit 1102B, the memory area ME1 and the memory area ME2 store block numbers and slit numbers as the slit data a2.

For example, if the rolls 30*a* through 30*d* are manufactured according to the pattern shown in FIG. 41, the memory area ME1 stores block #1 as an intra-areal block number and slit #1 and slit #3 as intra-areal slit numbers, and the memory area ME2 stores block #1 as an intra-areal block number and slit #2 and slit #4 as intra-areal slit numbers.

If the rolls 30*a* through 30*d* are manufactured according to the pattern shown in FIG. 42, the memory area ME1 stores block #1 as an intra-areal block number and slit #2 and slit #4 as intra-areal slit numbers, and the memory area ME2 stores block #1 as an intra-areal block number and slit #1 and slit #3 as intra-areal slit numbers.

Figure 54:
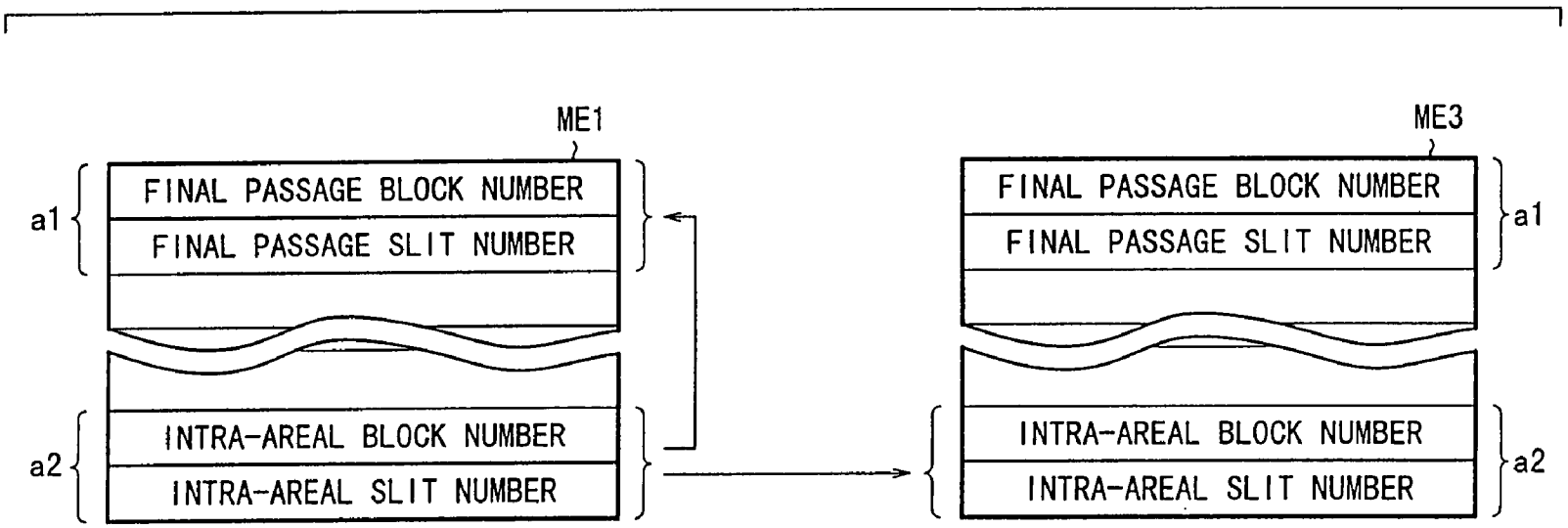
FIG. 54 is a diagram showing the manner in which the tracking data shown in FIG. 39 are rewritten.

For manufacturing the rolls 30*a* through 30*d* according to the pattern shown in FIG. 41, when the first feed unit 1104A is actuated to feed a core 30*a* of block #1, slit #1 to the first feed unit 1106A, the core passage detector 1122A detects passage of the roll 30*a*. Based on a detected signal representing the roll 30*a*, the controller 1136 stores tracking data of block #1, slit #1 as the slit data a2 in the memory area ME3 corresponding to the first feed unit 1106A. The controller 1136 also stores the tracking data of block #1, slit #1 of the roll 30*a* which have been stored as the slit data a2 up to present, as a final passage block number and a final passage slit number as the header a1 in the memory area ME1 which corresponds to the first feed unit 1104A to which the roll 30*a* is fed. FIG. 54 schematically shows such a process of rewriting the tracking data.

Similarly, when a core 30*b* of block #1, slit #2 is fed from the second feed unit 1104B to the second feed unit 1106B, tracking data of block #1, slit #2 are stored, as the slit data a2 in the memory area ME4, and tracking data of block #1, slit #2 are stored as the header a1 in the memory area ME2.

The above process of processing the tracking data with the controller 1136 is also performed as the rolls 30*a* through 30*d* are fed from the film processing and cutting mechanism 12 to various portions of the film feed mechanism 1200.

Since the rolls 30*a* through 30*d* are fed from the film processing and cutting mechanism 12 in either one of the patterns shown in FIGS. 41 and 42, the first transfer unit 1110A and the second transfer unit 1110B are required to detect the sequence in which the rolls 30*a* through 30*d* are fed, and selectively supply the rolls 30*a* through 30*d* to the main feed unit 1108.

A process of supplying the rolls 30*a* through 30*d* to the main feed unit 1108 in the order of slits will be described below with reference to flowcharts shown in FIGS. 55 and 56.

Figure 55:
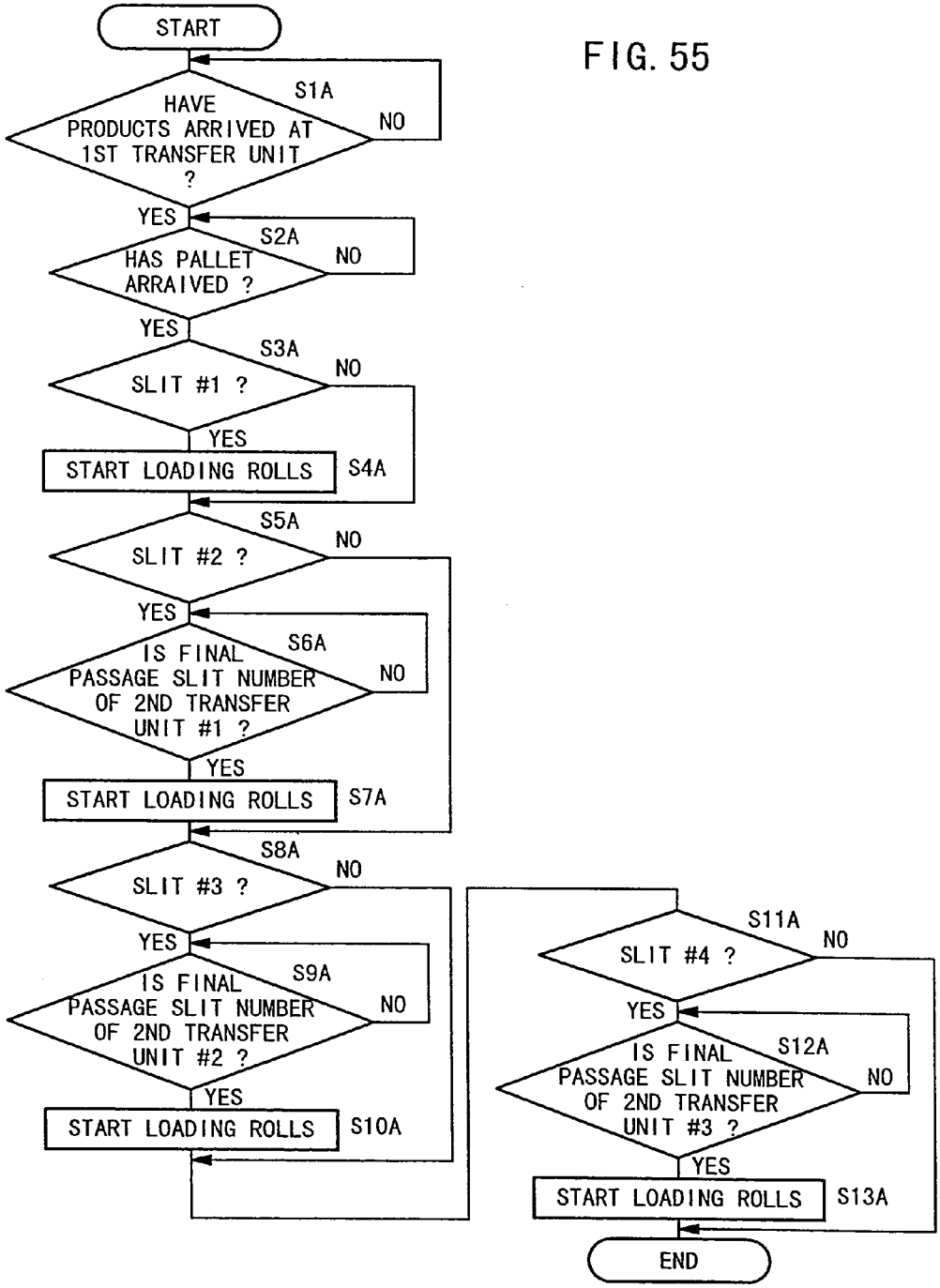
FIG. 55 is a flowchart of a processing sequence of a first transfer unit in the film processing and cutting machine shown in FIG. 33.

FIG. 55 shows a process in the first transfer unit 1110A. If the controller 1136 detects that the rolls 30*a* through 30*d* are supplied to the main transfer unit 1110A in step S1A and the pallet 1109 arrives at a given area in the main feed unit 1108 in step S2A, then the controller 1136 reads the tracking data stored in the memory area ME5. If the intra-areal slit number of the slit data a2 is slit #1 in step S3A, then the controller 1136 transfers the rolls 30*a* through 30*d* in the first transfer unit 1110A to the pallet 1109 in step S4A. In this case, the rolls 30*a* through 30*d* are supplied according to the pattern shown in FIG. 41.

Then, the controller 1136 reads again the tracking data stored in the memory area ME5. If the intra-areal slit number of the slit data a2 is slit #3 in step S8A, then the controller 1136 reads the tracking data stored in the memory area ME6 corresponding to the second transfer unit 1110B. If the final passage slit number of the header a1 of the tracking data is slit #2 in step S9A, then since it is determined that the rolls 30*a* through 30*d* of slit #2 have already been supplied from the second transfer unit 1110B to the pallet 1109, the controller 1136 transfers the rolls 30*a* through 30*d* of slit #3 to the pallet 1109 in step S10A.

If the intra-areal slit number of the slit data a2 stored in the memory area ME5 corresponding to the first transfer unit 1110A is slit #2 in step S5A, then the controller 1136 reads the tracking data stored in the memory area ME6 corresponding to the second transfer unit 1110B. After the rolls 30*a* through 30*d* whose final passage slit number of the header a1 is slit #1 are detected as being supplied to the main feed unit 1108 in step S6A, the controller 1136 transfers the rolls 30*a* through 30*d* of slit #2 to the pallet 1109 in step S7A. In this case, the rolls 30*a* through 30*d* are supplied according to the pattern shown in FIG. 42.

Then, the controller 1136 reads again the tracking data stored in the memory area ME5. If the intra-areal slit number of the slit data a2 is slit #4 in step S11A, then the controller 1136 reads the tracking data stored in the memory area ME6 corresponding to the second transfer unit 1110B. If the final passage slit number of the header a1 of the tracking data is slit #3 in step S12A, then since it is determined that the rolls 30*a* through 30*d* of slit #3 have already been supplied from the second transfer unit 1110B to the pallet 1109, the controller 1136 transfers the rolls 30*a* through 30*d* of slit #4 to the pallet 1109 in step S13A.

Figure 56:
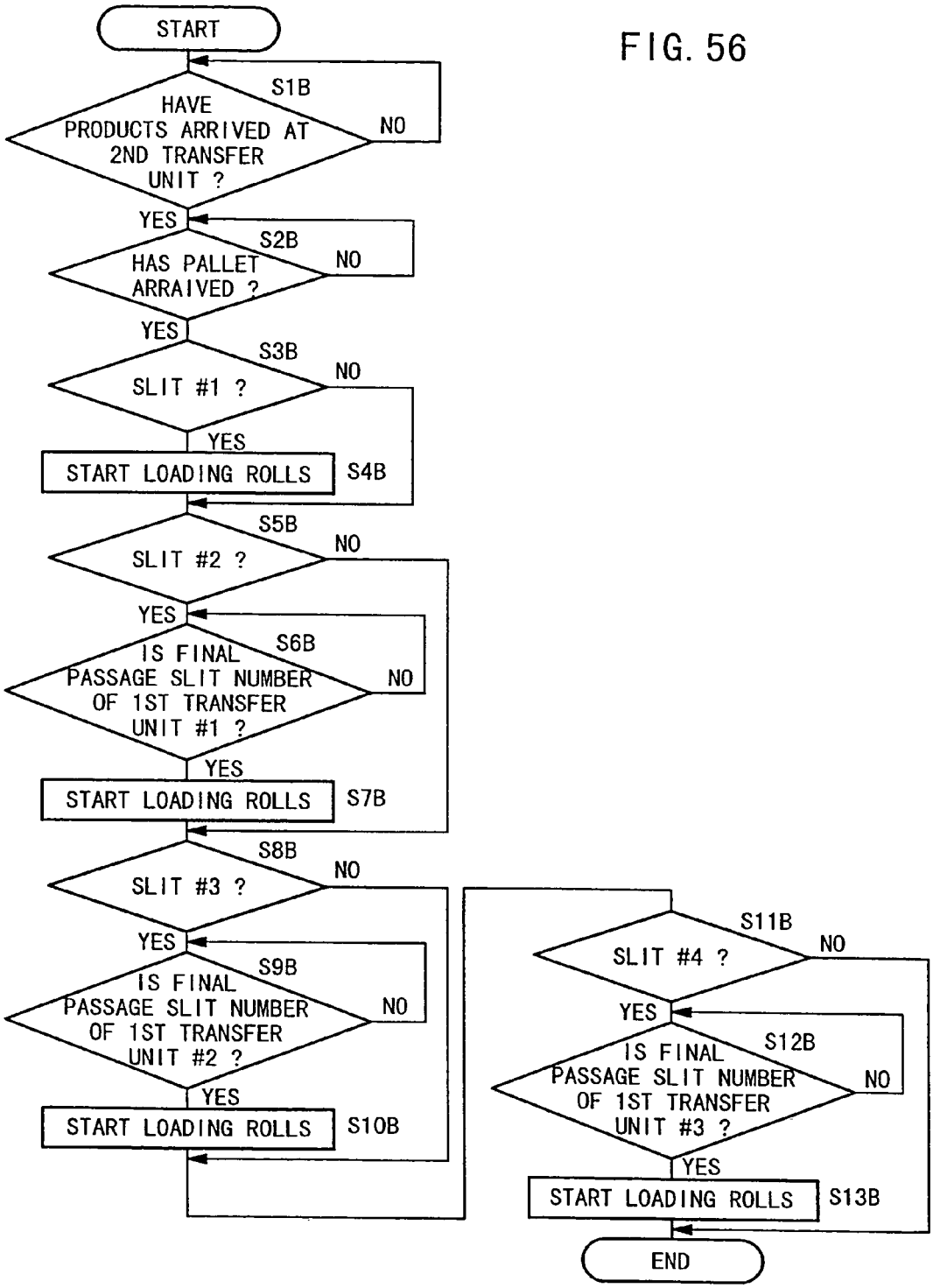
FIG. 56 is a flowchart of a processing sequence of a second transfer unit in the film processing and cutting machine shown in FIG. 33.

FIG. 56 shows a process in the second transfer unit 1110B. The second transfer unit 1110B performs the same process as the first transfer unit 1110A in steps S1B through S13B which correspond to steps S1A through S13A.

The main feed unit 1108 is thus supplied with the rolls 30*a* through 30*d* in the order of slits #1 through #4 which are manufactured from the film roll 14. Similarly, the main feed unit 1108 is supplied with the rolls 30*a* through 30*d* in the order of slits which have a next block number.

The rolls 30*a* through 30*d* transferred to the main feed unit 1108 are changed in orientation when necessary by the turntable 1112, and thereafter reach the roll discharger 1114. Inasmuch as the rolls 30*a* through 30*d* are supplied in a desired sequence to the roll discharger 1114, the operator can reliably discharge the rolls 30*a* through 30*d* as desired without an error. The rolls 30*a* through 30*d* are then delivered through the buffers 1116, 1118 and the roll transfer unit 1120 to a next process.

As described above, rolls 30*a* through 30*d* supplied via the first transfer unit 1110A and the second transfer unit 1110B are rearranged in the order of slits and supplied to the main feed unit 1108. In the above embodiment, the rolls 30*a* through 30*d* supplied via the first feed unit 1104A and the second feed unit 1104B are selected by the first transfer unit 1110A and the second transfer unit 1110B and supplied to the main feed unit 1108. However, rolls 30*a* through 30*d* supplied from three or more feed units may be supplied in a desired sequence to the main feed unit 1108 and arranged therein.

In the first embodiment, as shown in FIG. 15, the first and second free rollers 320*a*, 320*b* are pressed against the outer circumferential surface of the core 28, and the direction in which the first and second free rollers 320*a*, 320*b* are pressed, i.e., the direction indicated by the arrow V2, is opposite to the direction in which the elongate film 24*a* wound around the core 28 is tensioned, i.e., the direction indicated by the arrow V1.

Consequently, the first and second free rollers 320*a*, 320*b* are capable of applying pressing forces to the core 28 while counterbalancing the tension that is applied to the core 28 when the elongate film 24*a* is wound therearound, thus reliably preventing the core 28 from being flexed. Thus, the elongate film 24*a* is prevented from being transported unstably, and is smoothly and reliably wound around the core 28, providing a stable wound shape.

The first and second free rollers 320*a*, 320*b* are positioned at equal distances K from the hypothetical reference line LV. Therefore, the first and second free rollers 320*a*, 320*b* are stably and firmly supported on the output circumferential surface of the core 28, and the block 317 on which the first and second free rollers 320*a*, 320*b* are mounted does not need to rely on its own rigidity, allowing the gap 319 to be maintained reliably between the block 317 and the core 28.

The elongate film 24*a* can thus smoothly wound along the gap 319 and hence can be wound efficiently and highly accurately. The fourth free roller 334 is disposed in substantially diametrically opposite relation to the first and second free rollers 320*a*, 320*b*, thereby reliably supporting the core 28.

The third free roller 332 and the winding nip roller 402 are disposed on the hypothetical reference line LH in diametrically opposite relation to each other across the core 28. Therefore, pressing forces applied by the third free roller 332 and the winding nip roller 402 are held in equilibrium, preventing the core 28 from being flexed along the hypothetical reference line LH.

Figure 57:
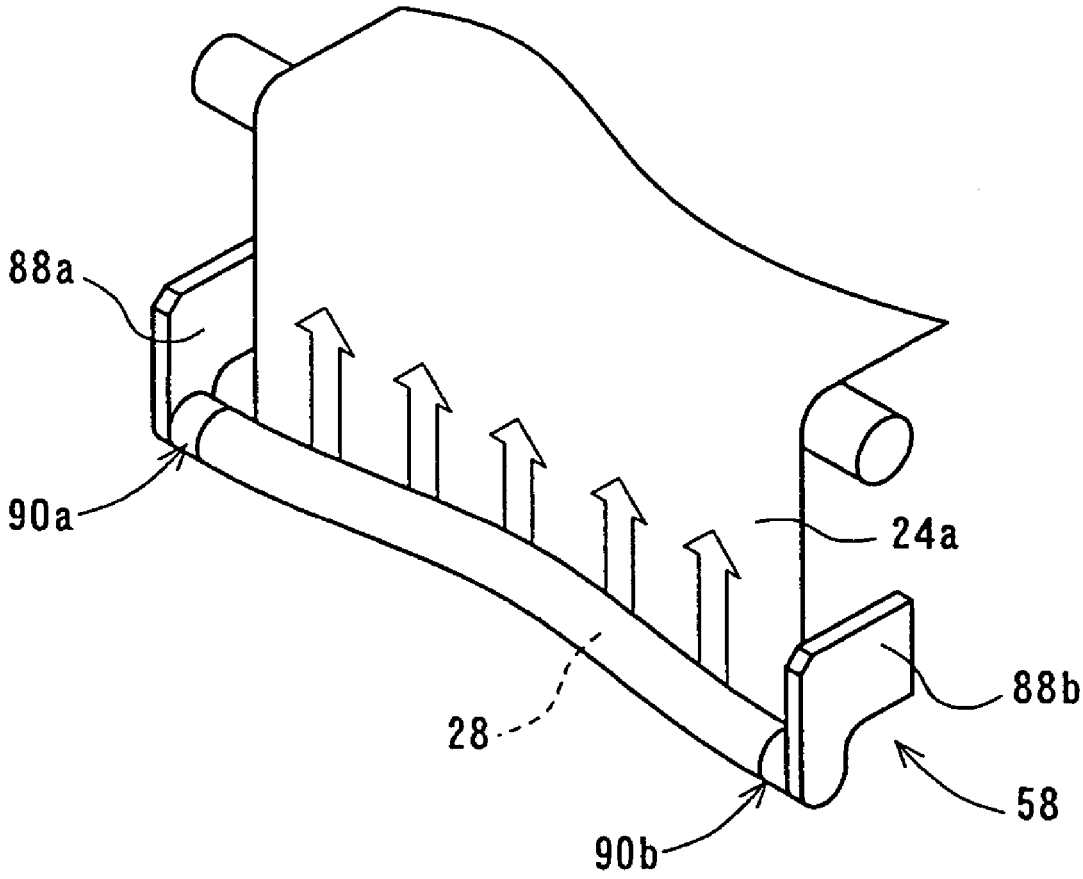
FIG. 57 is a perspective view showing the manner in which the elongate film is wound around the core without using the block wrapper.
Figure 58:
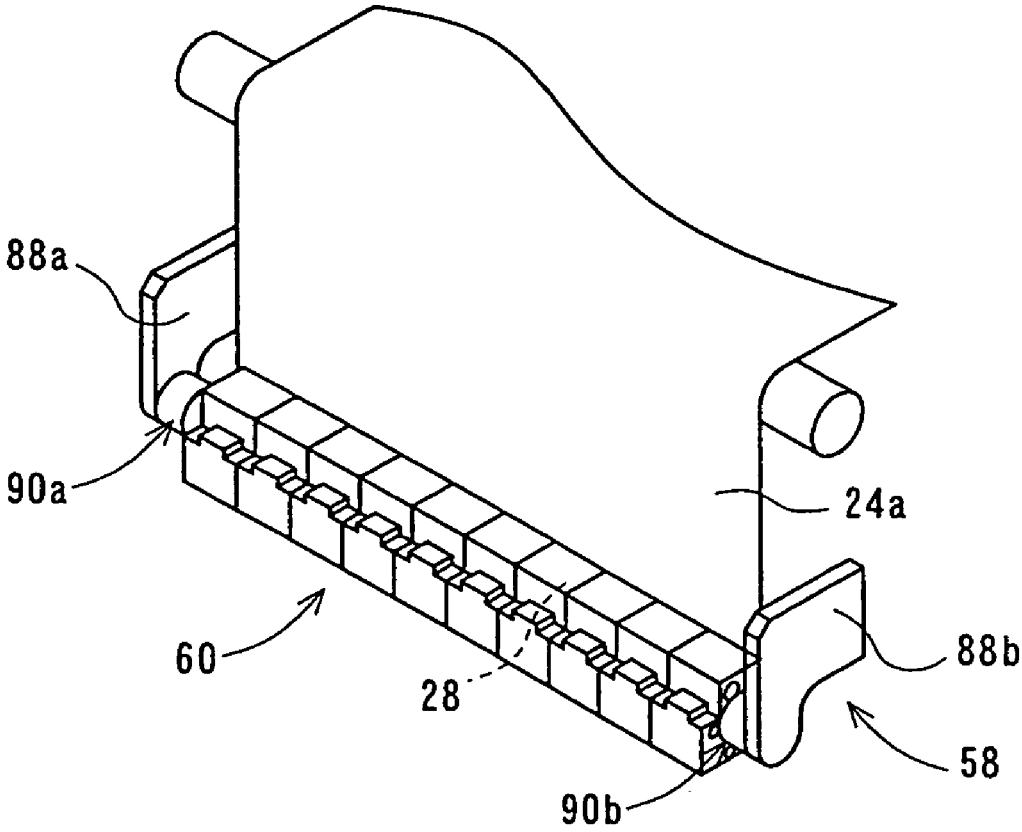
FIG. 58 is a perspective view showing the manner in which the elongate film is wound around the core using the block wrapper.

A predetermined number of block wrappers 60 corresponding to the axial length of the core 28 are arrayed in the axial direction of the core 28, and apply pressing forces to the core 28 over its entire length. Accordingly, uniform pressing forces can be applied to the core 28 in the entire axial direction, so that the core 28 can be maintained linearly over its entire length. Specifically, as shown in FIG. 57, if the core held by only the core chucks 90*a*, 90*b* is rotated by the core rotating mechanism 58 to wind the elongate film 24*a* around the core 28, the core 28 is liable to be largely flexed in its central region. However, as shown in FIG. 58, when the core 28 is rotated while pressing forces are being applied to the core 28 over its entire length by the block wrappers 60, the core 28 can be maintained linearly over its entire length, preventing the wound shape of the elongate film 24*a* from being disturbed.

By setting dimensions of the gaps 319, 331 between the blocks 317, 329 and the core 28, it is possible to wind the elongate film 24*a* well around the core 28. Specifically, when the base of the elongate film 24*a* was made of PET, the elongate film 24*a* had a thickness of 0.1 mm, the outside diameter of the core 28 was in the range from 50 mm to 90 mm, and the gaps 319, 331 were in the range from 0.1 mm to 0.8 mm, i.e., in the range from the thickness of the elongate film 24*a* to 0.8 mm, a stable wound shape was obtained. When the gaps 319, 331 were in the range from 0.8 mm to 1.2 mm, the elongate film 24*a* tended to float from the core 28. When the gaps 319, 331 were greater than 1.2 mm, the wound state was unstable, and a winding failure was caused. Therefore, the gaps 319, 331 should preferably be in the range from the thickness of the elongate film 24*a* to 0.8 mm.

The block 317 with the first and second free rollers 320*a*, 320*b* mounted thereon is movable toward and away from the core 28 by an actuator with a pressing force adjusting function, e.g., the vertical cylinder 310. The tension of the elongate film 24*a* when it is wound around the core 28 is in the range from 9.8 N (Newton) to 29.4 N (Newton) per 100 mm of the film, and is controlled by the torque produced by the servomotor 92 of the core rotating mechanism 58. The servomotor 92 may be replaced with a combination of an induction motor and a powder brake, a combination of an induction motor and a hysteresis clutch, or a combination of a speed-controlled motor and a dancer.

The pressing forces of the upper wrapper 300 are set by a regulator to be of the same value as the above tension value. For example, in the case where the block wrapper 60 has a width of 100 mm, the cylinder 310 has a bore diameter of 10 mm, and the upper wrapper 300 has a weight of 4.9 N (Newton), if the film tension value is 19.6 N (Newton) per 100 mm, then the pressing forces of the upper wrapper 300 are $18.6\times10^4$ Pa (Pascal).

The core 28 is apt to have a more flexible region in the axial direction thereof. If, for example, the pressing forces of the block wrapper 60 disposed at the center of the core 28 are higher than those of the other block wrappers 60, then the core 28 can accurately be corrected out of its flexed configuration.

If there is employed a mechanism capable of automatically controlling a pressure in ganged relation to the set tension value of the elongate film 24*a* when it is wound, then transverse film sizes can be changed automatically when the tension is changed according to transverse film size. By individually controlling the cylinders 310 of the respective block wrappers 60, the core 28 can be pressed so as to be slightly flexed in a direction opposite to the direction in which it is flexed under tension. Accordingly, the stability with which to transport the elongate film 24*a* is increased to reliably obtain a stable wound shape.

When the elongate film 24*a* is wound as described above, the tension applied to the elongate film 24*a* is appropriately adjusted to prevent the elongate film 24*a* from being subjected to an excessive tension, to prevent the elongate film 24*a* from being damaged, or to prevent the produced roll 30*a* from being loosened or irregularly wound.

Specifically, before the elongate films 24*a* through 24*d* are wound by the film winding apparatus 10, as shown in FIG. 36, the process control computer 1008 stores preset speed command values and preset winding tension command values in the speed command value memory 1018, the speed command value memories 1030*a* through 1030*d*, and the winding tension command value memories 1032*a* through 1032*d*.

Figure 59:
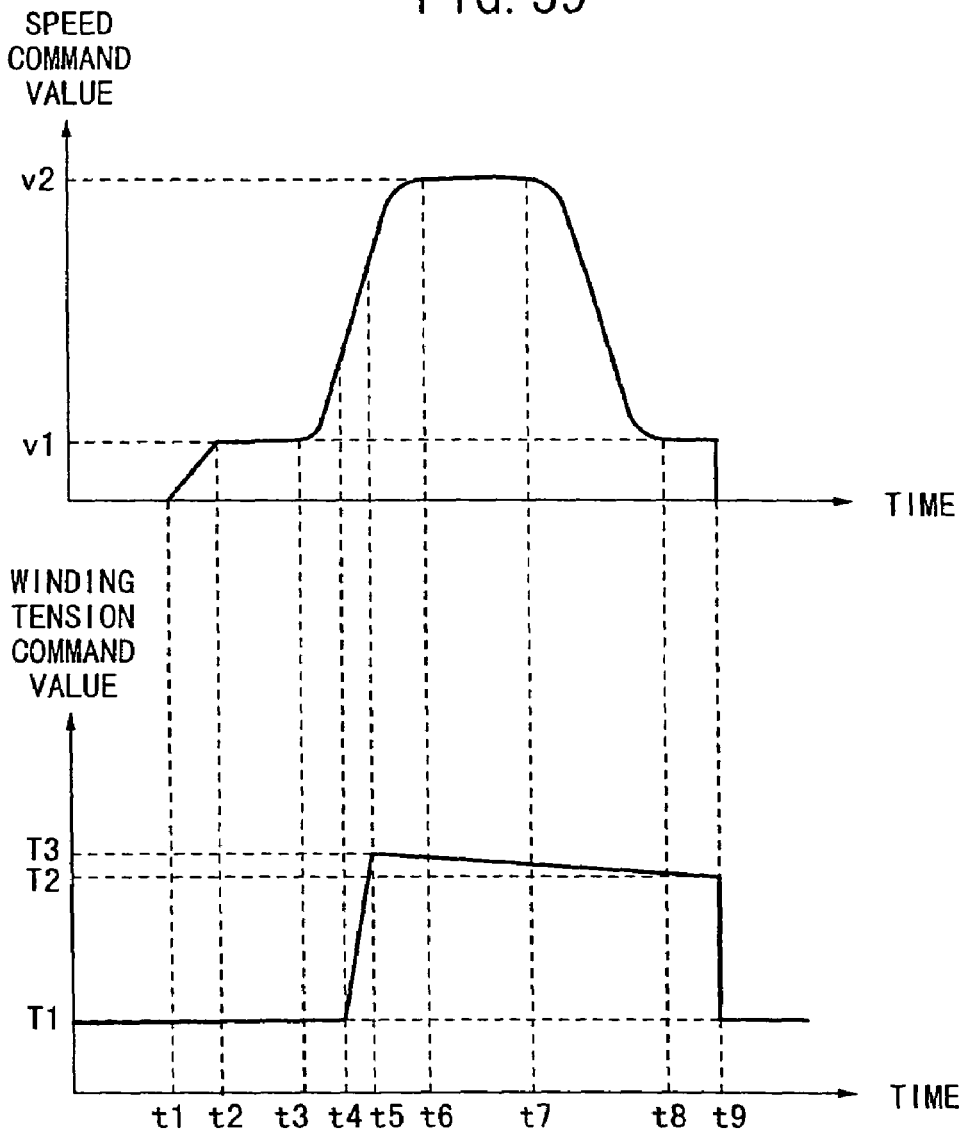
FIG. 59 is a diagram showing the relationship between speed command values for feeding a film and winding tension command values in the control circuit of the film winding apparatus of the film processing and cutting machine.

FIG. 59 shows in an upper portion thereof the relationship between speed command values for the servomotor 1016 and time, and FIG. 59 shows in a lower portion thereof the relationship between winding tension command values for the elongate films 24*a* through 24*d* which are stored in the winding tension command value memories 1032*a* through 1032*d* and time. The speed command values are stored in the speed command value memory 1018. The speed command value memories 1030*a* through 1030*d* store a constant speed command value for the servomotors 92.

The speed/torque controllers 1004*a* through 1004*d* reads a constant speed command value from the speed command value memories 1030*a* through 1030*d*, supply a drive signal based on the speed command value from the output units 1024*a* through 1024*d* via the motor drivers 1026 to the servomotors 92 to rotate the cores 28. The torque converting units 1034*a* through 1034*d* read a constant winding tension command value T1 shown in FIG. 59 from the winding tension command value memories 1032*a* through 1032*d*, convert the winding tension command value T1 into a torque command value, and supply the torque command value to the speed/torque controllers 1004*a* through 1004*d*. The speed/torque controllers 1004*a* through 1004*d* control the motor drivers 1026 to rotate the servomotors 92 with the torque command supplied from the torque converting units 1034*a* through 1034*d*.

After the core rotating mechanism 58 has been adjusted to the above state, the speed controller 1002 reads a speed command value from the speed command value memory 1018 at a time t1, and supplies a drive signal based on the speed command value from the output unit 1012 via the motor driver 1014 to the servomotor 1016 thereby rotating the suction drum 38. The suction drum 38 is accelerated from the time t1 to a time t2, and then rotated at a constant speed v1 to deliver the elongate raw film 16 to the film winding apparatus 10.

The elongate raw film 16 delivered by the suction drum 38 is cut by the cutting apparatus 26 into four elongate films 24*a* through 24*d*, which are then supplied to the core rotating mechanism 58 of the film winding apparatus 10. Then, the elongate films 24*a* through 24*d* start being wound around the cores 28 that are rotated by the servomotors 92. Since the servomotors 92 are controlled to produce a torque value which is equal to a constant torque command value that is obtained by converting the constant winding tension command value T1, a constant tension T1 is applied to the elongate films 24*a* through 24*d* when they are wound around the cores 28.

Then, the speed controller 1002 reads a speed command value from the speed command value memory 1018, and accelerates the suction drum 38 from a speed v1 to a speed v2 in an interval from a time t3 to a time t6, delivering the elongate raw film 16 to the film winding apparatus 10.

The speed/torque controllers 1004*a* through 1004*d* convert a winding tension command value, which gradually increases from the winding tension command value T1 read from the winding tension command value memories 1032*a* through 1032*d* to a winding tension command value T3 set depending on the length of the cores 28 during an interval from a time t4 to a time t5 which is set depending on the length of the cores 28, into a torque command value with the torque converting units 1034*a* through 1034*d*, and supply the torque command value to the motor drivers 1026 to control the servomotors 92. As a result, the elongate films 24*a* through 24*d* are wound around the cores 28 under winding tensions T1 through T3 which gradually increase.

When a time t5 is reached, the speed/torque controllers 1004*a* through 1004*d* gradually reduce the torque command value from the value corresponding to the winding tension command value T3, and winds the elongate films 24*a* through 24*d*.

During this time, the acceleration to deliver the elongate raw film 16 with the servomotor 1016 based on the command from the speed controller 1002 is gradually reduced. At a time t6, the speed command value from the speed controller 1002 is set to a constant speed command value v2. The speed command value v2 is kept until a time t7, and thereafter reduced to the speed command value v1 at a time t8 and then to 0 at a time t9.

During an interval from the time t5 to the time t9, the speed/torque controllers 1004*a* through 1004*d* gradually reduce the torque command value from the value corresponding to the winding tension command value T3 to the value corresponding to the winding tension command value T2, and thereafter set the torque command value to the value corresponding to the winding tension command value T1.

The elongate films 24*a* through 24*d* are thus wound around the respective cores 28 while adjusting the tension applied to the elongate films 24*a* through 24*d* in the manner described above, thereby producing good rolls 30*a* through 30*d*.

Specifically, when the elongate films 24*a* through 24*d* start being wound around the respective cores 28, the winding tension command value T1 is applied to the elongate films 24*a* through 24*d* are kept low. Since no large external forces are imposed on the cores 28 which are not given sufficient rigidity by the elongate films 24*a* through 24*d*, the cores 28 are not flexed, and hence the elongate films 24*a* through 24*d* are well wound around the cores 28.

When the elongate films 24*a* through 24*d* are wound to a certain length around the respective cores 28, they impart rigidity to the cores 28, making the cores 28 resistant to flexing. The tension of the elongate films 24*a* through 24*d* is then switched to the higher winding tension command value T3, allowing the elongate films 24*a* through 24*d* to be wound at a high speed around the cores 28 without being made unstable by becoming loose. For longer cores 28, the length of the elongate films 24*a* through 24*d* wound under the lower winding tension command value T1 is set to a larger value, so that the elongate films 24*a* through 24*d* can be wound around the cores 28 without flexing the cores 28. For shorter cores 28, since the shorter cores 28 are sufficiently rigid, the length of the elongate films 24*a* through 24*d* wound under the lower winding tension command value T1 is set to a smaller value, and the higher winding tension command value T3 switched from the lower winding tension command value T1 is set to a larger value. Thus, the elongate films 24*a* through 24*d* are prevented from being displaced while they are being wound, and can be well wound around the cores 28.

In the first embodiment, when the winding tension command value is increased from the value T1 to the value T3, it is increased gradually at a certain rate without abrupt tension variations. Consequently, the elongate films 24*a* through 24*d* are wound around the respective cores 28 without being damaged.

After the tension of the elongate films 24*a* through 24*d* has reached the winding tension command value T3, the elongate films 24*a* through 24*d* are wound while their tension is being gradually reduced. In this manner, the elongate films 24*a* through 24*d* are wound without being displaced and the ends of the rolls 30*a* through 30*d* are not disturbed, so that the rolls 30*a* through 30*d* are in a held in a very well wound state.

The winding tension values stored in the winding tension command value memories 1032*a* through 1032*d* may be set to individual values for the respective rolls 30*a* through 30*d* and may be independently controlled.

Examples under specific conditions will be described below.

1ST EXAMPLE

For winding elongate films 24*a* through 24*d* having a width of 1220 mm around respective cores 28 having a length of 1220 mm and an outside diameter of 3 inches, the elongate films 24*a* through 24*d* were wound to a length of 8 m (about 30 turns) under a tension T1=7.84 N/100 mm, and then wound to 10 m while increasing the tension from T1 to a tension T3=17.64 N/mm. Then, while gradually reducing the tension T3 at a rate of 20%, the elongate films 24*a* through 24*d* were wound to 61 m, producing rolls 30*a* through 30*d*. The number of turns wound under the low tension T1 was about 15% of the entire number of turns.

In 1st Example, though the cores 28 were elongate and liable to be flexed, any disturbance on the ends of the rolls 30*a* through 30*d* was less than a target value of 0.5 mm. The elongate films 24*a* through 24*d* were not displaced on the cores 28, and sufficiently well wound around the respective cores 28.

2ND EXAMPLE

For winding elongate films 24*a* through 24*d* having a width of 150 mm around respective cores 28 having a length of 150 mm and an outside diameter of 3 inches, the elongate films 24*a* through 24*d* were wound to about one-half of a turn around the cores 28 under a tension T1=7.84 N 1100 mm, and then wound while increasing the tension from T1 to a tension T3=24.5 N/mm. Then, while gradually reducing the tension T3 at a rate of 20%, the elongate films 24*a* through 24*d* were wound to 61 m, producing rolls 30*a* through 30*d*. The number of turns wound under the low tension T1 was about 0.5% of the entire number of turns.

In 2nd Example, because the cores 28 were short and less liable to be flexed, the elongate films 24*a* through 24*d* could be wound under a high tension from the start of the winding process, producing good rolls 30*a* through 30*d* whose elongate films 24*a* through 24*d* were not disturbed and displaced.

Other Examples are shown in Table 1 below. In these Examples, the cores 28 had an inside diameter of 73.7 mm, an outside diameter of 77.9 mm, and a length which was 0.5 to 1.0 mm smaller than the width of the elongate films 24*a* through 24*d*. By setting the length of the elongate films 24*a* through 24*d* to be wound around cores 28 under the low tension T1 as shown in Table 1 with respect to the overall length of rolls 30*a* through 30*d*, any disturbance of the ends of the rolls could be held to an allowable range of 0.5 mm.

TABLE 1

| Axial film length | Winding ratio under low tension T1 |
|---|---|
| 310 mm | 0.5% |
| 381 mm | 0.5% |
| 761 mm | 0.5% |
| 838 mm | 0.5% |
| 1220 mm | 1.5% |

In the first embodiment, when the axial length (raw film width) of the core 28 is changed, a desired one of the block wrappers 60 can be placed in the winding position P1. Specifically, as shown in FIG. 18, the servomotor 342 of the moving mechanism 62 is energized to rotate the ball screw 344, moving the moving base 348 which has the nut 350 threaded over the ball screw 344 in the directions indicated by the arrow D into alignment with one of the block wrappers 60 disposed in the winding position P1.

Figure 60:
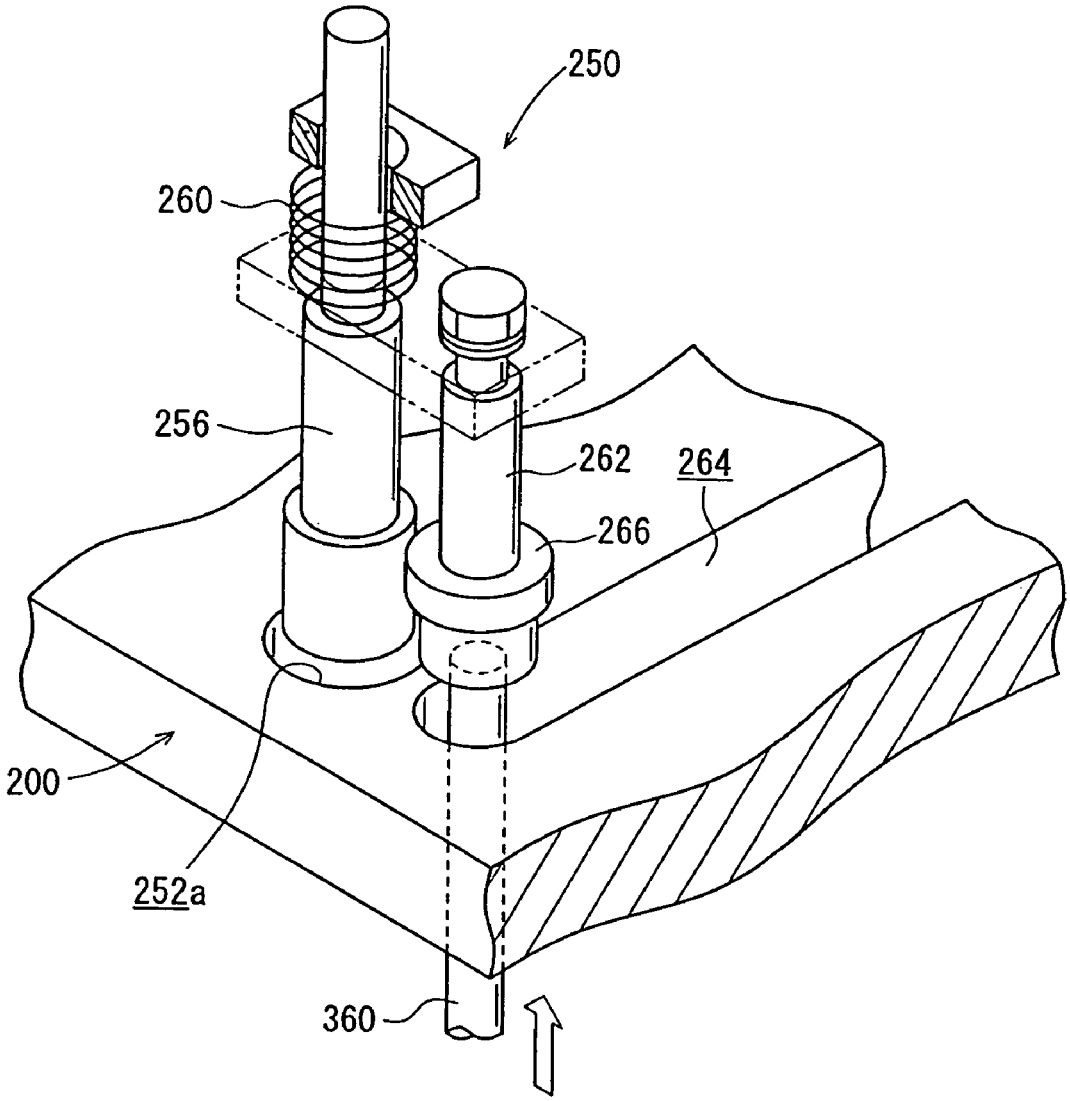
FIG. 60 is a perspective view showing the manner in which an operating pin is pressed by a drive rod of the moving mechanism.

The cylinder 356 is actuated to project the drive rod 360 upwardly, pushing up the operating pin 262 disposed on the base 254 on which the block wrapper 60 is mounted. Since the lock pin 256 is integrally coupled to the operating pin 262, the lock pin 256 is moved upwardly out of the first hole 252*a* defined in the first unit body 200, as shown in FIG. 60. Then, as shown in FIG. 18, the movable base 352 moves on the moving base 348 toward the core 28 in the direction indicated by the arrow C2, causing the drive rod 360 to move the block wrapper 60 from the retracted position P2 to the winding position P1.

When the movable base 352 is placed in a given position, the cylinder 356 moves the drive rod 360 downwardly. The operating pin 262 is released, allowing the lock pin 256 to move downwardly under the bias of the spring 260 and fit in the second hole 252*b* defined in the first unit body 200. The block wrapper 60 is now fixedly positioned at the winding position P1.

Similarly, other block wrappers 60 are moved from the retracted position P2 to the winding position P1. In this manner, a certain number of block wrappers 60 corresponding to the axial length of the core 28 are automatically replaced. The positions of the block wrappers 60 are detected by the respective position confirmation sensors 362.

A predetermined number of, e.g., 14, block wrappers 60 are thus placed in the axial directions of the core 28, i.e., in the directions indicated by the arrow D, and each of the block wrappers 60 is movable by the moving mechanism 62 in the directions indicated by the arrow C which are transverse to the directions indicated by the arrow D. A predetermined number of block wrappers 60 are placed in a forward position, i.e., the winding position P1, for handling cores 28 of different axial lengths. Therefore, the block wrappers 60 do not extend outside of the width of the elongate raw film 16, making it easy to reduce the overall size of the film winding apparatus 10.

Since each of the block wrappers 60 may only be movable between the retracted position P2 and the winding position P1, the moving mechanism 62 for moving each of the block wrappers 60 may comprise a rodless cylinder as the movable base 352. This arrangement is effective to make the required wiring and control process simpler than would be if servomotors or the like were incorporated in the respective block wrappers 60 for individually controlling the block wrappers 60 in the directions indicated by the arrow D.

The lock mechanism 250 is used to fixedly position each of the block wrappers 60 selectively in the retracted position P2 and the winding position P1. The lock mechanism 250 has the first and second holes 252*a*, 252*b* defined in the first unit body 200 and the lock pin 256 movably mounted on the base 254. Therefore, the lock mechanism 250 is relatively simple and economical in structure.

The operating pin 262 is movable in unison with the lock pin 256 of the lock mechanism 250, and can be lifted and lowered by the drive rod 360 of the moving mechanism 62. When the operating pin 262 is lifted by the drive rod 360, the lock pin 256 is displaced out of the first hole 252*a* or the second hole 252*b*, and simply when the drive rod 360 is moved along the groove 264 defined in the first unit body 200, each of the block wrappers 60 is smoothly and efficiently brought selectively into the retracted position P2 and the winding position P1.

It is thus possible to bring a certain number of block wrappers 60 depending on a change in the axial length of the core 28 into the winding position P1 with the simple arrangement and control process. Particularly, the elongate film 24*a* can be wound highly accurately and efficiently around various cores 28 of different axial lengths.

According to the first embodiment, furthermore, the first unit body 200 and the second unit body 406 can quickly be switched around for winding the elongate film 24*a* around the core 28 in the direction opposite to the above direction, i.e., in the clockwise direction.

When an empty transfer carriage 900 is placed in the unit replacing station ST2, as shown in FIGS. 21 and 22, the attachment plate 944 is moved forward by the cylinders 942 to insert the lock pins 940 into the positioning holes 936*a*, for example, defined in one of the longitudinal ends of the moving unit 906, and connect the air coupler 938 to the air coupler 910*a*. The transfer carriage 900 is now firmly positioned in the unit replacing station ST2 without the danger of being toppled.

Figure 61:
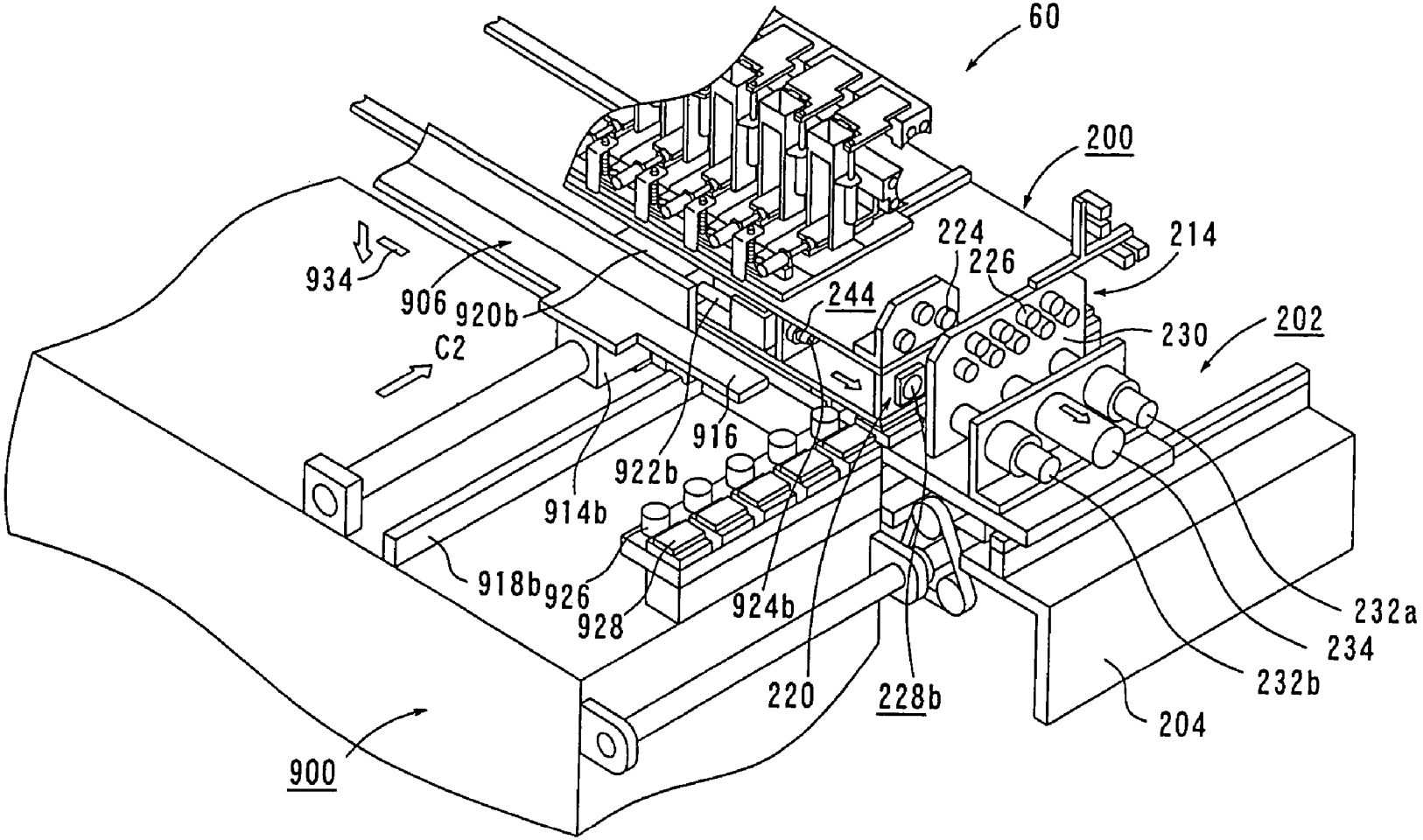
FIG. 61 is a perspective view showing the manner in which a moving unit on the transfer carriage engages the first unit body.
Figure 62:
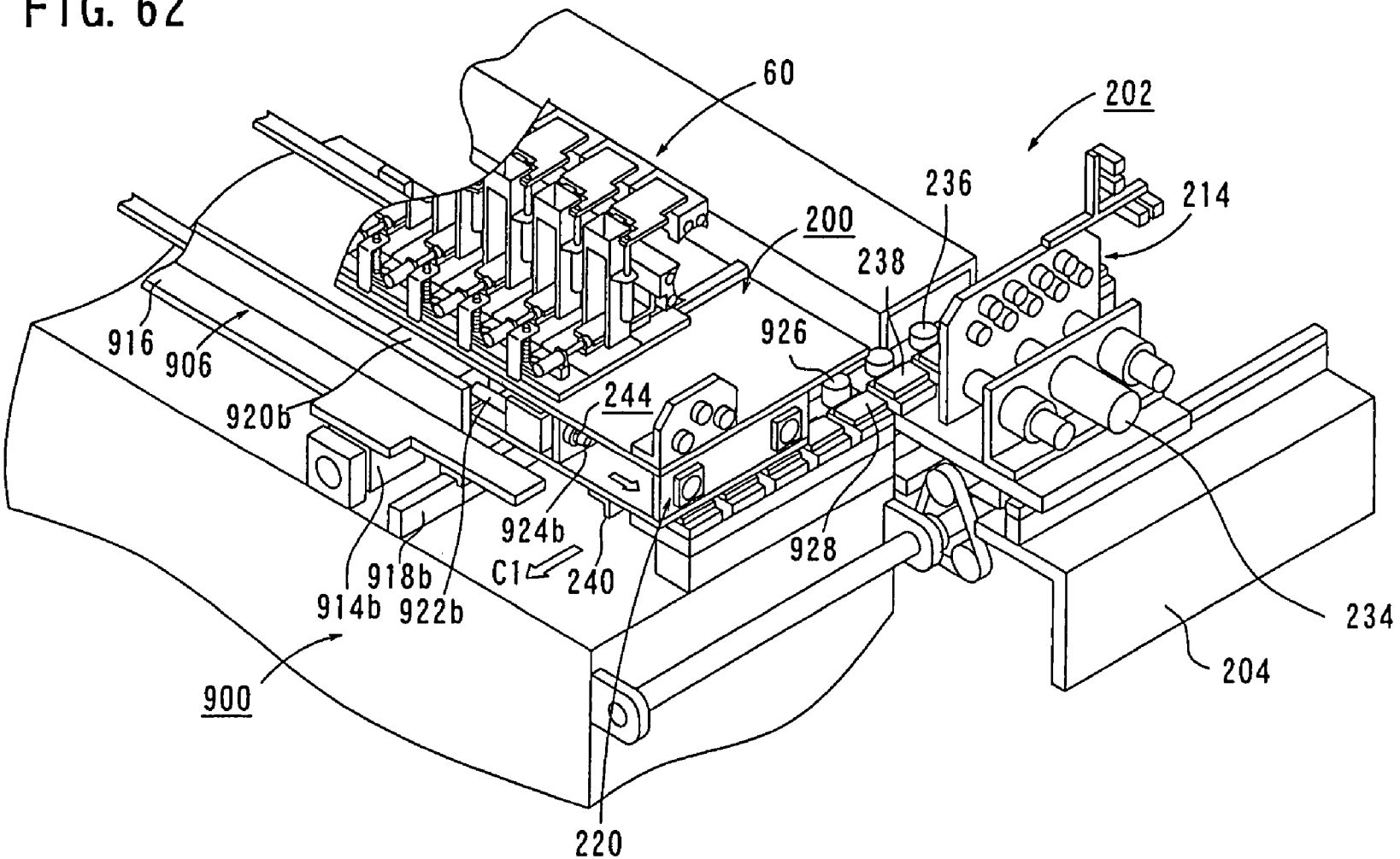
FIG. 62 is a perspective view showing the manner in which the first unit body is drawn onto the transfer carriage by the moving unit.

Then, the cylinder 930 of the lock unit 908 is actuated to lower the stopper 934, and the rodless cylinders 914*a*, 914*b* of the moving unit 906 are actuated. As shown in FIG. 61, the movable base 916 is moved toward the first unit body 200 in the direction indicated by the arrow C2 while being guided by the linear guides 918*a*, 918*b*, and the hooks 924*a*, 924*b* enter the first unit body 200 into alignment with the holes 244. The cylinders 920*a*, 920*b* are then actuated to displace the hooks 924*a*, 924*b* away from each other into the respective holes 244.

The cylinders 234 of the first drive unit 202 are actuated to move the joint plates 230 away from each other, releasing the air couplers 226 from the air couplers 224 and also releasing the lock pins 232*a*, 232*b* out of the holes 228*a*, 228*b*. Thus, the unit locks 222 releases the first unit body 200, and the air couplers 224, 226 are separated from each other.

The rodless cylinders 914*a*, 914*b* are actuated to move the movable base 916 which holds the first unit body 200 away from the first drive unit 202 in the direction indicated by the arrow C1. At this time, the receivers 240 of the first unit body 200 are guided by the cam followers 236 and the roller guides 238 of the first drive unit 202 and the cam rollers 926 and the roller guides 928 of the transfer carriage 900, and transferred smoothly from the first drive unit 202 onto the transfer carriage 900. Then, as shown in FIG. 22, the cylinder 930 of the lock unit 908 is actuated to project the stopper 934 upwardly into engagement with the first unit body 200, preventing the first unit body 200 from falling off the transfer carriage 900.

After the first unit body 200 is placed on the transfer carriage 900, the cylinders 942 in the unit replacing station ST2 are actuated to retract the attachment plate 944, releasing the lock pins 940 out of the positioning holes 936*a* and also releasing the air coupler 938 from the air coupler 910*a*. The transfer carriage 900 with the first unit body 200 placed thereon is taken out of the unit replacing station ST2 into the unit replacing station ST1 (see FIG. 3).

In the unit replacing station ST1, as in the unit replacing station ST2, an empty transfer carriage 900 is placed, and the second unit body 406 mounted on the second drive unit 401 is discharged onto the transfer carriage 900. The second unit body 406 which is placed on the transfer carriage 900 is delivered from the unit replacing station ST1 to the unit replacing station ST2.

When the transfer carriage 900 with the second unit body 406 placed thereon is brought into the unit replacing station ST2, the air coupler 938 is connected to the air coupler 910*a* (or 910*b*) and various actuators on the transfer carriage 900, i.e., the rodless cylinders 914*a*, 914*b* and the cylinders 920*a*, 920*b*, 930, can be supplied with drive air. Then, the lock unit 908 is actuated to move the stopper 934 downwardly to release the second unit body 406. Thereafter, the rodless cylinders 914*a*, 914*b* are actuated to move the second unit body 406 in unison with the movable base 916 toward the first drive unit 202.

The cylinders 234 of the first drive unit 202 to connect the first drive unit 202 to the joints 220 of the second unit body 406, after which the cylinders 920*a*, 920*b* are actuated to release the hooks 924*a*, 924*b* out of the holes 244. The rodless cylinders 914*a*, 914*b* are actuated to release the movable base 916 from the second unit body 406 and retract the movable base 916 onto the transfer carriage 900. The second unit body 406 is now mounted on the first drive unit 202. Similarly, the first unit body 200 is mounted on the second drive unit 401.

Figure 63:
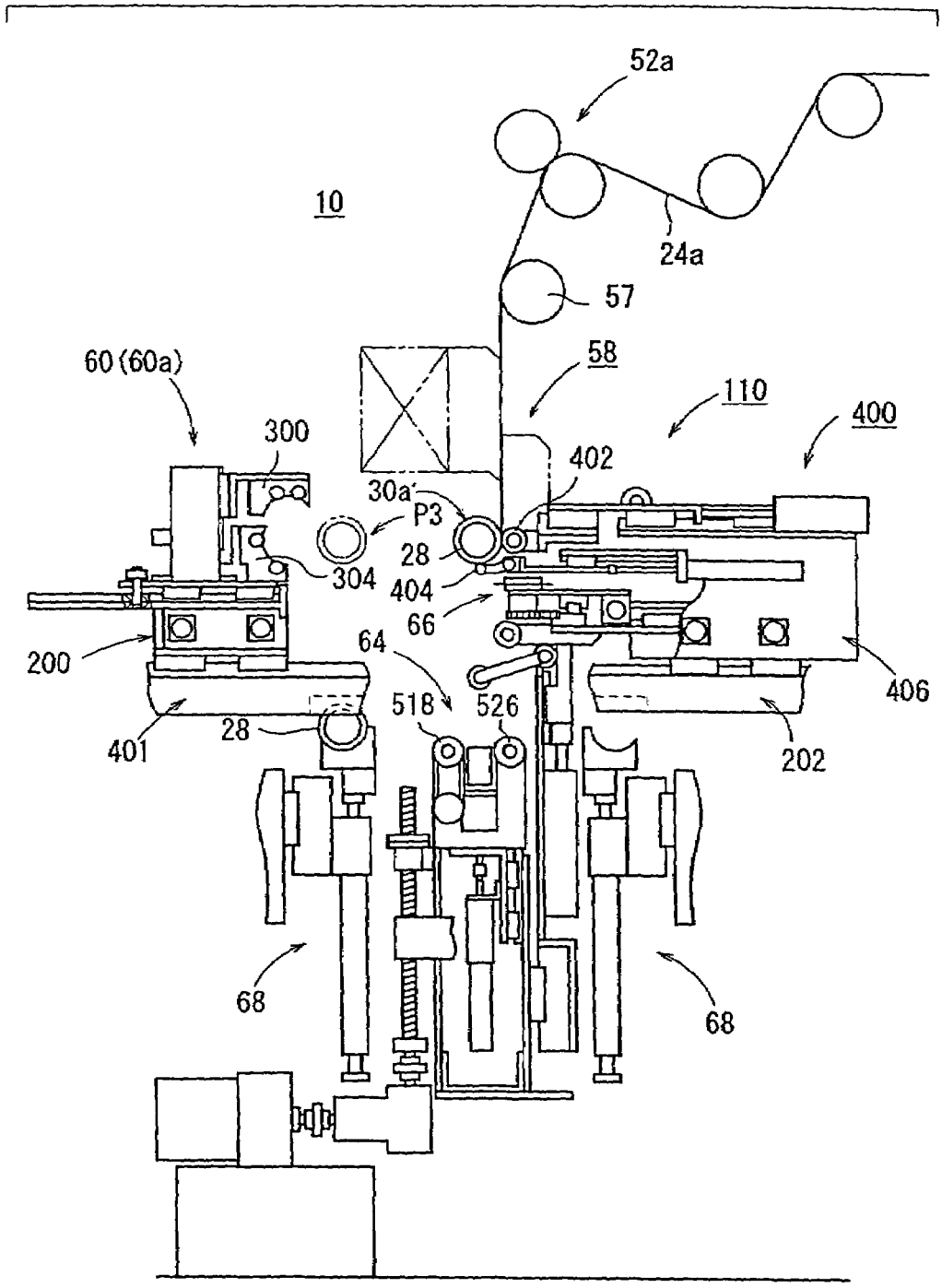
FIG. 63 is an elevational view showing the manner in which first and second unit bodies are installed respectively on first and second drive units and the elongate film is wound clockwise around the core.

As shown in FIG. 63, with the second unit body 406 mounted on the first drive unit 202 and the first unit body 200 mounted on the second drive unit 401, the switching roller 57 is positioned near the first drive unit 202 due to a change in the winding direction.

With the outer circumferential surface of the core 28 held by the block wrappers 60, the winding nip rollers 402, and the lower winding rollers 404, the servomotor 92 is energized to rotate the core chuck 90*a* in the direction opposite to the direction described above. The core 28 is rotated to wind the elongate film 24*a* clockwise to a given length therearound, producing a roll 30*a*'.

According to the first embodiment, as described above, the winding mechanism 110 is divided into the first unit body 200 incorporating the block wrappers 60 and the second unit body 406 incorporating the winding nip roller unit 400, and the first and second unit bodies 200, 406 have the respective joints 220 which are of identical construction.

Therefore, when the first unit body 200 is mounted on the first drive unit 202 and the second unit body 406 is mounted on the second drive unit 401, it is possible to wind the elongate film 24*a* counterclockwise around the core 28. When the first unit body 200 is mounted on the second drive unit 401 and the second unit body 406 is mounted on the first drive unit 202, it is possible to wind the elongate film 24*a* clockwise around the core 28.

Consequently, by selectively and replaceably mounting the first and second unit bodies 200, 406 on the first and second drive units 202, 401, the elongate film 24*a* can easily be wound around the core 28 with the coated surface facing inside or outside. Thus, the winding direction of the elongate film 24*a* can smoothly and quickly be changed. Since the first and second unit bodies 200, 406 can selectively be mounted on the first and second drive units 202, 401 using the joints 220 of identical construction, their structure is highly simple and economical.

The transfer carriage 900 is used for unit replacement, and the first and second unit bodies 200, 406 can automatically and quickly be replaced by actuating the moving unit 906 on the transfer carriage 900. Since the transfer carriage 900 has the lock unit 908 for locking the first unit body 200 or the second unit body 406, the first unit body 200 or the second unit body 406 is prevented from falling off the transfer carriage 900 when the transfer carriage 900 is moved.

The transfer carriage 900 does not incorporate a drive air source for actuating the moving unit 906 and the lock unit 908, but is supplied with drive air from the external drive air source via the air coupler 910*a* or 910*b* connected to the air coupler 938. Thus, the transfer carriage 900 is simplified in structure, can be operated easily, and is economical.

Similarly, the first and second unit bodies 200, 406 do not incorporate a drive air source for actuating their actuators, but are supplied with drive air from the external drive air source via the air coupler 226 of the first and second drive units 202, 401 which is connected to the air coupler 224. Thus, the first and second unit bodies 200, 406 are simplified in structure. The joints 220 of the first and second unit bodies 200, 406 have the unit locks 222 which can fixedly position the first and second unit bodies 200, 406 highly accurately and reliably on the first and second drive units 202, 401.

For a core 28 of smaller outside, the first unit body 200*a* is used instead of the first unit body 200. Specifically, the block wrappers 60 incorporated in the first unit body 200 are used to wind the elongate film 24*a* around a 3-inch core 28, for example, and the block wrappers 60*a* incorporated in the first unit body 200*a* are used to wind the elongate film 24*a* around a smaller-diameter core 28, e.g., a 2-inch core 28.

After the first unit body 200 mounted on the first drive unit 202 is transferred onto the transfer carriage 900, the transfer carriage 900 with the first unit body 200*a* mounted thereon is placed at the first drive unit 202, and the first unit body 200*a* is installed on the first drive unit 202.

On the second unit body 406, the cross cutter blade 446 of the cutting mechanism 66 incorporated in the winding nip roller unit 400 is positionally adjusted upwardly with respect to the smaller-diameter core 28 by the lifting and lowering cylinder 443 in order to allow the end of the elongate film 24*a* cut by the cross cutter blade 446 to be reliably wound around the smaller-diameter core 28 through 90°.

The first unit bodies 200, 200*a* (or more first unit bodies) are thus available for various cores 28 of different outside diameters, and a selected one of the first unit bodies 200, 200*a* is mounted on the first drive unit 202 or the second drive unit 401. In this manner, a change in the outside diameter of the core 28 can easily and quickly be handled. The elongate film 24*a* can be wound around any one of two or more cores 28 having different outside diameters with the coated surface facing inside or outside, with a simple arrangement for an increased yield.

According to the first embodiment, furthermore, even when the direction in which the elongate film 24*a* is wound around the core 28 and the length by which the elongate film 24*a* is wound around the core 28 are changed, the winding mechanism 110 and the product receiving mechanism 64 do not interfere with the core rotating mechanism 58. Specifically, the radius of the core chucks 90*a*, 90*b* of the core rotating mechanism 58 are smaller than the radius of the outer circumferential surface of the core 28. Moreover, the take-up arms 88*a*, 88*b* are of an arcuate shape having a radius of curvature smaller than the radius of the outer circumferential surface of the core 28 in the regions J1, J2 (see FIG. 23) interfering with the ejection roller 518 and the free roller 526 of the product receiving mechanism 64 and the regions J3, J4 (see FIGS. 24 and 25) interfering with the winding nip rollers 402 and the lower winding rollers 404 of the winding mechanism 110 when the elongate film 24*a* is wound counterclockwise and clockwise.

Therefore, even when the length by which the elongate film 24*a* is wound around the core 28 is considerably small, the winding mechanism 110 and the product receiving mechanism 64 do not interfere with the core chucks 90*a*, 90*b* and the take-up arms 88*a*, 88*b*. Thus, changes in the width of the elongate film 24*a* and the outside diameter of the wound elongate film 24*a* can easily and reliably be coped with.

The winding nip rollers 402 and the lower winding rollers 404 of the winding mechanism 110 and the ejection roller 518 and the free roller 526 of the product receiving mechanism 64 are of dimensions equal to or greater than the maximum width of the elongate film 24*a*. Therefore, even when the width of the elongate film 24*a* is changed, the pressure between the contact surfaces of the roll 30*a* and the ejection roller 518 and the free roller 526 does not increase, effectively preventing the surface of the roll 30*a*, i.e., the film emulsion surface of a roll which has an outer coated surface, from being damaged.

When the width of the elongate film 24*a* is changed, it is not necessary to change the sizes of the winding nip rollers 402 and the lower winding rollers 404, and the sizes of the ejection roller 518 and the free roller 526. Therefore, the equipment that is used is relatively simple and economical.

The interfering regions J1 through J4 are set to fall in the lower range of 180° of the outer circumferential surface of the core 28, and the take-up arms 88*a*, 88*b* are disposed in the remaining range of the outer circumferential surface of the core 28, i.e., in the upper range of 180° thereof. Consequently, even when the core rotating mechanism 58 is disposed in any position with respect to the axial direction of the core 28, i.e., in the transverse direction of the elongate film 24*a*), the core rotating mechanism 58 does not interfere with the winding mechanism 110 or the product receiving mechanism 64. Thus, changes in the winding direction of the elongate film 24*a* and the length by which the elongate film 24*a* is wound can easily and reliably be handled with a simple arrangement, making the entire apparatus highly adaptable.

As shown in FIGS. 8 and 9, when the cylinder 126 is actuated, the rod 124 is moved to radially expand and contract the wedge member 140. Therefore, the core chuck 90*b* can easily and reliably hold the inner circumferential surface of the core 28. When a smaller-diameter core 28 is used, the core chuck 90*b* is replaced with the core chuck 90*c* to handle such a smaller-diameter core 28 with ease.

For removing the core chuck 90*b* from the take-up arm 88*b*, the cover 178 is removed, and the mounting screws 172 are loosened to a given position, after which the rod fixing member 142 is moved along the oblong holes 174 radially of the rod 124. The distal end of the rod 124 is now moved within the rod hole 176 in the rod fixing member 142 from the smaller-diameter end to the larger-diameter end thereof, allowing the wedge member 140 and the rod fixing member 142 to be removed together from the rod 124.

On the fixing member 136, as shown in FIG. 10, when the mounting screws 150 are loosened to a given position, the support member 148 is moved away from the cylindrical member 144 under the bias of the springs 152. Therefore, the trapezoidal land 154 of the support member 148 is released from the trapezoidal groove 156 defined in the rotatable shaft 122, allowing the fixing member 136 to be removed from the rotatable shaft 122. Therefore, the core chucks 90*b*, 90*c* can easily and quickly be replaced, and the mounting screws 150, 172 are effectively prevented from being removed. The entire replacing process is highly simple.

According to the first embodiment, when the elongate films 24*a* through 24*d* of various widths are to be cut off the elongate raw film 16, the elongate films 24*a* through 24*d* are mixed together transversely across the elongate raw film 16. Specifically, as shown in FIGS. 64 and 65, an elongate film F1 having a maximum width H1, an elongate film F2 having a width H2, an elongate film F3 having a width H3, an elongate film F4 having a width H4, and an elongate film F5 having a width H5 can be cut off an elongate raw film having a width H.

Figure 64:
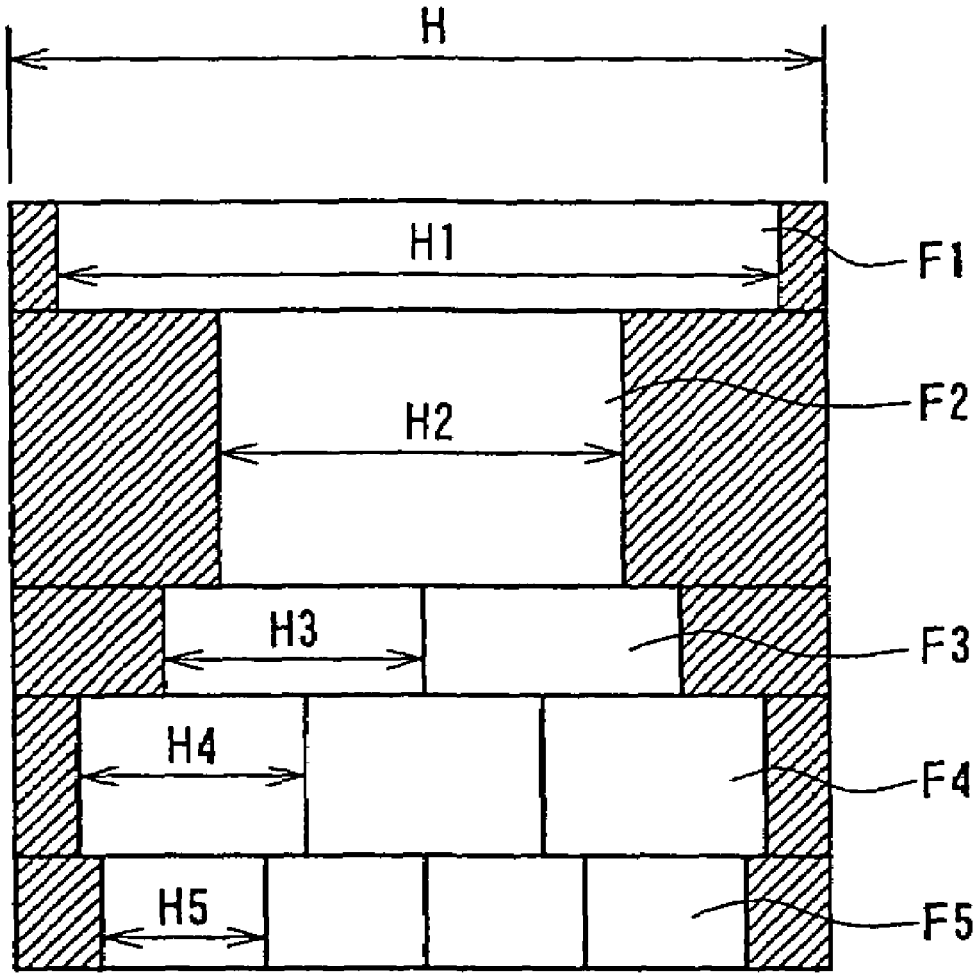
FIG. 64 is a view illustrative of the manner in which one type of elongate film is cut off transversely of an elongate raw film.
Figure 65:
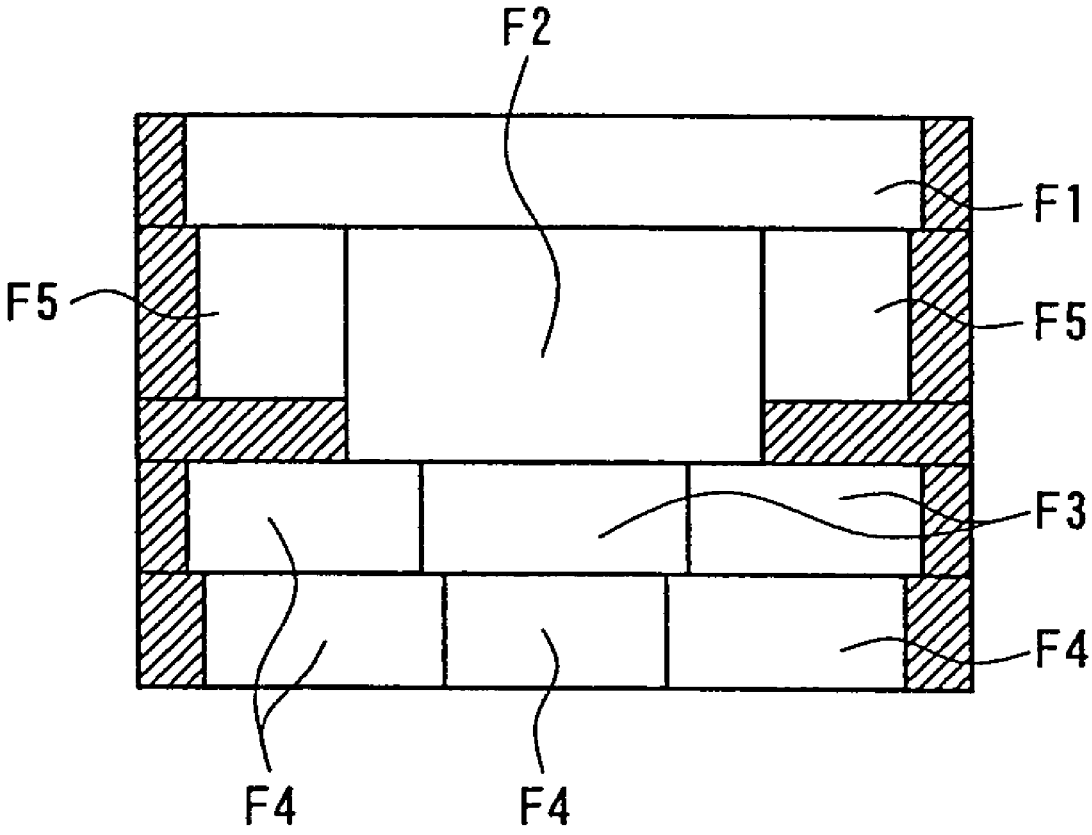
FIG. 65 is a view illustrative of the manner in which many types of elongate film are cut off transversely of an elongate raw film.

In FIG. 64, only one type of elongate films F1 through F5 is cut off the elongate raw film along each transverse cutting line. In FIG. 65, however, different types of elongate films F1 through F5 are cut off the elongate raw film along some transverse cutting lines. Therefore, elongate films F1 through F5 can be obtained from the elongate raw film at a greater yield according to the cutting pattern shown in FIG. 65 than according to the cutting pattern shown in FIG. 64.

Figure 93:
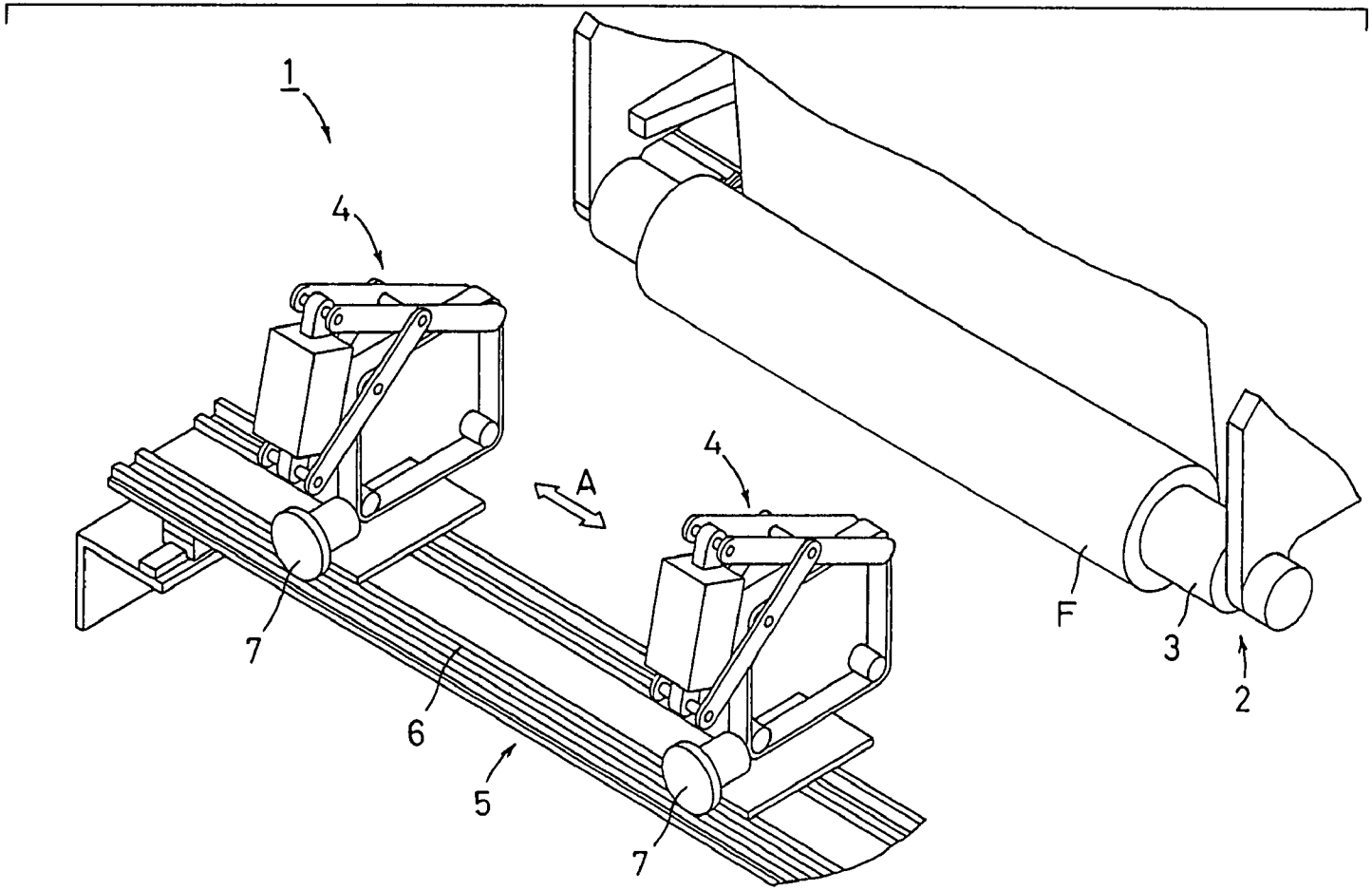
FIG. 93 is a perspective view of a moving mechanism for moving conventional belt wrappers.
Figure 94:
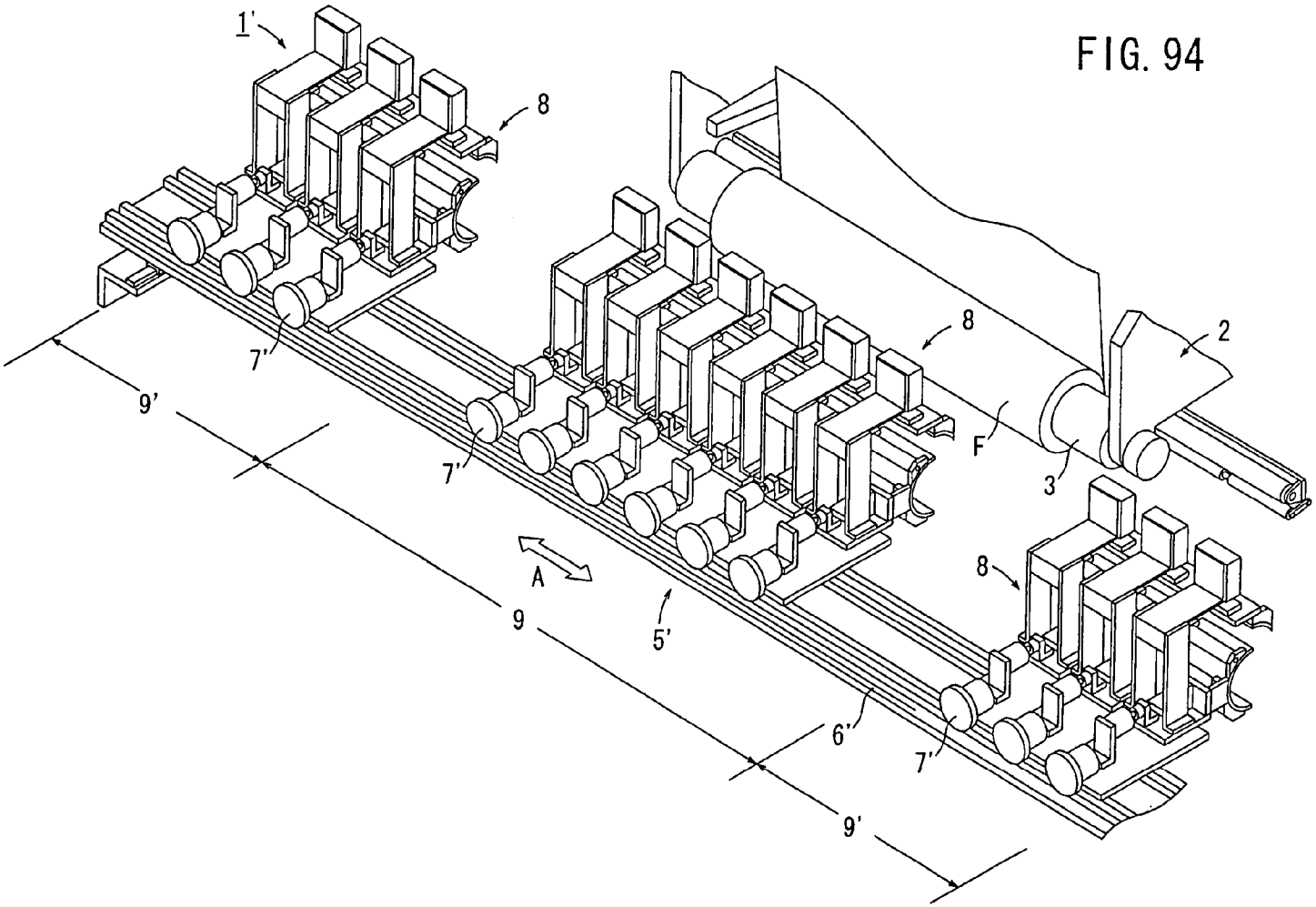
FIG. 94 is a perspective view of a moving mechanism for moving conventional block wrappers.
Figure 95:
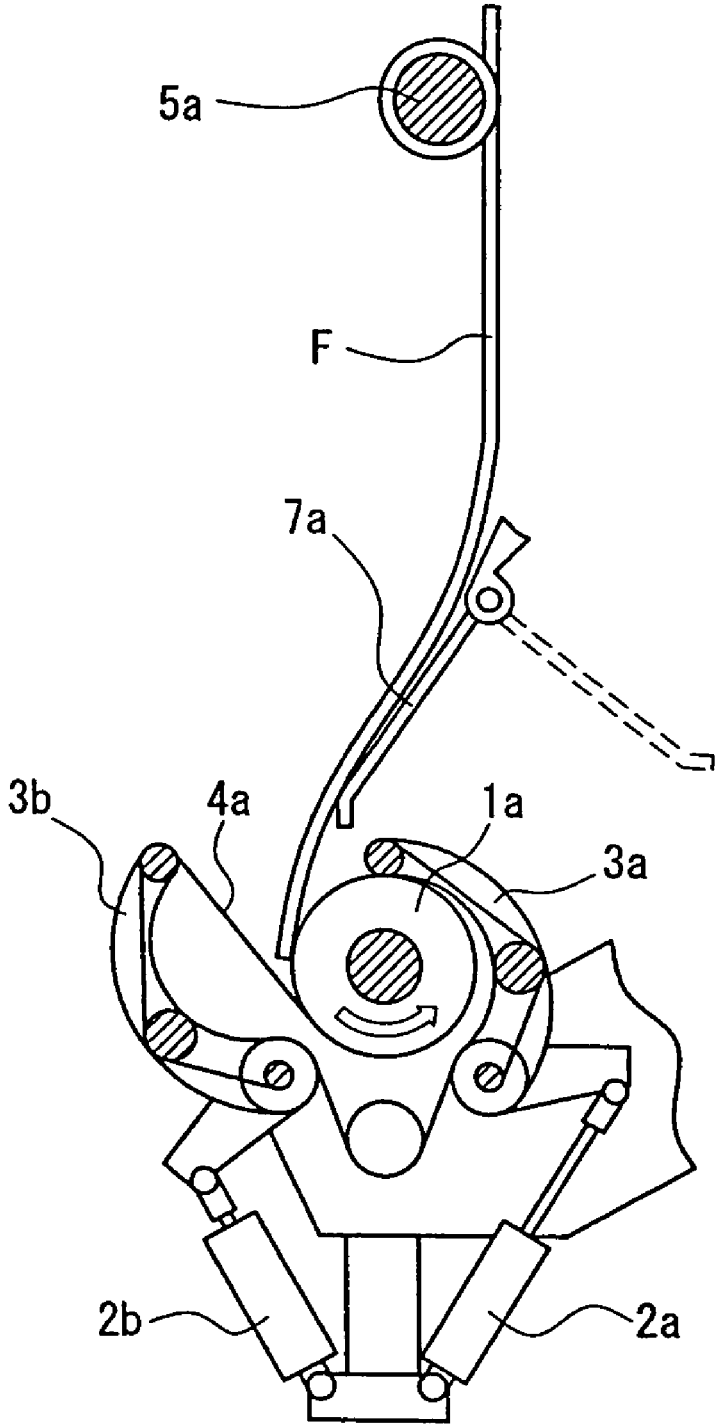
FIG. 95 is an elevational view of a conventional take-up apparatus.
Figure 96:
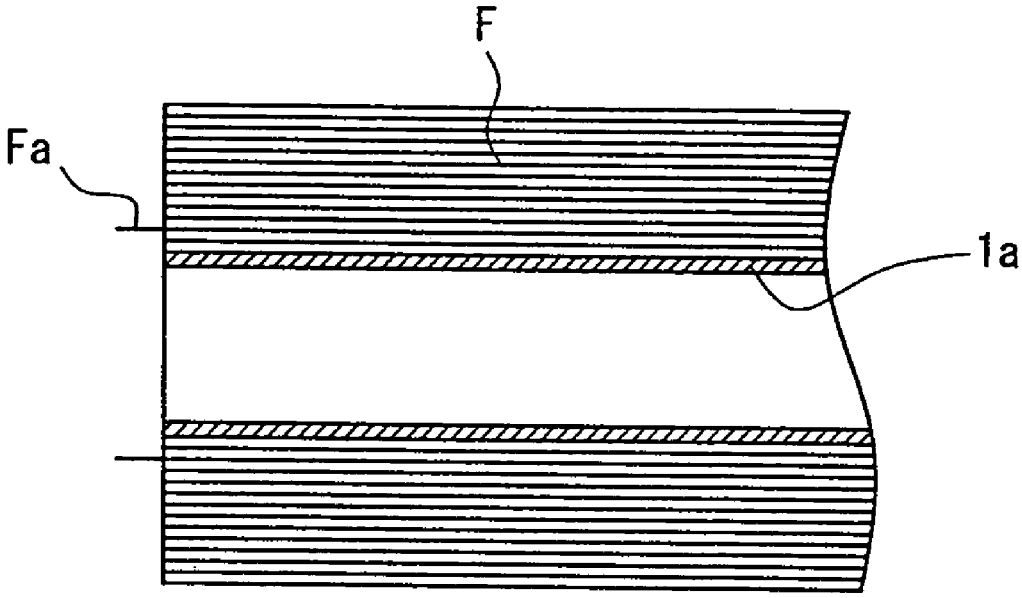
FIG. 96 is a fragmentary cross-sectional view showing a projecting edge of an elongate film wound around a core.
Figure 97:
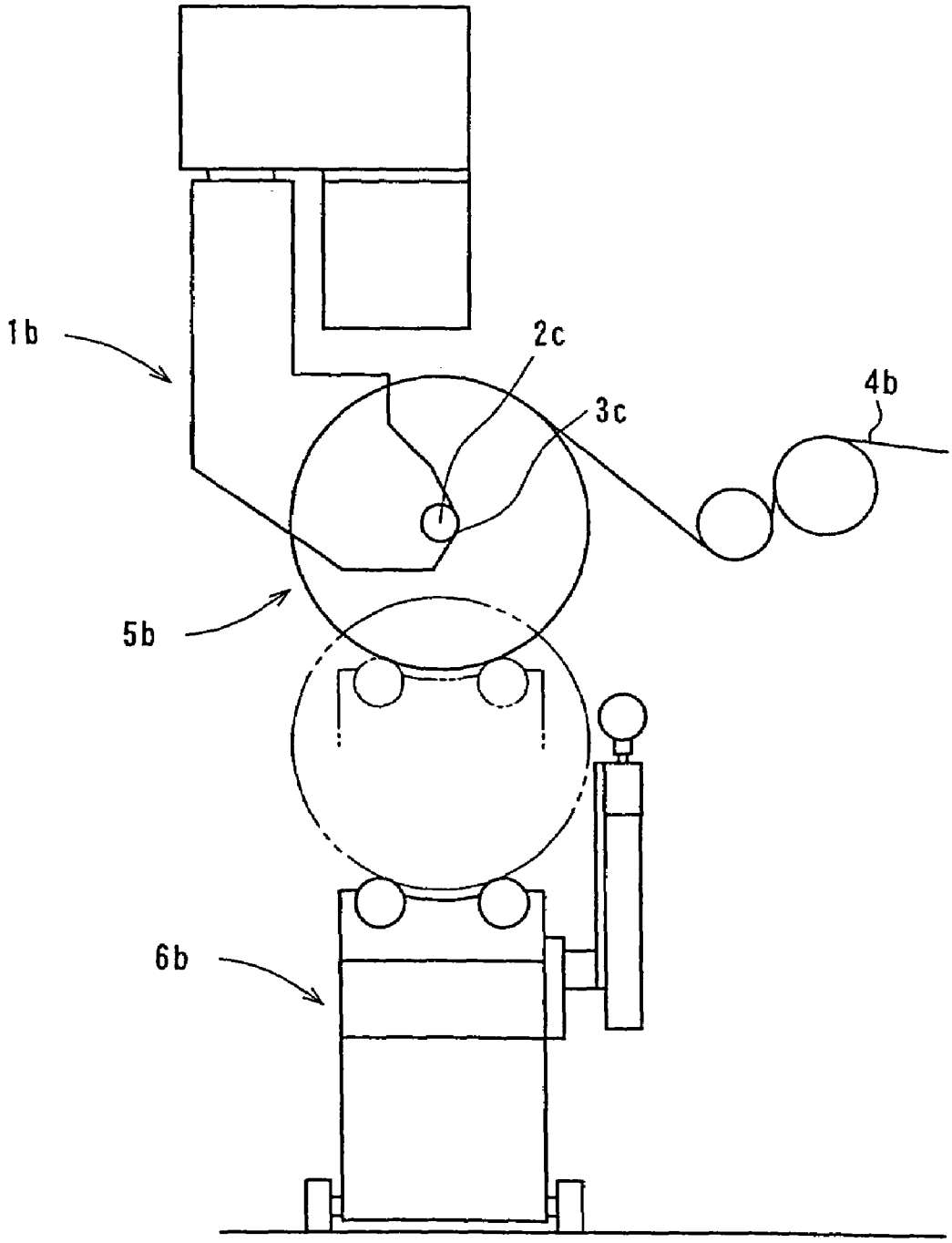
FIG. 97 is an elevational view of a conventional slitter apparatus.

In the first embodiment, the winding mechanism has the block wrappers 60. However, a plurality of belt wrappers 4 shown in FIG. 93, for example, may be arranged closely to each other and moved individually in the directions indicated by the arrows C in FIG. 18 by the moving mechanism 62.

Figure 66:
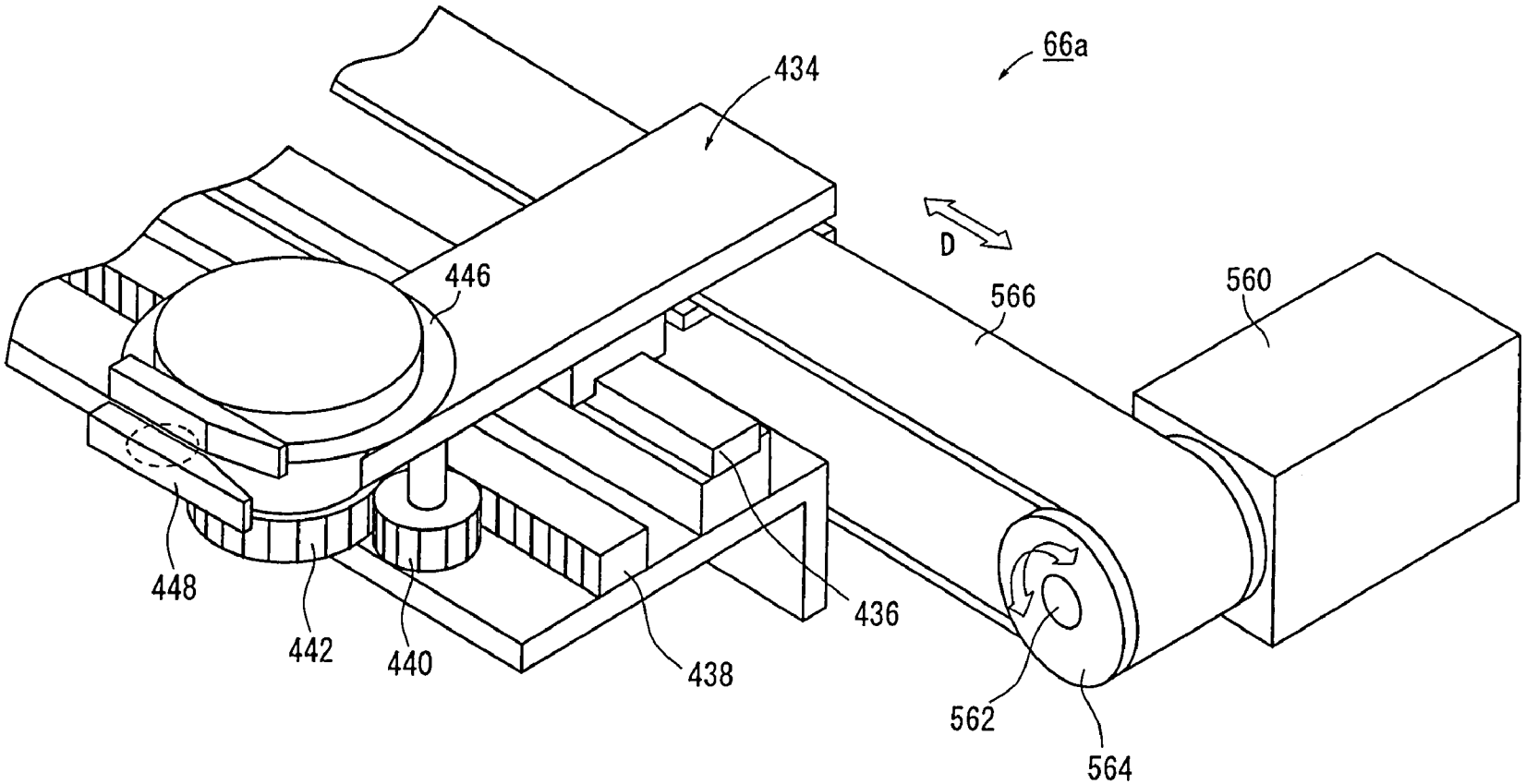
FIG. 66 is a perspective view of another cutting mechanism.

The cutting mechanism 66 shown in FIG. 20 may be replaced with a cutting mechanism 66*a* shown in FIG. 66. The cutting mechanism 66*a* has a servomotor 560 having a drive shaft 562 with a pulley 564 mounted thereon. A timing belt 566 is installed around the pulley 564 and fixed to the base member 434. The timing belt 566 is also installed around another pulley (not shown).

The cutting mechanism 66*a* operates as follows: When the servomotor 560 is energized, the timing belt 566 moves around the pulleys, causing the cross cutter blade 446 to cut off the elongate film 24*a*.

Figure 67:
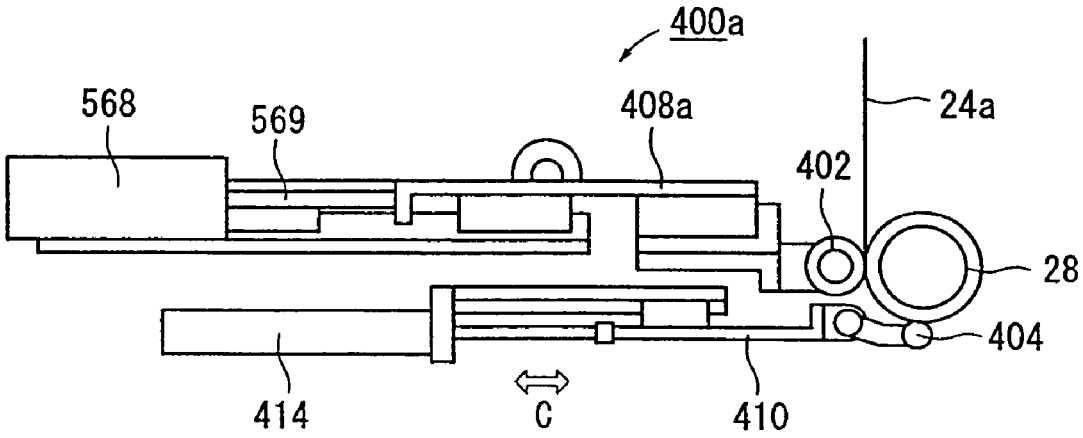
FIG. 67 is a view of another winding nip roller unit.

The winding nip roller unit 400 may be replaced with a winding nip roller unit 400*a* shown in FIG. 67. The winding nip roller unit 400*a* has a cylinder 568 for moving the winding nip roller 402 in the directions indicated by the arrow C. The cylinder 568 has a rod 569 extending therefrom and coupled to a movable upper plate 408*a* supporting the winding nip roller 402 thereon. The winding nip roller 402 is movable in unison with the movable upper plate 408*a* when the cylinder 568 is actuated.

A method of processing an edge according to the present invention will be described below with reference to a flowchart shown in FIG. 68.

As shown in FIG. 26, the control circuit 602 is supplied with data presenting the width of the edge 32, the thickness of the edge 32, and the specific gravity of the edge 32 from the computer 790 or on an off-line basis in step S51. Based on the supplied data, the control circuit 602 calculates a fully wound length (allowable wound length) based on a weight reference from the equipment strength limit/(width×thickness×specific gravity of the edge 32). The edge winding shaft 600*a* is rotated to wind the edge 32 therearound in step S52. Specifically, as shown in FIG. 30, the servomotor 718 is energized to cause the belt and pulley means 720 to rotate the rotatable cylinder 724, thereby winding the edge 32 around the radially expandable and contractible fingers 726*a* through 726*d*.

The control circuit 602 calculates the length of the roll 613 which is wound upon rotation of the edge winding shaft 600*a* based on an output signal from an encoder (not shown) on the suction drum 38 in step S53. If the wound length of the roll 613 becomes equal to the calculated fully wound length in step S54 (YES), then the edge winding shaft 600*a* is stopped against rotation in step S55.

Then, the cylinders 624*a*, 624*b* of the reserving mechanism 608 are actuated. As shown in FIG. 27, the slide base 628 is connected to the rods 626*a*, 626*b* extending from the cylinders 624*a*, 624*b*. The slide base 628 is moved in the direction indicated by the arrow X while being guided by the linear guides 622*a*, 622*b*. The free roller 618 whose opposite ends are supported on the slide base 628 is moved in the direction indicated by the arrow X with the edges 32 engaging the opposite ends of the free roller 618, moving the edges 32 as they are unwound from the edge winding shaft 600*a* to a given position in step S56. Actually, the distance that the free roller 618 is moved is set to a value corresponding to about two turns of the edges 32 around the edge winding shaft 600*a*.

After the free roller 618 is moved to the given position, as shown in FIG. 28, the nip roller 636 of the roller pair 610 is moved toward the backup roller 634 by the cylinders 650*a*, 650*b*. The edges 32 are now gripped by the nip roller 636 and the backup roller 634. Then, the cross-cutting mechanism 604 is actuated.

As shown in FIG. 29, the rodless cylinder 664 is moved along the guide bar 660 transversely across the elongate raw film 16 in the direction indicated by the arrow Y, guiding the edge 32 along the guide surfaces 678*a*, 687*b* of the base 668 to smoothly insert the edge 32 between the upper and lower blades 674, 676. At this time, since the upper blade 674 is rotated in the direction indicated by the arrow by the rack 666, the first pinion 670, and the second pinion 672, the edge 32 is transversely cut off by the upper blade 674 and the lower blade 676 in step S57.

After the edge 32 is cut off, as shown in FIGS. 30 and 31, the drive unit 728 is actuated. Specifically, the cylinder 738 is actuated to move the drive rod 734 forward, causing the radially expandable and contractible fingers 726*a* through 726*d* coupled to the distal end of the drive rod 734 by the links 732 to swing about the pins 730 in a direction to reduce the diameter of the distal end of the edge winding shaft 600*a*, i.e., toward the center thereof. Therefore, there is formed a gap between the inner circumferential surface of the roll 613 wound around the edge winding shaft 600*a* and the outer circumferential surfaces of the radially expandable and contractible fingers 726*a* through 726*d*, the gap being progressively greater in the forward direction.

The drive unit 742 of the film edge discharging mechanism 606 is then actuated. Specifically, the cylinder 746 is actuated to move the pushing member 750 coupled to the rod 748 forward while being supported by the slide base 714. The support tube 764 is rotatably supported on the pushing member 750 by the bearings 762, and the pusher 740 is fixed to the support tube 764. Therefore, the pusher 740 is moved forward along the radially expandable and contractible fingers 726*a* through 726*d*, pushing the roll 613 wound around the radially expandable and contractible fingers 726*a* through 726*d* with the gap formed therebetween, off the edge winding shaft 600*a* into the storage box 614 in step S58.

Figure 69:
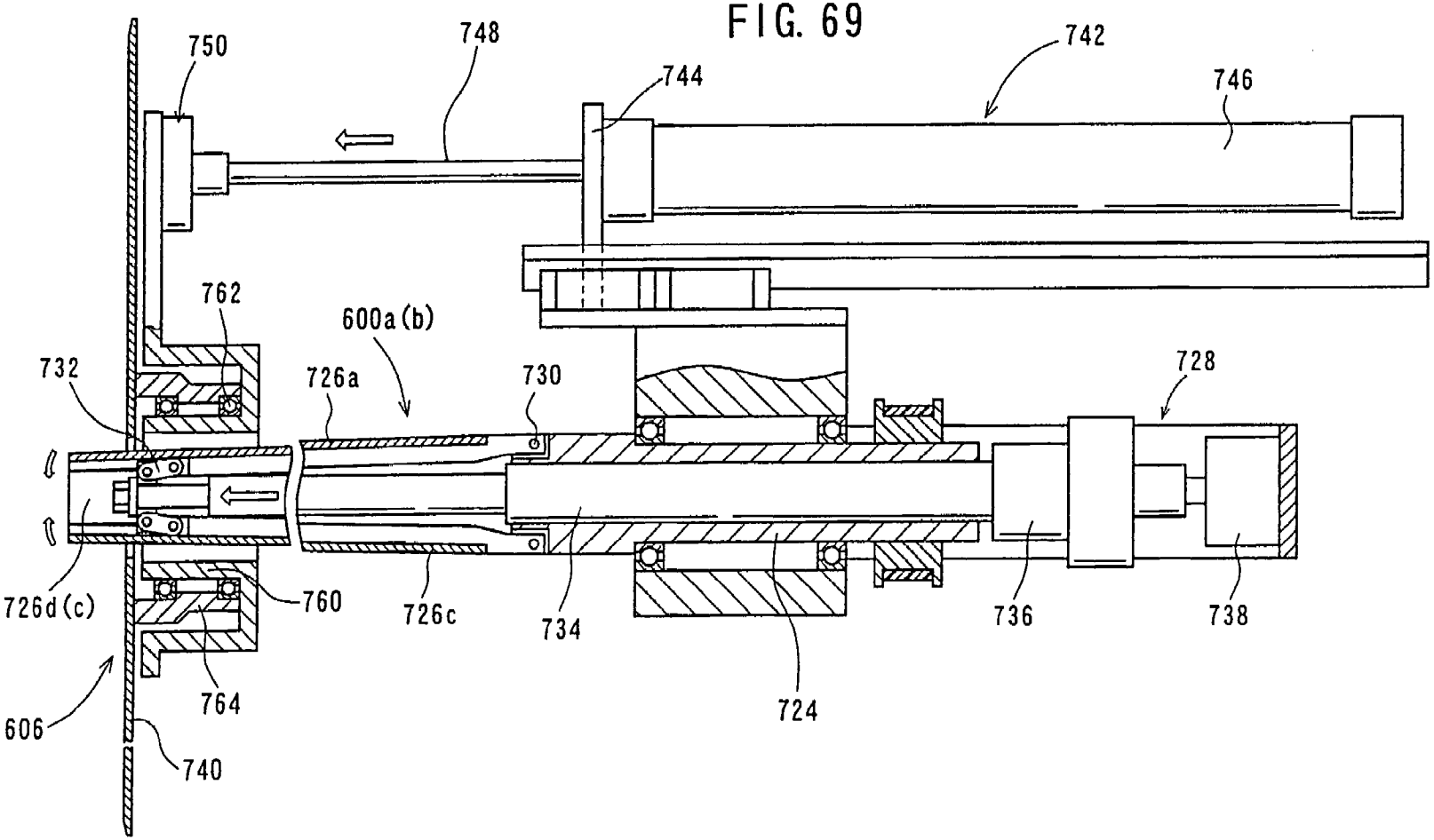
FIG. 69 is a cross-sectional view illustrative of the manner in which an edge winding shaft operates.
Figure 70:
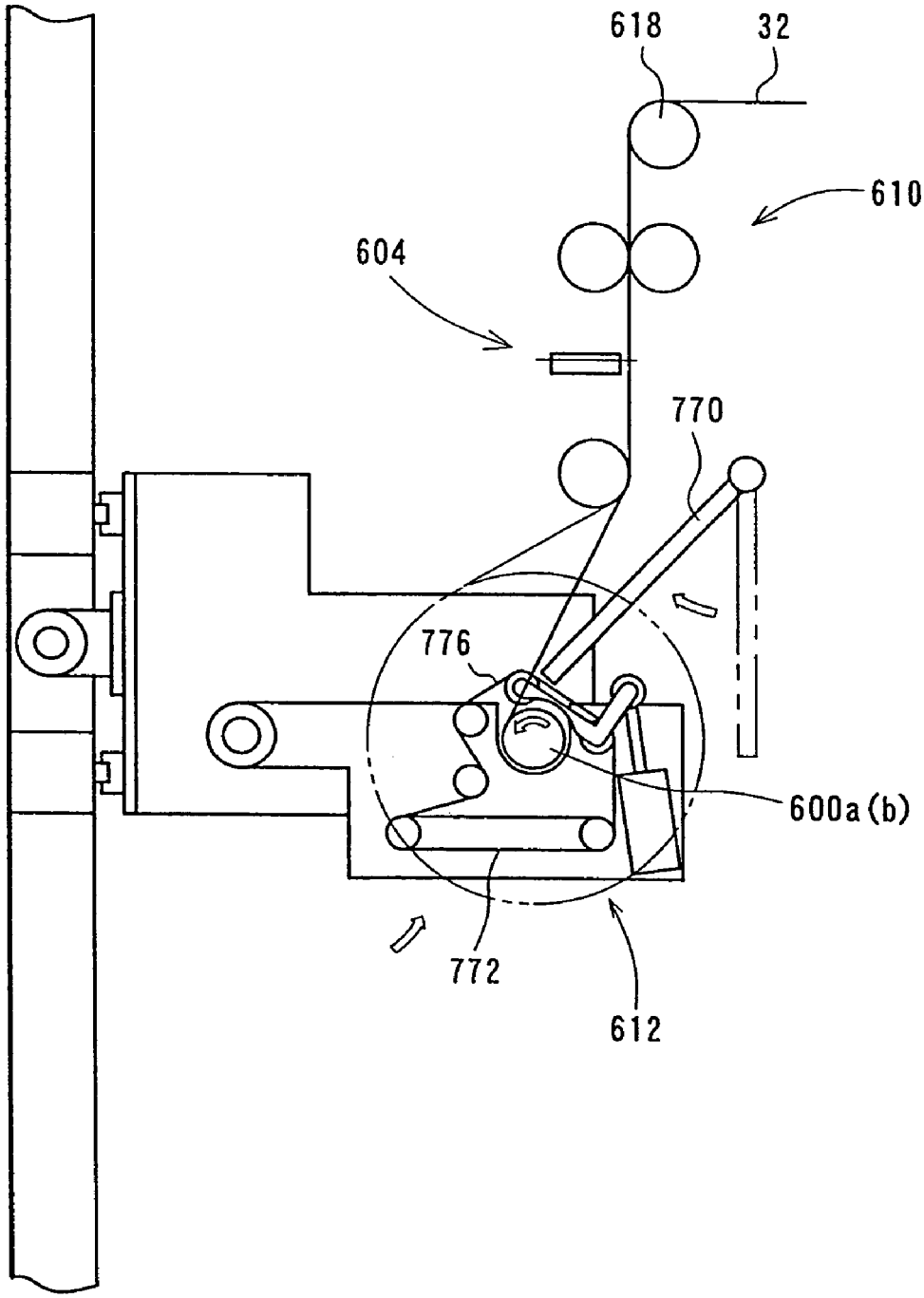
FIG. 70 is an elevational view illustrative of the manner in which a winding mechanism of the film edge processing apparatus operates.

At this time, as shown in FIG. 69, the distal ends of the radially expandable and contractible fingers 726*a* through 726*d* are swung to be contracted toward each other, allowing the roll 613 to be released easily and reliably from the edge winding shaft 600*a*. Thus, the roll 613 is automatically retrieved from the edge winding shaft 600*a*. The pusher 740 has the hole 766 that is shaped complementarily to the expandable and contractible fingers 726*a* through 726*b*, with the protrusions 768 reliably pressing the circumferential surface of the roll 613. The roll 613 is thus reliably automatically discharged from the edge winding shaft 600*a*.

After the roll 613 is discharged from the edge winding shaft 600*a*, the cylinder 746 is actuated in the reverse direction, moving the pusher 740 in unison with the pushing member 750 backward into a given retracted position. The edge 32 drawn into the reserving mechanism 608 is delivered to the edge winding shaft 600*a*.

Specifically, as shown in FIG. 28, when the torque motor 638 is energized, the backup roller 634 is rotated to feed the edges 32 gripped between the backup roller 634 and the nip roller 636 toward the edge winding shaft 600*a*. At the same time, as shown in FIG. 27, the cylinders 624*a*, 624*b* are actuated to move the free roller 618 toward the roller pair 610, and the edges 32 are delivered to the roller pair 610.

When the end of the edge 32 is delivered to the edge winding shaft 600*a*, as described above, the guide member 770 of the winding mechanism 612 is swung toward the edge winding shaft 600*a*, and the belt wrapper 772 is swung toward the edge winding shaft 600*a*, causing the belt 776 to engage the outer circumferential surface of the edge winding shaft 600*a*. Therefore, the end of the edge 32 is reliably fed to the edge winding shaft 600*a* while being guided by the guide member 770, and when the edge winding shaft 600*a* is rotated, the edge 32 is well wound around the edge winding shaft 600*a* by the belt wrapper 772.

It is thus possible to automatically and reliably wind the end of the edge 32 around the edge winding shaft 600*a*. After the edge 32 is wound by a certain weight around the edge winding shaft 600*a*, the guide member 770 and the belt wrapper 772 are retracted away from the edge winding shaft 600*a*.

In the first embodiment, as described above, the edge 32 is wound by a certain weight around the edge winding shaft 600*a*, the edge is automatically cut off by the cross-cutting mechanism 604, and the roll 613 wound around the edge winding shaft 600*a* is automatically discharged into the storage box 614 by the film edge discharging mechanism 606. The process of processing the edge 32 is thus easily automatized, greatly reducing the burden on the operator. It is not necessary to shut off the film processing and cutting machine 12, which would otherwise need to be shut off if the roll 613 were manually processed, thereby making it possible to perform the overall film processing process efficiently. Since the overall film processing process can easily be carried out without being attended by operators, the cost of processing the film is effectively reduced.

The weight of the roll 613 wound around the edge winding shaft 600*a* can be set to a weight more than the weight that can be carried by the operator. For example, whereas the weight that can be carried by the operator is limited to 147 N (Newton), the weight limit for the roll 613 in view of the equipment strength limit can be increased to 245 N (Newton), for example. Therefore, the roll 613 is removed from the edge winding shaft 600*a* less frequently, resulting in an increase in the operating efficiency.

If the distance between the edge winding shafts 600*a*, 600*b* is too small to cause the roll 613 to drop, then the edge winding units 700*a*, 700*b* which incorporate the edge winding shafts 600*a*, 600*b* are moved apart from each other. Specifically, as shown in FIG. 29, the servomotor 706 of the moving unit 704 is energized to rotate the ball screw 710, causing the nut 712 threaded over the ball screw 710 to move the slide base 714 along the support frame 702. After the edge winding shafts 600*a*, 600*b* are spaced away from each other, the rolls 613 wound around the edge winding shafts 600*a*, 600*b* by the respective film edge discharging mechanisms 606 are automatically dropped into the storage box 614 (see FIG. 32).

In the first embodiment, the process of automatically discharging the roll 613 according to the weight reference of the roll 613 has been described above. However, the roll 613 may be automatically discharged based on the fully wound length based on the weight limit of the roll 613 and the maximum wound length. Specifically, if the maximum wound radius of the roll 613 wound around the edge winding shaft 600*a* due to mechanical limitations is represented by MD and the radius of the outer circumference of the edge winding shaft 600*a* by D, then the maximum wound length of the roll 613 is calculated based on ($\pi MD^2 - \pi D^2$).

Figure 68:
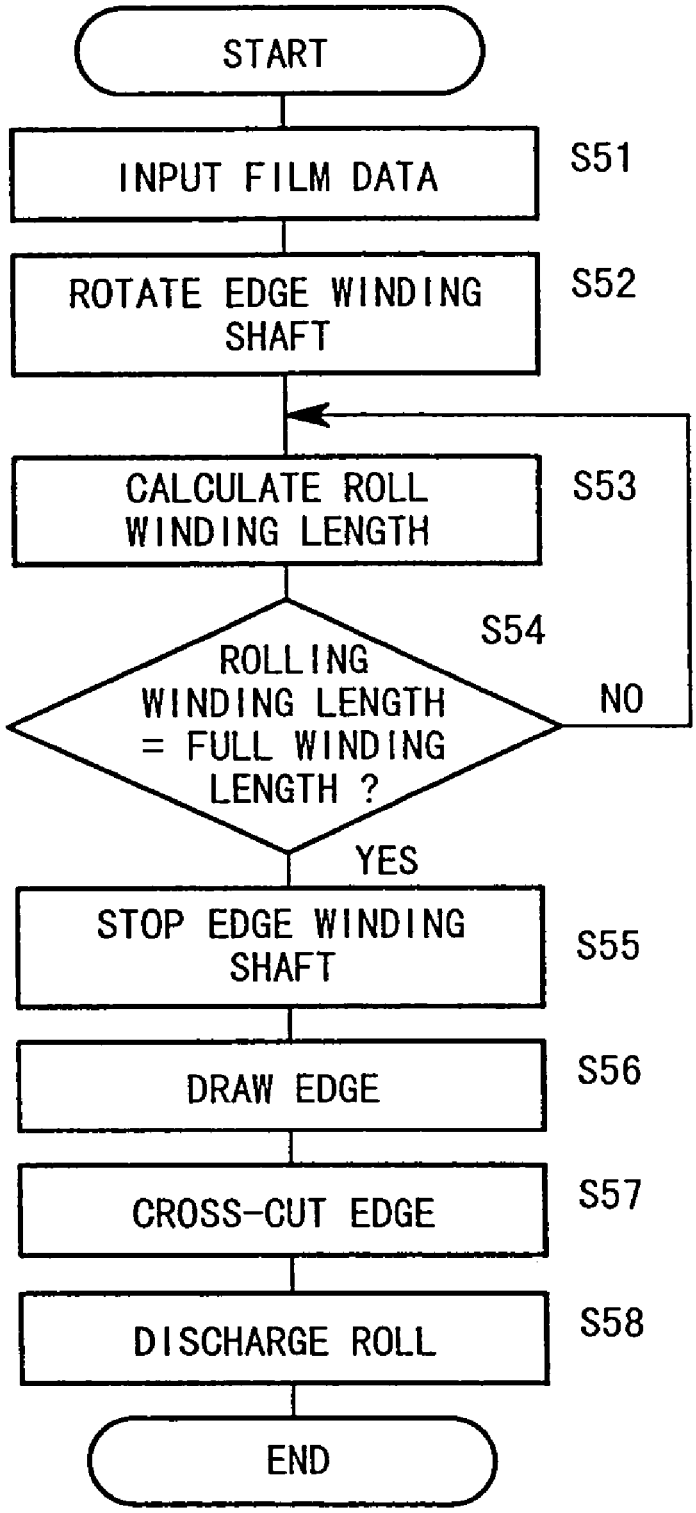
FIG. 68 is a flowchart of a process of processing a film edge.

Then, the fully wound length based on the weight limit and the maximum wound length are compared with each other, and the shorter length is set as an allowable winding length, after which the process of automatically discharging the roll 613 is carried out according to the flowchart shown in FIG. 68. Thus, the roll 613 can automatically be discharged smoothly without exceeding the weight allowable by the equipment and without interfering with other equipment pieces.

Figure 71:
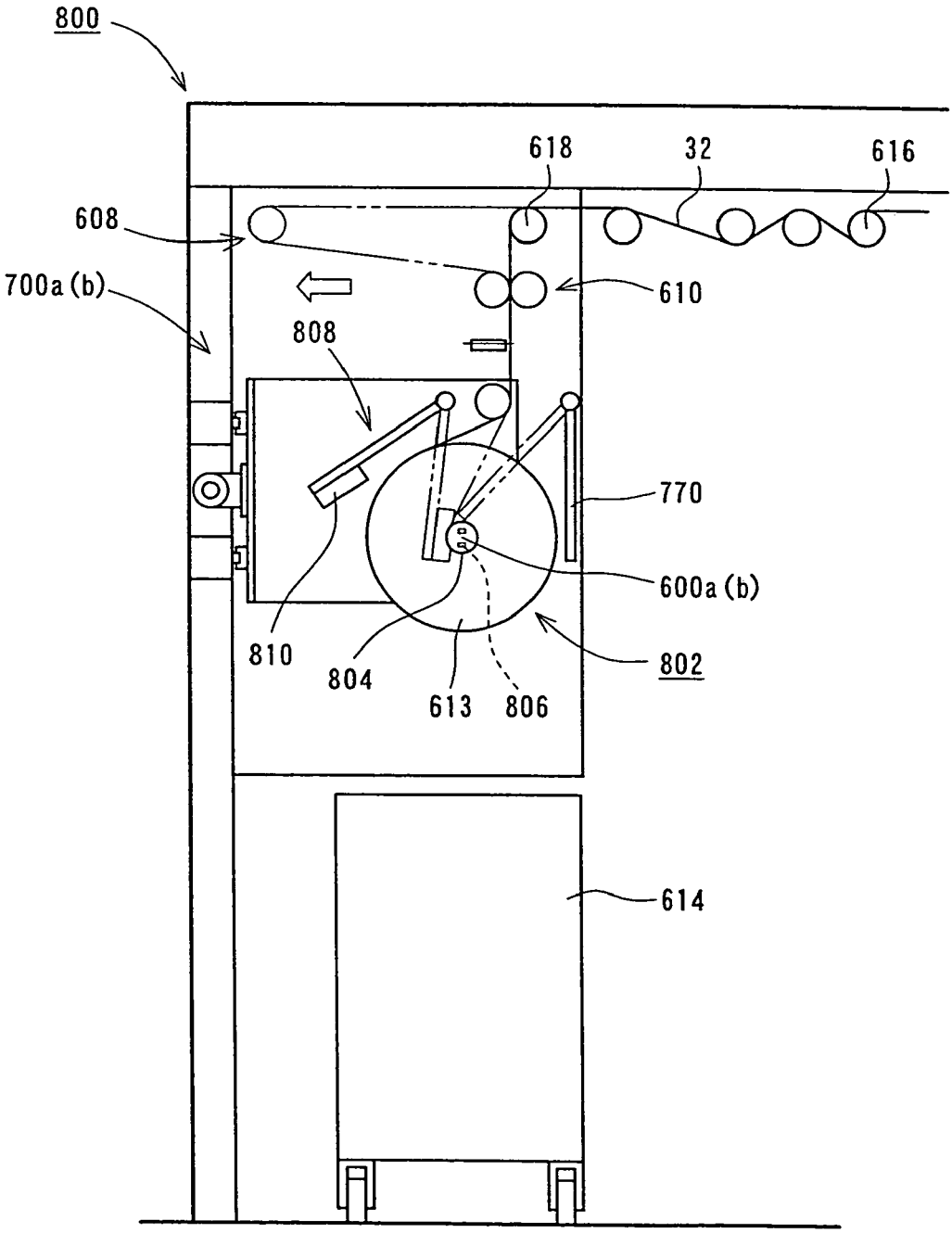
FIG. 71 is a schematic elevational view of a film edge processing apparatus according to a second embodiment of the present invention.

FIG. 71 shows in schematic elevation a film edge processing apparatus 800 according to a second embodiment of the present invention. Those parts of the film edge processing apparatus 800 which are identical to those of the processing apparatus 34 are denoted by identical reference characters, and will not be described in detail below.

The processing apparatus 800 has a winding mechanism 802 including an adhesive 804 to be coated on the outer circumferential surfaces of the edge winding shafts 600*a*, 600*b*, electric heating wires (heater) 806 mounted in the edge winding shafts 600*a*, 600*b* for heating the adhesive 804, and pressers 808 for pressing the edges 32 against the edge winding shafts 600*a*, 600*b*.

The adhesive 804 comprises a hot-melt adhesive whose adhesion capability increases with heat. The edge winding shafts 600*a*, 600*b* have their surfaces treated to increase the adhesion power of the adhesive 804 to a level greater than the edges 32. The pressers 808 are swingably mounted on the respective edge winding units 700*a*, 700*b*, and have cushion members 810 on their distal ends.

When the end of the edge 32 is delivered from the reserving mechanism 608 to the edge winding shaft 600*a*, the end of the edge 32 is guided by the guide member 770 from the reserving mechanism 608 to the edge winding shaft 600*a*. Then, the presser 808 is swung toward the edge winding shaft 600*a*, causing the cushion member 810 to press the end of the edge 32 against the outer circumferential surface of the edge winding shaft 600*a*. Then, the electric heating wire 806 is energized to heat the adhesive 804 to a predetermined temperature according to a heating time control process using a timer or a temperature control process using a sensor.

The end of the edge 32 is thus bonded to the outer circumferential surface of the edge winding shaft 600*a*. After the presser 808 and the guide member 770 are returned to their retracted positions, the edge winding shaft 600*a* is rotated to wind the edge 32 therearound.

According to the second embodiment, therefore, the end of the edge 32 can be wound around the edge winding shaft 600*a* with a simple arrangement according to a simple control process, and the edge 32 can effectively automatically be wound around the edge winding shaft 600*a*, as with the first embodiment. For discharging the roll 613 wound around the edge winding shaft 600*a*, the edge winding shaft 600*a* is first cooled to a given temperature, and then the roll 613 is discharged from the edge winding shaft 600*a*. Therefore, the roll 613 can automatically discharged from the edge winding shaft 600*a*, leaving all the adhesive 804 on the edge winding shaft 600*a*.

In the first and second embodiments, the elongate films 24*a* through 24*d* have been described as a web. However, the present invention is also applicable to any of various webs including resin sheets, paper, etc.

Figure 72:
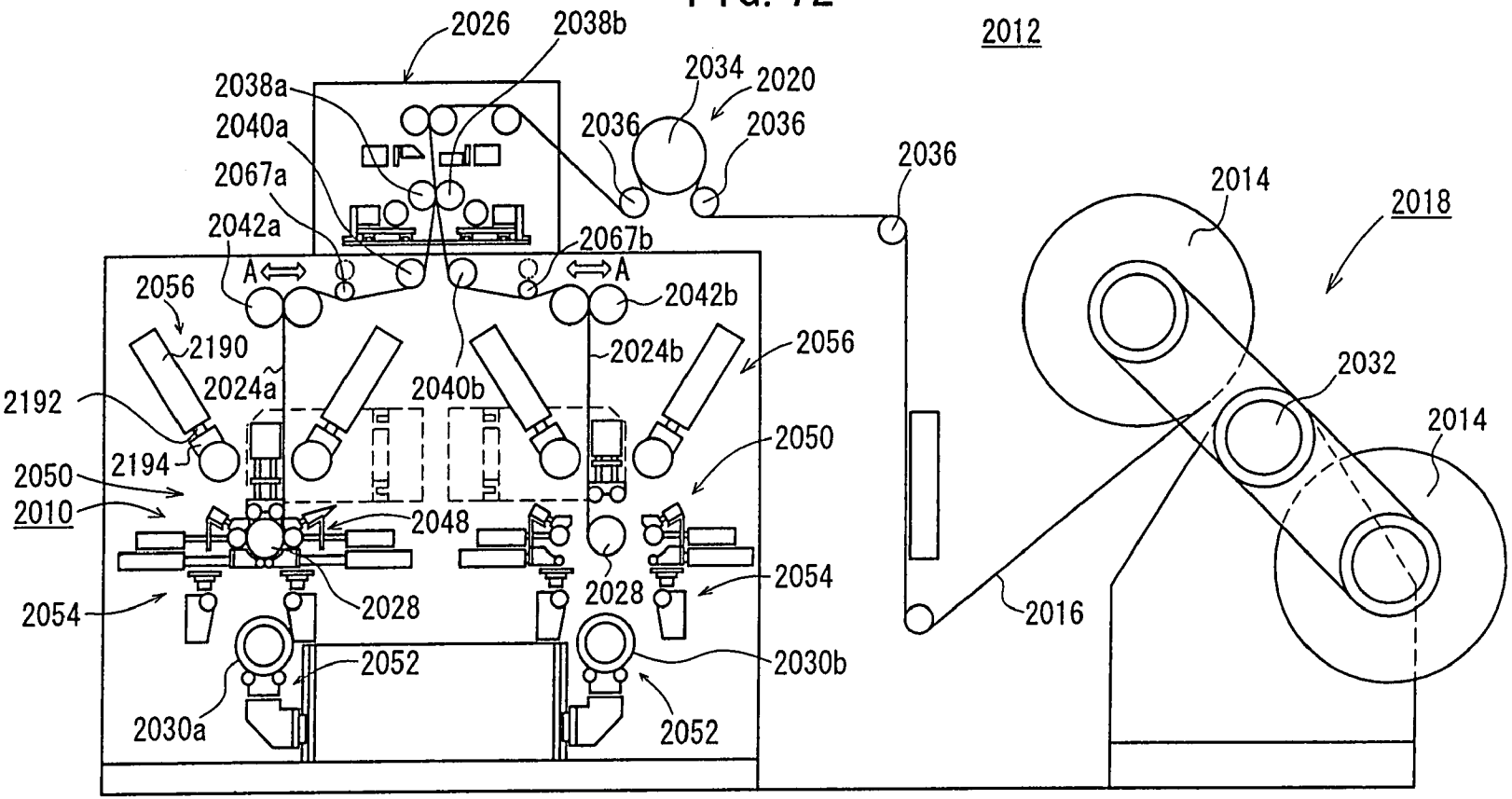
FIG. 72 is an elevational view of a film rewinding machine incorporating a film winding apparatus according to a third embodiment of the present invention.

FIG. 72 shows in elevation a film rewinding machine (web processing apparatus) 2012 incorporating a film winding apparatus 2010 according to a third embodiment of the present invention.

The film rewinding machine 2012 has a film delivery apparatus 2018 for rotating film rolls 14 to deliver an elongate raw film 2016, a feed apparatus 2020 for feeding the elongate raw film 2016 successively to next processes, a cutting apparatus 2026 for cutting the elongate raw film 2016 fed by the feed apparatus 2020 at transversely spaced intervals into a plurality of elongate films blanks and cutting off film edges from the elongate film blanks, thus producing elongate films (elongate webs) 2024*a*, 2024*b* having given widths, and film winding apparatus 2010 for winding the elongate films 2024*a*, 2024*b* around respective cores 2028 and cutting the elongate films 2024*a*, 2024*b* to given lengths, thereby producing rolls 2030*a*, 2030*b*.

The film delivery apparatus 2018 has a delivery shaft 2032 by which a pair of film rolls 2014 is supported for indexed movement. The film rolls 2014 are unwound by an unwinding motor (not shown). The feed apparatus 2020 has a main feed roller 2034 such as a suction drum and a plurality of rollers 2036. The main feed roller 2034 is controlled in speed to rotate according to a predetermined pattern of peripheral speeds by a servomotor (not shown). Either one of the rollers 2036 disposed between the main feed roller 2034 and the delivery shaft 2032 is combined with a tension detector (not shown) for detecting the tension of the elongate raw film 2016. The tension of the elongate raw film 2016 between the main feed roller 2034 and the delivery shaft 2032 is controlled by the tension detector and the unwinding motor mounted on the delivery shaft 2032.

The cutting apparatus 2026 has left and right rotary cutters 2038*a*, 2038*b*. Edges produced by the cutting apparatus 2026 are wound by edge winding units (not shown) whose widths can be changed. The tension of the edges is controlled according to a certain tension pattern by a servomotor.

Below the cutting apparatus 2026, there are disposed separation rollers 2040*a*, 2040*b* for separating severed elongate films 2024*a*, 2024*b* away from each other. The film winding apparatus 2010 are disposed downstream of the separation rollers 2040*a*, 2040*b* with nip roller pairs 2042*a*, 2042*b* interposed therebetween. In FIG. 72, there are two left and right film winding apparatus 10 associated with the elongate films 2024*a*, 2024*b*. Only the film winding apparatus 10 associated with the elongate films 2024*a* will be described below, and the film winding apparatus 10 associated with the elongate film 2024*b* will not be described below. Those parts of the film winding apparatus 10 associated with the elongate film 2024*b* which are identical to those of the film winding apparatus 10 associated with the elongate film 2024*a* are denoted by identical reference characters.

The film winding apparatus 2010 has a core rotating mechanism 2048 for holding and rotating a core 2028 in opposite directions, a film winding mechanism 2050 for winding the elongate film 2024*a* to a certain length around the core 2028 with its coated surface facing inside and outside, a product receiving mechanism 2052 for gripping the circumferential surface of the elongate film 2024*a* wound around the core 2028 while applying a certain tension to the elongate film 2024*a*, the product receiving mechanism 2052 being movable away from the film winding mechanism 2050, a cutting mechanism 2054 for transversely cutting the elongate film 2024*a* while it is being tensioned by the product receiving mechanism 2052, and a core supply mechanism 2056 for automatically supplying cores 2028 to the film winding mechanism 2050.

Figure 73:
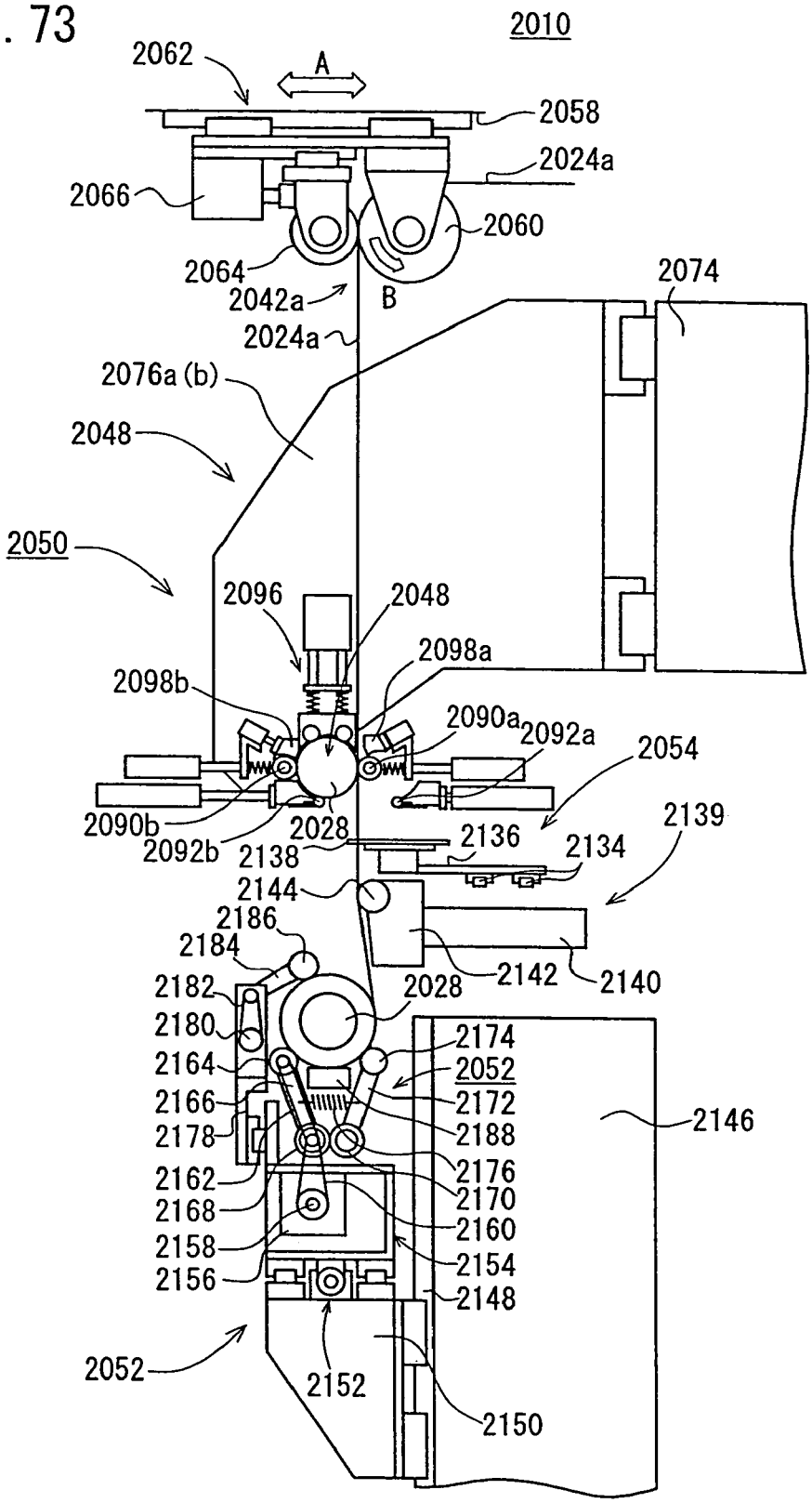
FIG. 73 is an elevational view of the film winding apparatus.

As shown in FIG. 73, the film rewinding mechanism 2012 has an upper frame 2058, and a path roller 2060 of the nip roller pair 2042*a* is mounted on the upper frame 2058 and is positionally adjustable in the directions indicated by the arrow A by a moving means 2062. To the path roller 2060, there is coupled a rotary actuator (not shown) for rotating the path roller 2060 at a peripheral speed higher than the main feed roller 2034 in the direction indicated by the arrow B.

A nip roller 2064 is rollingly held against the path roller 2060, and movable toward and away from the path roller 2060 by a cylinder 2066. When the nip roller 2064 is pressed against the path roller 2060 with the elongate film 2024*a* gripped therebetween, a certain tension is applied to the elongate film 2024*a* as it is fed into the cutting apparatus 2026 though no tension is applied to the elongate film 2024*a* downstream of the nip roller 2064. The moving means 2062 which supports the path roller 2060 and the nip roller 2064 is positionally adjustable in the transverse directions, indicated by the arrow A, of the core 2028.

As shown in FIG. 72, movable rollers 2067*a*, 2067*b* are disposed between the separation rollers 2040*a*, 2040*b* and the nip roller pairs 2042*a*, 2042*b* for preventing the elongate films 2024*a*, 2024*b* from becoming free of tension when the nip roller pairs 2042*a*, 2042*b* are moved in the directions indicated by the arrow A. The movable rollers 2067*a*, 2067*b* can be brought into at least two positions corresponding to the opposite sides of the core 2028.

Figure 74:
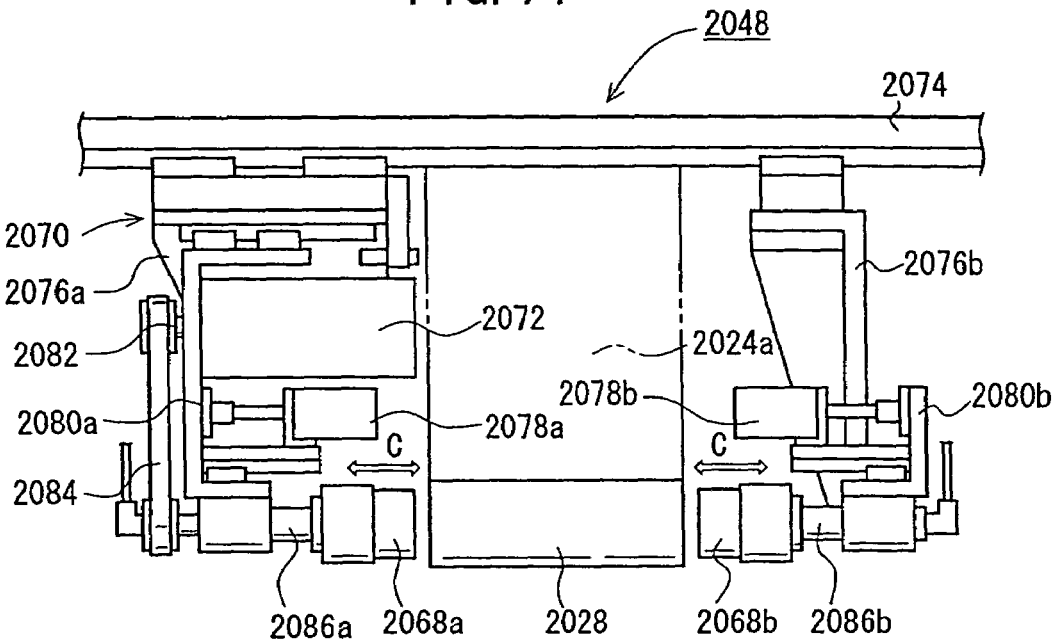
FIG. 74 is a front elevational view of a core rotating mechanism of the film winding apparatus.

As shown in FIG. 74, the core rotating mechanism 2048 has take-up chucks 2068*a*, 2068*b* for holding the opposite ends of the core 2028 and rotating the core 2028. The take-up chucks 2068*a*, 2068*b* are movable toward and away from each other in the directions indicated by the arrow C by a slide means 2070. To the take-up chuck 2068*a*, there is connected a torque-controllable servomotor 2072 for applying a tension to the elongate film 2024*a* after the elongate film 2024*a* is wound around the core 2028.

The slide means 2070 has a pair of arms 2076*a*, 2076*b* positionally adjustable along a guide rail 2074. A first movable base 2080*a* movable by a first cylinder 2078*a* is mounted on the arm 2076*a*. A servomotor 2072 is fixed to the first movable base 2080*a* and has a drive shaft 2082 to which a rotatable shaft 2086*a* of the take-up chuck 2068*a* is connected by a belt and pulley mechanism 2084. The rotatable shaft 2086*a* is rotatably supported on the first movable base 2080*a* by a bearing (not shown).

A second movable base 2080*b* movable by a second cylinder 2078*b* is mounted on the arm 2076*b*. A rotatable shaft 2086*b* of the take-up chuck 2068*b* is rotatably supported on the second movable base 2080*b* by a bearing (not shown).

As shown in FIG. 73, the film winding mechanism 2050 has first and second nip rollers 2090*a*, 2090*b* disposed on each side of the core 2028 for pressing the elongate core 2024*a* against the outer circumferential surface of the core 2028, first and second rollers 2092*a*, 2092*b* disposed on each side of the core 2028 for causing the end of the elongate film 24*a* to extend along the outer circumferential surface of the core 2028, first and second lower wrappers 2094*a*, 2094*b* on which the first and second rollers 2092*a*, 2092*b* are mounted, an upper wrapper 2096, and first and second introduction guide members (blocks) 2098*a*, 2098*b* disposed on each side of the upper wrapper 2096.

The first and second nip rollers 2090*a*, 2090*b*, the first and second rollers 2092*a*, 2092*b*, the first and second lower wrappers 2094*a*, 2094*b*, and the first and second introduction guide members 2098*a*, 2098*b* are symmetrically positioned with respect to a central line extending vertically across the core 2028.

Figure 75:
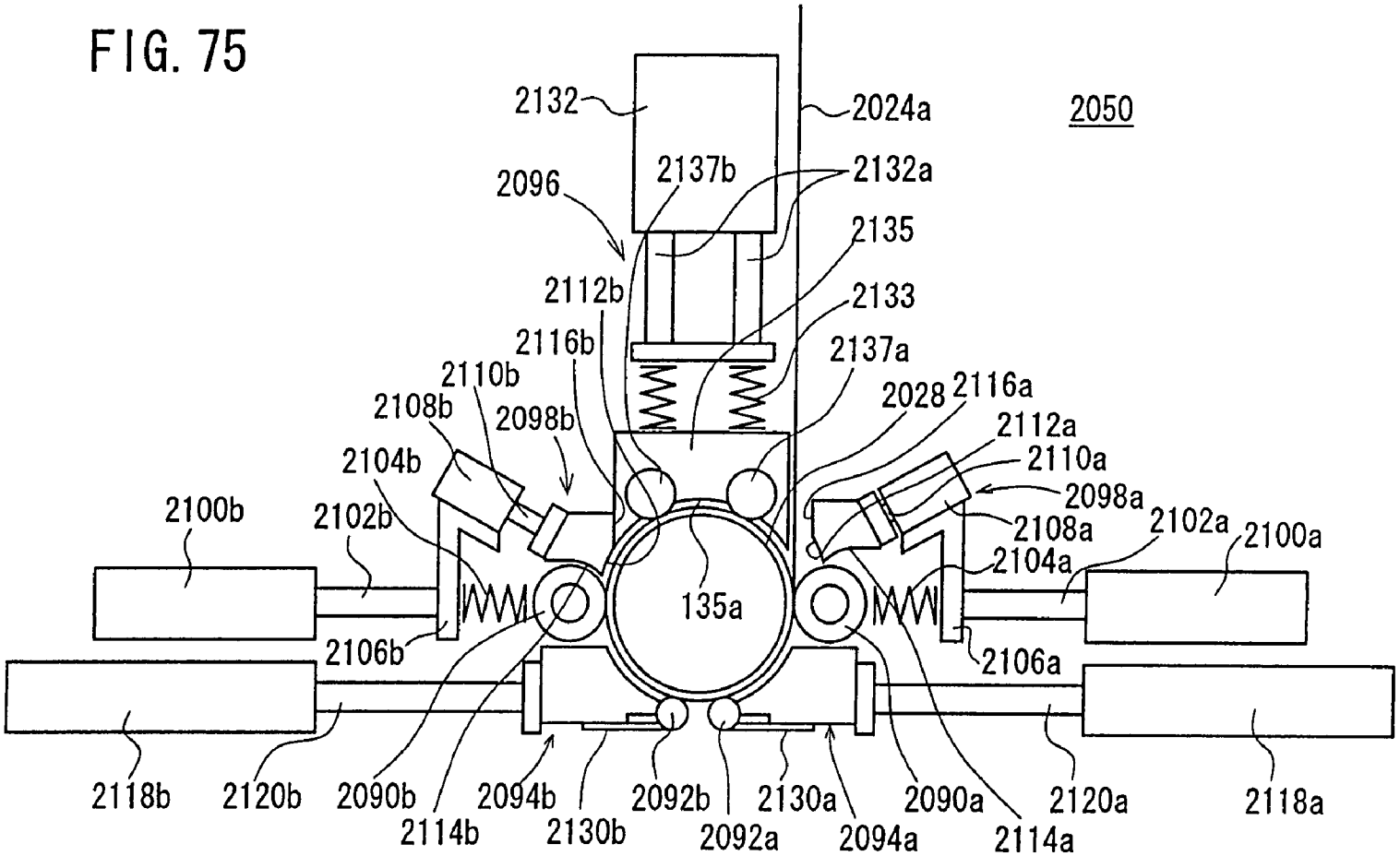
FIG. 75 is a front elevational view of a film take-up mechanism of the film winding apparatus.

As shown in FIG. 75, the first and second nip rollers 2090*a*, 2090*b* are rotatably supported on respective distal ends of rods 2102*a*, 2102*b* extending horizontally from respective first and second drive cylinders 2100*a*, 2100*b* which are disposed in confronting relation to each other. The nip pressures of the first and second nip rollers 2090*a*, 2090*b* are set by respective springs 2104*a*, 2104*b*. The nip pressures and material of the first and second nip rollers 2090*a*, 2090*b* are selected depending on the winding tension, coefficient of friction, and scratch resistance of the elongate film 2024*a*.

First and second cylinders 2108*a*, 2108*b* are mounted on the respective rods 2102*a*, 2102*b* by respective support bases 2106*a*, 2106*b*. The first and second cylinders 2108*a*, 2108*b* have respective rods 2110*a*, 2110*b* projecting therefrom substantially toward the center of the core 2028 and having respective distal ends on which the first and second introduction guide members 2098*a*, 2098*b* are fixedly mounted.

The first and second introduction guide members 2098*a*, 2098*b* have respective guide surfaces 2112*a*, 2112*b* curved along the outer profile of the core 2028 and also along an arcuate shape having a radius of curvature which is greater than the outside diameter of the core 2028, respective clearance surfaces 2114*a*, 2114*b* for avoiding interference with the first and second nip rollers 2090*a*, 2090*b*, and vertical surfaces 2116*a*, 2116*b* for engaging the upper wrapper 2096 when the first and second introduction guide members 2098*a*, 2098*b* are in a forward position (closed position).

Figure 76:
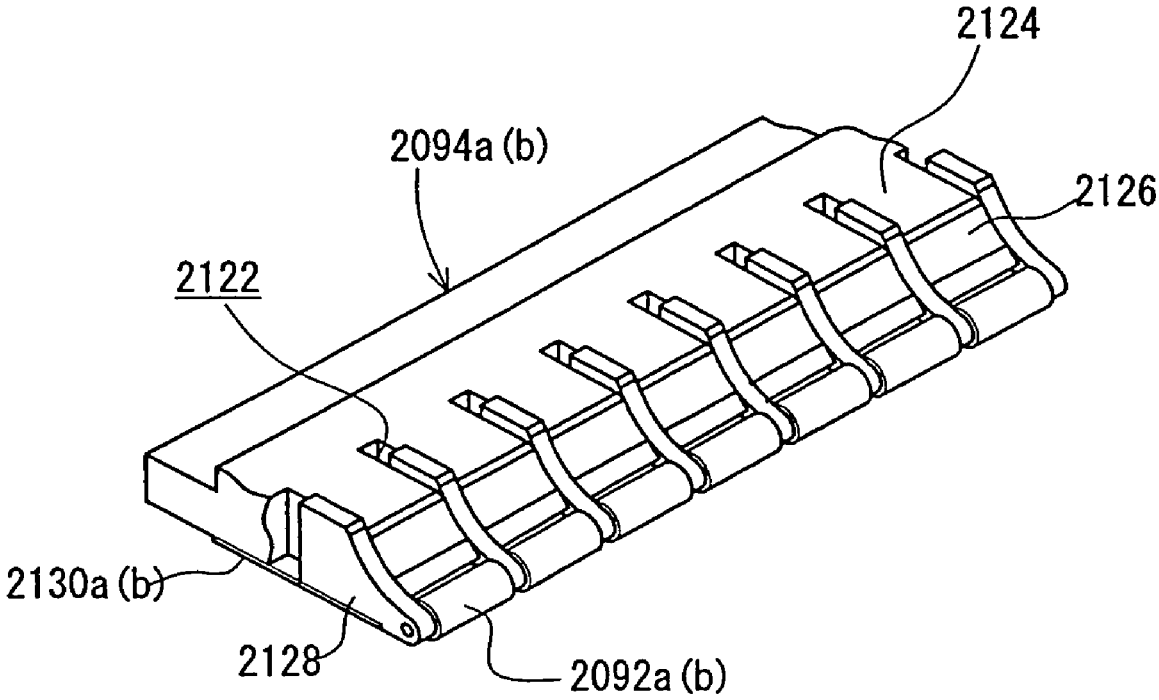
FIG. 76 is a perspective view of a lower wrapper of the film take-up mechanism.

The first and second lower wrappers 2094*a*, 2094*b* are fixed to the respective distal ends of rods 2120*a*, 2120*b* extending horizontally toward each other from first and second drive cylinders 2118*a*, 2118*b*. As shown in FIG. 76, each of the first and second lower wrappers 2094*a*, 2094*b* has a plurality of guides 2124 divided by slits 2122 and each having a certain width. The guides 2124 have respective guide surfaces 2126 disposed on their distal end portions and each having a radius of curvature which is slightly larger than the radius of curvature of the outer circumferential surface of the core 2028.

Support plates 2128 are placed respectively in the slits 2122 and swingably supported on the lower surfaces of the first and second lower wrappers 2094*a*, 2094*b* by leaf springs 2130. The first and second rollers 2092*a*, 2092*b* are rotatably supported on the support plates 2128. The first and second rollers 2092*a*, 2092*b* may be made of metal, plastics, or rubber, which is selected depending on the material of the elongate film 2024*a*.

As shown in FIG. 75, the upper wrapper 2096 has a vertical cylinder 2132 having a pair of downwardly extending rods 2032*a* on which a guide 2135 is vertically movably supported by springs 2133. The guide 2135 has a guide surface 2135*a* complementary in shape to the outer circumferential surface of the core 2028. First and second free rollers 2137*a*, 2137*b* are rotatably supported on the guide 2135 at the guide surface 2135*a*. The first and second free rollers 2137*a*, 2137*b* are axially symmetrically positioned at equal distances from the vertical central line of the core 2028, and can be centered by being supported on the outer circumferential surface of the core 2028. The upper wrapper 2096 is divided into units of small width, and can be placed in any desired position by a linear guide (not shown). The upper wrapper 2096 is retractable into a retracted position out of interference with the arms 2076*a*, 2076*b*.

Figure 77:
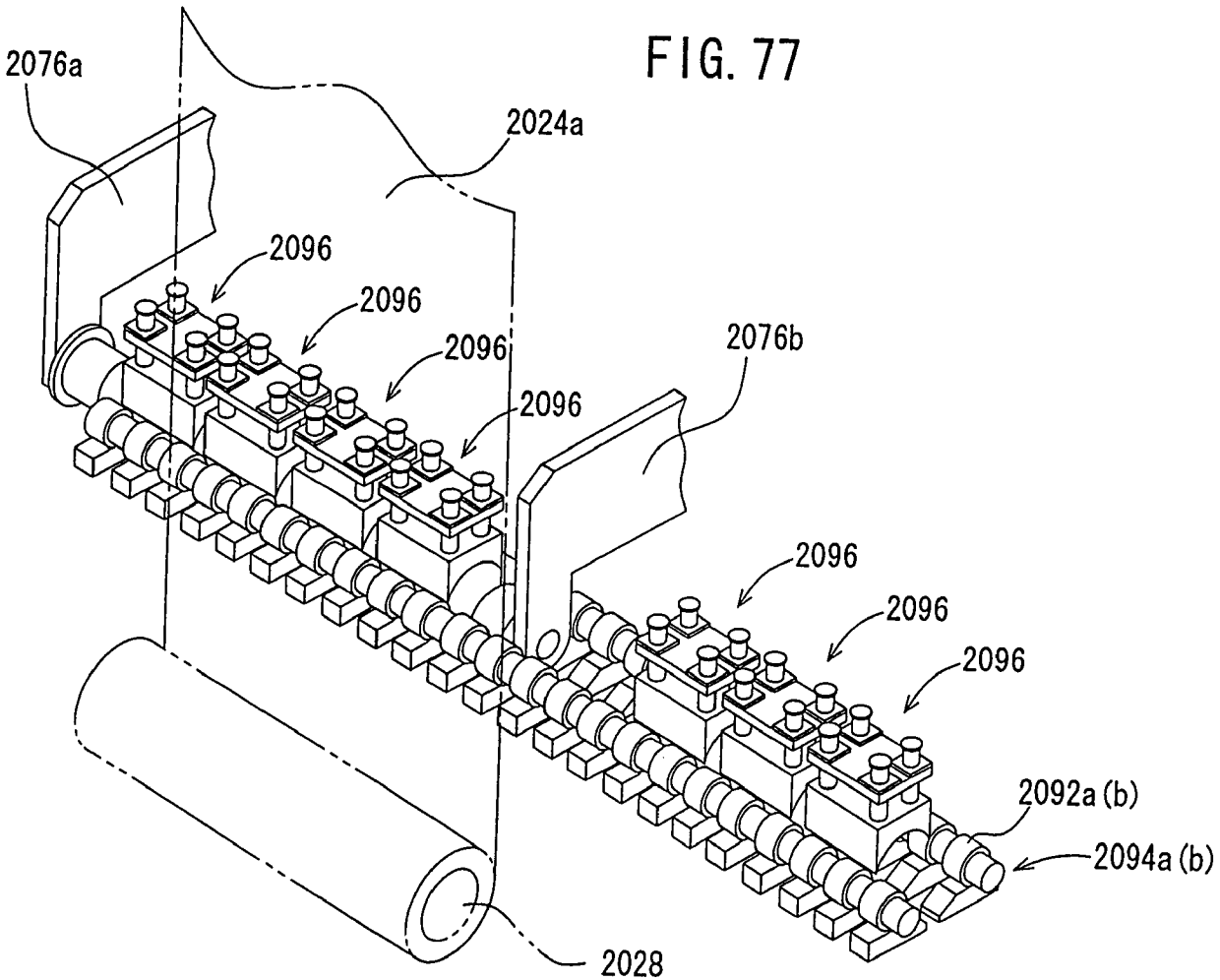
FIG. 77 is a perspective view of an upper wrapper of the film take-up mechanism.

As shown in FIG. 77, four upper wrappers 2096 are positioned between the arms 2076*a*, 2076*b*. The number of upper wrappers 2096 positioned between the arms 2076*a*, 2076*b* is increased or reduced when the with of the elongate film 2024*a* is changed.

As shown in FIG. 73, each of the cutting mechanisms 2054 has a movable base 2136 movable along guide rails 2134 in a direction transversely across the elongate film 2024*a*, and a disk-shaped cutter 2138 is rotatably mounted on the distal end of the movable base 2136. A film holding mechanism 2139 is disposed below the cutting mechanism 2054 and has a suction box 2142 that is horizontally movable by a drive cylinder 2140. A path changing roller 2144 is rotatably disposed on an upper portion of the suction box 2142.

When the elongate film 2024*a* starts being wound around the core 2028, the path changing roller 2144 functions to keep the elongate core 2024*a* substantially perpendicular to a straight line extending through the core 2028 and the first and second nip rollers 2090*a*, 2090*b*. The suction box 2142 is swingable about the path changing roller 2144, for example, to apply a tension to the elongate film 2024*a* while attracting the elongate film 2024*a*.

The product receiving mechanism 2052 has a vertically movable base 2150 that can be lifted and lowered along a guide rail 2148 on a side of a base 2146. On the vertically movable base 2150, there is mounted a block 2154 which is movable in a direction transversely across the elongate film 2024*a* by an automatic correcting means 2152. The block 2154 incorporates therein a torque motor 2156 having a drive shaft 2158 which operatively engages a tensioning roller 2164 through a first belt and pulley mechanism 2160 and a second belt and pulley mechanism 2162. The tensioning roller 2164 is drivably supported on the distal end of a first swing arm 2166.

The first swing arm 2166 is swingable about a pivot with a first gear 2168 mounted thereon. The first gear 2168 is held in mesh with a second gear 2170 mounted on a pivot about which the second swing arm 2172 is swingable. A free roller 2174 is rotatably supported on the distal end of the second swing arm 2172. A tensile spring 2176 is connected to and extends between substantially central portions of the first and second swing arms 2166, 2172. The first and second swing arms 2166, 2172 are associated with a lock mechanism (not shown) which locks them in a certain open or angularly spaced condition. For discharging a product 2030*a*, the product receiving mechanism 2052 is elevated to cause the product 2030*a* to spread the first and second swing arms 2166, 2172 away from each other. Then, the lock mechanism locks the free roller 2174 in position, allowing the product 2030*a* to be discharged stably.

A slide base 2178 is mounted on a side of the block 2154 for movement in a direction transversely across the elongate film 2024*a*, and a motor 2180 is mounted on the slide base 2178. An arm 2184 is swingably supported on the slide base 2178 and operatively connected to the motor 2180 by a belt and pulley mechanism 2182. A rider roller 2186 is rotatably supported on an upper portion of the arm 2184. A conveyor 2188 for discharging the product 2030*a* is disposed between the first and second swing arms 2166, 2172.

As shown in FIG. 72, the core supply mechanism 2056 has a pair of air cylinders 2190 disposed on each side of the path of the elongate film 2024*a* and having respective rods 2192 extending therefrom toward the winding position, with suction cups 2194 being mounted on the distal ends of the rods 2192. The suction cups 2194 attract the outer circumferential surfaces of cores 2028 and supply the cores 2028 to the winding position.

Operation of the film rewinding machine 2012 thus constructed will be described below with respect to the film winding apparatus 2010 according to the third embodiment.

As shown in FIG. 72, one of the film rolls 2014 mounted on the film delivery apparatus 2018 is unwound by the unwinding motor (not shown) to supply the elongate raw film 2026 to the main feed roller 2034 of the feed apparatus 2020. The main feed roller 2034 comprises a suction drum or the like, for example, and is controlled in speed to rotate according to a predetermined speed pattern by an AC servomotor (not shown). An encoder (not shown) is connected to the shaft of the main feed roller 2034 to detect the length of the elongate raw film 2016 that has been fed.

The elongate raw film 2026 which is adjusted in speed by the main feed roller 2034 is fed to the cutting apparatus 2026. In the cutting apparatus 2026, the rotary cutters 2038*a*, 2038*b* cut off both edges from the elongate raw film 2026, producing elongate films 2024*a*, 2024*b* having a given width. The elongate films 2024*a*, 2024*b* are then fed to the film winding apparatus 2010. The edges that are cut off are wound according to a certain tension pattern by edge winding units (not shown). A process of processing the elongate film 2024*a* will be described below.

Figure 78:
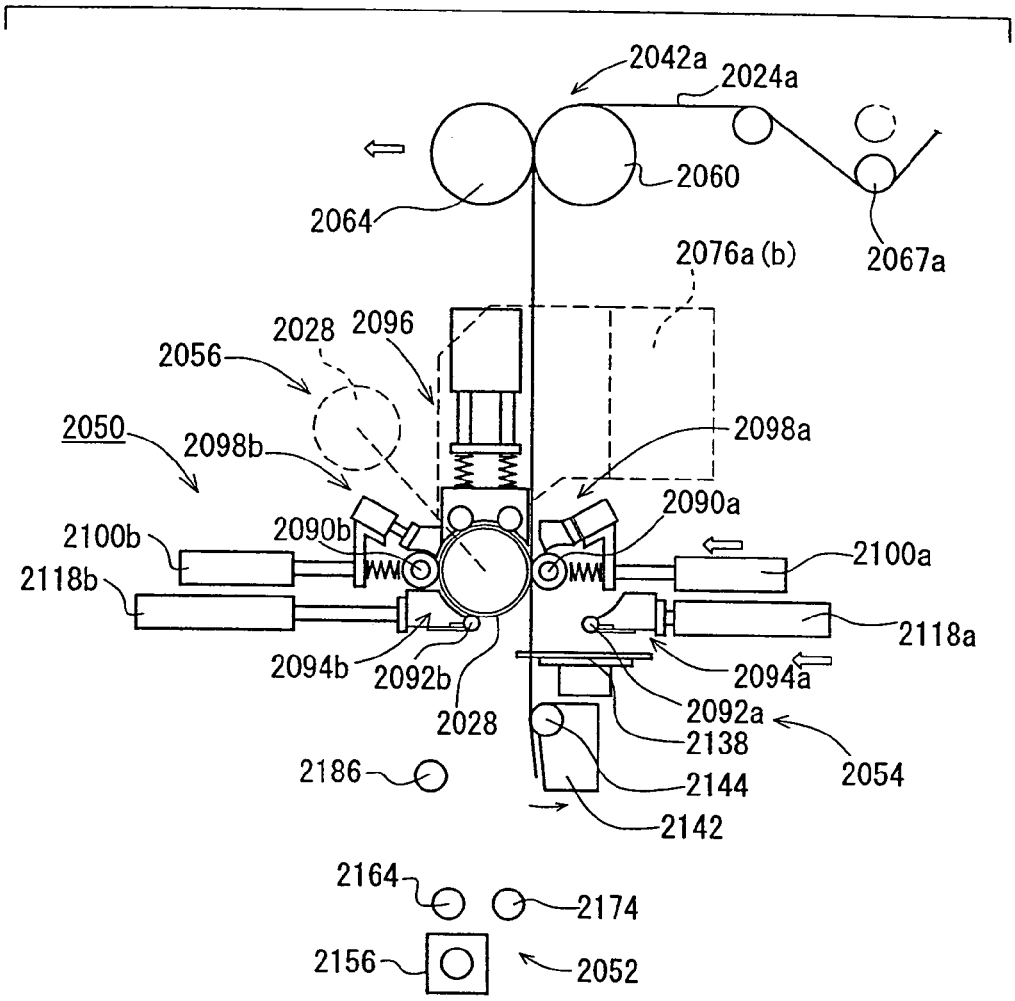
FIG. 78 is a view illustrative of the manner in which an elongate film is fed to the film take-up mechanism.

For starting to wind a first roll in the film winding apparatus 2010, as shown in FIG. 78, the core supply mechanism 2056 supplies a new core 2028 to the winding position, i.e., the position between the take-up chucks 2068*a*, 2068*b*, which support the opposite ends of the core 2028.

For inserting the elongate film 2024*a* between the core 2028 and the first nip roller 2090*a*, the core 2028 is held by the second nip roller 2090*b*, the second lower wrapper 2094*a*, the second roller 2092*b*, and the upper wrapper 2096 of the film winding mechanism 2050. At this time, the servomotor 2072 is energized to produce a torque. The first introduction guide member 2098*a* is retracted to the open position, and the second introduction guide member 2098*b* is kept in the closed position, i.e., the forward position.

The path roller 2060 is rotated to feed the elongate film 2024*a* vertically downwardly between the nip roller 2064 and the path roller 2060. The elongate film 2024*a* passes between the core 2028 and the first nip roller 2090*a* until its leading end is attracted by the suction box 2142. Then, the elongate film 2024*a* is supported by the path changing roller 2144, and extends in a direction perpendicular to the line interconnecting the core 2028 and the axis of the first nip roller 2090*a*. The elongate film 2024*a* is tensioned when the suction box 2142 is angularly moved in the direction indicated by the arrow.

Figure 79:
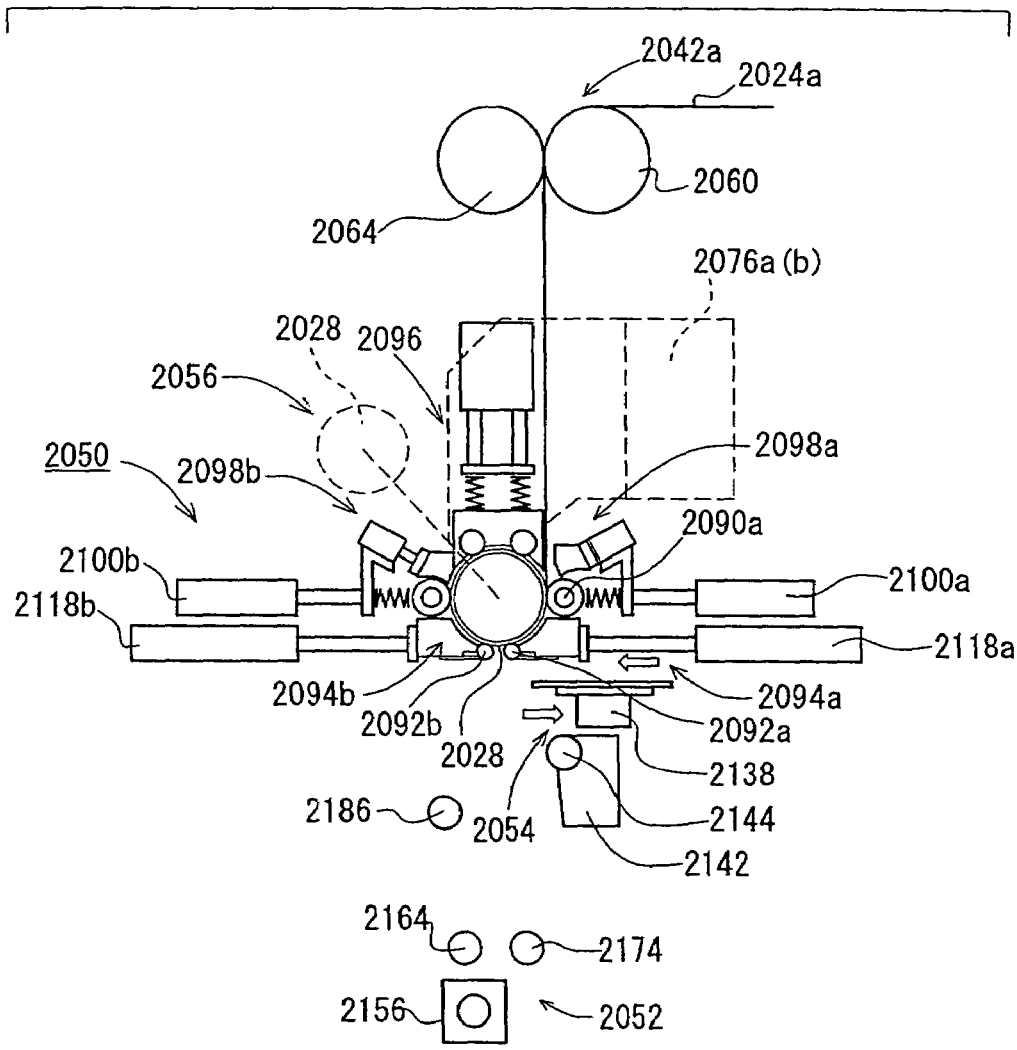
FIG. 79 is a view illustrative of the manner in which the end of the elongate film is caused to extend along the outer circumferential surface of a core.

Then, the cutter 2138 of the cutting mechanism 2054 is moved transversely across the elongate film 2024*a* to transversely cut or cross-cut the elongate film 2024*a*. When the first roller 2092*a* is displaced toward the core 2028 by the drive cylinder 2118*a*, the first roller 2092*a* winds the leading end portion of the elongate film 2024*a* around the core 2028 through an angular range of about 90° (see FIG. 79).

Figure 80:
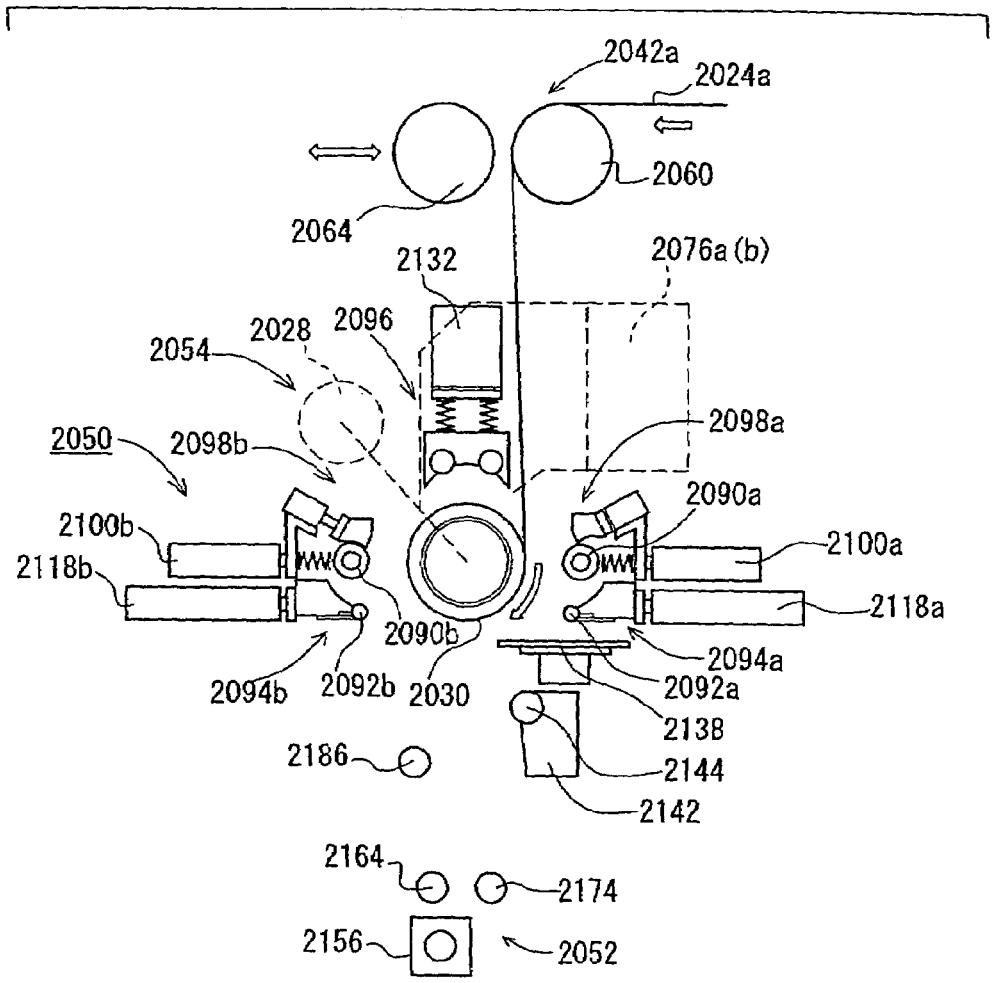
FIG. 80 is a view illustrative of the manner in which the elongate film is wound around the core.

After the first roller 2092*a* reaches its stroke end, the main feed roller 2034 is rotated, and the servomotor 2072 is energized to cause the belt and pulley mechanism 2084 to start rotating the take-up chuck 2068*a*, as shown in FIG. 74. The core 2028 is rotated thereby, winding the elongate film 2024*a* therearound to a length large enough to hold its tension, preferably two or three turns. Thereafter, as shown in FIG. 80, the cylinder 2132 is operated to retract the upper wrapper 2096 upwardly and the first and second cylinders 2100*a*, 2100*b* and the first and second cylinders 2118*a*, 2118*b* are actuated to move the first and second nip rollers 2090*a*, 2090*b* and the first and second lower wrappers 2094*a*, 2094*b* away from the core 2028.

Figure 81:
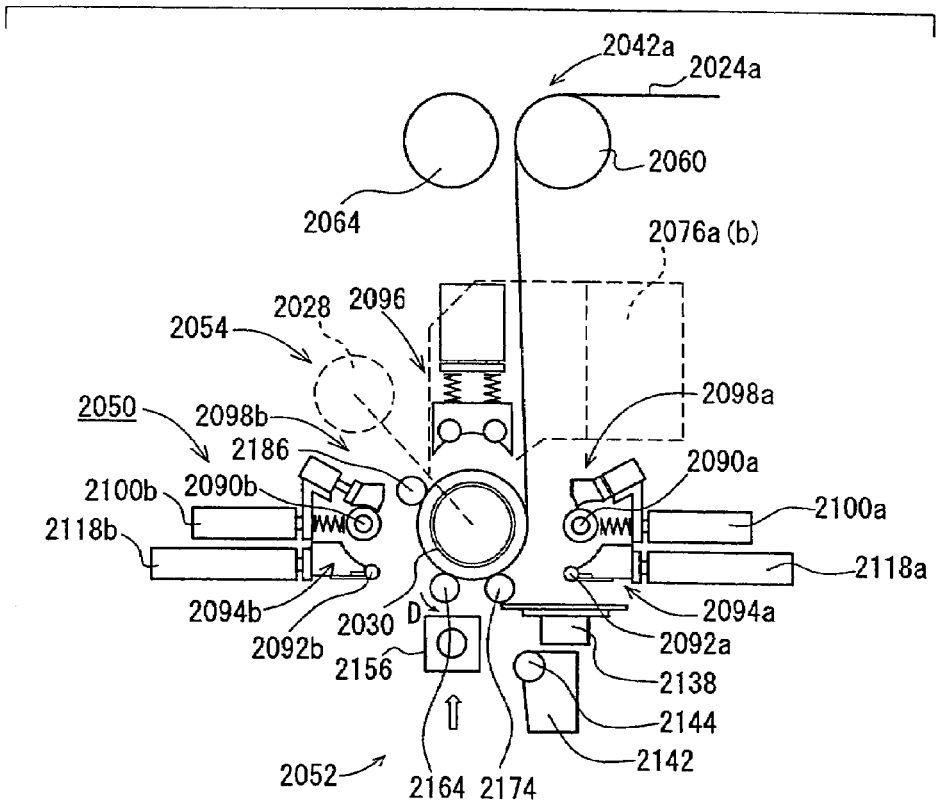
FIG. 81 is a view illustrative of the manner in which a film roll is received by the product receiving mechanism.

When the elongate film 2024*a* is wound to the prescribed length around the core 2028 by the film winding mechanism 2050, the product receiving mechanism 2052 is elevated to cause the rider roller 2186, the tensioning roller 2164, and the free roller 2174 to hold the roll 2030 (see FIG. 81). When the rider roller 2186, the tensioning roller 2164, and the free roller 2174 hold the roll 2030, the torque produced by the servomotor 2072 of the core rotating mechanism 2048 is controlled to apply a certain tension to the elongate film 2024*a* of the roll 2030.

The torque motor 2156 is then energized to cause the first and second belt and pulley mechanisms 2160, 2162 to rotate the tensioning roller 2164 in the direction indicated by the arrow D in FIG. 81. Therefore, the elongate film 2024*a* is given a certain tension by the tensioning roller 2164.

The servomotor 2072 of the core rotating mechanism 2048 is then de-energized, and the first and second cylinders 2078*a*, 2078*b* of the slide means 2070 are actuated to displace the take-up chucks 2068*a*, 2068*b* away from the opposite ends of the roll 2030, thus releasing the roll 2030. The roll 2030 is now transferred to the product receiving mechanism 2052 while being kept under tension by the tensioning roller 2164 and the free roller 2174, whereupon the product receiving mechanism 2052 descends to a product discharging position.

Figure 82:
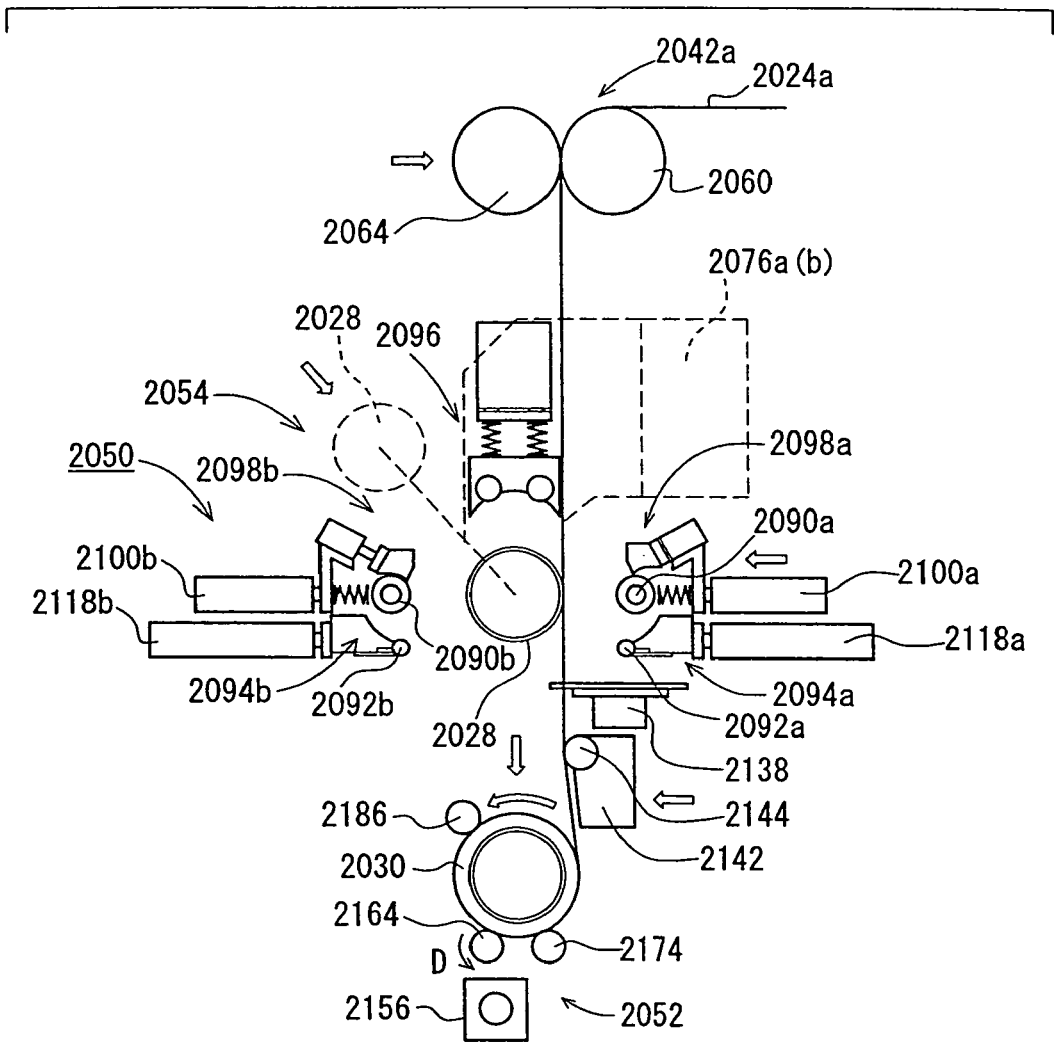
FIG. 82 is a view illustrative of the manner in which the product receiving mechanism is lowered.

At this time, as shown in FIG. 82, the upper portion of the elongate film 2024*a* is immovably held by the path roller 2060 and the nip roller 2064. Therefore, when the product receiving mechanism 2052 is lowered, the roll 2030 is lowered while being rotated in the direction indicated by the arrow and unwinding the elongate film 2024*a* from its outer circumferential surface. At this time, the torque roller 2156 produces a torque in the direction indicated by the arrow D.

When the roll 2030 is thus lowered, while the outer circumferential surface of the roll 2030 is being held by the rider roller 2186, the tensioning roller 2164, and the free roller 2174, the roll 2030 may be lowered to pull the elongate film 2024*a* from between the path roller 2060 and the nip roller 2064, i.e., without the roll 2030 being rotated about its own axis. At this time, the torque motor 2156 is energized to rotate in the direction indicated by the arrow D in FIG. 82 with a torque to apply a tension greater than the tension of the elongate film 2024*a*.

After the descent of the roll 2030 is completed, a new core 2028 is supplied to the winding position by the core supply mechanism 2056, and held by the take-up chucks 2068*a*, 2068*b*. The position of the path roller 2060 is set such that the path of the elongate film 2024*a* extends substantially perpendicularly to the line interconnecting the center of the core 2028 and the center of the first nip roller 2090*a*.

Figure 83:
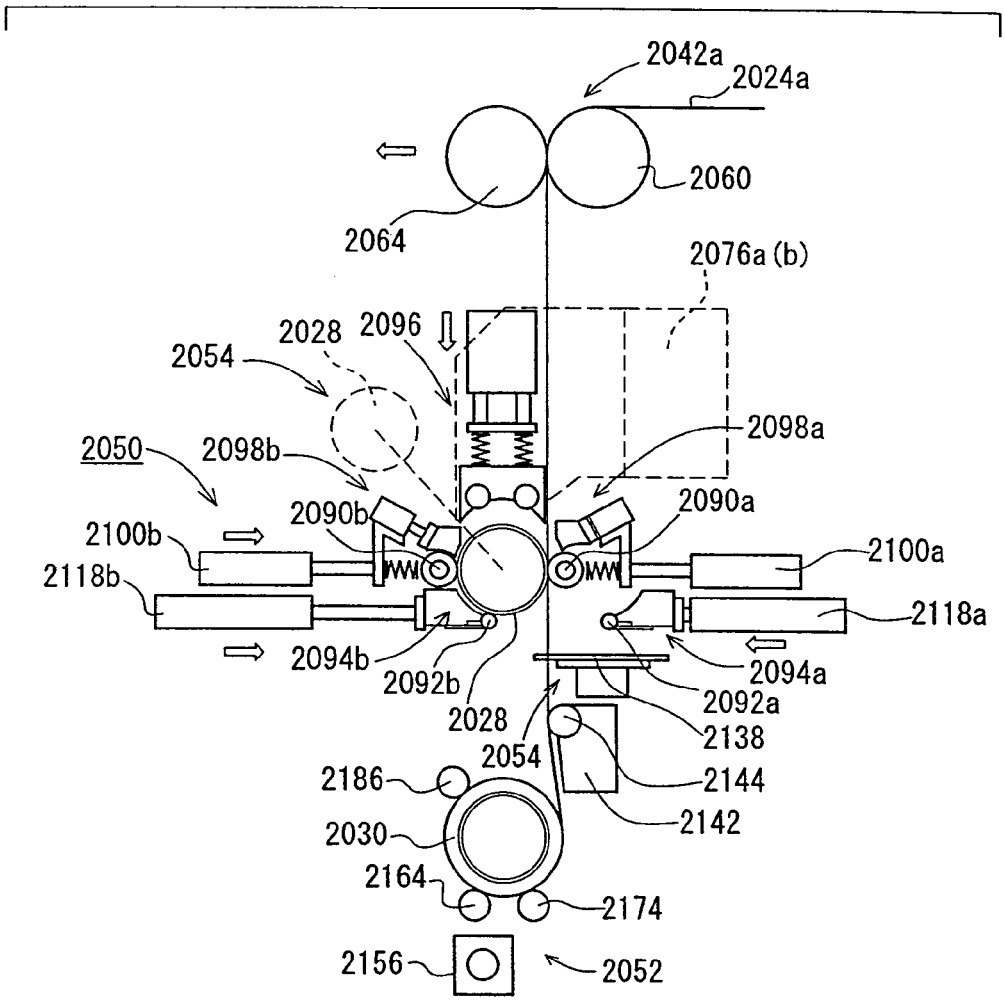
FIG. 83 is a view illustrative of the manner in which the elongate film is cut off.

When the core 2028 is held by the core rotating mechanism 2048, the firs nip roller 2090*a* is moved forward by the first drive cylinder 2100*a* and presses the elongate film 2024*a* against the outer circumferential surface of the core 2028. The upper wrapper 2096 is lowered, and the second lower wrapper 2094 and the second nip roller 2090*b* are moved forward by the second drive cylinders 2118*b*, 2100*b* and positioned around the core 2028 (see FIG. 83).

After the roll 2030 held by the product receiving mechanism 2052 is lowered, the torque motor 2156 of the product receiving mechanism 2052 is energized to actuate he cutter 2138 of the cutting mechanism 2054 while the elongate film 2024*a* is held under a certain tension. If the elongate film 2024*a* can be ruptured relatively easily, then the tensioning roller 2164 may be braked and then the torque motor 2156 may be de-energized, after which the elongate film 2024*a* may be cut off by the cutting mechanism 2054. Alternatively, the torque motor 2156 may be de-energized while the elongate film 2024*a* is being cut off by the cutting mechanism 2054.

Figure 84:
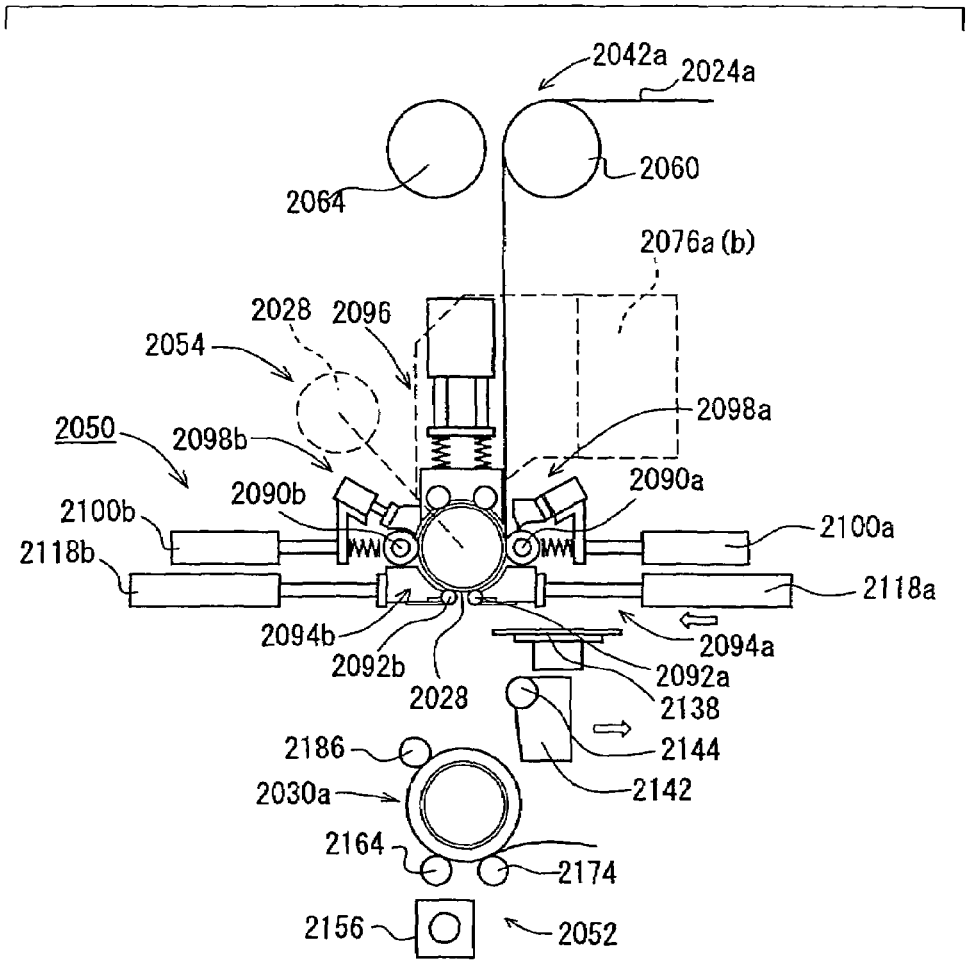
FIG. 84 is a view illustrative of the manner in which the elongate film starts being wound around the core.

The elongate film 2024*a* is now transversely cut off. The first drive cylinder 2118*a* is actuated to move the first roller 2092*a* toward the core 2028, winding the end of the elongate film 2024*a* which is free between the first nip roller 2090*a* and the cutter 2138 around the core 2028 (see FIG. 84).

Figure 85:
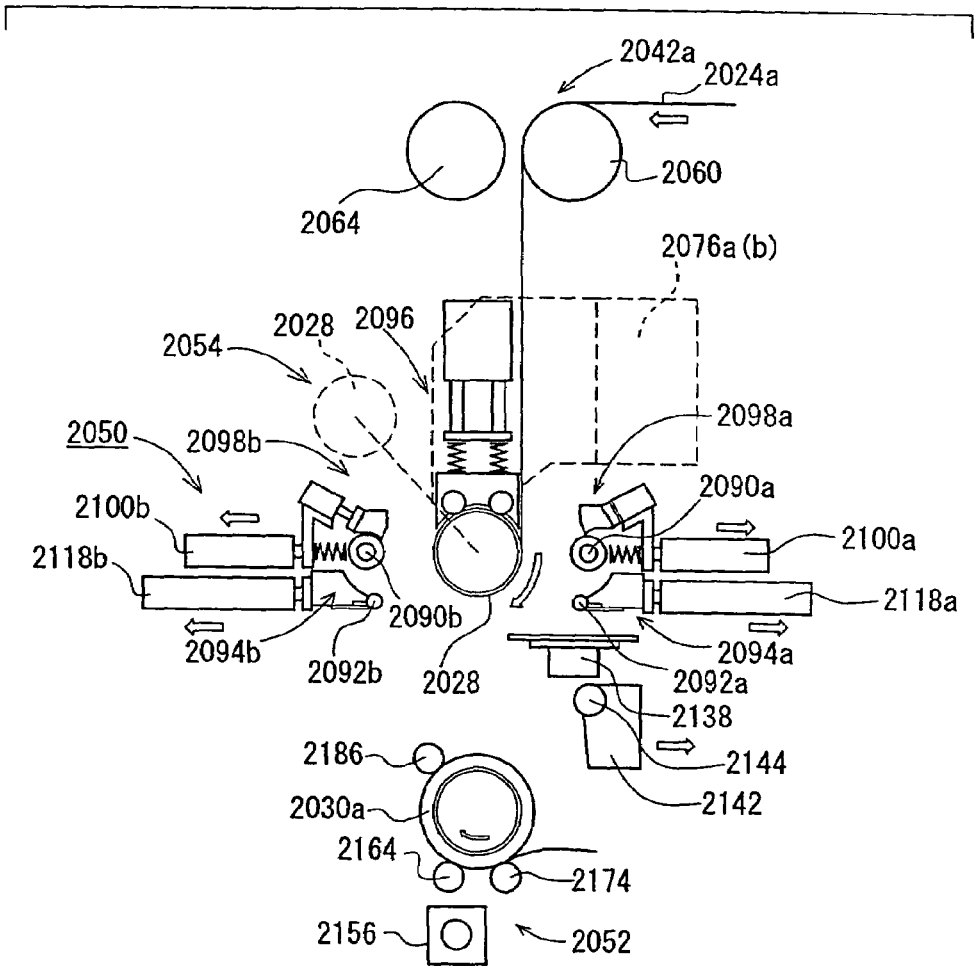
FIG. 85 is a view illustrative of the manner in which the elongate film is wound around the core.

The film winding mechanism 2050 is operated to wind two or three turns of the elongate film 2024*a* around the core 2028. Thereafter, as shown in FIG. 85, the first and second nip rollers 2090*a*, 2090*b*, the upper wrapper 2096, and the first and second lower wrappers 2094*a*, 2094*b* are displaced away from the core 2028, after which the elongate film 2024*a* is wound to a given length around the core 2028.

In the product receiving mechanism 2052, the tensioning roller 2164 is rotated to rotate a product 2030*a*, winding a trailing end portion of the elongate film 2024*a* to a suitable length. The product 2030*a* is then transferred from the product receiving mechanism 2052 to the conveyor 2188, by which the product 2030*a* is discharged. A tape applying mechanism (not shown) for holding the trailing end of the elongate film 2024*a* around the product 2030*a* with a tape may be disposed in the vicinity of the product receiving mechanism 2052.

The product 2030*a* is a roll where the elongate film 2024*a* is wound clockwise around the core 2028, i.e., a roll with an inner coated surface. A process of winding the elongate film 2024*a* counterclockwise around the core 2028 to produce a roll with an outer coated surface will be described below.

Figure 86:
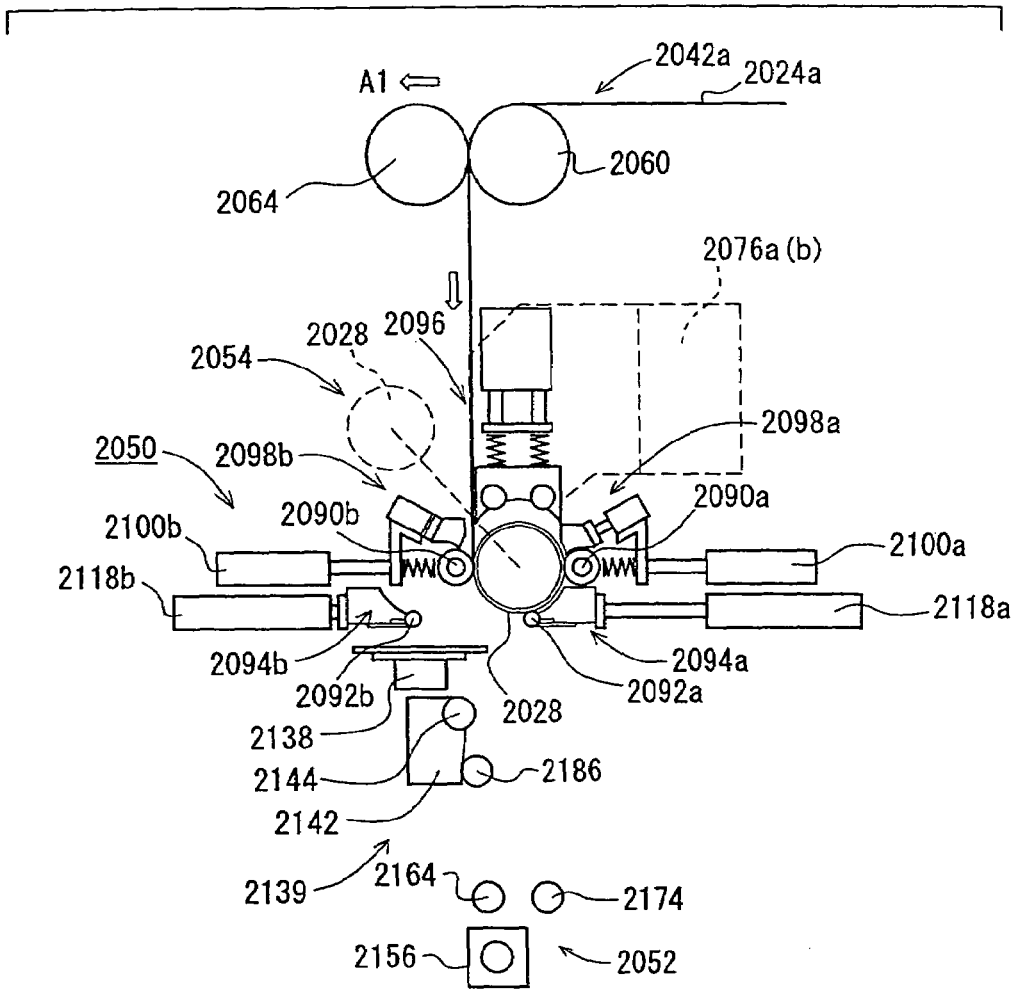
FIG. 86 is a view illustrative of the manner in which the elongate film is fed on an opposite side of the core and the core is rotated in a reverse direction.

As shown in FIG. 86, the nip roller pair 2042*a* is moved in the direction indicated by the arrow A1 by a distance corresponding to the diameter of the core 2028. The path roller 2060 is rotated to feed the elongate film 2024*a* vertically downwardly to insert the end of the elongate film 2024*a* between the core 2028 and the second nip roller 2090*b*. At this time, the second introduction guide member 2098*b* is disposed in the retracted position (open position), allowing the elongate film 2024*a* to be guided smoothly. When the leading end of the elongate film 2024*a* is positioned at the film holding mechanism 2139, the suction box 2142 is actuated to attract the elongate film 2024*a*.

Then, the same process as the above process of producing a roll with an inner coated surface is carried out to wind the elongate film 2024*a* counterclockwise around the core 2028, thus producing a product 2030*a* with an outer coated surface.

In the third embodiment, as described above, the film winding mechanism 2050 has the first and second nip rollers 2090*a*, 2090*b*, the first and second rollers 2092*a*, 2092*b*, the first and second lower wrappers 2094*a*, 2094*b*, the first and second introduction guide members 2098*a*, 2098*b*, and the upper wrapper 2096, which are movable, disposed axially symmetrically with respect to the vertical central line of the core 2028 disposed in the winding position (see FIG. 75). Therefore, when the elongate film 2024*a* is inserted between the core 2028 and the first nip roller 2090*a*, the core 2028 is rotated clockwise to feed the elongate film 2024*a* along the gap defined between the outer circumferential surface of the core 2028 and the first and second lower wrappers 2094*a*, 2094*b*, the second introduction guide member 2098*b*, and the upper wrapper 2096, and the elongate film 2024*a* is wound clockwise to a given length around the core 2028.

When the elongate film 2024*a* is inserted between the core 2028 and the second nip roller 2090*b*, the core 2028 is rotated counterclockwise to wind the elongate film 2024*a* to a given length counterclockwise smoothly around the core 2028. Therefore, the elongate film 2024*a* can be wound around the core 2028 to produce a roll with an inner coated surface or a roll with an outer-coated surface, producing a high-quality product 2030*a* free of edge protrusions of the elongate film 2024*a* which would otherwise occur if the conventional belt wrappers were used and their endless belts were moved in a meandering pattern.

When the elongate film 2024*a* is inserted between the core 2028 and the first nip roller 2090*a*, the first introduction guide member 2098*a* is brought into the retracted position, i.e., the open position, by the first cylinder 2108*a* to smoothly introduce the elongate film 2024*a*. When the elongate film 2024*a* is inserted between the core 2028 and the second nip roller 2090*b*, the second introduction guide member 2098*b* is brought into the retracted position, i.e., the open position, by the second cylinder 2108*b* to smoothly introduce the elongate film 2024*a*.

As shown in FIG. 73, the nip roller pair 2042*a* is movable in the directions indicated by the arrow A by the moving means 2062, and is selectively disposed on the opposite sides of the core 2028 depending on the winding direction of the elongate film 2024*a*. Therefore, it is possible to feed the elongate film 2024*a* accurately to a desired side (right or left side) of the core 2028, so that the elongate film 2024*a* can accurately be wound around the core 2028.

Figure 87:
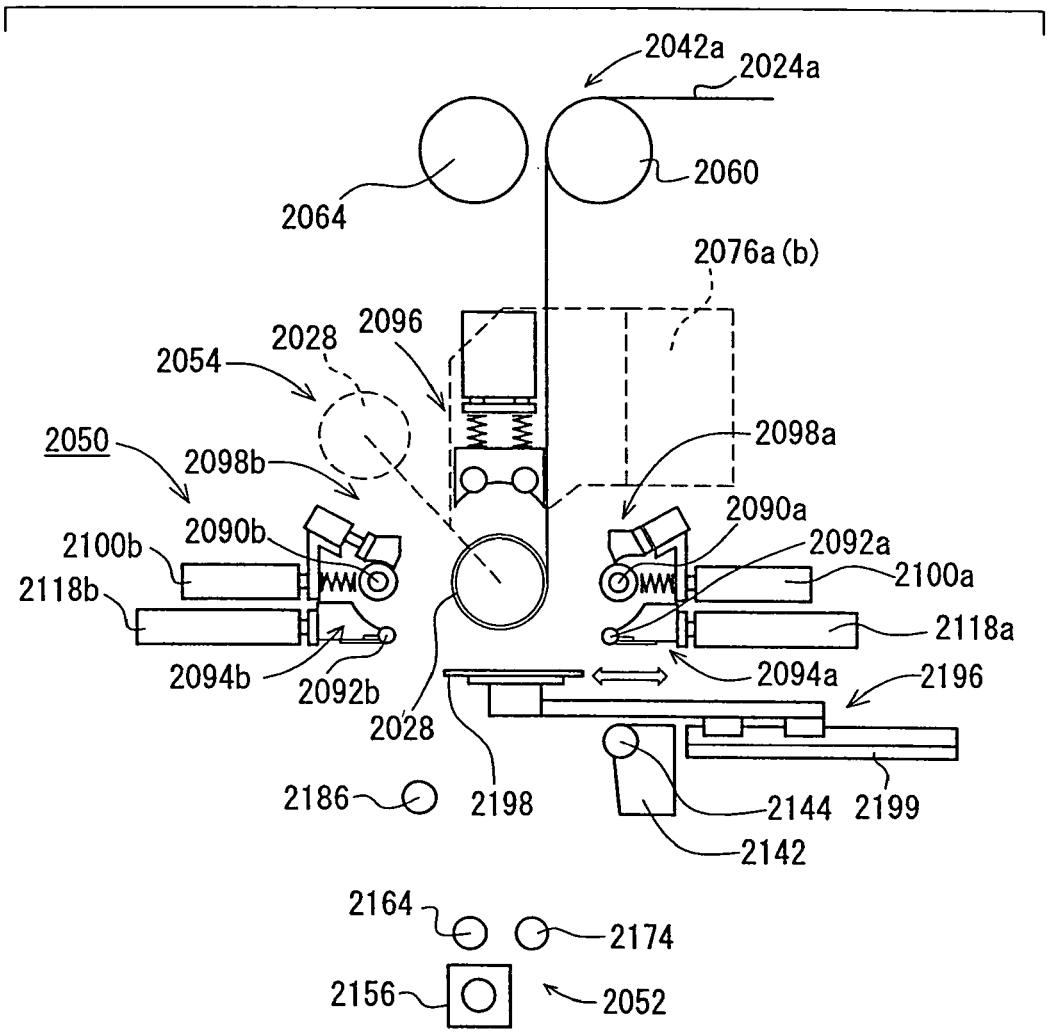
FIG. 87 is a view of a film take-up mechanism incorporating another cutting mechanism.

In the third embodiment, the two cutting mechanisms 2054 are disposed on the respective opposite sides of the core 2028. However, a cutting mechanism 2196 shown in FIG. 87 may be employed. The cutting mechanism 2196 has a single cutter 2198 which is movable by a slide means 2199 for cutting the elongate film 2024*a* that is selectively positioned on the opposite sides of the core 2028. Since only the single cutter 2198 is used, the cutting mechanism 2196 is simpler in structure.

Figure 88:
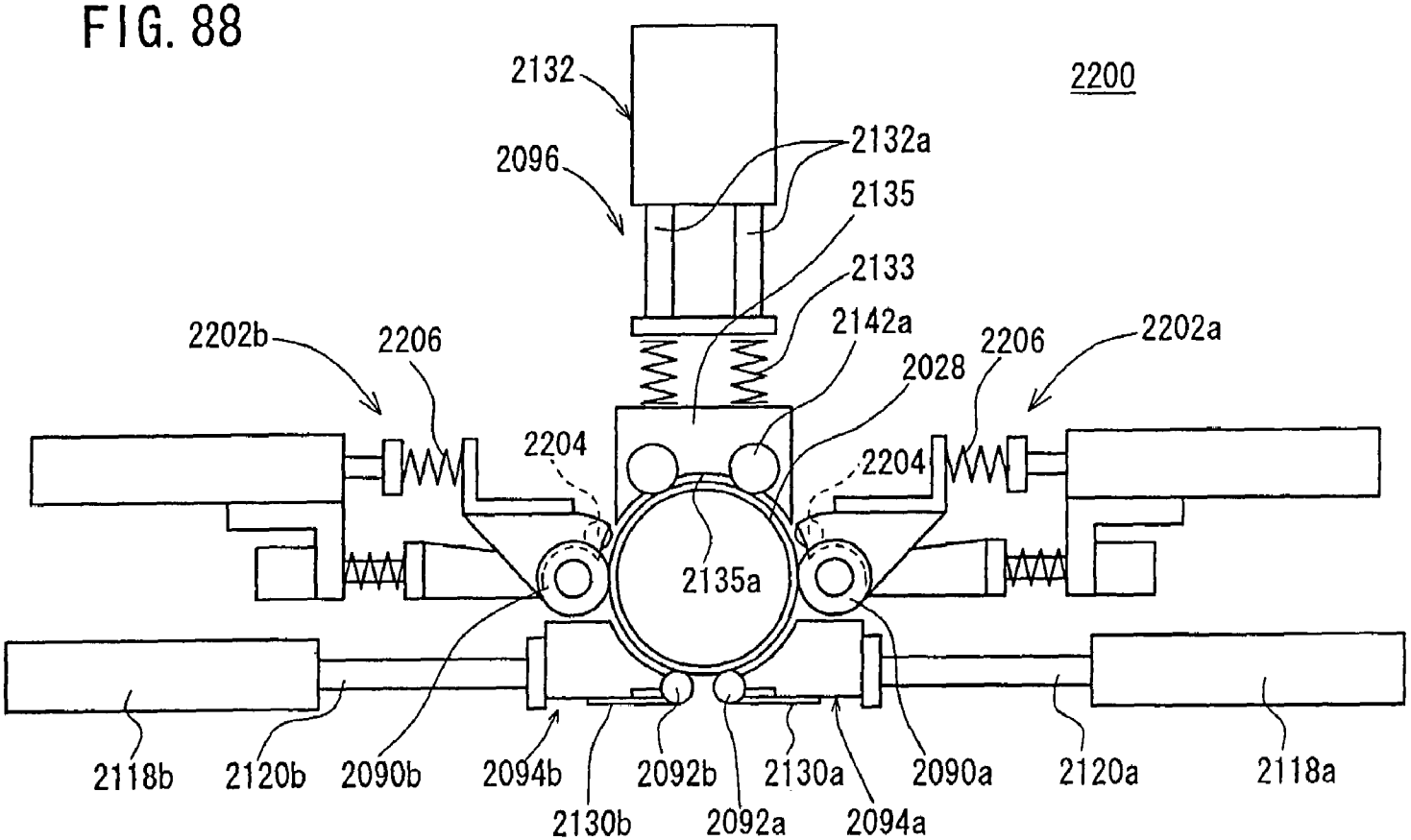
FIG. 88 is a front elevational view of a film take-up mechanism of a film winding mechanism according to a fourth embodiment of the present invention.

FIG. 88 shows in front elevation a film winding mechanism 2200 incorporated in a film winding apparatus according to a fourth embodiment of the present invention. Those parts of the film winding apparatus according to the fourth embodiment which are identical to those of the film winding apparatus 2010 according to the third embodiment are denoted by identical reference characters, and will not be described in detail below.

Figure 89:
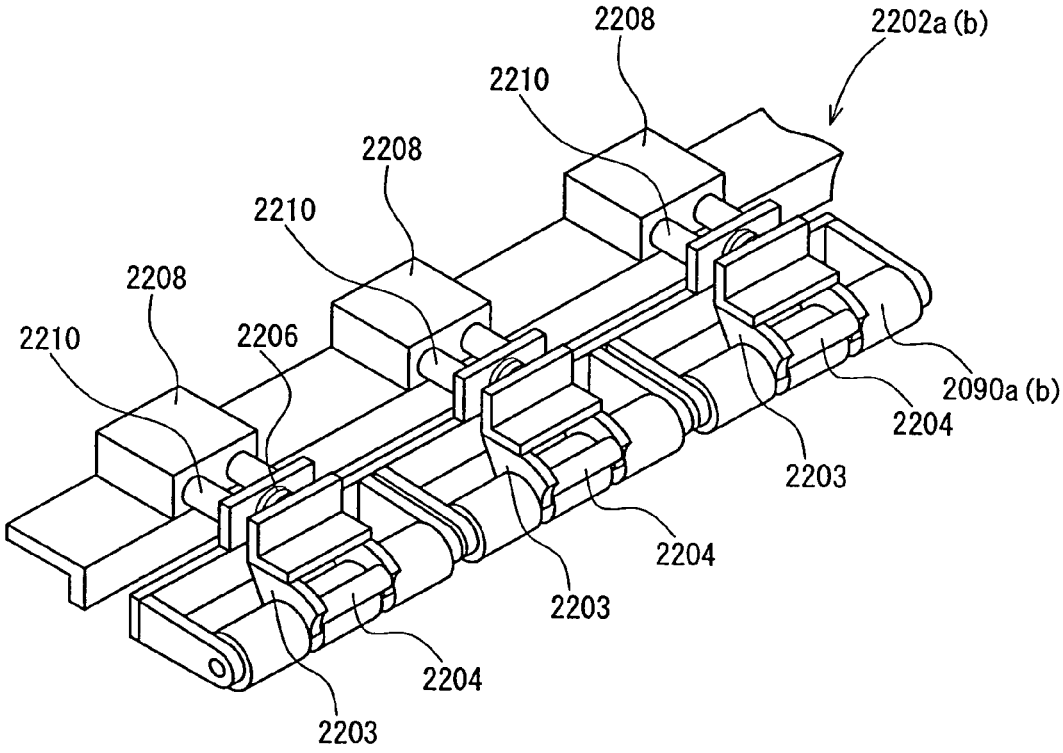
FIG. 89 is a perspective view of a portion of the film take-up mechanism.

The film winding mechanism 2200 has first and second introduction guide members 2202*a*, 2202*b*. As shown in FIGS. 88 and 89, each of the first and second introduction guide members 2202*a*, 2202*b* has a plurality of support plates 2203 axially divided and spaced at intervals corresponding to the width of the first and second nip rollers 2090*a*, 2090*b*, and a plurality of free rollers 2204 rotatably supported between the support plates 2203. The support plates 2203 are of a comb-toothed shape and extend into the shafts of the first and second nip rollers 2090*a*, 2090*b*. The support plates 2203 are movably held on rods 2210 extending from cylinders 2208 with springs 2206 interposed between the rods 2210 and the support plates 2203.

In the fourth embodiment, since the elongate film 2024*a* to be wound around the core 2028 is guided in contact with the free rollers 2204 of the first and second introduction guide members 2202*a*, 2202*b*, the elongate film 2024*a* is prevented from being damaged as the free rollers 2204 rotate in contact therewith.

The first and second nip rollers 2090*a*, 2090*b* and the first and second introduction guide members 2202*a*, 2202*b* are of an overlapping comb-toothed shape for thereby effectively guiding the elongate film 2024*a* to prevent the elongate film 2024*a* from becoming loose. Therefore, it is possible to wind the elongate film 2024*a* around the core 2028 in a high-quality form.

Figure 90:
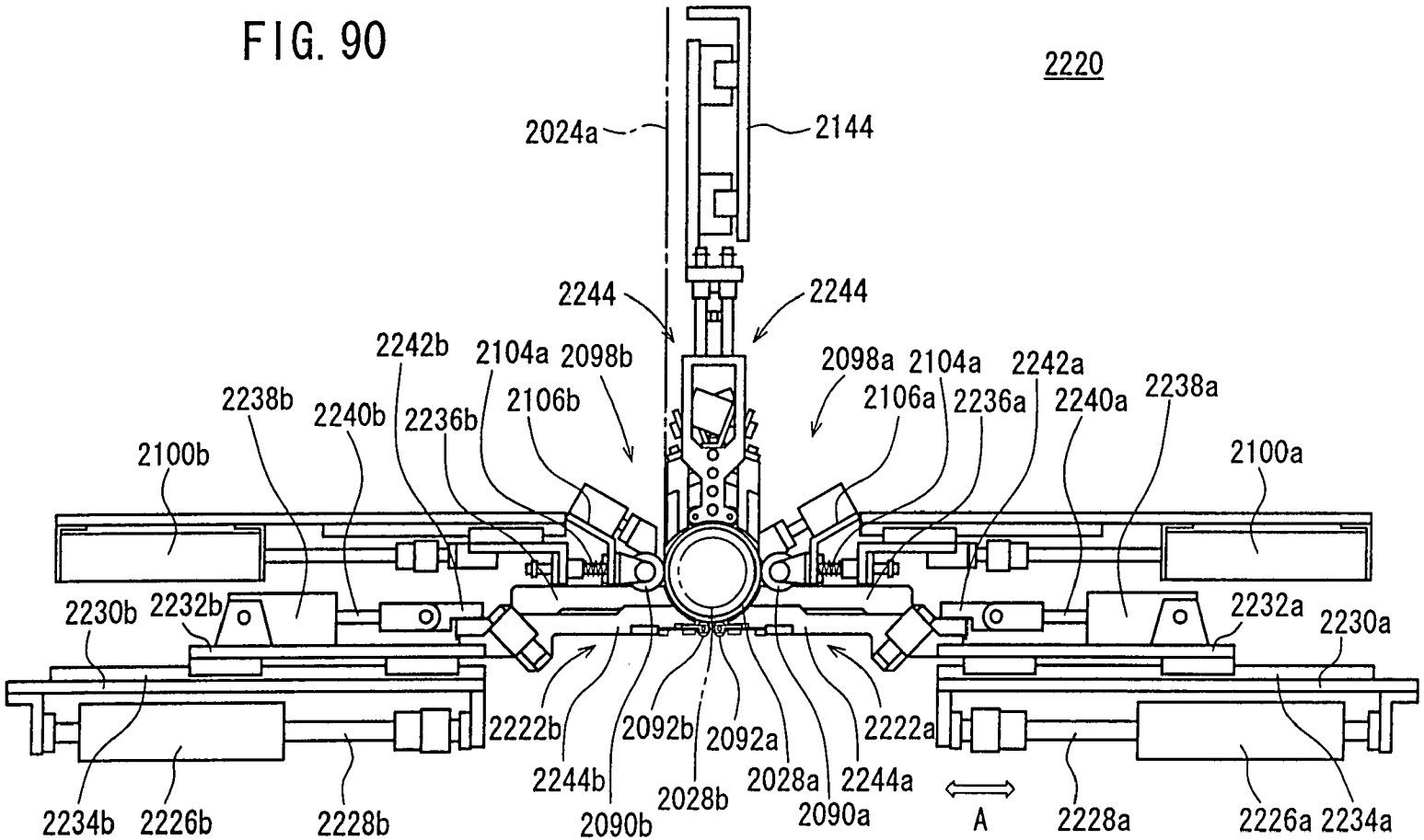
FIG. 90 is a front elevational view of a film take-up mechanism of a film winding mechanism according to a fifth embodiment of the present invention.

FIG. 90 shows in front elevation a film winding mechanism 2220 incorporated in a film winding apparatus according to a fifth embodiment of the present invention. Those parts of the film winding apparatus according to the fifth embodiment which are identical to those of the film winding apparatus 2010 according to the third embodiment are denoted by identical reference characters, and will not be described in detail below.

The film winding mechanism 2220 have a function to handle two cores 2028*a*, 2028*b* of different diameters and a function to wind the elongate film 2024*a* around the cores 2028*a*, 2028*b* to form a roll with an inner coated surface and a roll with an outer coated surface. The film winding mechanism 2220 employs first and second lower wrappers 2222*a*, 2222*b* and an upper wrapper 2224 which are specially designed.

The first and second lower wrappers 2222*a*, 2222*b* have respective first and second drive cylinders 2226*a*, 2226*b* fixed in respective positions and having respective rods 2228*a*, 2228*b* extending therefrom. Bases 2230*a*, 2230*b* are fixed to the respective rods 2228*a*, 2228*b* for movement in the directions indicated by the arrow A. Movable bases 2232*a*, 2232*b* are mounted on the respective bases 2230*a*, 2230*b* and movable in the directions indicated by the arrow A along linear guides 2234*a*, 2234*b* by actuators such as cylinders or the like (not shown).

Figure 91:
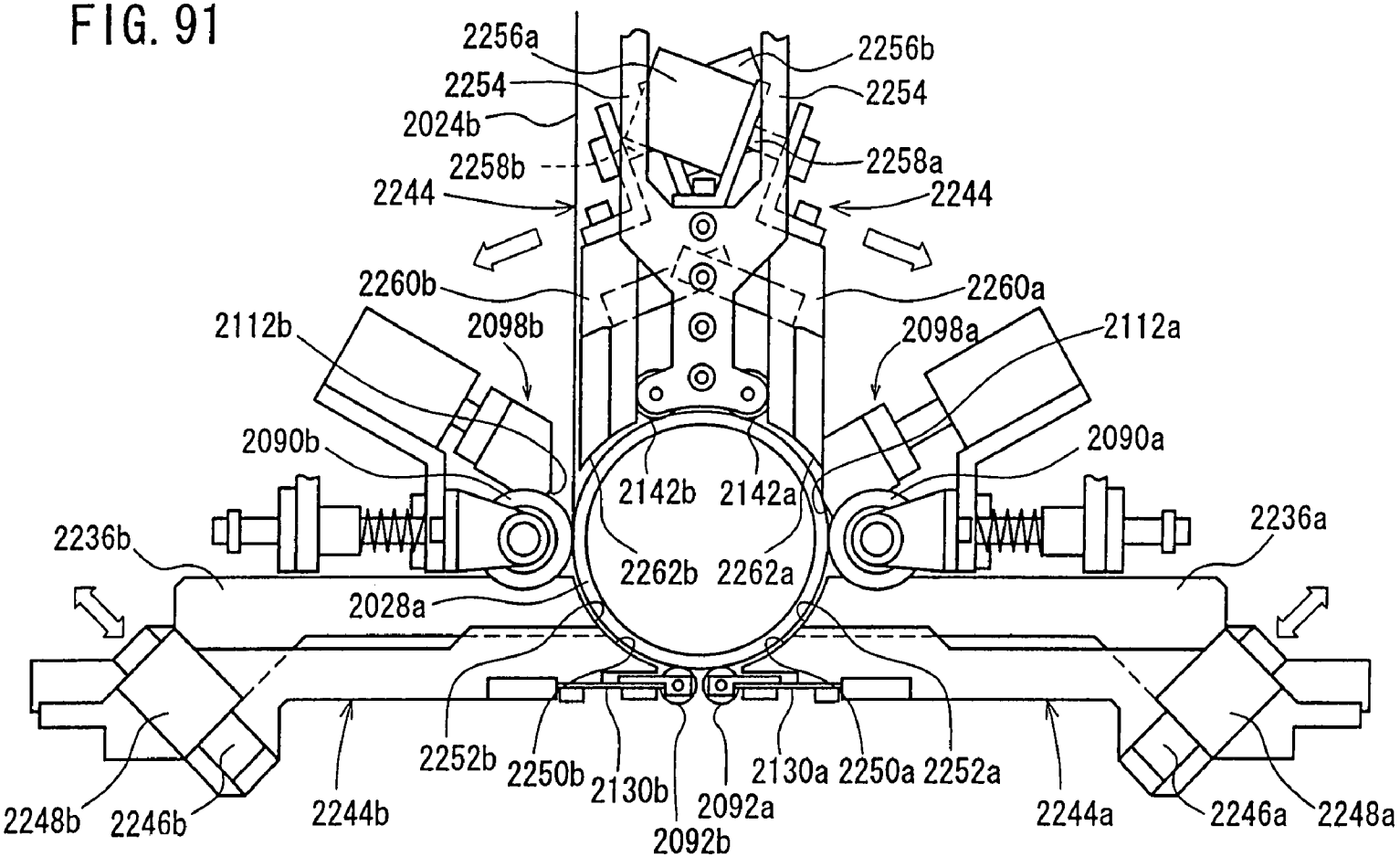
FIG. 91 is an enlarged view showing the manner in which an elongate film is wound around a large-diameter core by the film take-up mechanism.

First and second fixed guides 2236*a*, 2236*b* are mounted on the respective distal ends of the movable bases 2232*a*, 2232*b*, and first and second cylinders 2238*a*, 2238*b* are swingably mounted respectively on the rear ends of the movable bases 2232*a*, 2232*b*. The first and second cylinders 2238*a*, 2238*b* have respective rods 2240*a*, 2240*b* to which first and second movable guides 2244*a*, 2244*b* are fixed by joints 2242*a*, 2242*b*, respectively. As shown in FIG. 91, guide bars 2246*a*, 2246*b* inclined away from each other to the vertical direction are mounted on the respective movable guides 2244*a*, 2244*b*. The guide bars 2246*a*, 2246*b* are inserted respectively in tubes 2248*a*, 2248*b* on the first and second fixed guides 2236*a*, 2236*b*.

First and second rollers 2092*a*, 2092*b* are movably mounted on the distal ends of the first and second movable guides 2244*a*, 2244*b* by respective leaf springs 2130*a*, 2130*b*. The first and second movable guides 2244*a*, 2244*b* and the first and second fixed guides 2236*a*, 2236*b* are of an overlapping comb-toothed shape, and have, on their distal ends, guide surfaces 2250*a*, 2250*b*, 2252*a*, and 2252*b* having a radius of curvature which is slightly greater than the radius of the outer circumferential surface of a larger-diameter core 2028*a*.

The upper wrapper 2224 has a frame 2254 on which there are mounted first and second cylinders 2256*a*, 2256*b* that are inclined downwardly to the horizontal direction. The first and second cylinders 2256*a*, 2256*b* have respective rods 2258*a*, 2258*b* extending obliquely downwardly and supporting first and second movable guides 2260*a*, 2260*b*, respectively. The first and second movable guides 2260*a*, 2260*b* have guide surfaces 2262*a*, 2262*b*, respectively, which have a radius of curvature which is slightly greater than the radius of the outer circumferential surface of the larger-diameter core 2028*a*.

For winding the elongate film 2024*a* counterclockwise around the larger-diameter core 2028*a*, the film winding mechanism 2220 is disposed as shown in FIGS. 90 and 91. Specifically, as shown in FIG. 91, the first and second cylinders 2256*a*, 2256*b* of the upper wrapper 2224 are actuated to displace the first and second movable guides 2260*a*, 2260*b* coupled to the rods 2258*a*, 2258*b* obliquely downwardly away from each other as indicated by the arrows. Therefore, the guide surfaces 2262*a*, 2262*b* of the first and second movable guides 2260*a*, 2260*b* are positionally adjusted to match the outer circumferential surface of the larger-diameter core 2028*a*.

As shown in FIG. 90, the first drive cylinder 2226*a* is actuated to move the base 2230*a* toward the core 2028*a*, positioning the guide surfaces 2250*a*, 2252*a* of the first movable guide 2244*a* and the first fixed guide 2236*a* spaced from the outer circumferential surface of the core 2028*a* by a given gap, and holding the first roller 2092*a* in contact with the outer circumferential surface of the core 2028*a*. The first drive cylinder 2100*a* is actuated to move the first nip roller 2090*a* toward the core 2028*a* until it is brought into contact therewith and to place the first introduction guide member 2098*a* at the outer circumferential surface of the core 2028*a*.

Then, when the elongate film 2024*a* is inserted between the core 2028*a* and the second nip roller 2090*b*, the second drive cylinder 2100*b* is actuated to cause the second nip roller 2090*b* to hold the elongate film 2024*a* against the outer circumferential surface of the core 2028*a*. Then, as with the third embodiment, the leading end of the elongate film 2024*a* is cut off. The second drive cylinder 2226*b* is then actuated to move the second movable guide 2244*b* and the second fixed guide 2236*b* toward the core 2028*a*, causing the second roller 2092*b* to hold the end of the elongate film 2024*a* around the core 2028*a* and positioning the guide surfaces 2250*b*, 2252*b* of the second movable guide 2244*b* and the second fixed guide 2236*b* at the outer circumferential surface of the core 2028*a*. Thereafter, as with the third embodiment, the core 2028*a* is rotated counterclockwise to wind the elongate film 2024*a* to a certain length around the core 2028*a*.

Figure 92:
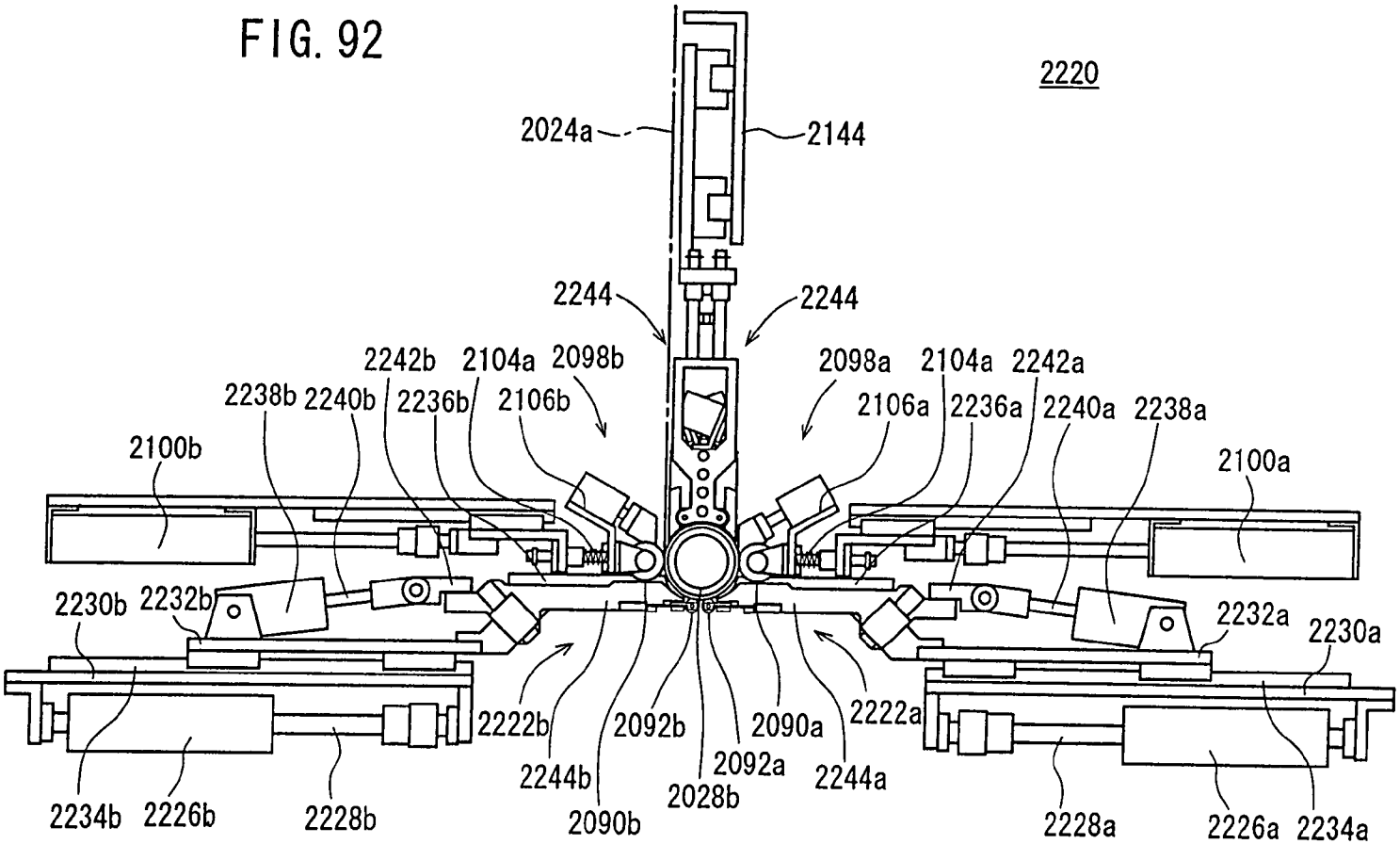
FIG. 92 is an enlarged view showing the manner in which an elongate film is wound around a small-diameter core by the film take-up mechanism.

If a core 2028*b* smaller in diameter than the core 2028*a* is used, then, as shown in FIG. 92, the first and second movable guides 2260*a*, 2260*b* of the upper wrapper 2224 are moved toward the frame 2254 by the first and second cylinders 2256*a*, 2256*b*, positioning the guide surfaces 2262*a*, 2262*b* at the outer circumferential surface of the core 2028*b*. The first and second cylinders 2238*a*, 2238*b* are actuated to displace the rods 2240*a*, 2240*b* inwardly.

The first and second movable guides 2244*a*, 2244*b* are now guided by the guide bars 2246*a*, 2246*b* and the tubes 2248*a*, 2248*b* to move obliquely upwardly with respect to the first and second fixed guides 2236*a*, 2236*b*. The movable bases 2232*a*, 2232*b* are guided by the linear guides 2234*a*, 2234*b* to move toward the core 2028*b* by a certain distance with respect to the bases 2230*a*, 2230*b*. The guide surfaces 2250*a*, 2250*b* of the first and second movable guides 2244*a*, 2244*b* and the first and second rollers 2092*a*, 2092*b* are now positioned complementarily to the outer circumferential surface of the core 2028*b*.

In the fifth embodiment, therefore, the film winding mechanism 2220 is capable of automatically handling the cores 2028*a*, 2028*b* having different outside diameters, and automatically changing the direction in which the elongate film 2024*a* is wound around the cores 2028*a*, 2028*b*. Therefore, the single film winding mechanism 2220 can automatically handle changes in the winding direction of the elongate film 2024*a* and the cores 2028*a*, 2028*b* having different outside diameters. The film winding mechanism 2220 can perform the overall film winding process efficiently, and is highly adaptable in operation.

In the third through fifth embodiments, the film winding apparatus 2010 is incorporated in the film rewinding mechanism 2012. However, the film winding apparatus 2010 may be incorporated in the film processing and cutting machine 12 according to the first embodiment.

In the web winding apparatus according to the present invention, a plurality of winding mechanisms arrayed in the axial direction of the core are movable in directions across the axial direction of the core, and only a certain number of winding mechanisms corresponding to the core are placed in the winding position. Therefore, the axial dimension of the web winding apparatus may be smaller than if a winding mechanism were movable in the axial direction of the core, and hence the size of the web winding apparatus can easily be reduced.

Each of the winding mechanisms is only required to be movable between the winding position and the retracted position. Thus, an actuator such as a cylinder or the like may be used to move these winding mechanisms, and hence the required wiring and control process may be simplified. Accordingly, the elongate web can highly accurately and efficiently be wound around various cores having different axial lengths with a simple and compact arrangement.

In the web winding apparatus according to the present invention, furthermore, a plurality of rollers and a plurality of blocks are disposed on both sides of the core for automatically winding the elongate web around the core in a desired winding direction. The web winding apparatus is capable of automatically handling changes in the winding direction of the elongate web, and of highly accurately and efficiently winding the elongate web around the core.

In the web winding apparatus according to the present invention, moreover, the core rotating mechanism is disposed in a region contacted by the winding mechanism and the product receiving mechanism, and has a dimension smaller than the outside diameter of the core. Therefore, even if the length of the elongate web wound around the core is considerably small, the winding mechanism and the product receiving mechanism are held out of interference with the core rotating mechanism. The web winding apparatus is thus capable of easily handling changes in the width and outside diameter of the roll, and of efficiently winding the elongate web with a simple arrangement.

In the web winding apparatus according to the present invention, the winding mechanism has first and second unit bodies having joints of identical structure. Simply by selectively coupling the first and second unit bodies to the first and second drive units, the elongate web can be wound around the core to selectively produce a roll with an inner coated surface and a roll with an outer coated surface. Accordingly, the web winding apparatus is thus capable of easily and reliably handling changes in the winding direction of the elongate web with a simple arrangement and process.

At least two first unit bodies are used for handling two or more cores having different outside diameters. Thus, The outside diameter of the core can easily be changed with a simple arrangement. The web winding apparatus is capable of easily handling changes in the outside diameter of the core and changes in the winding direction of the elongate web, and achieving an increased yield and an increased winding capability.

In the method of and apparatus for processing a web edge according to the present invention, after the web edge is automatically wound to a given diameter around the edge winding shaft, the web edge is automatically cut off, and automatically removed from the edge winding shaft. Therefore, the overall process of processing the web edge is easily automatized, greatly reducing the burden on the operator and efficiently performing the web processing process. The overall film processing process can easily be carried out without being attended by operators, the cost of processing the film is effectively reduced.

Furthermore, the web processing apparatus according to the present invention is capable of efficiently winding the elongate web in different winding directions around various cores having different diameters or axial lengths, smoothly and automatically producing various rolls. Therefore, a plurality of types of rolls can efficiently be produced together with a simple arrangement and process, making the web processing apparatus suitable for meeting demands for the production of many types of rolls in small quantities.

Although certain preferred embodiments of the present invention have been shown and described in detail, it should be understood that various changes and modifications may be made therein without departing from the scope of the appended claims.

What is claimed is:

1. A method of processing a web edge produced when a raw web is cut, comprising the steps of:

automatically winding said web edge around an edge winding shaft;

calculating an allowable wound length of said web edge to be wound around said edge winding shaft;

automatically cutting off said web edge after said web edge is wound to said allowable wound length around said edge winding shaft;

automatically removing the web edge which is cut off from said edge winding shaft;

calculating a fully wound length of said web edge based on an allowable weight of said web edge;

calculating a maximum wound length of said web edge based on a maximum wound diameter of said web edge; and comparing the calculated fully wound length and the calculated maximum wound length with each other, and setting a shorter one of the calculated fully wound length and the calculated maximum wound length as said allowable wound length.

2. A method according to claim 1, further comprising the steps of:

drawing a predetermined length of said web edge upstream of said edge winding shaft after said web edge is wound around said edge winding shaft;

gripping the drawn length of said web edge with a roller pair; and rotating said roller pair to deliver the drawn length of said web edge to said edge winding shaft after the web edge which is cut off is removed from said edge winding shaft.

3. A method according to claim 1, further comprising:

radially contracting said edge winding shaft and moving said web edge axially of said edge winding shaft to automatically discharge said web edge from said edge winding shaft after said web edge is cut off.

* * * * *